US007166408B2

(12) United States Patent
Oyamada et al.

(10) Patent No.: US 7,166,408 B2
(45) Date of Patent: Jan. 23, 2007

(54) IMAGE FORMING METHOD USING PHOTOTHERMOGRAPHIC MATERIAL

(75) Inventors: Takayoshi Oyamada, Kanagawa (JP); Takeshi Funakubo, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 10/974,925

(22) Filed: Oct. 28, 2004

(65) Prior Publication Data

US 2005/0260529 A1 Nov. 24, 2005

(30) Foreign Application Priority Data

| | | |
|---|---|---|
| Oct. 31, 2003 | (JP) | 2003-372131 |
| Nov. 10, 2003 | (JP) | 2003-379670 |
| Dec. 5, 2003 | (JP) | 2003-406947 |
| Sep. 15, 2004 | (JP) | 2004-268562 |

(51) Int. Cl.

| | |
|---|---|
| ***G03C 1/46*** | (2006.01) |
| ***G03C 1/498*** | (2006.01) |
| ***G03C 5/17*** | (2006.01) |
| ***G03C 5/29*** | (2006.01) |

(52) U.S. Cl. ..... 430/139; 430/353; 430/502; 430/264; 430/619; 430/967; 396/575

(58) Field of Classification Search ..... 430/139, 430/264, 353, 502, 619, 967; 396/575
See application file for complete search history.

(56) References Cited

U.S. PATENT DOCUMENTS

| | | | | |
|---|---|---|---|---|
| 3,864,709 | A * | 2/1975 | Bruns | 396/575 |
| 5,893,003 | A * | 4/1999 | Allen | 396/575 |
| 6,309,114 | B1 * | 10/2001 | Torisawa et al. | 396/575 |
| 6,464,413 | B1 * | 10/2002 | Oyamada | 396/575 |
| 6,689,546 | B1 * | 2/2004 | LaBelle et al. | 430/346 |
| 6,713,240 | B1 * | 3/2004 | Lynch et al. | 430/350 |
| 6,746,831 | B1 * | 6/2004 | Hunt | 430/350 |
| 2002/0135661 | A1 * | 9/2002 | Torisawa | 347/228 |
| 2005/0118542 | A1 * | 6/2005 | Mori et al. | 430/619 |

FOREIGN PATENT DOCUMENTS

| | | |
|---|---|---|
| JP | A 11-218894 | 8/1999 |
| JP | A 2002-90941 | 3/2002 |

* cited by examiner

*Primary Examiner*—Richard L. Schilling
(74) *Attorney, Agent, or Firm*—Margaret A. Burke; Sheldon J. Moss

(57) ABSTRACT

Provided is an image forming method including providing a photothermographic material having image forming layers containing at least a photosensitive silver halide, a non-photosensitive organic silver salt, a reducing agent, and a binder on both surfaces of a support, imagewise exposing the photothermographic material with a fluorescent intensifying screen, and thermally developing the photothermographic material in a thermal developing apparatus having a heating section, wherein the heating section has at least two heating means and a difference between a sensitivity when the photothermographic material is developed at 25° C. and relative humidity of 75% and a sensitivity when the photothermographic material is developed at 25° C. and relative humidity of 20% is 0.20 or less.

An image forming method similar to that described above in which the photothermographic material has an antistatic layer is also provided.

35 Claims, 7 Drawing Sheets

IMAGE FORMING METHOD USING PHOTOTHERMOGRAPHIC MATERIAL

CROSS-REFERENCE TO RELATED APPLICATION

This application claims priority under 35 USC 119 from Japanese Patent Application Nos. 2003-372131, 2003-379670, 2003-406947, and 2004-268562, the disclosures of which are incorporated by reference herein.

BACKGROUND OF THE INVENTION

1. Field of the Invention

The present invention relates to an image forming method using a photothermographic material. More particularly, the invention relates to an image forming method of forming an image on a double-sided photothermographic material having image forming layers on both surfaces of a support, by X-ray exposure.

2. Description of the Related Art

In recent years, decrease in the amount of processing liquid waste in the field of films for medical imaging has been keenly desired from the viewpoints of environmental protection and economy of space. For this reason, techniques regarding photothermographic materials for medical diagnosis and graphic arts, which can be exposed efficiently by laser image setters or laser imagers and can form clear black-toned images of high resolution and sharpness, is required. According to the photothermographic materials described above, thermal development systems which do not require liquid processing chemicals, are simpler, and do not damage the environment can be supplied to customers.

While similar requirements also exist in the field of general image forming materials, images for medical imaging require a particularly high image quality excellent in sharpness and granularity since fine representation is required, and are characterized in that images of blue-black tones are preferred from the viewpoint of easy diagnosis. At present, various kinds of hard copy systems utilizing dyes or pigments such as ink jet printers and electrophotographic systems have been marketed as general image forming systems, but they are not satisfactory as output systems for medical images.

Thermal image forming systems utilizing organic silver salts are described, for example, in U.S. Pat. Nos. 3,152,904 and 3,457,075, as well as in "Thermally Processed Silver Systems" by B. Shely, appearing in "Imaging Processes and Materials", Neblette, 8th edition, edited by J. Sturge, V. Warlworth, and A. Shepp, page 2, 1996. A photothermographic material generally comprises an image forming layer in which a catalytically active amount of photocatalyst (for example, a silver halide), a reducing agent, a reducible silver salt (for example, an organic silver salt), and if necessary, a toner for controlling the color tone of silver, dispersed in a binder. A photothermographic material forms a black silver image by being heated to a high temperature (for example, 80° C. or higher) after imagewise exposure to cause an oxidation-reduction reaction between a silver halide or a reducible silver salt (functioning as an oxidizing agent) and a reducing agent. The oxidation-reduction reaction is accelerated by the catalytic action of a latent image on the silver halide generated by exposure. As a result, a black silver image is formed in the exposed region. Photothermographic materials have been described in U.S. Pat. No. 2,910,377 and Japanese. Patent Application Publication (JP-B) No. 43-4924, as well as in many other documents.

Further, the Fuji Medical Dry Imager FM-DP L is an example of a practical medical image forming system using a photothermographic material that has been marketed.

Attempts have also been made at applying the above-mentioned photothermographic material as photosensitive material for photographing. The "photosensitive material for photographing" as used herein means a photosensitive material on which images are recorded by a one-shot exposure through a lens, rather than by writing the image information by a scanning exposure with a laser beam or the like. Conventionally, photosensitive materials for photographing are generally known in the field of wet developing photosensitive materials, and include films for medical use such as direct or indirect radiography films and mammography films. For example, an X-ray photothermographic material coated on both sides using a blue fluorescent intensifying screen is described in Japanese Patent (JP) No. 3229344, and a photothermographic material using tabular silver iodobromide grains is described in Japanese Patent Application Laid-Open (JP-A) No. 59-142539. As another example, a photothermographic material for medical use containing tabular grains that have a high content of silver chloride and have (100) major faces, and that are coated on both sides of a support, is described in JP-A No. 10-282606. Double-sided coated photothermographic materials are also disclosed in other patent documents (for example, in JP-A Nos. 2000-227642, 2001-22027, 2001-109101, and 2002-90941). However, according to these known examples, although fine particle silver halide grains having a grain size of 0.1 μm or less do not cause further hazing, the sensitivity is very low. These grains are therefore not usable for practical applications in photographing. And conversely, when using silver halide grains having a large grain size, because the remaining silver halide increases the degree of haze and adversely affects the print-out, there is a problem of deterioration of the image quality.

In addition, there has been heretofore no report concerning what kind of characteristics are obtained by thermal development of a photothermographic material having image forming layers on both sides of a support, and what is preferable for an optimum thermally developing method thereof with respect to that of a conventional single-sided coated photothermographic material.

Heretofore, in an image forming apparatus called a laser imager for preparing a print of a visible image from an image measured by a measuring device for medical use such as a CT or an MRI, a photothermographic material having an image forming layer on either side of a support such as a PET film is exposed to a light beam modulated in accordance with image data, and then, the photothermographic material thus exposed is thermally developed by means of a built-in thermal developing section to prepare an image.

FIG. 8 shows a conventional image forming apparatus provided with a thermal developing apparatus (see JP-A No. 11-218894) wherein an image forming apparatus 1 basically comprises a photothermographic material feeding section 3, an image exposing section 5, and a thermally developing section 7 in the order of a conveying direction of a photothermographic material A. The photothermographic material feeding section 3 takes out a sheet of the photothermographic material A from a magazine 9, and feeds the taken out photothermographic material A downstream in the conveying direction. The image exposing section 5 is a region where the photothermographic material A is imagewise exposed by light beam scanning exposure, and which is composed of an exposure unit 11 and a sub-scanning conveying means 13.

The photothermographic material A on which a latent image has been recorded in the image exposing section 5 is conveyed upwards by conveying roller pairs 15 and 17 or the like to the thermal developing section 7. The thermal developing section 7 is a region where the photothermographic material A is heated by the use of a heating drum 19 as a heating means to carry out thermal development, whereby the latent image is made to be a visible image, and which is composed of an endless belt 21, a film peeling claw 23, and support rollers 25*a* to 25*d* for supporting the endless belt 21.

The photothermographic material A carried into the thermal developing section 7 is further carried in between the heating drum 19 and the endless belt 21, and it is held between the heating drum 19 and the endless belt 21 by means of rotation of the heating drum 19. The photothermographic material A is conveyed in a state of close contact with the heating drum 19, and it is thermally developed by heat from the heating drum 19, whereby a latent image recorded by exposure becomes a visible image. In this case, only one side of the photothermographic material A is heated by heat from the heating drum 19. When a leading end of the thermally developed photothermographic material A reaches a vicinity of the peeling claw 23, the peeling claw 23 abuts upon the heating drum 19 to enter in between the heating drum 19 and the photothermographic material A, whereby the photothermographic material A is peeled off from the heating drum 19 to be discharged into a discharge tray 27.

SUMMARY OF THE INVENTION

A first aspect of the invention is to provide an image forming method comprising providing a photothermographic material having image forming layers containing at least a photosensitive silver halide, a non-photosensitive organic silver salt, a reducing agent, and a binder on both surfaces of a support, imagewise exposing the photothermographic material with a fluorescent intensifying screen, and thermally developing the photothermographic material in a thermal developing apparatus having a heating section, wherein:

1) the heating section has at least two heating means in which a first heating means for heating a first surface of the photothermographic material and a second heating means for heating a second surface of the photothermographic material are disposed separately in a back to back relation with each other along a conveying route of the photothermographic material, which is sandwiched by the first and second heating means; and 2) a difference between a sensitivity when the photothermographic material is developed at 25° C. and relative humidity of 75% and a sensitivity when the photothermographic material is developed at 25° C. and relative humidity of 20% is 0.02 or less.

A second aspect of the invention is to provide an image forming method for forming an image, comprising providing a photothermographic material having image forming layers containing at least a photosensitive silver halide, a non-photosensitive organic silver salt, a reducing agent, and a binder on both surfaces of a support, imagewise exposing the photothermographic material with a fluorescent intensifying screen, and thermally developing the photothermographic material in a thermal developing apparatus having a heating section, wherein the photothermographic material has an antistatic layer.

DETAILED DESCRIPTION OF THE INVENTION

Figure 1:
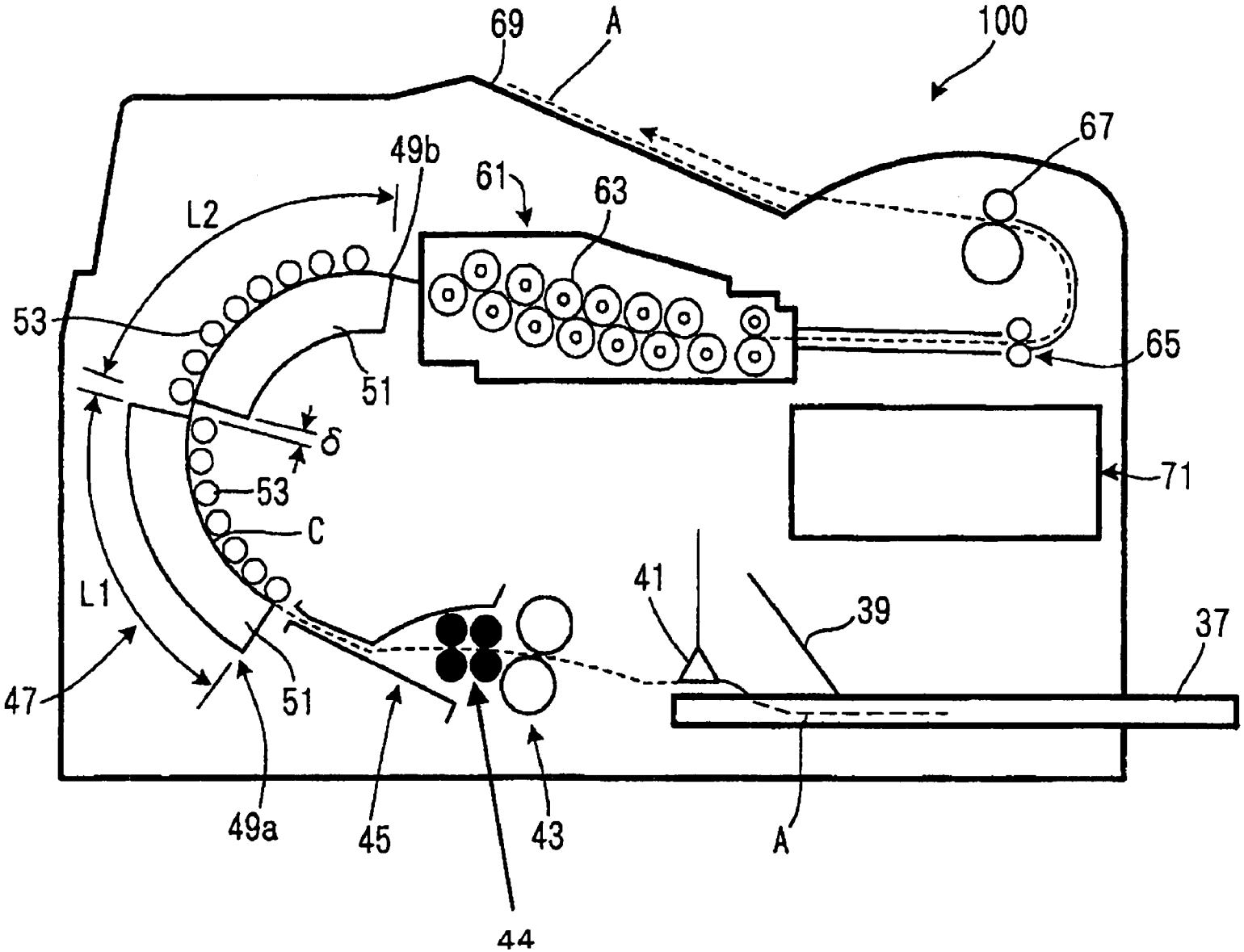
FIG. 1 is a structural diagram illustrating a first embodiment of a thermal developing apparatus according to the present invention.

Although a photothermographic material has the above-described significant characteristics, there was a more difficult problem than anticipated as to realization of uniform development. In the case of conventional wet development, since the whole of a photosensitive material is dipped into a developing solution, the developing solution permeates into the photosensitive material in a comparatively uniform state, whereby uniform development can be carried out. In the case of thermal development, however, difficulty in keeping uniformity of heat in a heating means and thermal conduction vary as a result of influence caused by many factors such as changes in relative dimensions of a photothermographic material and a heating means, intervention of foreign matter, and environmental temperature changes. Even though there are such problems as mentioned above, it is basically sufficient for heating a conventional single-sided coated photothermographic material to heat uniformly only one side of the photothermographic material.

On the other hand, in the case of a photothermographic material having image forming layers on both sides of a support, it is required to heat uniformly the image forming layers on both surface sides, so that it has been found that there is a peculiar problem different from that of a conventional single-sided coated photothermographic material. More specifically, it has been found there is a preheating effect such that when an image forming layer on one side of the support is heated to develop the same, another image forming layer on the other side is heated at a temperature lower than a thermal developing temperature by a heat quantity conducted thermally through the support. It has also been found that because of such a preheating effect, there are cases of influences such as acceleration of a developing process, variation in sensitivity, and variation in color tone of images dependent upon a photothermographic material.

A further problem of the invention is in that significant variations in photograph characteristics appear in the case where one surface of an image forming layer to be heated a closed state, while the other surface is in an open state. More specifically, an image on the former surface is abnormally blackened in a peripheral part thereof, or a degree of blackening appears strongly at a rear end of an image compared to a front end of the image along a conveying direction of a photothermographic material. As a result of earnest analyses and efforts by the present inventors, it has been found that these phenomena appear particularly remarkably in the case where a double-sided coated photosensitive material is used wherein one surface of a heating member becomes a closed system, while the other surface thereof becomes an open system. Causes therefor are not clear, but it is conjectured that a vapor or a droplet component produced by some heating operation influences photographic properties. Accordingly, it is considered that such a phenomenon as described above asymmetrically affects image forming layers on both surfaces of the photosensitive material.

A still further problem is that due to use of a fluorescent intensifying screen. For recording an X-ray image, a fluorescent intensifying screen is superposed on a photosensitive material, and they are exposed to X-rays, whereby the fluorescent intensifying screen is made radiative by the X-rays, so that photosensitive silver halide is exposed to the light emitted from the fluorescent intensifying screen. In order to obtain an image of a high resolution, a close contact between the photosensitive material and the fluorescent intensifying screen is required. In this respect, an air layer is excluded from the whole surface of a sheet to keep a perfect close-contact state, and exposure is carried out in this state. After exposure, the fluorescent intensifying screen is stripped off, and only the photosensitive material is developed to obtain a visible picture image. In the case of conventional wet development as well, when a fluorescent intensifying screen is stripped off, electrostatic light emission is generated due to electrostatic charge called exfoliation electrification, whereby uneven regions called static marks appear. In the case of conventional wet development, such trouble as described above is usually solved by incorporating a fluorocarbon compound into the outermost layer of a photosensitive material.

In a photothermographic material, however, it has been found that the situation is quite different from that of conventional wet development. In a photothermographic material having image forming layers containing a photosensitive silver halide, a non-photosensitive organic silver salt, a reducing agent, and a binder, a moisture content of the image forming layers is low as compared with that of wet developing photosensitive materials, so that exfoliation electrification is easily generated in the case of stripping off a fluorescent intensifying screen. Furthermore, since humidity decreases at the time of thermal development, conditions of extremely low humidity and a tendency for charging are created. In a thermal developing system wherein thermal energy is transmitted by means of thermal conduction derived from contact of a photothermographic material with a heating member in a thermal developing apparatus, close contact of a surface of the photothermographic material with the heating member is important, so that flat surface properties are required. This condition makes exfoliation electrification derived from a fluorescent intensifying screen worse.

Yet another typical problem of a photothermographic material is in a thermal development step. X-ray exposure is completed, a fluorescent intensifying screen is stripped off, and then, the photothermographic material is thermally developed. In order to achieve speeding up of the developing step and uniformity of development, a developing system in which the photothermographic material is heated while the photothermographic material passes between heating members while being conveyed at a contstant speed is preferable. Although the faster conveying speed brings about higher productivity, it becomes extremely likely for electrification trouble to occur when such a photothermographic material is conveyed at a high speed, because the inside of a heating zone heated at a high temperature has low humidity. Electrification is particularly severe in the case where at least one of heating members is a stationary member, and a photothermographic material is moved accompanied by friction, whereby the danger of generating discharge light emission becomes high. In this respect, such electrification is not such a significant problem in a conventional single-sided coated photothermographic material, because a surface which is in contact with the stationary member is a back surface and a back layer itself can be provided with a structure which is unlikely to generate electrification light emission, and moreover because, even when electrification light emission arises, since it is shielded by an antihalation dyestuff in the back layer or a film base, adverse effects on an image forming layer on a front surface are decreased.

For the present inventors, the task was to solve the various problems in an image forming method in which a fluorescent intensifying screen is superposed on such a double-sided coated photothermographic material, exposure is performed, and an image is formed by thermal development, and to develop an image forming method by which an image of good quality can be uniformly produced.

When a photothermographic material having image forming layers on both sides of a support is prepared and it is thermally developed after exposure, peculiar development density unevenness appears which is not observed in a photothermographic material having an image forming layer on only one surface thereof. Concerning the appearance of such unevenness, characteristic features thereof are firstly, that the appearance of unevenness is observed on one of the image forming layers, secondly, that there is a difference in image density between a peripheral part and a central part in a single sheet of photothermographic material, and thirdly, that when several sheets are continuously thermally developed, there is a difference in image density between the images developed in the first half of the sheets and those of the second half of the sheets. Causes of such unevenness in image densities are not clear, but the present inventors conclude that these causes of unevenness in image densities seem to be due to the influence of moisture contained in the photothermographic material. Namely, it is presumed that since photothermographic materials are influenced by humidity in an environment in which the photothermographic materials are stored, humidity in an environment in which the photothermographic materials are developed, and the like, their image densities vary according to their environments, and hence, stable images cannot be obtained.

As a result of earnest efforts for solving these problems by the present inventors, a solution was reached by improving the composition of a photothermographic material to provide a photothermographic material in which a difference between a sensitivity when the photothermographic material is developed at 25° C. and relative humidity of 75% and a sensitivity when the photothermographic material is developed at 25° C. and relative humidity of 20% is 0.20 or less. Specifically, it is effective to contain a huemectant in the photothermographic material, to form the outermost layer of the photothermographic material so as to include a hydrophilic binder containing a crosslinking agent, of to form the outermost layer so as to include a binder made from a hydrophobic polymer latex or a copolymerized polymer binder having monomer components (M1) and (M2). Another specific means is to provide a dehydration step between an exposure step and a heating step in which a photothermographic material is heated at a thermally developing temperature, wherein when a moisture content of the photothermographic material under an atmosphere at 25° C. and 70% RH after undergoing the dehydration step is A, and a moisture content of the photothermographic material under an atmosphere at 25° C. and 20% RH after undergoing the dehydration step is B, the moisture content A is made to be 150% or less with respect to the moisture content B. In this case, it is preferable to provide a preheating step for heating the photothermographic material at a temperature of from 40° C. to 105° C. for a period of time in a range from 0.1 second to 90 seconds in the dehydration step. It is more preferable that the heating temperature in the preheating step is 60° C. to 100° C. Still another specific means is to provide an antistatic layer.

The present invention will be described in detail below.

1. Photothermographic Material

In the present invention, a photographic characteristic curve means a D-log E curve representing a relationship between the common logarithm (log E) of an exposure value, i.e., the exposure energy, and the optical density (D), i.e., a scattered light photographic density, by plotting the former on the abscissa and the latter on the ordinate. In the present invention, sensitivity is expressed in terms of a reciprocal of the exposure amount necessary for giving a density of fog+1.0 on the photographic characteristic curve. The photothermographic material of the invention is characterized by that the absolute value of difference between the sensitivity obtained by developing the photothermographic material at 25° C. and 75% RH and the sensitivity obtained by developing at 25° C. and 20% RH is 0.20 or less. The said difference in sensitivity is preferably 0.05 or less.

In the invention, it is preferred that the amount of coated silver is 2.0 g/m$^2$ or less, and more preferably 0.3 g/m$^2$ to 1.5 g/m$^2$, per one surface.

The photothermographic material of the invention may have a layer including dyes such as an antihalation layer, a crossover cut layer or the like, a non-photosensitive layer such as an undercoat layer, an intermediate layer, a surface protective layer or the like, in addition to the image forming layer. The image forming layer may be a single layer or plural layers.

The constitutions and preferable components of these layers will be explained in detail below.

(Organic Silver Salt)

1) Composition

The organic silver salt according to the invention is relatively stable to light but serves as to supply silver ions and forms silver images when heated to 80° C. or higher under the presence of an exposed photosensitive silver halide and a reducing agent. The organic silver salt may be any organic material containing a source capable of reducing silver ions. Such non-photosensitive organic silver salt is disclosed, for example, in JP-A No. 10-62899 (paragraph Nos. 0048 to 0049), EP-A No. 0803764A1 (page 18, line 24 to page 19, line 37), EP-A No. 0962812A1, JP-A Nos. 11-349591, 2000-7683, and 2000-72711, and the like. A silver salt of organic acid, particularly, a silver salt of long chained fatty acid carboxylic acid (having 10 to 30 carbon atoms, preferably, having 15 to 28 carbon atoms) is preferable. Preferred examples of the organic silver salt can include, for example, silver lignocerate, silver behenate, silver arachidinate, silver stearate, silver oleate, silver laurate, silver capronate, silver myristate, silver palmitate, silver erucate and mixtures thereof. In the present invention, among the organic silver salts, it is preferred to use an organic silver salt with the silver behenate content of 50 mol % or more, more preferably, 85 mol % or more, and further preferably, 95 mol % or more. Further, it is preferred to use an organic silver salt with the silver erucate content of 2 mol % or less, more preferably, 1 mol % or less, and further preferably, 0.1 mol % or less.

2) Shape

There is no particular restriction on the shape of the organic silver salt usable in the invention and it may needle-like, bar-like, tabular, or flaky shape.

As the particle size distribution of the organic silver salt, monodispersion is preferred. In the monodispersion, the percentage for the value obtained by dividing the standard deviation for the length of minor axis and major axis by the minor axis and the major axis respectively is, preferably, 100% or less, more preferably, 80% or less and, further preferably, 50% or less. The shape of the organic silver salt can be measured by determining dispersion of an organic silver salt as transmission type electron microscopic images. Another method of measuring the monodispersion is a method of determining of the standard deviation of the volume weighted mean diameter of the organic silver salt in which the percentage for the value defined by the volume weight mean diameter (variation coefficient), is preferably, 100% or less, more preferably, 80% or less and, further preferably, 50% or less. The monodispersion can be determined from particle size (volume weighted mean diameter) obtained, for example, by a measuring method of irradiating a laser beam to an organic silver salt dispersed in a liquid, and determining a self correlation function of the fluctuation of scattered light to the change of time.

3) Preparing Method

Methods known in the art may be applied to the method for producing the organic silver salt used in the invention, and to the dispersion method thereof. For example, reference can be made to JP-A No. 10-62899, EP-A Nos. 0803763A1 and 0962812A1, JP-A Nos. 11-349591, 2000-7683, 2000-72711, 2001-163889, 2001-163890, 2001-163827, 2001-33907, 2001-188313, 2001-83652, 2002-6442, 2002-49117, 2002-31870 and 2002-107868, and the like.

When a photosensitive silver salt is present together during dispersion of the organic silver salt, fog increases and the sensitivity becomes remarkably lower, so that it is more preferred that the photosensitive silver salt is not substantially contained during dispersion. In the invention, the amount of the photosensitive silver salt to be disposed in the aqueous dispersion, is preferably 1 mol % or lower, and more preferably 0.1 mol % or lower, per 1 mol of the organic silver salt in the solution and, further preferably positive addition of the photosensitive silver salt is not conducted.

In the invention, the photosensitive material can be prepared by mixing an aqueous dispersion of an organic silver salt and an aqueous dispersion of a photosensitive silver salt and the mixing ratio between the organic silver salt and the photosensitive silver salt can be selected depending on the purpose. The ratio of the photosensitive silver salt to the organic silver salt is, preferably, in the range from 1 mol % to 30 mol %, more preferably, 2 mol % to 20 mol % and, particularly preferably, 3 mol % to 15 mol %. A method of mixing two or more kinds of aqueous dispersions of organic silver salts and two or more kinds of aqueous dispersions of photosensitive silver salts upon mixing are used preferably for controlling the photographic properties.

4) Addition Amount

While an organic silver salt in the invention can be used in a desired coating amount, a total amount of silver including silver halide is preferably in the range from 0.1 g/m$^2$ to 5.0 g/m$^2$, more preferably from 0.3 g/m$^2$ to 3.0 g/m$^2$, and particularly preferably from 0.5 g/m$^2$ to 2.0 g/m$^2$. It is preferable that a total coating amount of silver preferably is 1.8 g/m$^2$ or less, and more preferably 1.6 g/m$^2$ or less, to improve the image storability. It is capable to obtain sufficient image density even with such low amount of silver with using a preferable reducing agent of the present invention.

(Reducing Agent)

The photothermographic material of the invention preferably contains a reducing agent for the organic silver salt. The reducing agent may be any substance (preferably, organic substance) capable of reducing silver ions into metallic silver. Examples of the reducing agent are described in JP-A No. 11-65021 (column Nos. 0043 to 0045) and EP-A No. 0803764A1 (page 7, line 34 to page 18, line 12).

In the invention, a so-called hindered phenolic reducing agent or a bisphenol reducing agent having a substituent at the ortho-position to the phenolic hydroxy group is preferred. Particularly, the compound represented by the following formula (R) is preferred.

Formula (R)

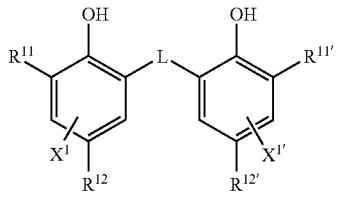

In formula (R), $R^{11}$ and $R^{11'}$ each independently represent an alkyl group having 1 to 20 carbon atoms. $R^{12}$ and $R^{12'}$ each independently represent a hydrogen atom or a group capable of substituting for a hydrogen atom on a benzene ring. L represents one selected from an —S— group and a —$CHR^{13}$— group. $R^{13}$ represents one of a hydrogen atom and an alkyl group having 1 to 20 carbon atoms. $X^1$ and $X^{1'}$ each independently represent one of a hydrogen atom and a group capable of substituting for a hydrogen atom on a benzene ring.

Each of the substituents is to be described specifically.

1) $R^{11}$ and $R^{11'}$ $R^{11}$ and $R^{11'}$ each independently represent one of a substituted or unsubstituted alkyl group having 1 to 20 carbon atoms. The substituent for the alkyl group has no particular restriction and can include, preferably, an aryl group, a hydroxy group, an alkoxy group, an aryloxy group, an alkylthio group, an arylthio group, an acylamino group, a sulfoneamide group, a sulfonyl group, a phosphoryl group, an acyl group, a carbamoyl group, an ester group, an ureido group, an urethane group, a halogen atom, and the like.

2) $R^{12}$ and $R^{12'}$, $X^1$ and $X^{1'}$ $R^{12}$ and $R^{12'}$ each independently represent one selected from a hydrogen atom and a group capable of substituting for a hydrogen atom on a benzene ring. $X^1$ and $X^{1'}$ each independently represent also one selected from a hydrogen atom and a group capable of substituting for a hydrogen atom on a benzene ring. Each of the groups capable of substituting for a hydrogen atom on the benzene ring can include, preferably, an alkyl group, an aryl group, a halogen atom, an alkoxy group, an acylamino group, and the like.

3) L

L represents one selected from an —S— group and a —$CHR^{13}$— group. $R^{13}$ represents one of a hydrogen atom and an alkyl group having 1 to 20 carbon atoms in which the alkyl group may have a substituent. Specific examples of the unsubstituted alkyl group for $R^{13}$ can include, for example, a methyl group, an ethyl group, a propyl group, a butyl group, a heptyl group, an undecyl group, an isopropyl group, a 1-ethylpentyl group, a 2,4,4-trimethylpentyl group, and the like. Examples of the substituent for the alkyl group can include, similar to substituent of $R^{11}$, a halogen atom, an alkoxy group, an alkylthio group, an aryloxy group, an arylthio group, an acylamino group, a sulfoneamide group, a sulfonyl group, a phosphoryl group, an oxycarbonyl group, a carbamoyl group, a sulfamoyl group, and the like.

4) Preferred Substituents $R^{11}$ and $R^{11'}$ are, preferably, a secondary or tertiary alkyl group having 3 to 15 carbon atoms. Specifically, an isopropyl group, an isobutyl group, a t-butyl group, a t-amyl group, a t-octyl group, a cyclohexyl group, a cyclopentyl group, a 1-methylcyclohexyl group, a 1-methylcyclopropyl group, or the like can be described. $R^{11}$ and $R^{11'}$ each independently represent, more preferably, an alkyl group having 4 to 12 carbon atoms and, among them, a t-butyl group, a t-amyl group, and a 1-methylcyclohexyl group are further preferred and, a t-butyl group is most preferred.

$R^{12}$ and $R^{12'}$ are, preferably, an alkyl group having 1 to 20 carbon atoms and can include, specifically, a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, a methoxyethyl group, and the like. More preferred are methyl group, ethyl group, propyl group, isopropyl group, and t-butyl group.

$X^1$ and $X^{1'}$ are, preferably, one selected from a hydrogen atom, a halogen atom, and an alkyl group, and more preferably, a hydrogen atom.

L is preferably a —$CHR^{13}$— group.

$R^{13}$ is, preferably, one of a hydrogen atom and an alkyl group having 1 to 15 carbon atoms. Preferable examples of the alkyl group can include a methyl group, an ethyl group, a propyl group, an isopropyl group, and a 2,4,4-trimethylpentyl group. Particularly preferable $R^{13}$ is a hydrogen atom, a methyl group, a propyl group, or an isopropyl group.

When $R^{13}$ is a hydrogen atom, $R^{12}$ and $R^{12'}$ are preferably an alkyl group having 2 to 5 carbon atoms, more preferably one of an ethyl group and a propyl group, and most preferably an ethyl group.

When $R^{13}$ is a primary or secondary alkyl group having 1 to 8 carbon atoms, $R^{12}$ and $R^{12'}$ are preferably a methyl group. The primary or secondary alkyl group having 1 to 8 carbon atoms as $R^{13}$ is preferably a methyl group, an ethyl group, a propyl group or an isopropyl group, and more preferably a methyl group, an ethyl group or a propyl group.

When all of $R^{11}$, $R^{11'}$, $R^{12}$ and $R^{12'}$ are a methyl group, $R^{13}$ is preferably a secondary alkyl group. In this case, the secondary alkyl group as $R^{13}$ is preferably an isopropyl group, an isobutyl group or a 1-ethylpentyl group, and more preferably an isopropyl group.

The reducing agent has different thermal development properties depending on the combination of $R^{11}$, $R^{11'}$, $R^{12}$, $R^{12'}$ and $R^{13}$. Since these properties can be controlled by using two or more kinds of the reducing agents in combination in various mixing ratios, it is preferable to use two or more kinds of the reducing agents depending on the purpose.
While examples of the compound as the reducing agent of the invention represented by formula (R) are listed below, the invention is not restricted to these compounds.
R-1
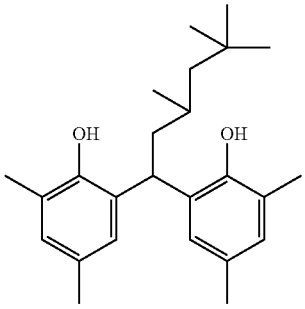
R-2
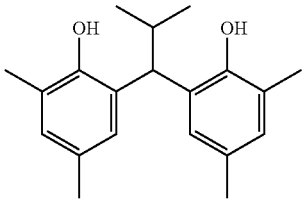
R-3
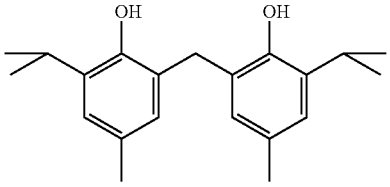
R-4
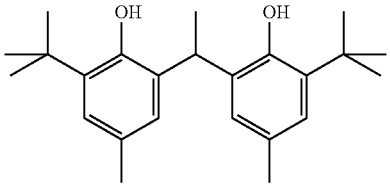
R-5
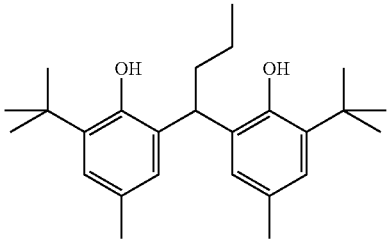
R-6
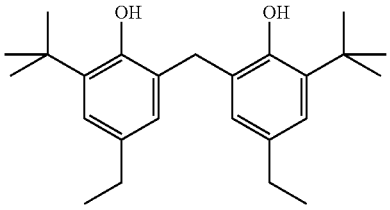
-continued
R-7
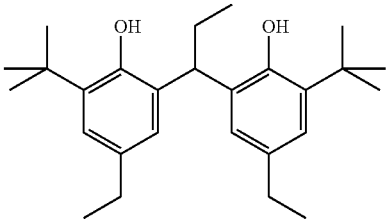
R-8
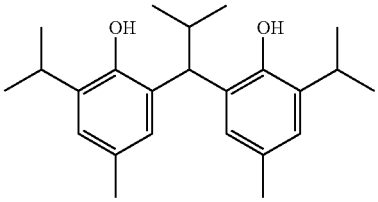
R-9
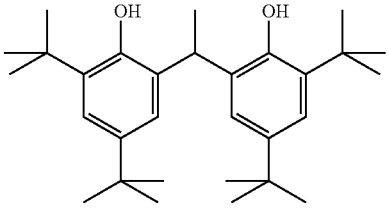
R-10
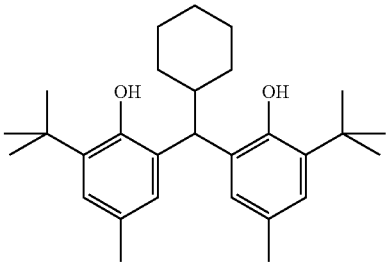
R-11
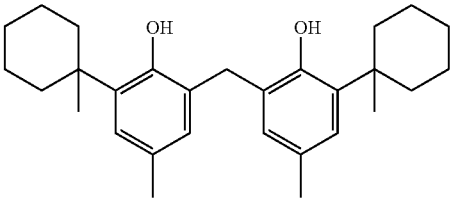
R-12
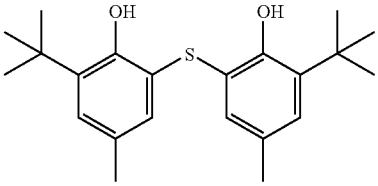
R-13
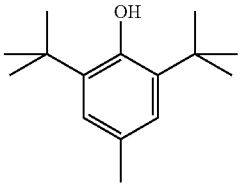

-continued

R-14

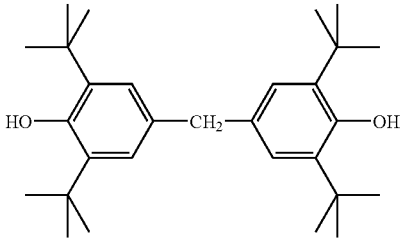

R-15

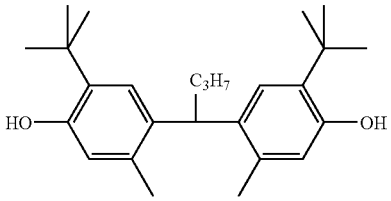

R-16

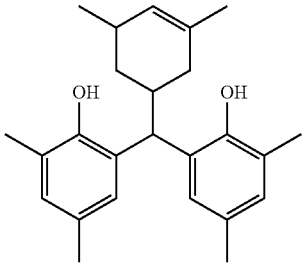

R-17

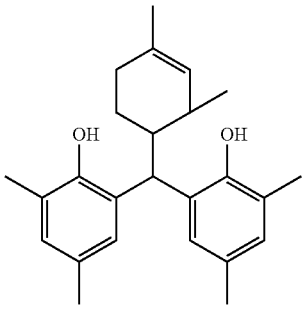

R-18

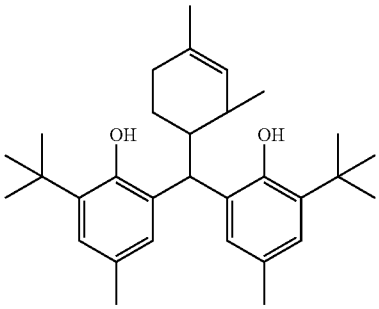

As preferred reducing agents of the invention other than those above, there can be mentioned compounds disclosed in JP-A Nos. 2001-188314, 2001-209145, 2001-350235, and 2002-156727.

In the invention, the addition amount of the reducing agent is, preferably, from 0.1 g/m$^2$ to 3.0 g/m$^2$, more preferably, 0.2 g/m$^2$ to 1.5 g/m$^2$ and, further preferably 0.3 g/m$^2$ to 1.0 g/m$^2$. It is, preferably, contained in a range of 5 mol % to 50 mol %, more preferably, 8 mol % to 30 mol % and, further preferably, 10 mol % to 20 mol % per 1 mol of silver in the image forming layer. The reducing agent of the invention is preferably contained in the image forming layer.

In the invention, the reducing agent may be incorporated into photothermographic material by being added into the coating solution in any form, such as in the form of solution, emulsion dispersion, solid fine particle dispersion, and the like.

As well known emulsion dispersing method, there can be mentioned a method comprising dissolving the reducing agent in an oil such as dibutyl phthalate, tricresyl phosphate, glyceryl triacetate, diethyl phthalate or the like, and an auxiliary solvent such as ethyl acetate, cyclohexanone, or the like, followed by mechanically forming the emulsified dispersion.

As solid fine particle dispersion method, there can be mentioned a method comprising dispersing the powder of the reducing agent in a proper medium such as water, by means of ball mill, colloid mill, vibrating ball mill, sand mill, jet mill, roller mill, or ultrasonics, thereby obtaining solid dispersion. In this case, there can also be used a protective colloid (such as polyvinyl alcohol), or a surfactant (for instance, an anionic surfactant such as sodium triisopropylnaphthalenesulfonate (a mixture of compounds having the isopropyl groups in different substitution sites)). In the mills enumerated above, generally used as the dispersion media are beads made of zirconia and the like, and Zr and the like eluting from the beads may be incorporated in the dispersion. Although depending on the dispersing conditions, the amount of Zr and the like generally incorporated in the dispersion is in the range from 1 ppm to 1000 ppm. It is practically acceptable so long as Zr is incorporated in an amount of 0.5 mg or less per 1 g of silver.

Preferably, an antiseptic (for instance, sodium benzoisothiazolinone salt) is added in the water dispersion.

In the invention, furthermore, the reducing agent is preferably used as a solid particle dispersion, and the reducing agent is added in the form of fine particles having average particle size from 0.01 μm to 10 μm, and more preferably, from 0.05 μm to 5 μm, and further preferably, from 0.1 μm to 2 μm. In the invention, other solid dispersions are preferably used with this particle size range.

(Humectant)

The photothermographic material of the invention preferably contains a humectant.

Compounds as a humectant agent which can be applied in this invention is preferably represented by the following formula (1).

Formula (1)

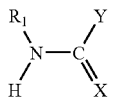

In formula (1), $R_1$ represents preferably one selected from a hydrogen atom, an alkyl group having 1 to 30 carbon atoms, a cycloalkyl group having 5 to 30 carbon atoms, an aryl group having 6 to 30 carbon atoms, and a heterocyclic group having 1 to 30 carbon atoms. When $R_1$ is an alkyl group, specific examples of the alkyl group can include a methyl group, an ethyl group, a propyl group, an isopropyl group, an n-butyl group, a tert-butyl group, a tert-amyl group, an n-hexyl group, an n-octyl group, a dodecyl group, an octadecyl group, a 2-ethylhexyl group, a benzyl group, a phenylethyl group, a dodecylthioethyl group, a methoxyethyl group, and the like.

When $R_1$ is an aryl group, specific examples of the aryl group can include a phenyl group, a naphtyl group, a cresyl group, xylyl group, a mesityl group, a 4-methoxyphenyl group, a 3-chlorophenyl group, a 2,4-dichlorophenyl group, a 4-cyanophenyl group, a 3-methanesulfonamidophenyl group, a 4-methylsulfonylphenyl group and the like. When $R_1$ is a cycloalkyl group, specific examples of the cycloalkyl can include a cyclopropyl group, a cyclobutyl group, a cyclopentyl group, a cyclohexyl group and the like, and further, they may have a substitutent. When $R_1$ is a heterocyclic group, the heterocyclic group preferably is a 5 to 7 membered saturated or unsaturated heterocyclic group, and specific examples can include heterocyclic groups such as pyrrolidine, pyrazine, piperazine, piperodine, morpholine, oxadine, oxazolidine, hydantoin, pyridine, pyrimidine, pyridazine, and the like. Among them, morpholine, oxazolidine, and a hidantoin ring are preferable.

X represents a calcogen atom, and preferably represents one of an oxygen atom and a sulfur atom. X is more preferably an oxygen atom. In the case where X is a sulfur atom, $R_1$ is preferably a hydrogen atom.

Y preferably represents one selected from an amino group, an alkylamino group having 1 to 30 carbon atoms, an N,N-dialkylamino group having 2 to 40 carbon atoms in total, an aniline group having 6 to 30 carbon atoms, a hydroxy group, an alkoxy group having 1 to 30 carbon atoms, an aryloxy group having 6 to 30 carbon atoms, an acylamino group having 1 to 30 carbon atoms, and a sulfonamide group having 1 to 30 carbon atoms.

In the case where Y is an amino group, Y may be substituted by an alkyl group or an aryl group.

Y may be substituted by one selected from a halogen atom, an alkyl group, an aryl group, a hydroxyl group, an alkoxyl group, an aryloxy group, an alkylthio group, an arylthio group, an acyl group, an alkoxycarbonyl group, a sulfonamide group, a sulfamoyl group, a carbamoyl group, an acyloxy group, a cyano group, an ureido group, an urethane group, a heterocyclic group, and the like. When a substituent of Y is a group having an alkyl group, specific examples of the alkyl group can include a methyl group, an ethyl group, a propyl group, an isopropyl group, an n-butyl group, a tert-butyl group, a tert-amyl group, an n-hexyl group, an n-octyl group, a dodecyl group, an octadecyl group, a 2-ethylhexyl group, a benzyl group, a phenoxyethyl group, a dodecylthioethyl group, a methoxyethoxyethyl group, and the like. When a substituent of Y is a group having an aryl group, specific examples of the aryl group can include a phenyl group, a naphtyl group, a cresyl group, a xylyl group, a mesityl group, a 4-methoxyphenyl group, a 3-chlorophenyl group, a 2,4-dichlorophenyl group, a 4-cyanophenyl group, a 3-methanesulfonamidophenyl group, a 4-methylsulfonylphenyl group, and the like.

In the case where Y is an amino group, Y is preferably one of an unsubstituted amino group, an N-alkylamino group having 1 to 8 carbon atoms, and an N,N-dialkylamino group, more preferably one of an unsubstituted amino group and an N-alkylamino group having 1 to 4 carbon atoms, and most preferably an unsubstituted amino group.

When Y is a dialkylamino group, the two alkyl groups in this group may bind each other to form a 5 to 7 membered ring. Specific examples in this case can include a pyrroridyl group, a piperidyl group, a morpholinyl group, and the like, and most preferably among them is a morpholinyl group.

When Y is an alkoxyl group, specific examples can include a methoxy group, an ethoxy group, an isopropoxy group, a butoxy group, a tert-butoxy group, an octyloxy group, a hexadecyloxy group, a cyclohexyloxy group, a methoxyethoxy group, a butoxyethoxy group, a phenoxyethoxy group, a 2,4-di-tert-amylphenoethoxy group, and the like. An alkoxy group having 1 to 6 carbon atoms is preferable and, a methoxy group, an ethoxy group, and a butoxy group are more preferable.

When Y is an aryloxy group, Y is preferably an aryloxy group having 6 to 12 carbon atoms. As specific examples, a phenoxy group, a cresyloxy group, and an anisidyloxy group are preferable.

When Y is an acylamino group, Y is preferably an acylamino group having 1 to 10 carbon atoms, and specific examples can include an acetylamino group, a butyloylamino group, a benzoylamino group, and the like.

When Y is a sulfonamide group, Y is preferably a sulfonamide group having 1 to 10 carbon atoms, specific examples can include a methanesulfonamide group, a butanesulfonamide group, an octanesulfonamide group, a benzenesulfonamide group, and the like.

When Y is one of an alkoxy group, an alkylamino group, a dialkylamino group, an acylamino group, and a sulfonamide, Y and $R_1$ may bind each other to form a 5 to 7 membered ring.

Particularly when Y is an acylamino group or a sulfonamide group, it is preferred that Y forms a ring, and it is particularly preferred that Y forms a hidantoin or an oxazoline ring.

Among the compounds represented by formula (1), urea and thiourea are particularly preferable, and urea is most preferable.

In this invention, the addition amount of the compound of formula (1) is preferably in a range from 1 $mg/m^2$ to 1 $g/m^2$, more preferably 10 $mg/m^2$ to 500 $mg/m^2$, and further preferably 30 $mg/m^2$ to 300 $mg/m^2$. The compound of this invention may be added in any layer on the side including the image forming layer, however, the compounds are preferably used in the image forming layer or in the layer adjacent to the image forming layer.

The compound of formula (1) in this invention may be added in any form, such as an aqueous solution, a solution of organic solvent such as methanol or the like, a solid dispersion, an emulsion and the like, according to its property. However, it is added preferably as an aqueous solution or a solid dispersion. When it is added as a solid dispersion, the method for preparing a solid dispersion, which is described above on an adding method of a reducing agent, may be used.

The compound of formula (1) in this invention may be used alone or two or more kinds thereof may be used in combination.

Specific examples of the compound represented by formula (1) are described below, however, the present invention is not limited thereto.

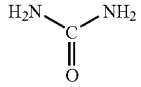

1

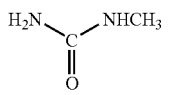

2

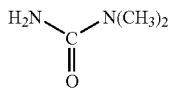

3

-continued

4 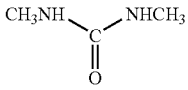

5 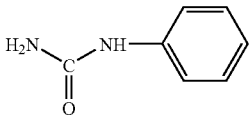

5 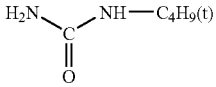

6 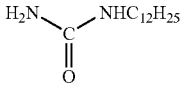

7 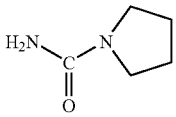

8 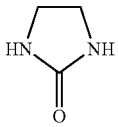

9 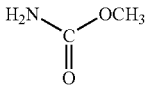

10 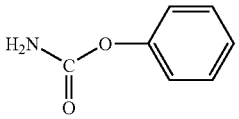

11 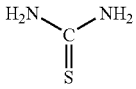

12 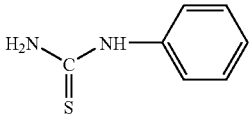

13 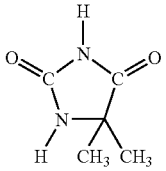

14 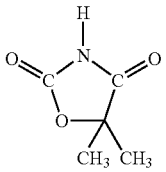

15

-continued

16 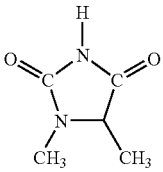

17 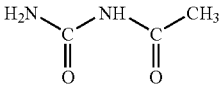

18 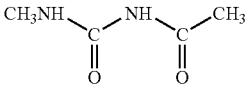

19 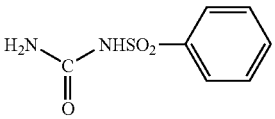

20 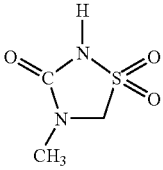

21 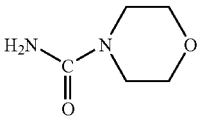

22 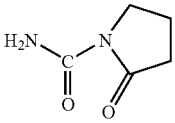

23 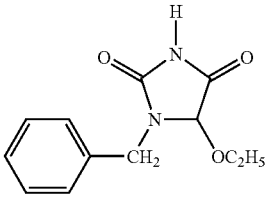

(Means for Nucleation)

The means for nucleation which can be used in the present invention is the means which can induce a new development in the neighborhood of the initial developing part as a result of initial development. As the means for nucleation which can be used in the present invention, the compound conventionally known as a nucleator and an infectious reducing agent can be used, however the compound having the function described above can be used in the present invention without limitation of these.

1) Nucleator

The nucleator used in the present invention is explained below.

The nucleator according to the invention is the compound, which can form a compound that can newly induce a development by the reaction with developing product in consequence of an initial development. It was conventionally known to use a nucleator for the ultra-high contrast photosensitive materials suitable for the use for graphic arts. The ultra-high contrast photosensitive materials had an average gradient of 10 or more and were unsuitable for conventional photographic materials, and especially unsuitable for the medical use where high diagnostic ability was required. And because the ultra-high contrast photosensitive material had rough graininess and did not have enough sharpness, there was no aptitude in a medical diagnostic use. The nucleator in the present invention completely differs from the nucleator in the conventional ultra-high contrast photosensitive material as regards the effect. The nucleator in the present invention does not make a gradation hard. The nucleator in the present invention is the compound can cause development sufficiently, even if the number of photosensitive silver halide grain with respect to non-photosensitive silver salt of organic acid is extremely lessened. Although that mechanism is not clear, when thermal development is performed using the nucleator according to the present invention, it becomes clear that the number of developed silver grain exists larger than the number of photosensitive silver halide grain in the maximum density part, and it is presumed that the nucleator according to the present invention has the action to form the new development point (development nuclei) in the part where a silver halide grain does not exist.

As the nucleator, hydrazine derivative compounds represented by the following formula (V), vinyl compounds represented by the following formula (VI), and quaternary onium compounds represented by the following formula (P) are preferable. Among the vinyl compounds, cyclic olefine compounds represented by formulae (A), (B) and (C) are particularly preferable.

Formula (V)

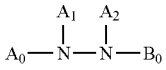

Formula (VI)

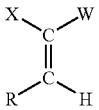

Formula (P)

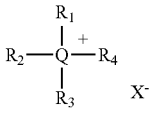

Formula (A)

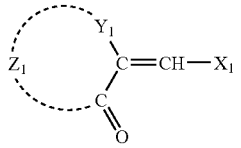

Formula (B)

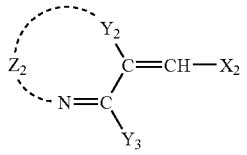

-continued

Formula (C)

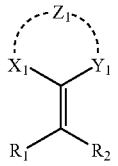

In formula (V), $A_0$ represents one selected from an aliphatic group, an aromatic group, a heterocyclic group, and a $-G_0-D_0$ group, each of which may have a substituent. $B_0$ represents a blocking group. $A_1$ and $A_2$ both represent a hydrogen atom, or one of $A_1$ or $A_2$ represents a hydrogen atom and the other represents one selected from an acyl group, a sulfonyl group, and an oxalyl group. Herein, $G_0$ represents one selected from a —CO— group, a —COCO— group, a —CS— group, a —C(═$NG_1D_1$)— group, an —SO— group, an —$SO_2$— group, and a —P(O) ($G_1D_1$)— group. $G_1$ represents one selected from a mere bonding hand, an —O— group, an —S— group, and an —N($D_1$) group. $D_1$ represents one selected from an aliphatic group, an aromatic group, a heterocyclic group, and a hydrogen atom. In the case where a plurality of $D_1$ exist in one molecule, those may be the same as or different from each other. $D_0$ represents one selected from a hydrogen atom, an aliphatic group, an aromatic group, a heterocyclic group, an amino group, an alkoxy group, an aryloxy group, an alkylthio group, and an arylthio group. As preferable $D_0$, a hydrogen atom, an alkyl group, an alkoxy group, an amino group and the like are described.

In formula (V), the aliphatic group represented by $A_0$ preferably has 1 to 30 carbon atoms, and particularly preferably is a normal, blanched or cyclic alkyl group having 1 to 20 carbon atoms. For example, a methyl group, an ethyl group, a t-butyl group, an octyl group, a cyclohexyl group, a benzyl group are described. These may be further substituted by a suitable substituent (e.g., an aryl group, an alkoxy group, an aryloxy group, an alkylthio group, an arylthio group, a sulfoxy group, a sulfonamide group, a sulfamoyl group, an acylamino group, an ureido group and the like).

In formula (V), the aryl group represented by $A_0$ preferably is an aryl group of a single or condensed ring. For example, a benzene ring or a naphthalene ring is described. As a heterocyclic ring represented by $A_0$, the heterocyclic ring of a single or condensed ring containing at least one heteroatom selected from a nitrogen atom, a sulfur atom and an oxygen atom is preferable. For example, a pyrrolidine ring, an imidazole ring, a tetrahydrofuran ring, a morpholine ring, a pyridine ring, a pyrimidine ring, a quinoline ring, a thiazole ring, a benzothiazole ring, a thiophene ring and a furan ring are described. In $A_0$, an aryl group, a heterocyclic group and a $-G_0-D_0$ group may have a substituent. As $A_0$, an aryl group and a $-G_0-D_0$ group are particularly preferable.

And, in formula (V), $A_0$ preferably contains at least one of a diffusion-resistant group or an adsorptive group to silver halide. As a diffusion-resistant group, a ballast group usually used as non-moving photographic additive is preferable. As a ballast group, a photochemically inactive alkyl group, alkenyl group, alkynyl group, alkoxy group, phenyl group, phenoxy group, alkylphenoxy group and the like are described and it is preferred that the substituent part has 8 or more carbon atoms in total.

In formula (V), as an adsorption promoting group to silver halide, thiourea, a thiourethane group, a mercapto group, a thioether group, a thione group, a heterocyclic group, a thioamido heterocyclic group, a mercapto heterocyclic group or an adsorptive group described in JP-A No. 64-90439 and the like are described.

In formula (V), $B_0$ represents a blocking group and preferably a $-G_0-D_0$ group. $G_0$ represents one selected from a —CO— group, a —COCO— group, a —CS— group, a —C(=$NG_1D_1$) group, a —SO— group, a —$SO_2$— group, and a —P(O)($G_1D_1$)— group. As preferable $G_0$, a —CO— group and a —COCO— group are described. $G_1$ represents one selected from a mere bonding hand, a —O— group, a —S— group, and a —N($D_1$)— group. $D_1$ represents one selected from an aliphatic group, an aromatic group, a heterocyclic group, and a hydrogen atom. In the case where plural $D_1$ exist in a molecule, they may be the same or different. $D_0$ represents one selected from a hydrogen atom, an aliphatic group, an aromatic group, a heterocyclic group, an amino group, an alkoxy group, an aryloxy group, an alkylthio group, and an arylthio group. As preferable $D_0$, a hydrogen atom, an alkyl group, an alkoxy group, an amino group and the like are described. $A_1$ and $A_2$ both represent a hydrogen atom, or one represents a hydrogen atom and the other represents one selected from an acyl group (an acetyl group, a trifluoroacetyl group, a benzoyl group or the like), a sulfonyl group (a methanesulfonyl group, a toluenesulfonyl group or the like), and an oxalyl group (an ethoxalyl group or the like).

As specific examples of the compound represented by formula (V), the compound H-1 to H-35 of chemical formula Nos. 12 to 18 and the compound H-1-1 to H-4-5 of chemical formula Nos. 20 to 26 in JP-A No. 2002-131864 are described, however specific examples are not limited in these.

These compounds represented by formula (V) can be easily synthesized by known methods. For example, these can be synthesized by referring to U.S. Pat. Nos. 5,464,738 and 5,496,695.

In addition, hydrazine derivatives preferably used are the compound H-1 to H-29 described in U.S. Pat. No. 5,545,505, columns 11 to 20 and the compounds 1 to 12 described in U.S. Pat. No. 5,464,738, columns 9 to 11. These hydrazine derivatives can be synthesized by known methods.

Next, formula (VI) is explained. In formula (VI), although X and R are displayed in a cis form, a trans form for X and R is also included in formula (VI). This is also similar to the structure display of specific compounds.

In formula (VI), X represents an electron-attracting group, and W represents one selected from a hydrogen atom, an alkyl group, an alkenyl group, an alkynyl group, an aryl group, a heterocyclic group, a halogen atom, an acyl group, a thioacyl group, an oxalyl group, an oxyoxalyl group, a thiooxalyl group, an oxamoyl group, an oxycarbonyl group, a thiocarbonyl group, a carbamoyl group, a thiocarbamoyl group, a sulfonyl group, a sulfinyl group, an oxysulfinyl group, a thiosulfinyl group, a sulfamoyl group, an oxysulfinyl group, a thiosulfinyl group, a sulfinamoyl group, a phosphoryl group, a nitro group, an imino group, a N-carbonylimino group, a N-sulfonylimino group, a dicyanoethylene group, an ammonium group, a sulfonium group, a phosphonium group, a pyrylium group, and an immonium group.

R represents one selected from a halogen atom, a hydroxyl group, an alkoxy group, an aryloxy group, a heterocyclic oxy group, an alkenyloxy group, an acyloxy group, an alkoxycarbonyloxy group, an aminocarbonyloxy group, a mercapto group, an alkylthio group, an arylthio group, a heterocyclic thio group, an alkenylthio group, an acylthio group, an alkoxycarbonylthio group, an aminocarbonylthio group, an organic or inorganic salt of hydroxy group or mercapto group (e.g., a sodium salt, a potassium salt, a silver salt and the like), an amino group, an alkylamino group, a cyclic amino group (e.g., a pyrrolidino group and the like), an acylamino group, an oxycarbonylamino group, a heterocyclic group (a 5 or 6 membered nitrogen containing heterocycle, e.g., a benzotriazolyl group, an imidazolyl group, a triazolyl group, a tetrazolyl group and the like), an ureido group, and a sulfonamide group. X and W, and X and R may bind each other to form a cyclic structure. As the ring formed by X and W, for example, pyrazolone, pyrazolidinone, cyclopentanedione, β-ketolactone, β-ketolactam and the like are described.

Explaining formula (VI) further, the electron-attracting group represented by X is a substituent which can have a positive value of substitution constant σp. Specifically, a substituted alkyl group (halogen substituted alkyl and the like), a substituted alkenyl group (cyanovinyl and the like), a substituted or unsubstituted alkynyl group (trifluoromethylacetylenyl, cyanoacetylenyl and the like), a substituted aryl group (cyanophenyl and the like), a substituted or unsubstituted heterocyclic group (pyridyl, triazinyl, benzoxazolyl and the like), a halogen atom, a cyano group, an acyl group (acetyl, trifluoroacetyl, formyl and the like), a thioacetyl group (thioacetyl, thioformyl and the like), an oxalyl group (methyloxalyl and the like), an oxyoxalyl group (ethoxalyl and the like), a thiooxalyl group (ethylthiooxalyl and the like), an oxamoyl group (methyloxamoyl and the like), an oxycarbonyl group (ethoxycarbonyl and the like), a carboxyl group, a thiocarbonyl group (ethylthiocarbonyl and the like), a carbamoyl group, a thiocarbamoyl group, a sulfonyl group, a sulfinyl group, an oxysulfonyl group (ethoxysulfonyl and the like), a thiosulfonyl group (ethylthiosulfonyl and the like), a sulfamoyl group, an oxysulfinyl group (methoxysulfinyl and the like), a thiosulfinyl group (methylthiosulfinyl and the like), a sulfinamoyl group, a phosphoryl group, a nitro group, an imino group, a N-carbonylimino group (N-acetylimino and the like), a N-sulfonylimino group (N-methanesulfonylimino and the like), a dicyanoethylene group, an ammonium group, a sulfonium group, a phosphonium group, a pyrylium group, an immonium group and the like are described, and a heterocyclic one formed by an ammonium group, a sulfonium group, a phosphonium group, an immonium group, and the like are also included. The substituent having σp value of 0.30 or more is particularly preferable.

As an alkyl group represented by W, methyl, ethyl, trifluoromethyl and the like are described. As an alkenyl group, vinyl, halogen substituted vinyl, cyanovinyl and the like are described. As an aryl group, nitrophenyl, cyanophenyl, pentafluorophenyl and the like are described, and as a heterocyclic group, pyridyl, pyrimidyl, triazinyl, succinimido, tetrazolyl, triazolyl, imidazolyl, benzimidazolyl and the like are described. As W, the electron-attracting group having a positive σp value is preferable and that value preferably is 0.30 or more.

Among the substituents of R described above, a hydroxy group, a mercapto group, an alkoxy group, an alkylthio group, a halogen atom, an organic or inorganic salt of hydroxy group or mercapto group, and a heterocyclic group are preferably described, more preferably a hydroxy group, an alkoxy group, an organic or inorganic salt of hydroxyl group or mercapto group and a heterocyclic group are described, and particularly preferably a hydroxy group and an organic or inorganic salt of hydroxy group or mercapto group are described.

And among the substituents of X and W described above, the group having a thioether bond in the substituent is preferable.

As specific examples of the compound represented by formula (VI), compound 1-1 to 92-7 of chemical formula Nos. 27 to 50 described in JP-A No. 2002-131864 are described, however specific examples are not limited in these.

In formula (P), Q represents one selected from a nitrogen atom and a phosphor atom. $R_1$, $R_2$, $R_3$ and $R_4$ each independently represent one selected from a hydrogen atom and a substituent, and $X^-$ represents an anion. And $R_1$ to $R_4$ may bind each other to form a ring.

As the substituent represented by $R_1$ to $R_4$, an alkyl group (a methyl group, an ethyl group, a propyl group, a butyl group, a hexyl group, a cyclohexyl group and the like), an alkenyl group (an allyl group, a butenyl group and the like), an alkynyl group (a propargyl group, a butynyl group and the like), an aryl group (a phenyl group, a naphthyl group and the like), a heterocyclic group (a piperidinyl group, a piperazinyl group, a morpholinyl group, a pyridyl group, a furyl group, a thienyl group, a tetrahydrofuryl group, a tetrahydrothienyl group, a sulforanyl group and the like), an amino group and the like are described.

As the ring formed by binding $R_1$ to $R_4$ each other, a piperidine ring, a morpholine ring, a piperazine ring, a quinuclidine ring, a pyridine ring, a pyrrole ring, an imidazole ring, a triazole ring, a tetrazole ring and the like are described.

The group represented by $R_1$ to $R_4$ may have a substituent such as a hydroxy group, an alkoxy group, an aryloxy group, a carboxyl group, a sulfo group, an alkyl group, an aryl group and the like. $R_1$, $R_2$, $R_3$ and $R_4$ preferably are a hydrogen atom and an alkyl group.

As the anion represented by $X^-$, an organic or inorganic anion such as a halogen ion, a sulfate ion, a nitrate ion, an acetate ion, a p-toluenesulfonate ion and the like are described.

As a structure of formula (P), the structure described in paragraph Nos. 0153 to 0163 in JP-A No. 2002-131864 is still more preferable.

As the specific compounds of formula (P), P-1 to P-52 and T-1 to T-18 of chemical formula Nos. 53 to 62 in JP-A No. 2002-131864 can be described, however the specific compound is not limited in these.

The quaternary onium compound described above can be synthesized by referring to known methods. For example, the tetrazolium compound described above can be synthesized by referring to the method described in Chemical Reviews, vol. 55, pages 335 to 483.

Next, the compounds represented by formulae (A) and (B) are explained in detail. In formula (A), $Z_1$ represents a nonmetallic atomic group capable to form a 5 to 7 membered ring structure with —$Y_1$—C(═CH—$X_1$)—C(═O)—. $Z_1$ preferably is an atomic group selected from a carbon atom, an oxygen atom, a sulfur atom, a nitrogen atom and a hydrogen atom, and several atoms selected from these are bound each other by single bond or double bond to form a 5 to 7 membered ring structure with —$Y_1$—C(═CH—$X_1$)—C(═O)—. $Z_1$ may have a substituent, and $Z_1$ itself may be an aromatic or a non-aromatic carbon ring, or $Z_1$ may be a part of an aromatic or a non-aromatic heterocycle, and in this case, a 5 to 7 membered ring structure formed by $Z_1$ with —$Y_1$—C(═CH—$X_1$)—C(═O)— forms a condensed ring structure.

In formula (B), $Z_2$ represents a nonmetallic atomic group capable to form a 5 to 7 membered ring structure with —$Y_2$—C(═CH—$X_2$)—C($Y_3$)═N—. $Z_2$ preferably is an atomic group selected from a carbon atom, an oxygen atom, a sulfur atom, a nitrogen atom and a hydrogen atom, and several atoms selected from these are bound each other by single bond or double bond to form a 5 to 7 membered ring structure with —$Y_2$—C(═CH—$X_2$)—C($Y_3$)═N—. $Z_2$ may have a substituent, and $Z_2$ itself may be an aromatic or a non-aromatic carbon ring, or $Z_2$ may be a part of an aromatic or a non-aromatic heterocycle and in this case, a 5 to 7 membered ring structure formed by $Z_2$ with —$Y_2$—C(═CH—$X_2$)—C($Y_3$)═N— forms a condensed ring structure.

In the case where $Z_1$ and $Z_2$ have a substituent, examples of substituent are selected from the compounds described below. Namely, as typical substituent, for example, a halogen atom (fluorine atom, chlorine atom, bromine atom or iodine atom), an alkyl group (includes an aralkyl group, a cycloalkyl group and an active methylene group), an alkenyl group, an alkynyl group, an aryl group, a heterocyclic group, a heterocyclic group containing a quaternary nitrogen (e.g., a pyridinio group), an acyl group, an alkoxycarbonyl group, an aryloxycarbonyl group, a carbamoyl group, a carboxy group or a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group, an alkoxy group (includes the group in which an ethylene oxy group or a propylene oxy group unit are repeated), an aryloxy group, a heterocyclic oxy group, an acyloxy group, an alkoxy carbonyloxy group, an aryloxy carbonyloxy group, a carbamoyloxy group, a sulfonyloxy group, an amino group, an alkylamino group, an arylamino group, a heterocyclic amino group, a N-substituted nitrogen containing heterocyclic group, an acylamino group, a sulfonamide group, an ureido group, a thioureido group, an imido group, an alkoxycarbonylamino group, an aryloxycarbonylamino group, a sulfamoylamino group, a semicarbazide group, a thiosemicarbazide group, a hydrazino group, a quaternary ammonio group, an oxamoylamino group, an alkylsulfonylureido group, an arylsulfonylureido group, an acylureido group, an acylsulfamoylamino group, a nitro group, a mercapto group, an alkylthio group, an arylthio group, a heterocyclic thio group, an alkylsulfonyl group, an arylsulfonyl group, a sulfo group or a salt thereof, a sulfamoyl group, an acylsulfamoyl group, a sulfonylsulfamoyl group or a salt thereof, a group containing phosphoric amide or phosphoric ester structure, a silyl group, a stannyl group and the like are described. These substituents may be further substituted by these substituents.

Next, $Y_3$ is explained. In formula (B), $Y_3$ represents one of a hydrogen atom and a substituent, and when $Y_3$ represents a substituent, following group is specifically described as that substituent. Namely, an alkyl group, an aryl group, a heterocyclic group, a cyano group, an acyl group, an alkoxycarbonyl group, an aryloxycarbonyl group, a carbamoyl group, an amino group, an alkylamino group, an arylamino group, a heterocyclic amino group, an acylamino group, a sulfonamide group, an ureido group, a thioureido group, an imido group, an alkoxy group, an aryloxy group, an alkylthio group, an arylthio group, a heterocyclic thio group and the like are described. These substituents may be substituted by any substituents, and specifically, examples of the substituents which $Z_1$ or $Z_2$ may have, are described.

In formulae (A) and (B), $X_1$ and $X_2$ each independently represent one selected from a hydroxy group (or a salt thereof), an alkoxy group (e.g., a methoxy group, an ethoxy group, a propoxy group, an isopropoxy group, an octyloxy group, a dodecyloxy group, a cetyloxy group, a t-buthoxy group and the like), an aryloxy group (e.g., a phenoxy group, a p-t-pentylphenoxy group, a p-t-octylphenoxy group and the like), a heterocyclic oxy group (e.g., a benzotriazolyl-5-oxy group, a pyridinyl-3-oxy group and the like), a mercapto group (or a salt thereof), an alkylthio group (e.g., methylthio group, an ethlythio group, a butylthio group, a dodecylthio group and the like), an arylthio group (e.g., a phenylthio group, a p-dodecylphenylthio group and the like), a heterocyclic thio group (e.g., a 1-phenyltetrazoyl-5-thio group, a 2-methyl-1-phenyltriazolyl-5-thio group, a mercaptothiadiazolylthio group and the like), an amino group, an alkylamino group (e.g., a methylamino group, a propylamino group, an octylamino group, a dimethylamino group and the like), an arylamino group (e.g., an anilino group, a naphthylamino group, an o-methoxyanilino group and the like), a heterocyclic amino group (e.g., a pyridylamino group, a benzotriazole-5-ylamino group and the like), an acylamino group (e.g., an acetamide group, an octanoylamino group, a benzoylamino group and the like), a sulfonamide group (e.g., a methanesulfonamide group, a benzenesulfonamide group a dodecylsulfonamide group and the like), and a heterocyclic group.

Herein, a heterocyclic group is an aromatic or non-aromatic, a saturated or unsaturated, a single ring or condensed ring, or a substituted or unsubstituted heterocyclic group. For example, a N-methylhydantoyl group, a N-phenylhydantoyl group, a succinimido group, a phthalimido group, a N,N'-dimethylurazolyl group, an imidazolyl group, a benzotriazolyl group, an indazolyl group, a morpholino group, a 4,4-dimethyl-2,5-dioxo-oxazolyl group and the like are described.

And herein, a salt represents a salt of an alkali metal (sodium, potassium and lithium) or a salt of an alkali earth metal (magnesium and calcium), a silver salt or a quaternary ammonium salt (a tetraethylammonium salt, a dimethylcetylbenzylammonium salt and the like), a quaternary phosphonium salt and the like. In formulae (A) and (B), $Y_1$ and $Y_2$ represent —C(═O)— or —$SO_2$—.

The preferable range of the compound represented by formulae (A) and (B) is described in JP-A No. 11-231459, paragraph Nos. 0027 to 0043. As specific examples of the compound represented by formulae (A) and (B), compound 1 to 110 of Table 1 to 8 in JP-A No. 11-231459 are described, however the invention is not limited in these.

Next, the compound represented by formula (C) is explained in detail. In formula (C), $X_1$ represents one selected from an oxygen atom, a sulfur atom, and a nitrogen atom. In the case where $X_1$ is a nitrogen atom, the bond of $X_1$ and $Z_1$ may be either a single bond or a double bond, and in the case of a single bond, a nitrogen atom may have a hydrogen atom or any substituent. As this substituent, for example, an alkyl group (includes an aralkyl group, a cycloalkyl group, an active methylene group and the like), an alkenyl group, an alkynyl group, an aryl group, a heterocyclic group, an acyl group, an alkoxycarbonyl group, an aryloxycarbonyl group, a carbamoyl group, an alkylsulfonyl group, an arylsulfonyl group, a heterocyclic sulfonyl group and the like are described.

$Y_1$ represents the group represented by one selected from —C(═O)—, —C(═S)—, —SO—, —$SO_2$—, —C(═$NR_3$)— and —($R_4$) C═N—. $Z_1$ represents a nonmetallic atomic group capable to form a 5 to 7 membered ring containing $X_1$ and $Y_1$. The atomic group to form that ring is an atomic group which consists of 2 to 4 atoms that are other than metal atoms, and these atoms may be combined by single bond or double bond, and these may have a hydrogen atom or any subsituent (e.g., an alkyl group, an aryl group, a heterocyclic group, an alkoxy group, an alkylthio group, an acyl group, an amino group or an alkenyl group). When $Z_1$ forms a 5 to 7 membered ring containing $X_1$ and $Y_1$, the ring is a saturated or unsaturated heterocyclic ring, and may be a single ring or may have a condensed ring. When $Y_1$ is the group represented by C(═$NR_3$), ($R_4$)C═N, the condensed ring of this case may be formed by binding $R_3$ or $R_4$ with the substituent of $Z_1$.

In formula (C), $R_1$, $R_2$, $R_3$ and $R_4$ each independently represent one of a hydrogen atom and a substituent. However, $R_1$ and $R_2$ do not bind each other to form a ring structure.

When $R_1$ and $R_2$ represent a monovalent substituent, the following groups are described as a monovalent substituent.

For example, a halogen atom (fluorine atom, chlorine atom, bromine atom or iodine atom), an alkyl group (an aralkyl group, a cycloalkyl group, an active methylene group and the like), an alkenyl group, an alkynyl group, an aryl group, a heterocyclic group, a heterocyclic group containing a quaternary nitrogen (e.g., a pyridinio group), an acyl group, an alkoxycarbonyl group, an aryloxycarbonyl group, a carbamoyl group, a carboxy group and a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group and a salt thereof, an alkoxy group (includes the group in which an ethylene oxy group or a propylene oxy group unit are repeated), an aryloxy group, a heterocyclic oxy group, an acyloxy group, an alkoxy carbonyloxy group, an aryloxycarbonyloxy group, a carbamoyloxy group, a sulfonyloxy group, an amino group, an alkylamino group, an arylamino group, an heterocyclic amino group, a N-substituted nitrogen containing heterocyclic group, an acylamino group, a sulfonamide group, an ureido group, a thioureido group, an imido group, an alkoxycarbonylamino group, an aryloxycarbonylamino group, a sulfamoylamino group, a semicarbazide group, a thiosemicarbazide group, a hydrazino group, a quaternary ammonio group, an oxamoylamino group, an alkylsulfonylureido group, an arylsulfonylureido group, an acylureido group, an acylsulfamoylamino group, a nitro group, a mercapto group and a salt thereof, an alkylthio group, an arylthio group, an heterocyclic thio group, an alkylsulfonyl group, an arylsulfonyl group, an alkylsulfinyl group, an arylsulfinyl group, a sulfo group and a salt thereof, a sulfamoyl group, an acylsulfamoyl group, a sulfonylsulfamoyl group and a salt thereof, a phosphoryl group, a group containing phosphoric amide or phosphoric ester structure, a silyl group, a stannyl group and the like are described. These substituents may be further substituted by these monovalent substituents.

When $R_3$ and $R_4$ represent a substituent, the same substituent as what $R_1$ and $R_2$ may have except the halogen atom can be described as a substituent. Furthermore, $R_3$ and $R_4$ may connect to $Z_1$ to form a condensed ring.

Next, among the compounds represented by formula (C), preferable compounds are described. In formula (C), $Z_1$ preferably is an atomic group which forms a 5 to 7 membered ring with $X_1$ and $Y_1$, and consists of the atoms selected from 2 to 4 carbon atoms, a nitrogen atom, a sulfur atom and an oxygen atom. A heterocycle which $Z_1$ forms with $X_1$ and $Y_1$ preferably contains 3 to 40 carbon atoms in total, more preferably 3 to 25 carbon atoms in total, and most preferably 3 to 20 carbon atoms in total. $Z_1$ preferably comprises at least one carbon atom.

In formula (C), $Y_1$ is preferably one of —C(═O)—, —C(═S)—, —$SO_2$—, and —($R_4$)C═N—, particularly preferably one of —C(=O)—, —C(=S)—, and —$SO_2$— and most preferably —C(=O)—.

In formula (C), in the case where $R_1$ and $R_2$ represent a monovalent substituent, the monovalent substituent represented by $R_1$ and $R_2$ each preferably are the following group having 0 to 25 carbon atoms in total, namely, that is an alkyl group, an aryl group, a heterocyclic group, an alkoxy group, an aryloxy group, a heterocyclic oxy group, an alkylthio group, an arylthio group, a heterocyclic thio group, an amino group, an alkylamino group, an arylamino group, a heterocyclic amino group, an ureido group, an imido group, an acylamino group, a hydroxy group or a salt thereof, a mercapto group or a salt thereof, or an electron-attracting group. Herein, an electron-attracting group means the substituent capable to have a positive value of Hammett substituent constant σp, and specifically a cyano group, a sulfamoyl group, an alkylsulfonyl group, an arylsulfonyl group, a sulfonamide group, an imino group, a nitro group, a halogen atom, an acyl group, a formyl group, a phosphoryl group, a carboxy group (or a salt thereof), a sulfo group (or a salt thereof), a saturated or unsaturated heterocyclic group, an alkenyl group, an alkynyl group, an acyloxy group, an acylthio group, a sulfonyloxy group or an aryl group substituted by these electron-attracting group are described. These substituents may have any substituents.

In formula (C), when $R_1$ and $R_2$ represent a monovalent substituent, more preferable are one of an alkoxy group, an aryloxy group, a heterocyclic oxy group, an alkylthio group, an arylthio group, a heterocyclic thio group, an amino group, an alkylamino group, an arylamino group, a heterocyclic amino group, an ureido group, an imido group, an acylamino group, a sulfonamide group, a heterocyclic group, a hydroxy group, a salt thereof, a mercapto group, a salt thereof, and the like. In formula (C), $R_1$ and $R_2$ particularly preferably are one of a hydrogen atom, an alkoxy group, an aryloxy group, an alkylthio group, an arylthio group, a heterocyclic group, a hydroxy group, a salt thereof, a mercapto group, a salt thereof, and the like. In formula (C), most preferably, one of $R_1$ and $R_2$ is a hydrogen atom and another is one selected from an alkoxy group, an aryloxy group, an alkylthio group, an arylthio group, a heterocyclic group, a hydroxy group, a salt thereof, a mercapto group, and a salt thereof.

In formula (C), when $R_3$ represents a substituent, the following groups having 1 to 25 carbon atoms in total, namely, those are an alkyl group (includes an aralkyl group, a cycloalkyl group, an active methylene group and the like), an alkenyl group, aryl group, a heterocyclic group, a heterocyclic group containing a quaternary nitrogen (e.g., a pyridinio group), an acyl group, an alkoxycarbonyl group, an aryloxycarbonyl group, a carbamoyl group, an alkylsulfonyl group, an arylsulfonyl group, an alkylsulfinyl group, an arylsulfinyl group, a sulfosulfamoyl group, an alkoxy group, an aryloxy group, a heterocyclic oxy group, an alkylthio group, an arylthio group, a heterocyclic thio group, an amino group and the like, can preferably be described. An alkyl group and an aryl group are particularly preferable.

In formula (C), when $R_4$ represents a substituent, the following groups having 1 to 25 carbon atoms in total, namely, those are an alkyl group (includes an aralkyl group, a cycloalkyl group, an active methylene group and the like), an aryl group, a heterocyclic group, a heterocyclic group containing a quaternary nitrogen (e.g., a pyridinio group), an acyl group, an alkoxycarbonyl group, an aryloxycarbonyl group, a carbamoyl group, an alkylsulfonyl group, an arylsulfonyl group, an alkylsulfinyl group, an arylsulfinyl group, a sulfosulfamoyl group, an alkoxy group, an aryloxy group, a heterocyclic oxy group, an alkylthio group, an arylthio group, a heterocyclic thio group and the like, are preferably used. Particularly preferably, an alkyl group, an aryl group, an alkoxy group, an aryloxy group, a heterocyclic oxy group, an alkylthio group, an arylthio group, a heterocyclic thio group and the like are described. When $Y_1$ represents $C(R_4)$=N, the carbon atom in $Y_1$ binds with the carbon atom substituted by $X_1$ or $Y_1$.

Specific compounds represented by formula (C) are represented by A-1 to A-230 of chemical formula Nos. 6 to 18 described in JP-A No. 11-133546, however the invention is not limited in these.

The nucleator described above may be incorporated into photothermographic material by being added into the coating solution, such as in the form of a solution, an emulsion dispersion, a solid fine particle dispersion, and the like.

As well known emulsion dispersing method, there can be mentioned a method comprising dissolving the nucleator in an oil such as dibutylphthalate, tricresylphosphate, dioctylsebacate, tri(2-ethylhexyl)phosphate and the like and an auxiliary solvent such as ethyl acetate and cyclohexanone, and then adding a surfactant such as sodium dodecylbenzenesulfonate, sodium oleil-N-methyltaurinate, sodium di(2-ethylhexyl)sulfosuccinate and the like; from which an emulsion dispersion is mechanically produced. During the process, for the purpose of controlling viscosity of oil droplet and refractive index, the addition of polymer such as α-methylstyrene oligomer, poly(t-butylacrylamide) or the like is preferable.

As solid particle dispersing method, there can be mentioned a method comprising dispersing the powder of the nucleator in a proper medium such as water, by means of ball mill, colloid mill, vibrating ball mill, sand mill, jet mill, roller mill, or ultrasonics, thereby obtaining solid dispersion. In this case, there can also be used a protective colloid (such as polyvinyl alcohol), or a surfactant (for instance, an anionic surfactant such as sodium triisopropylnaphthalenesulfonate (a mixture of compounds having the isopropyl groups in different substitution sites)). In the mills enumerated above, generally used as the dispersion media are beads made of zirconia and the like, and Zr and the like eluting from the beads may be incorporated in the dispersion. Although depending on the dispersing conditions, the amount of Zr and the like generally incorporated in the dispersion is in the range of from 1 ppm to 1000 ppm. It is practically acceptable so long as Zr is incorporated in an amount of 0.5 mg or less per 1 g of silver.

Preferably, an antispective (for instance, sodium benzoisothiazolinone salt) is added in the water dispersion.

The nucleator is particularly preferably used as solid particle dispersion, and is added in the form of fine particles having average particle size from 0.01 μm to 10 μm, preferably from 0.05 μm to 5 μm and, more preferably from 0.1 μm to 2 μm.

In the photothermographic material which is subjected to a rapid development where time period for development is 20 seconds or less, the compound represented by formulae (V) and (P) is used preferably, and the compound represented by formula (V) is used particularly preferably, among the nucleators described above.

In the photothermographic material where low fog is required, the compound represented by formula (VI) is used preferably, and the compound represented by formulae (A), (B) and (C) is more preferably used, and the compound represented by formulae (A) and (B) is particularly preferably used. Moreover, in the photothermographic materials having a few change of photographic property against environmental conditions when used on various environmental conditions (temperature and humidity), the compound represented by formula (C) is preferably used.

Although preferred specific compounds among the above-mentioned nucleators are shown below, the invention is not limited in these.

SH-1

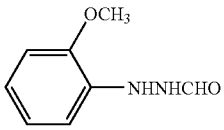

SH-2

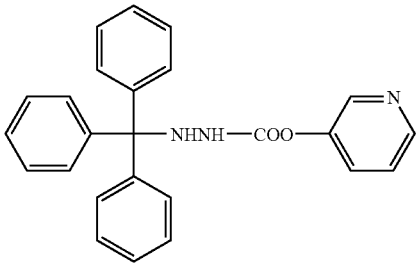

SH-3

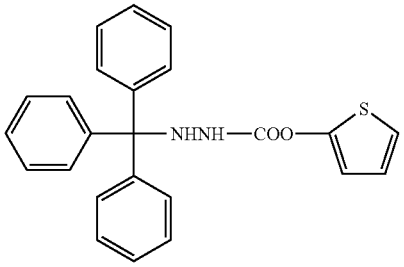

SH-4

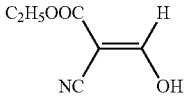

SH-5

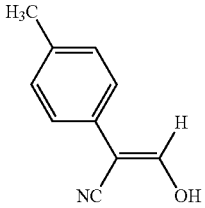

SH-6

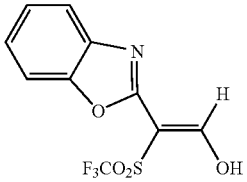

SH-7

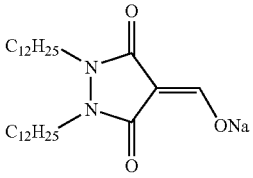

-continued

SH-8

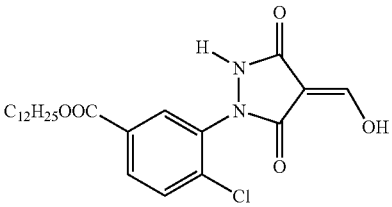

SH-9

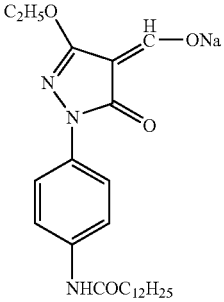

SH-10

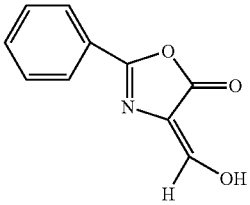

SH-11

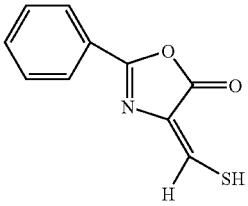

SH-12

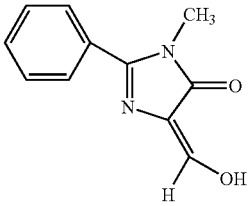

The nucleator of the present invention can be added to the image forming layer or the layer adjacent to the image forming layer, however, preferably to the image forming layer. The addition amount of nucleator is in a range of $10^{-5}$ mol to 1 mol per 1 mol of organic silver salt, and preferably, in a range of $10^{-4}$ mol to $5\times10^{-1}$ mol. The nucleator may be added only one kind or, two or more kinds in combination.

In the photothermographic material of the present invention, the image forming layer containing photosensitive silver halide may be two or more layers and in the case where there are two or more layers, any image forming layer may contain the nucleator. It is preferred to have at least two image forming layers which one of them contains the nucleator and the other does not contain the nucleator.

2) Infectious Developing Reducing Agent

An infectious developing reducing agent is explained. "Infectious development" is a development mechanism generally known for wet development system, for example, is explained in "KAITEI SYASHIN KOUGAKU NO KISO—GINEN SYASHIN HEN" (NIPPON SYASHIN GAKKAI, edit, 1998, CORONA Co.), pages 339 to 341. "Infectious development" is a phenomenon which a more powerful reducing product is generated by the oxidation product of reducing agent generated by early development and accelerates a development.

The present inventors found out that in the thermal development of photothermographic material comprising, on at least one surface of a support, at least a photosensitive silver halide, a non-photosensitive organic silver salt, a reducing agent for silver ions and a binder, the photothermographic material having high sensitivity and high image quality in which the gradation of photographic characteristic curve of the image becomes 2 to 4 can be obtained by using infectious development reducing agent.

Furthermore, it is found out that the photothermographic material of the present invention having a value obtained by dividing a total coating amount of silver contained in the non-photosensitive organic silver salt and the photosensitive silver halide per unit of area by a number of the photosensitive silver halide grains per unit of area, is $5\times10^{-14}$ g/grain or more can achieve high sensitivity and high image quality.

Furthermore, as a result of that a coating amount of silver of 2.0 g/m$^2$ or less and a maximum density of 2.5 or higher can be obtained, it is found out that higher sensitivity and high image quality can be obtained.

As the infectious development reducing agent used in the present invention, any reducing agent may be used as far as it has the ability of infectious development.

Preferable infectious development reducing agent used in the present invention is the compound represented by the following formula (R1).

Formula (R1)

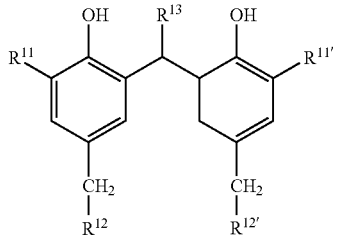

In formula (R1) described above, $R^{11}$ and $R^{11'}$ each independently represent a secondary or tertiary alkyl group having 3 to 20 carbon atoms. $R^{12}$ and $R^{12}$ each independently represent one selected from a hydrogen atom and a linking group through a nitrogen, an oxygen, a phosphor or a sulfur atom. $R^{13}$ represents one selected from a hydrogen atom and an alkyl group having 1 to 20 carbon atoms.

Formula (R1) described above is explained in detail. As $R^{11}$ and $R^{11'}$ described above, a secondary or tertiary alkyl group having 3 to 12 carbon atoms is preferable. Specifically, an isopropyl group, a tert-butyl group, a tert-amyl group, a 1,1-dimethylpropyl group, a 1,1-dimethylbutyl group, a 1,1-dimethylhexyl group, a 1,1-3,3-tetramethylbutyl group, a 1,1-dimethyldecyl group, a 1-methylcyclohexyl group, a tert-octyl group, a 1-methylcyclopropyl group and the like are preferable, and a tert-butyl group, a tert-amyl group, a tert-octyl group and a 1-methylcyclohexyl group are more preferable, and a tert-butyl group is most preferable.

In the case where $R^{12}$ and $R^{12'}$ are an aryloxy group, an arylthio group, an anilino group, a heterocyclic group or a heterocyclic thio group, each of which may have a substituent. As the said substituent, although any group may be possible as far as it is capable of substituting for a hydrogen atom on a benzene ring and a heterocycle, and, an alkyl group, an aryl group, a heterocyclic group, a halogen atom, an alkoxy group, a hydroxy group, an aryloxy group, an alkylthio group, an arylthio group, an amino group, an acyl group, an acyloxy group, an acylamino group, an alkoxycarbonyl group, a carbamoyl group, a sulfonyl group, a sulfonamide group, a sulfonyloxy group, a sulfamoyl group, a sulfoxido group, an ureido group or an urethane group or the like are described. In the case where $R^{12}$ and $R^{12'}$ are an alkoxy group, a carbonyloxy group, an acyloxy group, an alkylthio group, an amino group, an acylamino group, an ureido group or an urethane group, these groups may further have a substituent and as examples of the said substituent, an alkoxy group, an alkoxycarbonyl group, an acyloxy group, an sulfonyl group, a carbonyl group, an alkylthio group, an aryloxy group, an arylthio group, a sulfonamide group, an acylamino group and the like are described. As $R^{12}$ and $R^{12'}$ described above, a hydrogen atom, a hydroxy group, an amino group or an anilino group is more preferable, and further, a hydrogen atom, a methoxy group or a benzyloxy group is most preferable.

As $R^{13}$ described above, a hydrogen atom or an alkyl group having 1 to 15 carbon atoms is preferable, and an alkyl group having 1 to 8 carbon atoms is more preferable. As the said alkyl group, a methyl group, an ethyl group, a propyl group, an isopropyl group, or a 2,4,4-trimethylpenthyl group is preferable. As $R^{13}$ described above, a hydrogen atom, a methyl group, an ethyl group, a propyl group or an isopropyl group is particularly preferable.

Typical examples of the reducing agent represented by formula (R1) of the present invention are shown below, however the present invention is not limited in these.

R1-1

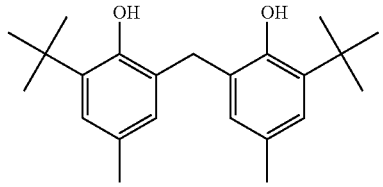

R1-2

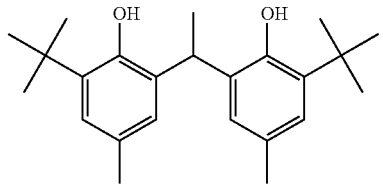

R1-3

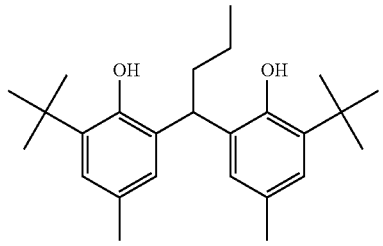

-continued
R1-4
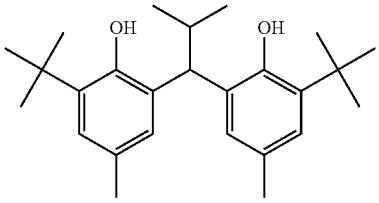
R1-5
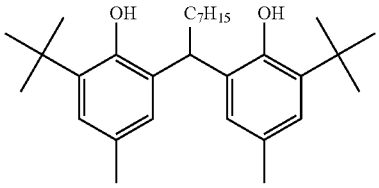
R1-6
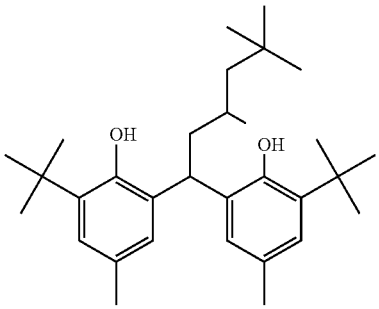
R1-7
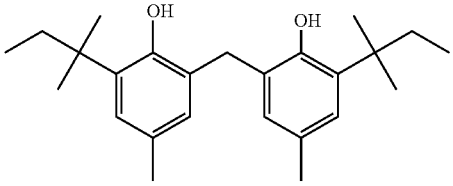
R1-8
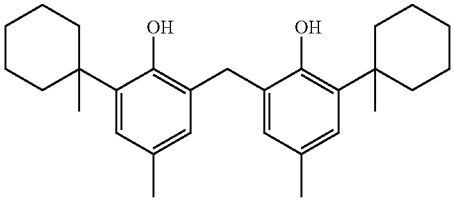
R1-9
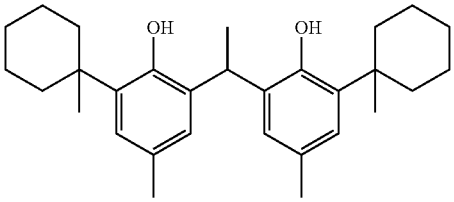
R1-10
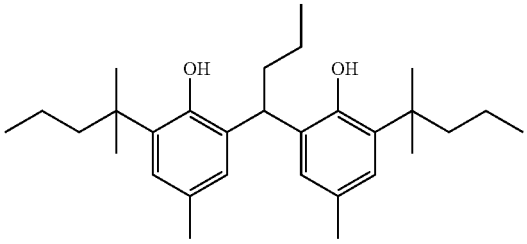
-continued
R1-11
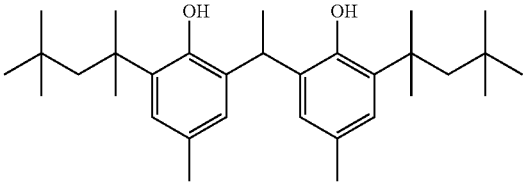
R1-12
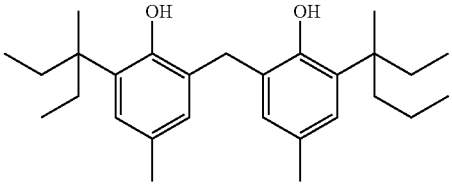
R1-13
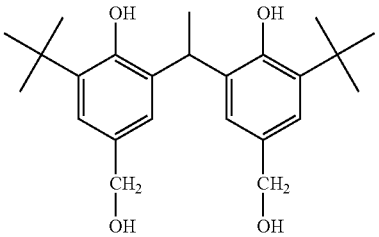
R1-14
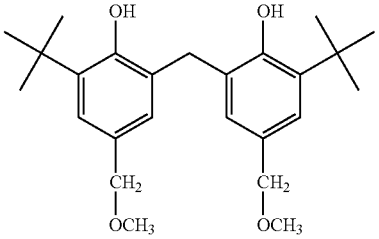
R1-15
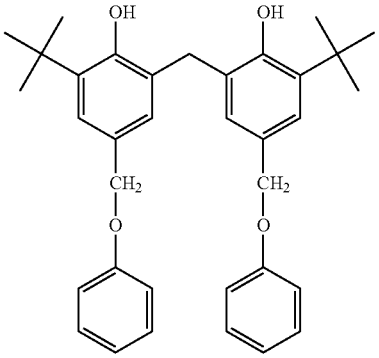
R1-16
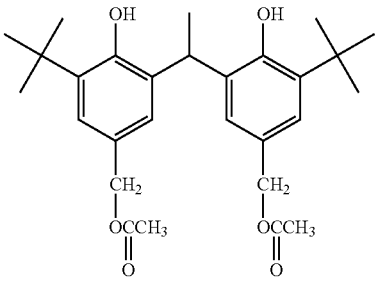

-continued
R1-17
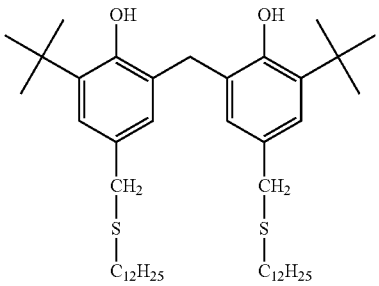
R1-18
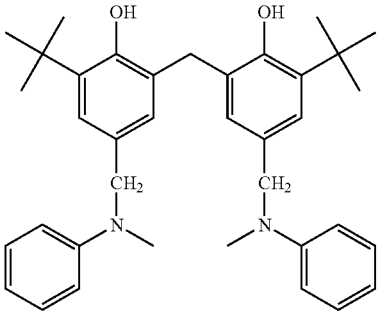
R1-19
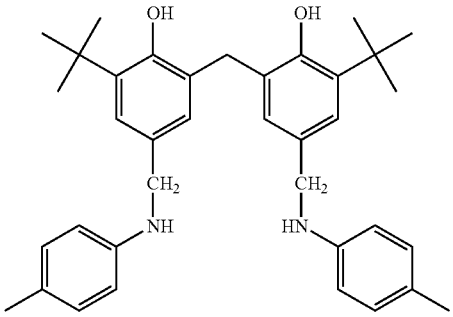
R1-20
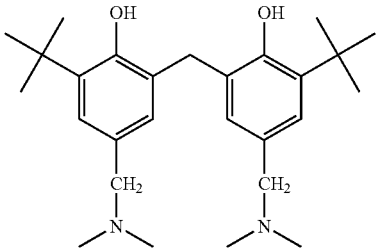
R1-21
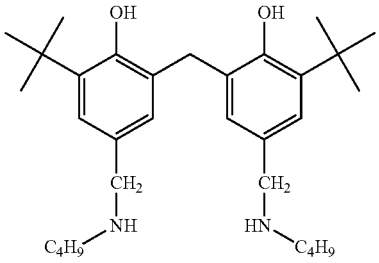
-continued
R1-22
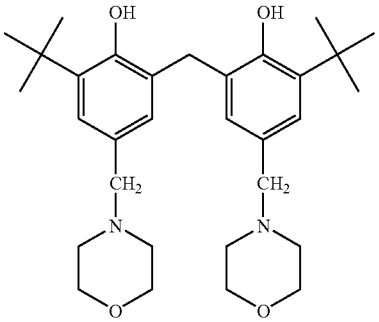
R1-23
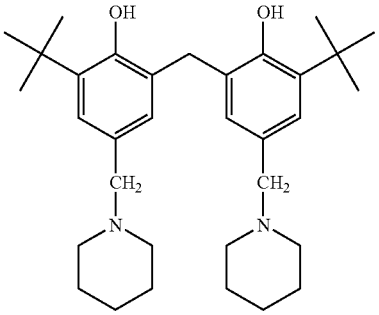
R1-24
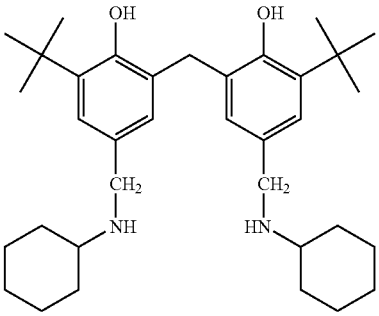
R1-25
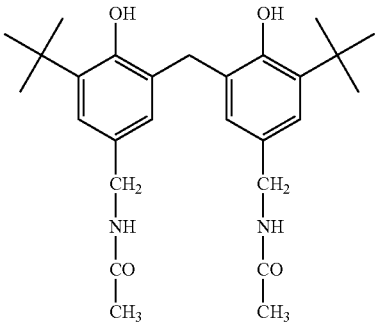
R1-26
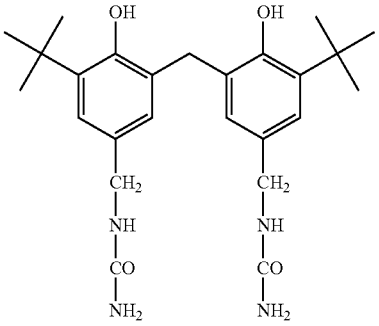

-continued
R1-27
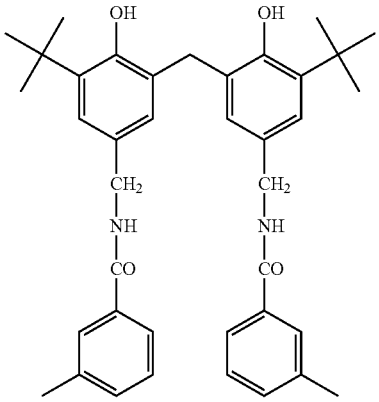
R1-28
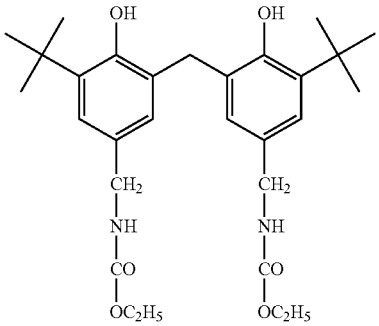
R1-29
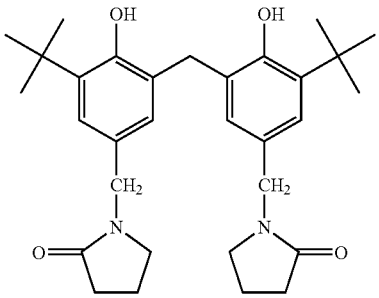
R1-30
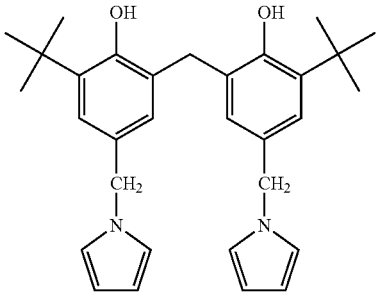
-continued
R1-31
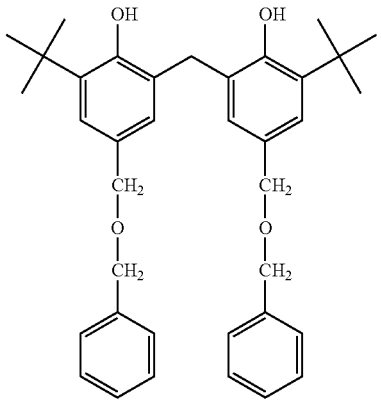
R1-32
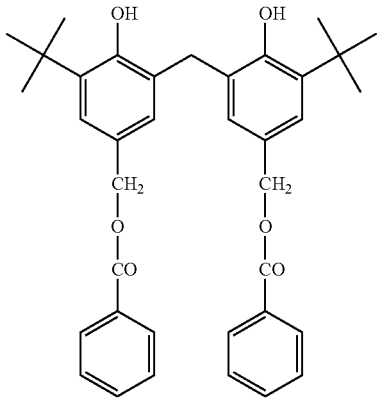
R1-33
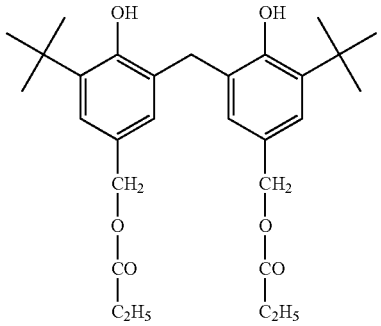
R1-34
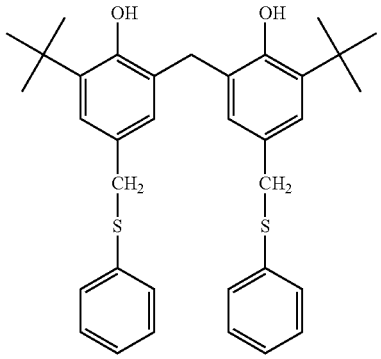

-continued

R1-35

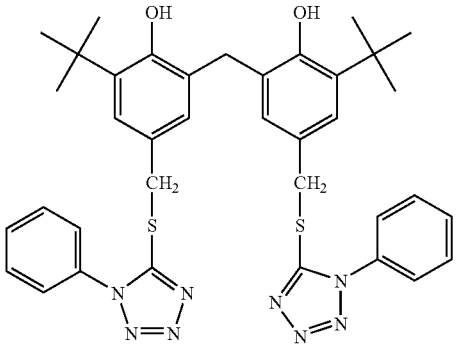

R1-36

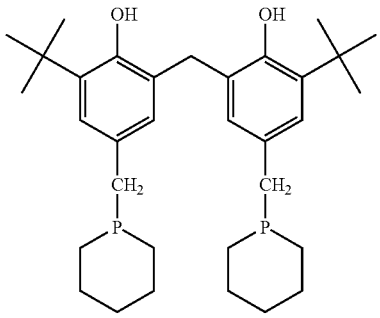

The addition amount of the reducing agent represented by the above-described formula (R1) is preferably from 0.01 $g/m^2$ to 5.0 $g/m^2$, and more preferably from 0.1 $g/m^2$ to 3.0 $g/m^2$. It is preferably contained in the range from 5 mol % to 50 mol % and, more preferably, 10 mol % to 40 mol %, per 1 mol of silver in the surface including the image forming layer. The reducing agent represented by the above-described formula (R1) is preferably contained in the image forming layer.

In the invention, other reducing agents may be used in combination with the reducing agent represented by formula (R1). The reducing agent which can be used in combination may be any substance (preferably, organic substance) capable of reducing silver ions into metallic silver. Examples of the reducing agent are described in JP-A No. 11-65021 (column Nos. 0043 to 0045) and EP No. 0803764 (p. 7, line 34 to p. 18, line 12).

In the invention, the reducing agent which can be used in combination is preferably a so-called hindered phenolic reducing agent or a bisphenol agent having a substituent at the ortho-position to the phenolic hydroxy group.

It is preferably a reducing agent represented by the aformentioned formula (R).

In the case where plural reducing agents are used, the ratio of combination by mole is 1/99 to 99/1, and preferably 5/95 to 95/5.

The reducing agent of the invention can be added in the image forming layer which comprises an organic silver salt and a photosensitive silver halide, or in the layer adjacent to the image forming layer, but it is preferably contained in the image forming layer.

The reducing agent of the invention may be incorporated into photothermographic material by being added into the coating solution in any form, such as in the form of a solution, an emulsion dispersion, a solid fine particle dispersion, and the like, but the reducing agent is particularly preferably used in the form of a solid particle dispersion. The reducing agent is added in the form of fine particles having average particle size from 0.01 μm to 10 μm, more preferably, from 0.05 μm to 5 μm and, further preferably, from 0.1 μm to 1 μm.

(Development Accelerator)

In the photothermographic material of the invention, sulfoneamide phenolic compounds described in the specification of JP-A No. 2000-267222, and represented by formula (A) described in the specification of JP-A No. 2000-330234; hindered phenolic compounds represented by formula (II) described in JP-A No. 2001-92075; hydrazine compounds described in the specification of JP-A No. 10-62895, represented by formula (I) described in the specification of JP-A No. 11-15116, represented by formula (D) described in the specification of JP-A No. 2002-156727, and represented by formula (1) described in the specification of JP-A No. 2002-278017; and phenolic or naphthalic compounds represented by formula (2) described in the specification of JP-A No. 2001-264929 are used preferably as a development accelerator. The development accelerator described above is used in the range from 0.1 mol % to 20 mol %, preferably, in the range from 0.5 mol % to 10 mol % and, more preferably, in the range from 1 mol % to 5 mol % with respect to the reducing agent. The introducing methods to the photothermographic material can include, the same methods as those for the reducing agent and, it is particularly preferred to add as a solid dispersion or an emulsion dispersion. In a case of adding as an emulsion dispersion, it is preferred to add as an emulsion dispersion dispersed by using a high boiling solvent which is solid at a normal temperature and an auxiliary solvent at a low boiling point, or to add as a so-called oilless emulsion dispersion not using the high boiling solvent.

In the present invention, it is more preferred to use as a development accelerator, hydrazine compounds represented by formula (D) described in the specification of JP-A No. 2002-156727, and phenolic or naphtholic compounds represented by formula (2) described in the specification of JP-A No. 2001-264929.

Particularly preferred development accelerators of the invention are compounds represented by the following formulae (A-1) and (A-2).

$$Q_1—NHNH—Q_2 \qquad \text{Formula (A-1)}$$

(wherein, $Q_1$ represents an aromatic group or a heterocyclic group which bonds at a carbon atom to —NHNH—$Q_2$ and $Q_2$ represents one selected from a carbamoyl group, an acyl group, an alkoxycarbonyl group, an aryloxycarbonyl group, a sulfonyl group, and a sulfamoyl group).

In formula (A-1), the aromatic group or the heterocyclic group represented by $Q_1$ is, preferably, 5 to 7 membered unsaturated ring. Preferred examples are benzene ring, pyridine ring, pyrazine ring, pyrimidine ring, pyridazine ring, 1,2,4-triazine ring, 1,3,5-triazine ring, pyrrole ring, imidazole ring, pyrazole ring, 1,2,3-triazole ring, 1,2,4-triazole ring, tetrazole ring, 1,3,4-thiadiazole ring, 1,2,4-thiadiazole ring, 1,2,5-thiadiazole ring, 1,3,4-oxadiazole ring, 1,2,4-oxadiazole ring, 1,2,5-oxadiazole ring, thiazole ring, oxazole ring, isothiazole ring, isooxazole ring, and thiophene ring. Condensed rings in which the rings described above are condensed to each other are also preferred.

The rings described above may have substituents and in a case where they have two or more substituents, the substituents may be identical or different with each other. Examples of the substituents can include halogen atom, alkyl group, aryl group, carboamide group, alkylsulfoneamide group, arylsulfonamide group, alkoxy group, aryloxy group, alkylthio group, arylthio group, carbamoyl group, sulfamoyl group, cyano group, alkylsulfonyl group, arylsulfonyl group, alkoxycarbonyl group, aryloxycarbonyl group and acyl group. In a case where the substituents are groups capable of substitution, they may have further substituents and examples of preferred substituents can include halogen atom, alkyl group, aryl group, carbonamide group, alkylsulfoneamide group, arylsulfoneamide group, alkoxy group, aryloxy group, alkylthio group, arylthio group, acyl group, alkoxycarbonyl group, aryloxycarbonyl group, carbamoyl group, cyano group, sulfamoyl group, alkylsulfonyl group, arylsulfonyl group and acyloxy group.

The carbamoyl group represented by $Q_2$ is a carbamoyl group preferably having 1 to 50 carbon atoms and, more preferably, having 6 to 40 carbon atoms, and examples can include not-substituted carbamoyl, methyl carbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-{3-(2,4-tert-pentylphenoxy)propyl}carbamoyl, N-(2-hexyldecyl) carbamoyl, N-phenylcarbamoyl, N-(4-dodecyloxyphenyl) carbamoyl, N-(2-chloro-5-dodecyloxycarbonylphenyl) carbamoyl, N-naphthylcarbaoyl, N-3-pyridylcarbamoyl and N-benzylcarbamoyl.

The acyl group represented by $Q_2$ is an acyl group, preferably having 1 to 50 carbon atoms and, more preferably 6 to 40 carbon atoms and can include, for example, formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, and 2-hydroxymethylbenzoyl. Alkoxycarbonyl group represented by $Q_2$ is an alkoxycarbonyl group, preferably, of 2 to 50 carbon atom and, more preferably, of 6 to 40 carbon atoms and can include, for example, methoxycarbonyl, ethoxycarbonyl, isobutyloxycarbonyl, cyclehexyloxycarbonyl, dodecyloxycarbonyl and benzyloxycarbonyl.

The aryloxy carbonyl group represented by $Q_2$ is an aryloxycarbonyl group, preferably, having 7 to 50 carbon atoms and, more preferably, having 7 to 40 carbon atoms and can include, for example, phenoxycarbonyl, 4-octyloxyphenoxycarbonyl, 2-hydroxymethylphenoxycarbonyl, and 4-dodecyloxyphenoxycarbonyl. The sulfonyl group represented by $Q_2$ is a sulfonyl group, preferably having 1 to 50 carbon atoms and, more preferably, having 6 to 40 carbon atoms and can include, for example, methylsulfonyl, butylsulfonyl, octylsulfonyl, 2-hexadecylsulfonyl, 3-dodecyloxypropylsulfonyl, 2-octyloxy-5-tert-octylphenyl sulfonyl, and 4-dodecyloxyphenyl sulfonyl.

The sulfamoyl group represented by $Q_2$ is sulfamoyl group, preferably having 0 to 50 carbon atoms, more preferably, 6 to 40 carbon atoms and can include, for example, not-substituted sulfamoyl, N-ethylsulfamoyl group, N-(2-ethylhexyl)sulfamoyl, N-decylsulfamoyl, N-hexadecylsulfamoyl, N-{3-(2-ethylhexyloxy)propyl}sulfamoyl, N-(2-chloro-5-dodecyloxycarbonylphenyl)sulfamoyl, and N-(2-tetradecyloxyphenyl)sulfamoyl. The group represented by $Q_2$ may further have a group mentioned as the example of the substituent of 5 to 7-membered unsaturated ring represented by $Q_1$ at the position capable of substitution. In a case where the group has two or more substituents, such substituents may be identical or different with each other.

Then, preferred range for the compounds represented by formula (A-1) is to be described. 5 to 6 membered unsaturated ring is preferred for $Q_1$, and benzene ring, pyrimidine ring, 1,2,3-triazole ring, 1,2,4-triazole ring, tetrazole ring, 1,3,4-thiadiazole ring, 1,2,4-thiadiazole ring, 1,3,4-oxadiazole ring, 1,2,4-oxadiazole ring, thioazole ring, oxazole ring, isothiazole ring, isooxazole ring and a ring in which the ring described above is condensed with a benzene ring or unsaturated hetero ring are further preferred. Further, $Q_2$ is preferably a carbamoyl group and, particularly, a carbamoyl group having hydrogen atom on the nitrogen atom is particularly preferred.

Formula (A-2)

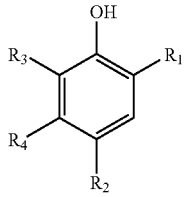

In formula (A-2), $R_1$ represents one selected from an alkyl group, an acyl group, an acylamino group, a sulfoneamide group, an alkoxycarbonyl group, and a carbamoyl group. $R_2$ represents one selected from a hydrogen atom, a halogen atom, an alkyl group, an alkoxy group, an aryloxy group, an alkylthio group, an arylthio group, an acyloxy group, and a carbonate ester group. $R_3$ and $R_4$ each represent a group capable of substituting for a hydrogen atom on a benzene ring which is mentioned as the example of the substituent for formula (A-1). $R_3$ and $R_4$ may bond together to form a condensed ring.

$R_1$ is, preferably, one selected from the following groups having 1 to 20 carbon atoms, namely, those are an alkyl group (for example, methyl group, ethyl group, isopropyl group, butyl group, tert-octyl group, or cyclohexyl group), an acylamino group (for example, acetylamino group, benzoylamino group, methylureido group, or 4-cyanophenylureido group), and a carbamoyl group (for example, n-butylcarbamoyl group, N,N-diethylcarbamoyl group, phenylcarbamoyl group, 2-chlorophenylcarbamoyl group, or 2,4-dichlorophenylcarbamoyl group.). Among them, an acylamino group (including ureido group or urethane group) is more preferred.

$R_2$ is preferably one of a halogen atom (more preferably, chlorine atom, bromine atom), an alkoxy group (for example, methoxy group, butoxy group, n-hexyloxy group, n-decyloxy group, cyclohexyloxy group or benzyloxy group), and an aryloxy group (for example, phenoxy group or naphthoxy group).

$R_3$ preferably is one of a hydrogen atom, a halogen atom, and an alkyl group having 1 to 20 carbon atoms, and most preferably a halogen atom. $R_4$ is preferably one of a hydrogen atom, alkyl group, and an acylamino group, and more preferably one of an alkyl group and an acylamino group. Examples of the preferred substituent thereof are identical with those for $R_1$. In a case where $R_4$ is an acylamino group, $R_4$ may preferably bond with $R_3$ to form a carbostyryl ring.

In a case where $R_3$ and $R_4$ in formula (A-2) link together to form a condensed ring, a naphthalene ring is particularly preferred as the condensed ring. The same substituent as the example of the substituent referred to for formula (A-1) may bond to the naphthalene ring. In a case where formula (A-2) is a naphtholic compound, $R_1$, is, preferably, a carbamoyl group. Among them, benzoyl group is particularly preferred. $R_2$ is, preferably, one of an alkoxy group and an aryloxy group and, particularly preferably an alkoxy group.

Preferred specific examples for the development accelerator of the invention are to be described below. The invention is not restricted to them.

A-1

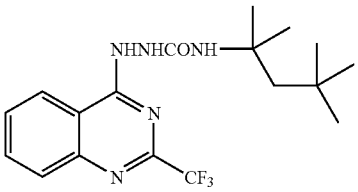

A-2

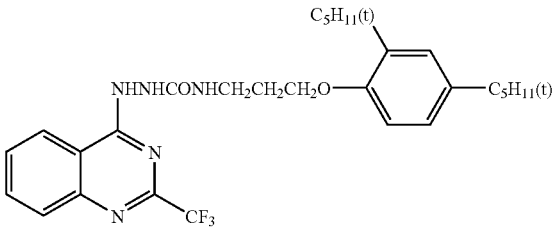

A-3

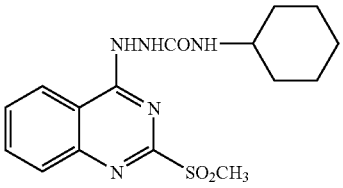

A-4

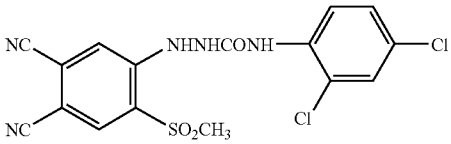

A-5

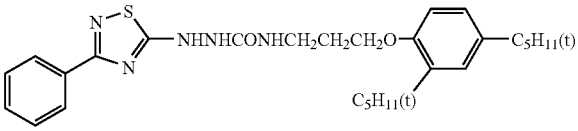

A-6

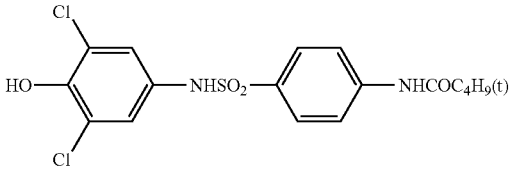

A-7

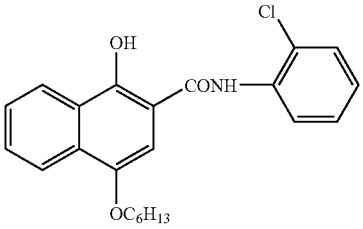

-continued

A-8

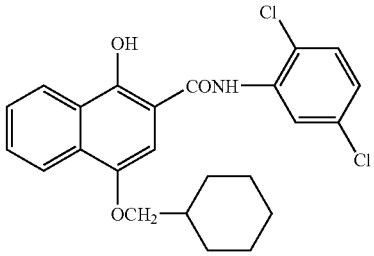

A-9

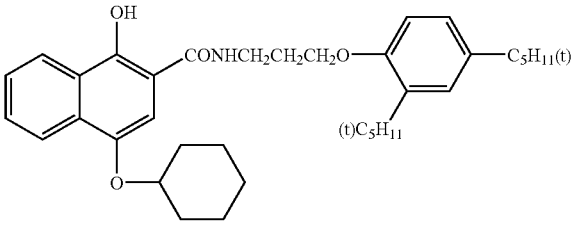

A-10

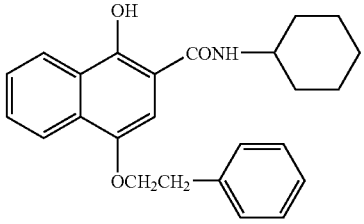

A-11

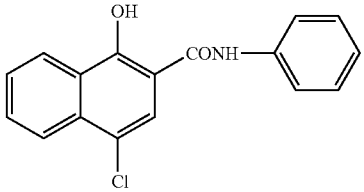

A-12

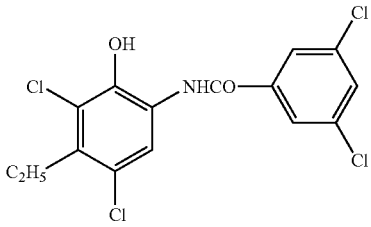

(Hydrogen Bonding Compound)

In the invention, in the case where the reducing agent has an aromatic hydroxy group (—OH) or an amino group (—NHR, R is a hydrogen atom or an alkyl group), particularly in the case where the reducing agent is a bisphenol described above, it is preferred to use in combination, a non-reducing compound having a group capable of reacting with these groups of the reducing agent, and that is also capable of forming a hydrogen bond therewith.

As a group forming a hydrogen bond with a hydroxy group or an amino group, there can be mentioned a phosphoryl group, a sulfoxido group, a sulfonyl group, a carbonyl group, an amide group, an ester group, an urethane group, an ureido group, a tertiary amino group, a nitrogen-containing aromatic group, and the like. Preferred among them is phosphoryl group, sulfoxido group, amide group (not having >N—H moiety but being blocked in the form of >N—Ra (where, Ra represents a substituent other than H)), urethane group (not having >N—H moiety but being blocked in the form of >N—Ra (where, Ra represents a substituent other than H)), and ureido group (not having >N—H moiety but being blocked in the form of >N—Ra (where, Ra represents a substituent other than H)).

In the invention, particularly preferable as the hydrogen bonding compound is the compound expressed by formula (D) shown below.

Formula (D)

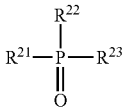

In formula (D), $R^{21}$ to $R^{23}$ each independently represent one selected from an alkyl group, an aryl group, an alkoxy group, an aryloxy group, an amino group, and a heterocyclic group, which may be substituted or unsubstituted.

In the case where $R^{21}$ to $R^{23}$ contain a substituent, examples of the substituent include a halogen atom, an alkyl group, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group, a phosphoryl group, and the like, in which preferred as the substituents are an alkyl group or an aryl group, e.g., methyl group, ethyl group, isopropyl group, t-butyl group, t-octyl group, phenyl group, a 4-alkoxyphenyl group, a 4-acyloxyphenyl group, and the like.

Specific examples of an alkyl group expressed by $R^{21}$ to $R^{23}$ include methyl group, ethyl group, butyl group, octyl group, dodecyl group, isopropyl group, t-butyl group, t-amyl group, t-octyl group, cyclohexyl group, 1-methylcyclohexyl group, benzyl group, phenetyl group, 2-phenoxypropyl group, and the like.

As an aryl group, there can be mentioned phenyl group, cresyl group, xylyl group, naphthyl group, 4-t-butylphenyl group, 4-t-octylphenyl group, 4-anisidyl group, 3,5-dichlorophenyl group, and the like.

As an alkoxyl group, there can be mentioned methoxy group, ethoxy group, butoxy group, octyloxy group, 2-ethylhexyloxy group, 3,5,5-trimethylhexyloxy group, dodecyloxy group, cyclohexyloxy group, 4-methylcyclohexyloxy group, benzyloxy group, and the like.

As an aryloxy group, there can be mentioned phenoxy group, cresyloxy group, isopropylphenoxy group, 4-t-butylphenoxy group, naphthoxy group, biphenyloxy group, and the like.

As an amino group, there can be mentioned are dimethylamino group, diethylamino group, dibutylamino group, dioctylamino group, N-methyl-N-hexylamino group, dicyclohexylamino group, diphenylamino group, N-methyl-N-phenylamino, and the like.

Preferred as $R^{21}$ to $R^{23}$ are an alkyl group, an aryl group, an alkoxy group, and an aryloxy group. Concerning the effect of the invention, it is preferred that at least one or more of $R^{21}$ to $R^{23}$ are an alkyl group or an aryl group, and more preferably, two or more of them are an alkyl group or an aryl group. From the viewpoint of low cost availability, it is preferred that $R^{21}$ to $R^{23}$ are of the same group.

Specific examples of hydrogen bonding compounds represented by formula (D) of the invention and others are shown below, but it should be understood that the invention is not limited thereto.

D-1

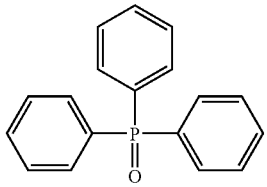

D-2

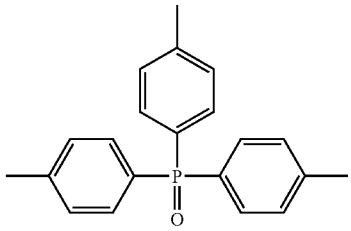

D-3

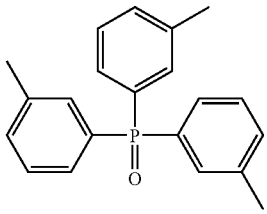

D-4

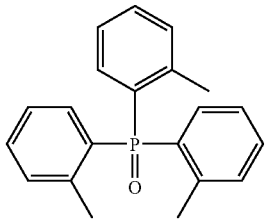

D-5

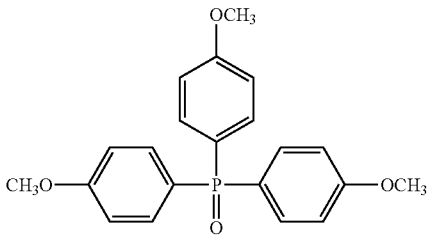

D-6

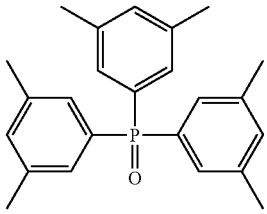

-continued

D-7

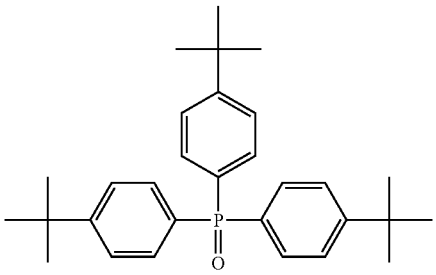

D-8

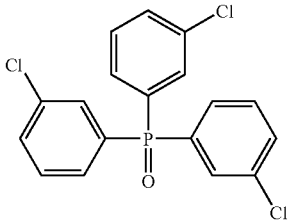

D-9

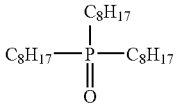

D-10

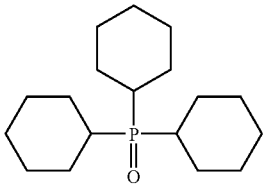

D-11

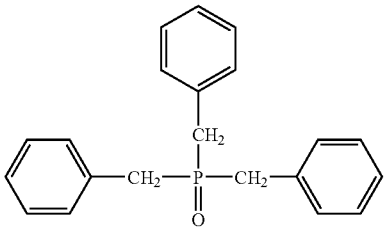

D-12

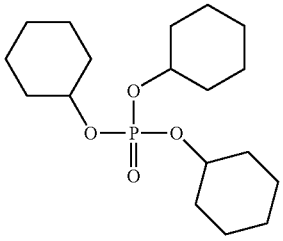

D-13

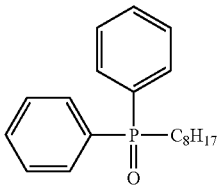

-continued

D-14

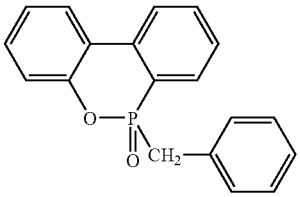

D-15

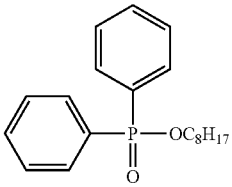

D-16

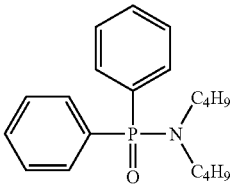

D-17

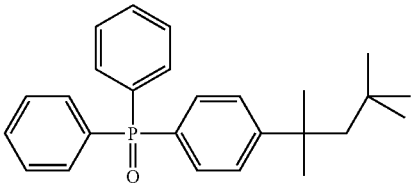

D-18

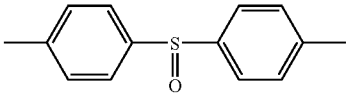

D-19

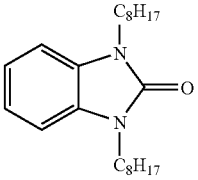

D-20

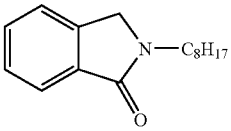

D-21

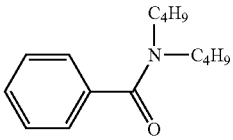

Specific examples of hydrogen bonding compounds other than those enumerated above can be found in those described in JP-A Nos. 2001-281793 and 2002-14438.

The hydrogen bonding compound of the invention can be used in the photothermographic material by being incorporated into the coating solution in the form of solution, emulsion dispersion, or solid fine particle dispersion similar to the case of the reducing agent, but it is preferred to use as a solid dispersion. In the solution, the hydrogen bonding compound of the invention forms a hydrogen-bonded complex with a compound having a phenolic hydroxy group, and can be isolated as a complex in crystalline state depending on the combination of the reducing agent and the compound expressed by formula (D).

It is particularly preferred to use the crystal powder thus isolated in the form of a solid fine particle dispersion, because it provides stable performance. Further, it is also preferred to use a method of leading to form complex during dispersion by mixing the reducing agent and the compound represented by formula (D) in the form of powders and dispersing them with a proper dispersing agent using a sand grinder mill and the like.

The hydrogen bonding compound of the invention is preferably used in the range from 1 mol % to 200 mol %, more preferably from 10 mol % to 150 mol %, and further preferably, from 30 mol % to 100 mol %, with respect to the reducing agent.

(Photosensitive Silver Halide)

1) Halogen Composition

The photosensitive silver halide used in the present invention has a silver iodide content of 40 mol % or higher. Other components are not particularly limited and can be selected from silver halide such as silver chloride, silver bromide and the like, and organic silver salts such as silver thiocyanate, silver phosphate and the like, and particularly, silver bromide and silver chloride are preferable. By using such a silver halide having a high silver iodide content, a preferable photothermographic material having excellent image storability after developing process, particularly showing remarkably small increase in fogging in irradiation with light can be designed.

Further, it is preferable that the silver iodide content is 80 mol % or higher, and it is extremely preferable from the standpoint of image storability against irradiation with light after developing process particularly when the silver iodide content is 90 mol % or higher.

The distribution of the halogen composition in a grain may be uniform or the halogen composition may be changed stepwise, or it may be changed continuously. Further, a silver halide grain having a core/shell structure can be preferably used. Preferred structure is a twofold to fivefold structure and, more preferably, core/shell grain having a twofold to fourfold structure can be used. A core-high-silver iodide-structure which has a high content of silver iodide in the core part, and a shell-high-silver iodide-structure which has a high content of silver iodide in the shell part can also be preferably used.

2) Grain Size

Concerning the photosensitive silver halide grains which can be used in the present invention, the mean grain size of the silver halide grains has two preferable regions.

One preferable region is a sufficiently small region compared with conventional silver bromide or low-iodide content silver iodobromide. The mean grain size of the silver halide is preferably 5 nm to 70 nm, and more preferably 5 nm to 55 nm. The term "grain size" used here means an average diameter of a circle having the same area as the projected area observed through an electron microscope.

In another preferable region, the mean equivalent spherical diameter of the silver halide is 0.3 μm to 5.0 μm, and more preferably 0.35 μm to 3.0 μm. The term "mean equivalent spherical diameter" used here means an average diameter of a sphere having the same volume as the volume of silver halide grain. As for measuring method, the volume of a grain is calculated from projected area and thickness of individual grains by observation through electron microscope, and thereafter the equivalent spherical diameter is determined by converting the volume to a sphere having the volume equivalent to the obtained volume.

3) Coating Amount

The coating amount of the photosensitive silver halide grains is in the range from 0.5 mol % to 15 mol %, preferably from 0.5 mol % to 12 mol %, further preferably from 0.5 mol % to 10 mol %, still more preferably from 1 mol % to 9 mol %, and particularly preferably from 1 mol % to 7 mol %, per 1 mol of the organic silver salt described above in each case.

4) Method of Grain Formation

The method of forming photosensitive silver halide is well-known in the relevant art and, for example, methods described in Research Disclosure No. 10729, June 1978, and U.S. Pat. No. 3,700,458 can be used. Specifically, a method of preparing a photosensitive silver halide by adding a silver-supplying compound and a halogen-supplying compound in a gelatin or other polymer solution and then mixing them with an organic silver salt is used. Further, a method described in JP-A No. 11-119374 (paragraph Nos. 0217 to 0224) and methods described in JP-A Nos. 11-352627 and 2000-347335 are also preferred.

5) Grain Form

While examples of forms of silver halide grains in the invention are cubic grains, octahedral grains, dodecahedral grains, tetradecahedral grains, tabular grains, spherical grains, rod-like grains, potato-like grains and the like, particularly preferable in the invention are tabular grains, dodecahedral grains and tetradecahedral grains. The term "dodecahedral grain" means a grain having faces of (001), {1(−1)0} and {101} and the term "tetradecahedral grain" means a grain having faces of (001), {100} and {101}. The {100} expresses a family of crystallographic planes equivalent to a (100) face.

Silver iodide of the invention can assume any of a β phase or a γ phase contained. The term "β phase" described above means a high silver iodide structure having a wurtzite structure of a hexagonal system and the term "γ phase" means a high silver iodide structure having a zinc blend structure of a cubic crystal system.

An average content of γ phase in the present invention is determined by a method presented by C. R. Berry. In the method, an average content of γ phase is calculated from the peak ratio of the intensity owing to γ phase (111) to that owing to β phase (100), (101), 002) in powder X ray diffraction method. Detail description, for example, is described in Physical Review, volume 161, No. 3, p. 848 to 851 (1967).

According to the method of forming tabular grains of silver iodide, preferably used are those described in JP-A Nos. 59-119350 and 59-119344. As for forming dodecahedral grains, tetradecahedral grains and octahedral grains, the methods described in JP-A Nos. 2002-081020, 2003-287835, and 2003-287836 can be used for reference.

The tabular silver halide grains have a mean equivalent spherical diameter of 0.3 μm to 8.0 μm, and preferably 0.5 μm to 3.0 μm. The term "equivalent spherical diameter" used here means a diameter of a sphere having the same volume as the volume of silver halide grain. As for measuring method, the volume of a grain is calculated from projected area and thickness of individual grains by observation through electron microscope, and thereafter the equivalent spherical diameter is determined by converting the volume to a sphere having the volume equivalent to the obtained volume.

The tabular silver halide grains preferably have a mean thickness of 0.3 μm or less, more preferably 0.2 μm or less, and further preferably 0.15 μm or less.

The aspect ratio of the tabular grain is preferably in a range from 2 to 100, and more preferably from 5 to 50.

The silver halide having high silver iodide content of the invention can take a complicated form, and as the preferable form, there are listed, for example, connecting grains as shown in R. L. JENKINS et al., J. of Phot. Sci. Vol. 28 (1980), p 164, FIG. 1. Flat plate particles as shown in FIG. 1 of the same literature can also be preferably used. Grains obtained by rounding corners of silver halide grains can also be preferably used. The surface index (Miller index) of the outer surface of a photosensitive silver halide particle is not particularly restricted, and it is preferable that the ratio occupied by the [100] surface is rich, because of showing high spectral sensitization efficiency when a spectral sensitizer is adsorbed. The ratio is preferably 50% or more, more preferably 65% or more, further preferably 80% or more. The ratio of the [100] surface, Miller index, can be determined by a method described in T. Tani; J. Imaging Sci., 29, 165 (1985) utilizing adsorption dependency of the [111] surface and [100] surface in adsorption of a sensitizing dye.

6) Heavy Metal

The photosensitive silver halide grain of the invention can contain metals or complexes of metals belonging to groups 8 to 10 of the periodic table (showing groups 1 to 18). The metal or the center metal of the metal complex from groups 8 to 10 of the periodic table is preferably rhodium, ruthenium or iridium. The metal complex may be used alone, or two or more kinds of complexes comprising identical or different species of metals may be used together. A preferred content is in the range from $1\times10^{-9}$ mol to $1\times10^{-3}$ mol per 1 mol of silver. The heavy metals, metal complexes and the adding method thereof are described in JP-A No. 7-225449, in paragraph Nos. 0018 to 0024 of JP-A No. 11-65021 and in paragraph Nos. 0227 to 0240 of JP-A No. 11-119374.

In the present invention, a silver halide grain having a hexacyano metal complex that is present on the outermost surface of the grain is preferred. The hexacyano metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. In the invention, hexacyano Fe complex is preferred.

Since the hexacyano complex exists in ionic form in an aqueous solution, paired cation is not important and alkali metal ion such as sodium ion, potassium ion, rubidium ion, cesium ion and lithium ion, ammonium ion, alkyl ammonium ion (for example, tetramethyl ammonium ion, tetraethyl ammonium ion, tetrapropyl ammonium ion, and tetra (n-butyl) ammonium ion), which are easily misible with water and suitable to precipitation operation of a silver halide emulsion are preferably used.

The hexacyano metal complex can be added while being mixed with water, as well as a mixed solvent of water and an appropriate organic solvent miscible with water (for example, alcohols, ethers, glycols, ketones, esters and amides) or gelatin.

The addition amount of the hexacyano metal complex is preferably from $1\times10^{-5}$ mol to $1\times10^{-2}$ mol per 1 mol of silver, and more preferably from $1\times10^{-4}$ mol to $1\times10^{-3}$ mol per 1 mol of silver.

In order to allow the hexacyano metal complex to be present on the outermost surface of a silver halide grain, the hexacyano metal complex is directly added in any stage of: after completion of addition of an aqueous solution of silver nitrate used for grain formation, before completion of emulsion formation step prior to a chemical sensitization step, of conducting chalcogen sensitization such as sulfur sensitization, selenium sensitization and tellurium sensitization or noble metal sensitization such as gold sensitization, during washing step, during dispersion step and before chemical sensitization step. In order not to grow the fine silver halide grain, the hexacyano metal complex is preferably rapidly added after the grain is formed, and it is preferably added before completion of the emulsion formation step.

Addition of the hexacyano complex may be started after addition of 96% by weight of an entire amount of silver nitrate to be added for grain formation, more preferably started after addition of 98% by weight and, particularly preferably, started after addition of 99% by weight.

When any of the hexacyano metal complex is added after addition of an aqueous silver nitrate just before completion of grain formation, it can be adsorbed to the outermost surface of the silver halide grain and most of them form an insoluble salt with silver ions on the surface of the grain. Since silver hexacyanoferrate (II) is a less soluble salt than AgI, re-dissolution with fine grains can be prevented and fine silver halide grains with smaller grain size can be prepared.

Metal atoms that can be contained in the silver halide grain used in the invention (for example, $[Fe(CN)_6]^{4-}$), desalting method of a silver halide emulsion and chemical sensitizing method are described in paragraph Nos. 0046 to 0050 of JP-A No. 11-84574, in paragraph Nos. 0025 to 0031 of JP-A No. 11-65021, and paragraph Nos. 0242 to 0250 of JP-A No. 11-119374.

7) Gelatin

As the gelatin contained the photosensitive silver halide emulsion used in the invention, various kinds of gelatins can be used. It is necessary to maintain an excellent dispersion state of a photosensitive silver halide emulsion in an organic silver salt containing coating solution, and low molecular weight gelatin having a molecular weight of 10,000 to 100,000 is preferably used. And phthalated gelatin is also preferably used. These gelatins may be used at grain formation or at the time of dispersion after desalting treatment and it is preferably used during grain formation.

8) Chemical Sensitization

The photosensitive silver halide in the present invention can be used without chemical sensitization, but is preferably chemically sensitized by at least one of chalcogen sensitizing method, gold sensitizing method and reduction sensitizing method. The chalcogen sensitizing method includes sulfur sensitizing method, selenium sensitizing method and tellurium sensitizing method.

In sulfur sensitization, unstable sulfur compounds can be used. Such unstable sulfur compounds are described in Chimie et Pysique Photographique, written by P. Grafkides, (Paul Momtel, 5th ed., 1987) and Research Disclosure (vol. 307, Item 307105), and the like.

As typical examples of sulfur sensitizer, known sulfur compounds such as thiosulfates (e.g., hypo), thioureas (e.g., diphenylthiourea, triethylthiourea, N-ethyl-N'-(4-methyl-2-thiazolyl)thiourea and carboxymethyltrimethylthiourea), thioamides (e.g., thioacetamide), rhodanines (e.g., diethylrhodanine, 5-benzylydene-N-ethylrhodanine), phosphinesulfides (e.g., trimethylphosphinesulfide), thiohydantoins, 4-oxo-oxazolidin-2-thione derivatives, disulfides or polysulfides (e.g., dimorphorinedisulfide, cystine, hexathiocanthione), polythionates, sulfur element and active gelatin can be used. Specifically, thiosulfates, thioureas and rhodanines are preferred.

In selenium sensitization, unstable selenium compounds can be used. These unstable selenium compounds are described in JP-B Nos. 43-13489 and 44-15748, JP-A Nos. 4-25832, 4-109340, 4-271341, 5-40324, 5-11385, 6-51415, 6-175258, 6-180478, 6-208186, 6-208184, 6-317867, 7-92599, 7-98483, and 7-140579, and the like.

As typical examples of selenium sensitizer, colloidal metal selenide, selenoureas (e.g., N,N-dimethylselenourea, trifluoromethylcarbonyl-trimethylselenourea and acetyltrimethylselemourea), selenamides (e.g., selenamide and N,N-diethylphenylselenamide), phosphineselenides (e.g., triphenylphosphineselenide and pentafluorophenyltriphenylphosphineselenide), selenophosphates (e.g., tri-p-tolylselenophosphate and tri-n-butylselenophosphate), selenoketones (e.g., selenobenzophenone), isoselenocyanates, selenocarbonic acids, selenoesters, diacylselenides can be used. Furthermore, non-unstable selenium compounds such as selenius acid, selenocyanic acid, selenazoles and selenides described in JP-B Nos. 46-4553 and 52-34492 can also be used. Specifically, phosphineselenides, selenoureas and salts of selenocyanic acids are preferred.

In the tellurium sensitization, unstable tellurium compounds are used. Unstable tellurium compounds described in JP-A Nos. 4-224595, 4-271341, 4-333043, 5-303157, 6-27573, 6-175258, 6-180478, 6-208186, 6-208184, 6-317867, 7-140579, 7-301879, 7-301880 and the like, can be used as tellurium sensitizer.

As typical examples of tellurium sensitizer, phosphinetellurides (e.g., butyl-diisopropylphosphinetelluride, tributylphosphinetelluride, tributoxyphosphinetelluride and ethoxy-diphenylphosphinetellride), diacyl(di)tellurides (e.g., bis(diphenylcarbamoyl)ditelluride, bis(N-phenyl-N-methylcarbamoyl)ditelluride, bis(N-phenyl-N-methylcarbamoyl)ditelluride, bis(N-phenyl-N-benzylcarbamoyl)telluride and bis(ethoxycarmonyl)telluride),telluroureas (e.g., N,N'-dimethylethylenetellurourea and N,N'-diphenylethylenetellurourea), telluramides, telluroesters are used. Specifically, diacyl(di)tellurides and phosphinetellurides are preferred. Especially, the compounds described in paragraph No. 0030 of JP-A No. 11-65021 and compounds represented by formulae (II), (III) and (IV) in JP-A No. 5-313284 are more preferred.

Specifically, as for the chalcogen sensitization of the invention, selenium sensitization and tellurium sensitization are preferred, and tellurium sensitization is particularly preferred.

In gold sensitization, gold sensitizer described in Chimie et Physique Photographique, written by P. Grafkides, (Paul Momtel, 5th ed., 1987) and Research Disclosure (vol. 307, Item 307105) can be used. To speak concretely, chloroauric acid, potassium chloroaurate, potassium aurithiocyanate, gold sulfide, gold selenide and the like can be used. In addition to these, the gold compounds described in U.S. Pat. Nos. 2,642,361, 5,049,484, 5,049,485, 5,169,751, and 5,252,455, Belg. Patent No. 691857, and the like can also be used. And another novel metal salts except gold such as platinum, palladium, iridium and so on described in Chimie et Pysique Photographique, written by P. Grafkides, (Paul Momtel, 5th ed., 1987) and Research Disclosure (vol. 307, Item 307105) can be used.

The gold sensitization can be used independently, but it is preferably used in combination with the above chalcogen sensitization. Specifically, these sensitizations are gold-sulfur sensitization (gold-plus-sulfur sensitization), gold-selenium sensitization, gold-tellurium sensitization, gold-sulfur-selenium sensitization, gold-sulfur-tellurium sensitization, gold-selenium-tellurium sensitization and gold-sulfur-selenium-tellurium sensitization.

In the invention, chemical sensitization can be applied in the presence of silver halide solvent. Specifically, thiocyanates (e.g., potassium thiocyanate), thioethers (e.g., compounds described in U.S. Pat. Nos. 3,021,215 and 3,271,157, JP-A Nos. 58-30571 and 60-136736, especially, 3,6-dithia-1,8-octanediol), tetra-substituted thioureas (e.g., compounds described in JP-A No. 59-11892 and U.S. Pat. No. 4,221,863, especially, tetramethylthiourea), thione compounds described in JP-A No. 60-11341, selenoethers described in JP-A No. 63-29727, U.S. Pat. No. 4,782,013, and the like, telluroether compounds described in JP-A No. 2-118566, and sulfites can be described. Particularly among them, thiocyanates, thioethers, tetra-substituted thioureas, and thione compounds are preferable, and more preferable among them is thiocyanates. The addition amount of silver halide solvent preferably is from $10^{-5}$ mol to $10^{-3}$ mol per 1 mol of silver halide.

In the invention, chemical sensitization can be applied at any time so long as it is after grain formation and before coating, and it can be applied, after desalting, (1) before spectral sensitization, (2) simultaneously with spectral sensitization, (3) after spectral sensitization and (4) just before coating.

The addition amount of chalcogen sensitizer used in the invention may vary depending on the silver halide grain used, the chemical ripening condition and the like, and it is about $10^{-8}$ mol to $10^{-1}$ mol, and preferably, about $10^{-7}$ mol to $10^{-2}$ mol, per 1 mol of silver halide.

Similarly, the addition amount of the gold sensitizer used in the invention may vary depending on various conditions and it is generally about $10^{-7}$ mol to $10^{-2}$ mol and, more preferably, $10^{-6}$ mol to $5\times10^{-3}$ mol per 1 mol of silver halide. There is no particular restriction on the condition for the chemical sensitization in the invention and, appropriately, the pAg is 8 or lower, preferably, 7.0 or lower, more preferably, 6.5 or lower and, particularly preferably, 6.0 or lower, and the pAg is 1.5 or higher, preferably, 2.0 or higher and, particularly preferably, 2.5 or higher; the pH is 3 to 10, preferably, 4 to 9; and the temperature is at 20° C. to 95° C., preferably, 25° C. to 80° C.

In the invention, reduction sensitization can also be used in combination with the chalcogen sensitization or the gold sensitization. It is specifically preferred to use in combination with the chalcogen sensitization.

As the specific compound for the reduction sensitization, ascorbic acid, thiourea dioxide or dimethylamine borane is preferred, as well as use of stannous chloride, aminoimino methane sulfonic acid, hydrazine derivatives, borane compounds, silane compounds and polyamine compounds are preferred. The reduction sensitizer may be added at any stage in the photosensitive emulsion production process from crystal growth to the preparation step just before coating. Further, it is preferred to apply reduction sensitization by ripening while keeping the pH to 8 or higher and the pAg to 4 or lower for the emulsion, and it is also preferred to apply reduction sensitization by introducing a single addition portion of silver ions during grain formation.

The addition amount of the reduction sensitizer may also vary depending on various conditions and it is generally about $10^{-7}$ mol to $10^{-1}$ mol and, more preferably, $10^{-6}$ mol to $5\times10^{-2}$ mol per 1 mol of silver halide.

In the silver halide emulsion used in the invention, a thiosulfonate compound may be added by the method shown in EP-A No. 293917.

The photosensitive silver halide grain in the invention is preferably chemically sensitized by at least one method of gold sensitizing method and chalcogen sensitizing method for the purpose of designing a high-sensitivity photothermographic material.

9) Compound that can be One-electron-oxidized to Provide a One-electron Oxidation Product Which Releases One or More Electrons The photothermographic material of the invention preferably contains a compound that can be one-electron-oxidized to provide a one-electron oxidation product which releases one or more electrons. The said compound can be used alone or in combination with various chemical sensitizers described above to increase the sensitivity of silver halide.

As the compound that can be one-electron-oxidized to provide a one-electron oxidation product which releases one or more electrons is a compound selected from the following Groups 1 and 2.

(Group 1) a compound that can be one-electron-oxidized to provide a one-electron oxidation product which further releases one or more electrons, due to being subjected to a subsequent bond cleavage reaction;

(Group 2) a compound that can be one-electron-oxidized to provide a one-electron oxidation product, which further releases one or more electrons after being subjected to a subsequent bond formation.

The compound of Group 1 will be explained below.

In the compound of Group 1, as for a compound that can be one-electron-oxidized to provide a one-electron oxidation product which further releases one electron, due to being subjected to a subsequent bond cleavage reaction, specific examples include examples of compound referred to as "one photon two electrons sensitizer" or "deprotonating electron-donating sensitizer" described in JP-A No. 9-211769 (Compound PMT-1 to S-37 in Tables E and F, pages 28 to 32); JP-A No. 9-211774; JP-A No. 11-95355 (Compound INV1 to 36); JP-W No. 2001-500996 (Compound 1 to 74, 80 to 87, and 92 to 122); U.S. Pat. Nos. 5,747,235 and 5,747,236; EP-A No. 786692A1 (Compound INV 1 to 35); EP-A No. 893732A1; U.S. Pat. Nos. 6,054,260 and 5,994,051; etc. Preferred ranges of these compounds are the same as the preferred ranges described in the quoted specifications.

In the compound of Group 1, as for a compound that can be one-electron-oxidized to provide a one-electron oxidation product which further releases one or more electrons, due to being subjected to a subsequent bond cleavage reaction, specific examples include the compounds represented by formula (1) (same as formula (1) described in JP-A No. 2003-114487), formula (2) (same as formula (2) described in JP-A No. 2003-114487), formula (3) (same as formula (1) described in JP-A No. 2003-114488), formula (4) (same as formula (2) described in JP-A No. 2003-114488), formula (5) (same as formula (3) described in JP-A No. 2003-1-14488), formula (6) (same as formula (1) described in JP-A No. 2003-75950), formula (7) (same as formula (2) described in JP-A No. 2003-75950), and formula (8), and the compound represented by formula (9) among the compounds which can undergo the chemical reaction represented by reaction formula (1). And the preferable range of these compounds is the same as the preferable range described in the quoted specification.

Formula (1)

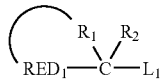

Formula (2)

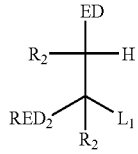

Formula (3)

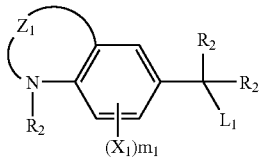

Formula (4)

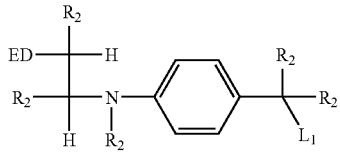

Formula (5)

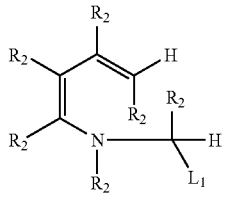

Formula (6)

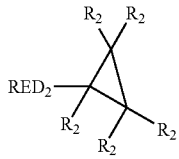

Formula (7)

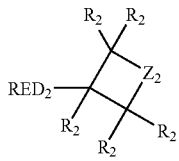

Formula (8)

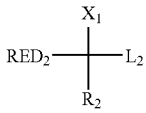

Reaction formula (1)

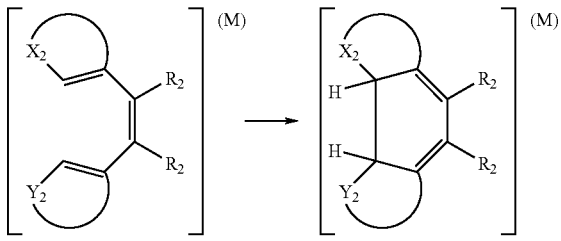

-continued

Formula (9)

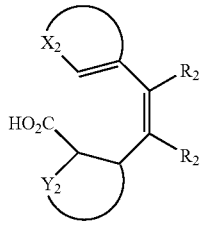

In the formulae, $RED_1$ and $RED_2$ represent a reducible group. $R_1$ represents a nonmetallic atomic group forming a cyclic structure equivalent to a tetrahydro derivative or an octahydro derivative of a 5 or 6 membered aromatic ring (including a hetero aromatic ring) with a carbon atom (C) and $RED_1$. $R_2$ represents a hydrogen atom or a substituent. In the case where plural $R_2$ exist in a same molecule, these may be the same or different. $L_1$ represents a leaving group. ED represents an electron-donating group. $Z_1$ represents an atomic group capable to form a 6 membered ring with a nitrogen atom and two carbon atoms of a benzene ring. $X_1$ represents a substituent, and $m_1$ represents an integer of 0 to 3. $Z_2$ represents one selected from —$CR_{11}R_{12}$—, —$NR_{13}$—, and —O—. $R_{11}$ and $R_{12}$ each independently represent one of a hydrogen atom and a substituent.

$R_{13}$ represents one selected from a hydrogen atom, an alkyl group, an aryl group, and a heterocyclic group. $X_1$ represents one selected from an alkoxy group, an aryloxy group, a heterocyclic oxy group, an alkylthio group, an arylthio group, a heterocyclic thio group, an alkylamino group, an arylamino group, and a heterocyclic amino group. $L_2$ represents one selected from a carboxy group, a salt thereof, and a hydrogen atom. $X_2$ represents a group to form a 5 membered heterocycle with C═C. M represents one selected from a radical, a radical cation, and a cation.

Next, the compound of Group 2 is explained.

In the compound of Group 2, as for a compound that can be one-electron-oxidized to provide a one-electron oxidation product which further releases one or more electrons, after being subjected to a subsequent bond cleavage reaction, specific examples can include the compound represented by formula (10) (same as formula (1) described in JP-A No. 2003-140287), and the compound represented by formula (11) which can undergo the chemical reaction represented by reaction formula (1). The preferable range of these compounds is the same as the preferable range described in the quoted specification.

Formula (10)

$X—L_2—Y$

Reaction formula (1)

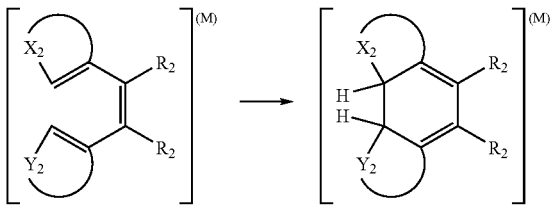

-continued

Formula (11)

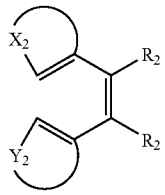

In the formula described above, X represents a reducible group which can be one-electron-oxidized. Y represents a reactive group containing a carbon-carbon double bond part, a carbon-carbon triple bond part, an aromatic group part or benzo-condensed nonaromatic heterocyclic group which can react with one-electron-oxidized product formed by one-electron-oxidation of X to form a new bond. $L_2$ represents a linking group to link X and Y. $R_2$ represents one of a hydrogen atom and a substituent. In the case where plural $R_2$ exist in a same molecule, these may be the same or different.

$X_2$ represents a group to form a 5 membered heterocycle with C═C. $Y_2$ represents a group to form a 5 or 6 membered aryl group or heterocyclic group with C═C. M represents one selected from a radical, a radical cation, and a cation.

The compounds of Groups 1 and 2 preferably are "the compound having an adsorptive group to silver halide in a molecule" or "the compound having a partial structure of a spectral sensitizing dye in a molecule". The representative adsorptive group to silver halide is the group described in JP-A No. 2003-156823, page 16 right, line 1 to page 17 right, line 12. A partial structure of a spectral sensitizing dye is the structure described in JP-A No. 2003-156823, page 17 right, line 34 to page 18 right, line 6.

As the compound of Groups 1 and 2, "the compound having at least one adsorptive group to silver halide in a molecule" is more preferred, and "the compound having two or more adsorptive groups to silver halide in a molecule" is further preferred. In the case where two or more adsorptive groups exist in a single molecule, those adsorptive groups may be the same or different with each other.

As preferable adsorptive group, a nitrogen containing heterocyclic group substituted by a mercapto group (e.g., a 2-mercaptothiazole group, a 3-mercapto-1,2,4-triazole group, a 5-mercaptotetrazole group, a 2-mercapto-1,3,4-oxadiazole group, a 2-mercaptobenzoxazole group, a 2-mercaptobenzothiazole group, a 1,5-dimethyl-1,2,4-triazolium-3-thiolate group and the like) or a nitrogen containing heterocyclic group having —NH— group as a partial structure of heterocycle capable to form a silver imidate (>NAg) (e.g., a benzotriazole group, a benzimidazole group, an indazole group and the like) are described. A 5 -mercaptotetrazole group, a 3-mercapto-1,2,4-triazole group and a benzotriazole group are particularly preferable and a 3-mercapto-1,2,4-triazole group and a 5-mercaptotetrazole group are most preferable.

As an adsorptive group, the group which has 2 or more mercapto groups as a partial structure in a molecule is also particularly preferable. Herein, a mercapto group (—SH) may become a thione group in the case where it can tautomerize. As preferred examples of adsorptive group having two or more mercapto groups as a partial structure (dimercapto-substituted nitrogen containing heterocyclic group and the like), a 2,4-dimercaptopyrimidine group, a 2,4-dimercaptotriazine group and a 3,5-dimercapto1,2,4-triazole group are described.

Further, a quaternary salt structure of nitrogen or phosphor is also preferably used as an adsorptive group. As typical quaternary salt structure of nitrogen, an ammonio group (a trialkylammonio group, a dialkylarylammonio group, a dialkylheteroarylammonio group, an alkyldiarylammonio group, an alkyldiheteroarylammonio group and the like) and a nitrogen containing heterocyclic group including quaternary nitrogen atom are described.

As a quaternary salt structure of phosphor, a phosphonio group (a trialkylphosphonio group, a dialkylarylphosphonio group, a dialkylheteroarylphosphonio group, an alkyldiarylphosphonio group, an alkyldiheteroarylphosphonio group, a triarylphosphonio group, a triheteroarylphosphonio group and the like) are described. A quaternary salt structure of nitrogen is more preferably used and a 5 or 6 membered aromatic heterocyclic group containing a quaternary nitrogen atom is further preferably used. Particularly preferably, a pyrydinio group, a quinolinio group and an isoquinolinio group are used. These nitrogen containing heterocyclic groups including a quaternary nitrogen atom may have any substituent.

As examples of counter anion of quaternary salt, halogen ion, carboxylate ion, sulfonate ion, sulfate ion, perchlorate ion, carbonate ion, nitrate ion, $BF_4^-$, $PF_6^-$, $Ph_4B^-$ and the like are described. In the case where the group having negative charge at carboxylate group and the like exists in a molecule, an inner salt may be formed with it. As a counter ion outside of a molecule, chloro ion, bromo ion and methanesulfonate ion are particularly preferable.

The preferred structure of the compound represented by Groups 1 and 2 having a quaternary salt of nitrogen or phosphor as an adsorptive group is represented by formula (X).

$$(P—Q_1—)_i—R(—Q_2—S)_j \qquad \text{Formula (X)}$$

In formula (X), P and R each independently represent a quaternary salt structure of nitrogen or phosphor, which is not a partial structure of a spectral sensitizing dye. $Q_1$ and $Q_2$ each independently represent a linking group and typically represent one selected from a single bond, an alkylene group, an arylene group, a heterocyclic group, —O—, —S—, —$NR_N$, —C(═O)—, —$SO_2$—, —SO—, —P(═O)—, and a group which consists of combination thereof. Herein, $R_N$ represents one selected from a hydrogen atom, an alkyl group, an aryl group, and a heterocyclic group. S represents a residue which is obtained by removing one atom from the compound represented by Group 1 or 2. i and j are an integral number of one or more, and are selected in a range of i+j=2 to 6. It is preferred that i is 1, 2 or 3 and j is 1 or 2. It is more preferred that i is 1 or 2 and j is 1. And, it is particularly preferred that i is 1 and j is 1. The compound represented by formula (X) preferably has 10 to 100 carbon atoms in total, more preferably 10 to 70 carbon atoms, further preferably 11 to 60 carbon atoms, and particularly preferably 12 to 50 carbon atoms in total.

The compounds of Groups 1 and 2 may be used at any time during preparation of the photosensitive silver halide emulsion and production of the photothermographic material. For example, the compound may be used in a photosensitive silver halide grain formation step, in a desalting step, in a chemical sensitization step, and before coating, etc. The compound may be added in several times, during these steps. The compound is preferably added, after the photosensitive silver halide grain formation step and before the desalting step; in the chemical sensitization step (just before the chemical sensitization to immediately after the chemical sensitization); or before coating. The compound is more preferably added, just before the chemical sensitization step to before mixing with the non-photosensitive organic silver salt.

It is preferred that the compound of Groups 1 and 2 used in the invention is dissolved in water, a water-soluble solvent such as methanol and ethanol, or a mixed solvent thereof, to be added. In the case where the compound is dissolved in water and solubility of the compound is increased by increasing or decreasing a pH value of the solvent, the pH value may be increased or decreased to dissolve and add the compound.

The compound of Groups 1 and 2 used in the invention is preferably added to the image forming layer comprising the photosensitive silver halide and the non-photosensitive organic silver salt. The compound may be added to a surface protective layer, or an intermediate layer, as well as the image forming layer comprising the photosensitive silver halide and the non-photosensitive organic silver salt, to be diffused to the image forming layer in the coating step. The compound may be added before or after addition of a sensitizing dye. Each compound is contained in the image forming layer preferably in an amount of $1\times10^{-9}$ mol to $5\times10^{-1}$ mol, more preferably $1\times10^{-9}$ mol to $5\times10^{-2}$ mol, per 1 mol of silver halide.

10) Compound Having Adsorptive Group and Reducible Group

The photothermographic material of the present invention preferably comprises a compound having an adsorptive group and a reducible group in a molecule. It is preferred that the compound having an adsorptive group and a reducible group used in the invention is represented by the following formula (I).

$$A\text{-}(W)n\text{-}B \qquad \text{Formula (I)}$$

In formula (I), A represents a group capable of adsorption to a silver halide (hereafter, it is called an adsorptive group), W represents a divalent linking group, n represents 0 or 1, and B represents a reducible group.

In formula (I), the adsorptive group represented by A is a group to adsorb directly to a silver halide or a group to promote adsorption to a silver halide. As typical examples, a mercapto group (or a salt thereof), a thione group (—C(═S)—), a nitrogen atom, a heterocyclic group containing at least one atom selected from a nitrogen atom, a sulfur atom, a selenium atom and a tellurium atom, a sulfide group, a disulfide group, a cationic group, an ethynyl group and the like are described.

The mercapto group (or a salt thereof) as an adsorptive group means a mercapto group (or a salt thereof) itself and simultaneously more preferably represents a heterocyclic group or an aryl group or an alkyl group substituted by at least one mercapto group (or a salt thereof). Herein, as the heterocyclic group, a monocyclic or a condensed aromatic or nonaromatic heterocyclic group having at least a 5 to 7 membered ring, e.g., an imidazole ring group, a thiazole ring group, an oxazole ring group, a benzimidazole ring group, a benzothiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, a triazine ring group and the like are described. A heterocyclic group having a quaternary nitrogen atom may also be adopted, wherein a mercapto group as a substituent may dissociate to form a mesoion. As a counter ion, whereby a mercapto group forms a salt thereof, a cation such as an alkali metal, an alkali earth metal, a heavy metal and the like ($Li^+$, $Na^-$, $K^+$, $Mg^{2+}$, $Ag^+$, $Zn^{2+}$ and the like), an ammonium ion, a heterocyclic group comprising a quaternary nitrogen atom, a phosphonium ion and the like are described.

Further, the mercapto group as an adsorptive group may become a thione group by a tautomerization.

The thione group as an adsorptive group may also contain a chain or a cyclic thioamide group, a thioureido group, a thiouretane group or a dithiocarbamic acid ester group.

The heterocyclic group containing at least one atom selected from a nitrogen atom, a sulfur atom, a selenium atom and a tellurium atom as an adsorptive group represents a nitrogen atom containing heterocyclic group having —NH— group, as a partial structure of heterocycle, capable to form a silver iminate (>NAg) or a heterocyclic group, having "—S—" group, "—Se—" group, "—Te—" group or "═N—" group as a partial structure of heterocycle, and capable to coordinate to a silver ion by a chelate bonding. As the former examples, a benzotriazole group, a triazole group, an indazole group, a pyrazole group, a tetrazole group, a benzimidazole group, a purine group and the like are described. As the latter examples, a thiophene group, a thiazole group, a benzoxazole group, a thiadiazole group, an oxadiazole group, a triazine group, a selenoazole group, a benzoselenazole group, a tellurazole group, a benzotellurazole group and the like are described.

The sulfide group or disulfide group as an adsorptive group contains all groups having "—S—" or "—S—S—" as a partial structure.

The cationic group as an adsorptive group means the group containing a quaternary nitrogen atom, such as an ammonio group or a nitrogen containing heterocyclic group including a quaternary nitrogen atom. As examples of the heterocyclic group containing a quaternary nitrogen atom, a pyridinio group, a quinolinio group, an isoquinolinio group, an imidazolio group and the like are described.

The ethynyl group as an adsorptive group means —C≡CH group and the said hydrogen atom may be substituted.

The adsorptive group described above may have any substituent.

Further, as typical examples of an adsorptive group, the compounds described in pages 4 to 7 in the specification of JP-A No. 11-95355 are described.

As an adsorptive group represented by A in formula (I), a heterocyclic group substituted by a mercapto group (e.g., a 2-mercaptothiadiazole group, a 2-mercapto-5-aminothiadiazole group, a 3-mercapto-1,2,4-triazole group, a 5-mercaptotetrazole group, a 2-mercapto-1,3,4-oxadiazole group, a 2-mercaptobenzimidazole group, a 1,5-dimethyl-1,2,4-triazorium-3-thiolate group, a 2,4-dimercaptopyrimidine group, a 2,4-dimercaptotriazine group, a 3,5-dimercapto-1,2,4-triazole group, a 2,5-dimercapto-1,3-thiazole group and the like) or a nitrogen atom containing heterocyclic group having a —NH— group capable to form an imino-silver (>NAg) as a partial structure of heterocycle (e.g., a benzotriazole group, a benzimidazole group, an indazole group and the like) is preferable, and more preferable as an adsorptive group is a 2-mercaptobenzimidazole group or a 3,5-dimercapto-1,2,4-triazole group.

In formula (I), W represents a divalent linking group. The said linking group may be any divalent linking group, as far as it does not give a bad effect toward a photographic property. For example, a divalent linking group, which includes a carbon atom, a hydrogen atom, an oxygen atom a nitrogen atom and a sulfur atom, can be used. As typical examples, an alkylene group having 1 to 20 carbon atoms (e.g., a methylene group, an ethylene group, a trimethylene group, a tetramethylene group, a hexamethylene group and the like), an alkenylene group having 2 to 20 carbon atoms, an alkynylene group having 2 to 20 carbon atoms, an arylene group having 6 to 20 carbon atoms (e.g., a phenylene group, a nephthylene group and the like), —CO—, —$SO_2$—, —O—, —S—, —$NR_1$—, and the combination of these linking groups are described. Herein, $R_1$ represents a hydrogen atom, an alkyl group, a heterocyclic group, or an aryl group.

The divalent linking group represented by W may have any substituent.

In formula (I), a reducible group represented by B represents a group capable to reduce a silver ion. As the examples, a formyl group, an amino group, a triple bonding group such as an acetylene group, a propargyl group and the like, a mercapto group, hydroxylamines, hydroxamic acids, hydroxyureas, hydroxyurethanes, hydroxysemicarbazides, reductones (reductone derivatives are contained), anilines, phenols (chroman-6-ols, 2,3-dihydrobenzofuran-5-ols, aminophenols, sulfonamidophenols and polyphenols such as hydroquinones, catechols, resorcinols, benzenetriols, bisphenols are contained), aclhydrazines, carbamoylhydrazides and a residue which is obtained by removing one hydrogen atom from 3-pyrazolidones and the like can be described. They may have any substituent.

The oxidation potential of a reducible group represented by B in formula (I), can be measured by using the measuring method described in Akira Fujishima, "DENKIKAGAKU SOKUTEIHO", pages 150 to 208, GIHODO SHUPPAN and The Chemical Society of Japan, "ZIKKEN KAGAKUKOZA", 4th ed., vol. 9, pages 282 to 344, MARUZEN. For example, the method of rotating disc voltammetry can be used; namely the sample is dissolved in the solution (methanol:pH 6.5 Britton-Robinson buffer=10%:90% (% by volume)) and after bubbling with nitrogen gas during 10 minutes the voltamograph can be measured under the condition of 1000 rotations/minute, the sweep rate 20 mV/second, at 25° C. by using a rotating disc electrode (RDE) made by glassy carbon as a working electrode, a platinum electrode as a counter electrode and a saturated calomel electrode as a reference electrode. The half wave potential (E1/2) can be calculated by that obtained voltamograph.

When a reducible group represented by B in the present invention is measured by the method described above, an oxidation potential preferably is in the range of about −0.3 V to about 1.0 V, more preferably about −0.1 V to about 0.8 V, and particularly preferably about 0 V to about 0.7 V.

In formula (I), a reducible group represented by B preferably is one selected from hydroxylamines, hydroxamic acids, hydroxyureas, hydroxysemicarbazides, reductones, phenols, acylhydrazines, carbamoylhydrazides, and a residue which is obtained by removing one hydrogen atom from 3-pyrazolidones and the like.

The compound of formula (I) in the present invention may have the ballasted group or polymer chain in it generally used in the non-moving photographic additives as a coupler. And as a polymer, for example, the polymer described in JP-A No. 1-100530 can be described.

The compound of formula (I) in the present invention may be bis or tris type of compound. The molecular weight of the compound represented by formula (I) in the present invention is preferably 100 to 10,000 and more preferably 120 to 1,000 and particularly preferably 150 to 500.

The examples of the compound represented by formula (I) in the present invention are shown below, but the present invention is not limited in these.

(1)
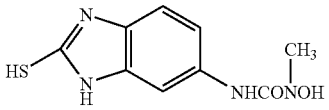
(2)
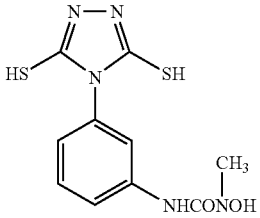
(3)
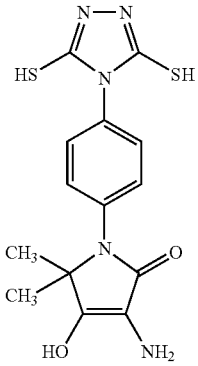
(4)
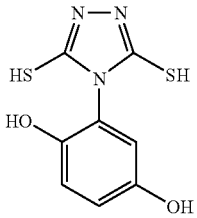
(5)
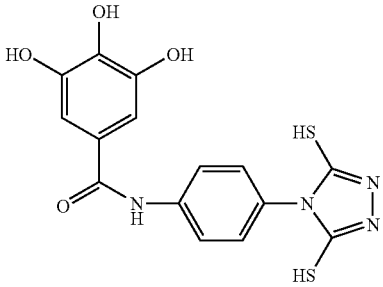
(6)
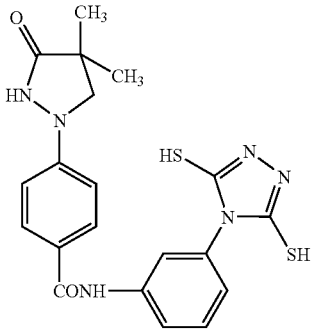
-continued
(7)
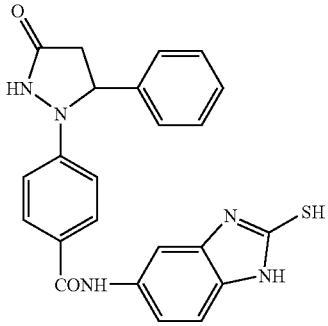
(8)
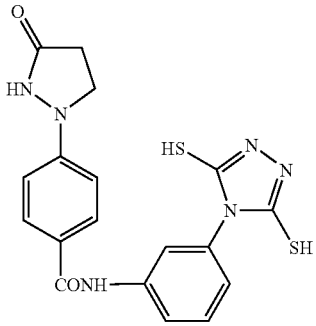
(9)
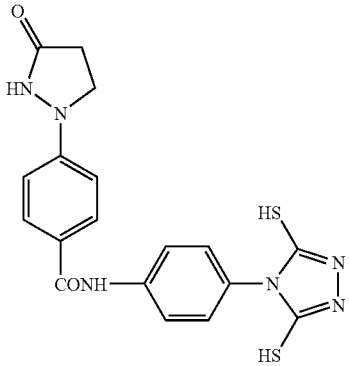
(10)
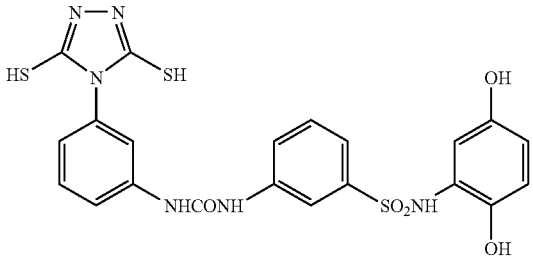
(11)
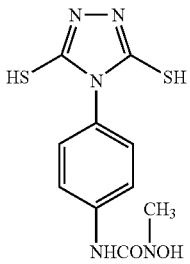

-continued (12)

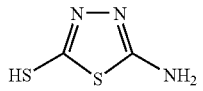

(13)

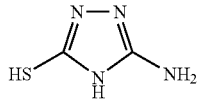

Further, example compounds 1 to 30 and 1"-1 to 1"-77 shown in EP-A No. 1308776A2, pages 73 to 87 are also described as preferable examples of the compound having an adsorptive group and a reducible group according to the invention.

These compounds can be easily synthesized by the known method. The compound of formula (I) in the present invention can be used alone as only one kind of the compound, but it is preferred to use two or more kinds of the compounds in combination. When two or more kinds of the compounds are used in combination, those may be added to the same layer or the different layers, whereby adding methods may be different from each other.

The compound represented by formula (I) in the present invention preferably is added to an image forming layer and more preferably is to be added at an emulsion preparing process. In the case, wherein these compounds are added at an emulsion preparing process, these compounds may be added at any step in the process. For example, the silver halide grain forming step, a step before starting of desalting step, the desalting step, the step before chemical ripening, the chemical ripening step, the step before preparing a final emulsion and the like are described. Also, the addition can be performed in the plural divided times during the process. It is preferred to be used in the image forming layer, but also to be diffused at a coating step from a protective layer or an intermediate layer adjacent to the image forming layer, wherein these compounds are added in the protective layer or the intermediate layer in combination with their addition to the image forming layer.

The preferred addition amount is largely depend on the adding method described above or the kind of the compound, but generally $1\times10^{-6}$ mol to 1 mol per 1 mol of photosensitive silver halide, preferably $1\times10^{-5}$ mol to $5\times10^{-1}$ mol, and more preferably $1\times10^{-4}$ mol to $1\times10^{-1}$ mol.

The compound represented by formula (I) in the present invention can be added by dissolving in water or water-soluble solvent such as methanol, ethanol and the like or a mixed solution thereof. At this time, pH may be arranged suitably by an acid or an alkaline and a surfactant can be coexisted. Further, these compounds may be added as an emulsified dispersion by dissolving them in an organic solvent having a high boiling point and also may be added as a solid dispersion.

11) Sensitizing Dye

As the sensitizing dye applicable in the invention, those capable of spectrally sensitizing silver halide grains in a desired wavelength region upon adsorption to silver halide grains having spectral sensitivity suitable to spectral characteristic of an exposure light source can be selected advantageously. Particularly, the photothermographic material of the invention is preferably spectrally sensitized to have a spectral sensitive peak in a range of 600 nm to 900 nm, or in a range of 300 nm to 500 nm. The sensitizing dyes and the adding method are disclosed, for example, in JP-A No. 11-65021 (paragraph Nos. 0103 to 0109), as a compound represented by the formula (II) in JP-A No. 10-186572, dyes represented by the formula (I) in JP-A No. 11-119374 (paragraph No. 0106), dyes described in U.S. Pat. Nos. 5,510,236 and 3,871,887 (Example 5), dyes disclosed in JP-A Nos. 2-96131 and 59-48753, as well as in page 19, line 38 to page 20, line 35 of EP-A No. 0803764A1, and in JP-A Nos. 2001-272747, 2001-290238 and 2002-23306. The sensitizing dyes described above may be used alone or, two or more kinds of them may be used in combination.

In the invention, the sensitizing dye may be added at any amount according to the properties of sensitivity and fog, but it is preferably added from $10^{-6}$ mol to 1 mol, and more preferably from $10^{-4}$ mol to $10^{-1}$ mol, per 1 mol of silver halide in the image forming layer.

The photothermographic material of the invention may also contain super sensitizers in order to improve spectral sensitizing effect. The super sensitizers usable in the invention can include those compounds described in EP-A No. 587338, U.S. Pat. Nos. 3,877,943 and 4,873,184, JP-A Nos. 5-341432, 11-109547 and 10-111543, and the like.

12) Combined Use of a Plurality of Silver Halides

The photosensitive silver halide emulsion in the photothermographic material used in the invention may be used alone as one kind, or two or more kinds of them (for example, those of different average particle sizes, different halogen compositions, of different crystal habits and of different conditions for chemical sensitization) may be used together. Gradation can be controlled by using plural kinds of photosensitive silver halide of different sensitivity. The relevant techniques can include those described, for example, in JP-A Nos. 57-119341, 53-106125, 47-3929, 48-55730, 46-5187, 50-73627, and 57-150841. It is preferred to provide a sensitivity difference of 0.2 or more in terms of log E between each of the emulsions.

13) Mixing Silver Halide and Organic Silver Salt

The photosensitive silver halide in the invention is particularly preferably formed under the absence of the non-photosensitive organic silver salt and chemically sensitized. This is because a sufficient sensitivity can not sometimes be attained by the method of forming the silver halide by adding a halogenating agent to the organic silver salt.

The method of mixing the silver halide and the organic silver salt can include a method of mixing a separately prepared photosensitive silver halide and an organic silver salt by a high speed stirrer, ball mill, sand mill, colloid mill, vibration mill, or homogenizer, or a method of mixing a photosensitive silver halide completed for preparation at any timing in the preparation of an organic silver salt and preparing the organic silver salt. The effect of the invention can be obtained preferably by any of the methods described above.

14) Mixing Silver Halide into Coating Solution

In the invention, the time of adding silver halide to the coating solution for the image forming layer is preferably in the range from 180 minutes before to just prior to the coating, more preferably, 60 minutes before to 10 seconds before coating. But there is no restriction for mixing method and mixing condition as far as the effect of the invention appears sufficient. As an embodiment of a mixing method, there is a method of mixing in the tank controlling the average residence time to be desired. The average residence time herein is calculated from addition flux and the amount of solution transferred to the coater. And another embodiment of mixing method is a method using a static mixer, which is described in 8th edition of "Ekitai Kongo Gijutu"

by N. Harnby and M. F. Edwards, translated by Koji Takahashi (Nikkan Kogyo Shinbunsha, 1989).

(Compound Which Substantially Reduces Visible Light Absorption by Photosensitive Silver Halide After Thermal Development)

In the present invention, it is preferred that the photothermographic material contains the compound which substantially reduces visible light absorption derived from photosensitive silver halide after thermal development against before thermal development.

In the present invention, it is particularly preferred that silver iodide complex-forming agent, which acts specifically on silver iodide, is used as the compound which substantially reduces visible light absorption derived from photosensitive silver halide after thermal development.

<Silver Iodide Complex-forming Agent>

As for the silver iodide complex-forming agent according to the present invention, at least one of nitrogen atom and sulfur atom in the compound is possible to contribute to a Lewis acid-base reaction which gives an electron to a silver ion, as a ligand atom (electron donor: Lewis base). The stability of the complex is defined by successive stability constant or total stability constant, but it depends on the combination of silver ion, iodide ion and the silver complex-forming agent. As a general guide, it is possible to obtain a big stability constant by chelate effect from intramolecular chelate ring formation, by means of increasing the acid-bace dissociation constant and the like.

Ultra violet-visible light absorption spectrum of photosensitive silver halide can be measured by the method of transmission or the method of reflection. When the absorption derived from other compounds added to the photothermographic material overlaps with the absorption of photosensitive silver halide, ultra violet-visible light absorption spectrum of photosensitive silver halide can be observed by using, independently or in combination, the means of difference spectrum and removal of other compounds by solvent and the like.

As a silver iodide complex-forming agent according to the present invention, a 5 to 7 membered heterocyclic compound containing at least one nitrogen atom is preferable. In the case where the compound does not have a mercapto group, a sulfide group, or a thione group as a substituent, the said nitrogen containing 5 to 7 membered heterocycle may be saturated or unsaturated, and may have other substituent. The substituent on a heterocycle may bind each other to form a ring.

As preferable examples of 5 to 7 membered heterocyclic compounds, pyrrole, pyridine, oxazole, isoxazole, thiazole, isothiazole, imidazole, pyrazole, pyrazine, pyrimidine, pyridazine, indole, isoindole, indolizine, quinoline, isoquinoline, benzimidazole, 1H-imidazole, quinoxaline, quinazoline, cinnoline, phthalazine, naphthylizine, purine, pterizine, carbazole, acridine, phenanthoridine, phenanthroline, phenazine, phenoxazine, phenothiazine, benzothiazole, benzoxazole, benzimidazole, 1,2,4-triazine, 1,3,5-triazine, pyrrolidine, imidazolidine, pyrazolidine, piperidine, piperazine, morpholine, indoline, isoindoline, and the like can be described. More preferably, pyridine, imidazole, pyrazole, pyrazine, pyrimidine, pyridazine, indole, isoindole, indolizine, quinoline, isoquinoline, benzimidazole, 1H-imidazole, quinoxaline, quinazoline, cinnoline, phthalazine, 1,8-naphthylizine, 1,10-phenanthroline, benzimidazole, benzotriazole, 1,2,4-triazine, 1,3,5-triazine and the like can be described. Particularly preferably, pyridine, imidazole, pyrazine, pyrimidine, pyridazine, phtharazine, triazine, 1,8-naphthylizine and 1,10-phenanthroline, and the like can be described.

These rings may have a substituent and any substituent can be used as far as it does not show a bad influence to photographic property. As preferable examples, a halogen atom (fluorine atom, chlorine atom, bromine atom or iodine atom), an alkyl group (a straight, a branched, a cyclic alkyl group containing a bicycloalkyl group or an active methylene group), an alkenyl group, an alkynyl group, an aryl group, a heterocyclic group (substituted position is not asked), an acyl group, an alkoxycarbonyl group, an aryloxycarbonyl group, a heterocyclic oxycarbonyl group, a carbamoyl group, a N-acylcarbamoyl group, a N-sulfonylcarbamoyl group, a N-carbamoylcarbamoyl group, a N-sulfamoylcarbamoyl group, a carbazoyl group, a carboxy group and a salt thereof, an oxalyl group, an oxamoyl group, a cyano group, a carboimidoyl group, a formyl group, a hydroxy group, an alkoxy group (the group repeating ethylene oxy group units or propylene oxy group units is included), an aryloxy group, a heterocyclic oxy group, an acyloxy group, an alkoxycarbonyloxy group, an aryloxycarbonyloxy group, a carbamoyloxy group, a sulfonyloxy group, an amino group, an alkylamino group, an arylamino group, a heterocyclic amino group, an acylamino group, a sulfonamide group, an ureido group, a thioureido group, an imido group, an alkoxycarbonylamino group, an aryloxycarbonylamino group, a sulfamoylamino group, a semicarbazide group, an ammonio group, an oxamoylamino group, a N-alkylsulfonylureido group, a N-arylsulfonylureido group, a N-acylureido group, N-acylsulfamoylamino group, a nitro group, a heterocyclic group containing a quaternary nitrogen atom (e.g., a pyridinio group, an imidazolio group, a quinolinio group, an isoquinolinio group), an isocyano group, an imino group, an alkylsulfonyl group, an arylsulfonyl group, an alkylsulfinyl group, an arylsulfinyl group, a sulfo group and a salt thereof, a sulfamoyl group, a N-acylsulfamoyl group, a N-sulfonylsulfamoyl group and a salt thereof, a phosphino group, a phosphinyl group, a phosphinyloxy group, a phosphinylamino group, a silyl group, and the like are described. Here, an active methylene group means the methine group substituted by two electron-attracting groups, wherein the electron-attracting group means an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group, a carbonimidoyl group. Herein, two electron-attracting groups may bind each other to form a cyclic structure. And, the salt means a salt formed with positive ion such as an alkaline metal, an alkaline earth metal, a heavy metal or the like, or organic positive ion such as an ammonium ion, a phosphonium ion or the like. These substituents may be further substituted by these substituents.

These heterocycles may be further condensed by another ring. In the case where the substituent is an anion group (e.g., $—C_2^-$, $—SO_3^-$, $—S^-$ and the like), the heterocycle containing nitrogen atom of the invention may become a positive ion (e.g., pyridinium, 1,2,4-triazolium and the like) and may form an intramolecular salt.

In the case where a heterocyclic compound is pyridine, pyrazine, pyrimidine, pyridazine, phthalazine, triazine, naththilizine or phenanthroline derivative, the acid dissociation constant (pKa) of a conjugated acid of nitrogen containing heterocyclic part in acid dissociation equilibrium of the said compound preferably is 3 to 8 in the mixture solution of tetrahydrofuran/water (3/2) at 25° C., and more preferably, the pKa is 4 to 7.

As the heterocyclic compound, pyridine, pyridazine or phtharazine derivative is preferable, and particularly preferable is pyridine or phthalazine derivative.

In the case where these heterocyclic compounds have a mercapto group, a sulfide group or a thione group as the substituent, pyridene, thiazole, isothiazole, oxazole, isoxazole, imidazole, pyrazole, pyrazine, pyrimidine, pyridazine, triazine, triazole, thiadiazole or oxadiazole derivatives are preferable, and thiazole, imidazole, pyrazole, pyrazine, pyrimidine, pyridazine, triazine, triazole derivatives are particularly preferable.

For example, as the said silver iodide complex-forming agent, the compound represented by the following formula (C1) or (C2) can be used.

Formula (C1)

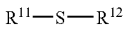

Formula (C2)

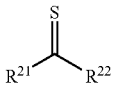

In formula (C1), $R^{11}$ and $R^{12}$ each independently represent one selected from a hydrogen atom and a substituent. In formula (C2), $R^{21}$ and $R^{22}$ each independently represent one selected from a hydrogen atom and a substituent. However, both of $R^{11}$ and $R^{12}$ are not hydrogen atoms together and both of $R^{21}$ and $R^{22}$ are not hydrogen atoms together. As the substituent herein, the substituent explained as the substituent of a 5 to 7 membered nitrogen containing heterocyclic type silver iodide complex-forming agent mentioned above can be described.

Further, the compound represented by formula (C3) described below can also be used preferably.

Formula (C3)

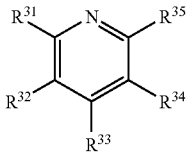

In formula (C3), $R^{31}$ to $R^{35}$ each independently represent one selected from a hydrogen atom and a substituent. As the substituents represented by $R^{31}$ to $R^{35}$, the substituent of a 5 to 7 membered nitrogen containing heterocyclic type silver iodide complex-forming agent mentioned above can be described. In the case where the compound represented by formula (C3) has a substituent, preferred substituting position is $R^{32}$ to $R^{34}$. $R^{31}$ to $R^{35}$ may bind each other to form a saturated or an unsaturated ring. Preferred substituent is a halogen atom, an alkyl group, an aryl group, a carbamoyl group, a hydroxy group, an alkoxy group, an aryloxy group, a carbamoyloxy group, an amino group, an acylamino group, an ureido group, an alkoxycarbonylamino group, an aryloxycarbonylamino group and the like.

In the compound represented by formula (C3), the acid dissociation constant (pKa) of conjugated acid of pyridine ring part preferably is 3 to 8 in the mixed solution of tetrahydrofuran/water (3/2) at 25° C., and particularly preferably, pKa is 4 to 7.

Furthermore, the compound represented by formula (C4) is also preferable.

Formula (C4)

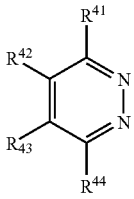

In formula (C4), $R^{41}$ to $R^{44}$ each independently represent one selected from a hydrogen atom and a substituent. $R^{41}$ to $R^{44}$ may bind each other to form a saturated or an unsaturated ring. As the substituent represented by $R^{41}$ to $R^{44}$, the substituent of a 5 to 7 membered nitrogen containing heterocyclic type silver iodide complex-forming agent mentioned above can be described. As preferred group, an alkyl group, an alkenyl group, an alkynyl group, an aryl group, a hydroxy group, an alkoxy group, an aryloxy group a hetecyclic oxy group and a group which forms a phthalazine ring by benzo-condensation are described. In the case where a hydroxy group exists at the carbon atom adjacent to nitrogen atom of the compound represented by formula (C4), there exists equilibrium between pyridazinone.

The compound represented by formula (C4) more preferably forms a phthalazine ring represented by the following formula (C5), and furthermore, this phthalazine ring particularly preferably has at least one subsutituent. As examples of $R^{51}$ to $R^{56}$ in formula (C5), the substituent of a 5 to 7 membered nitrogen containing heterocyclic type silver iodide complex-forming agent mentioned above can be described. And as more preferable examples of the substituent, an alkyl group, an alkenyl group, an alkynyl group, an aryl group, a hydroxy group, an alkoxy group, an aryloxy group and the like are described. An alkyl group, an alkenyl group, an aryl group, an alkoxy group and an aryloxy group are preferable and an alkyl group, an alkoxy group and an aryloxy group are more preferable.

Formula (C5)

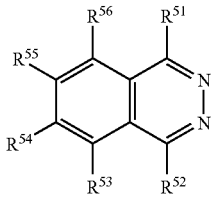

Further, the compound represented by formula (C6) described below is also a preferable embodiment.

Formula (C6)

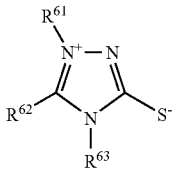

In formula (C6), $R^{61}$ to $R^{63}$ each independently represent one selected from a hydrogen atom and a substituent. As examples of the substituent represented by $R^{62}$, the substituent of a 5 to 7 membered nitrogen containing heterocyclic type silver iodide complex-forming agent mentioned above can be described.

As the compound preferably used, the compound represented by the following formula (C7) is described.

$$R^{71}—S-(L)_n-S—R^{72}$$ Formula (C7)

In formula (C7), $R^{71}$ and $R^{72}$ each independently represent one selected from a hydrogen atom and a substituent. L represents a divalent linking group. n represents 0 or 1. As the substituents represented by $R^{71}$ and $R^{72}$, an alkyl group (containing a cycloalkyl group), an alkenyl group (containing a cycloalkenyl group), an alkynyl group, an aryl group, a heterocyclic group, an acyl group, an aryloxycarbonyl group, an alkoxycarbonyl group, a carbamoyl group, an imido group, and a complex substituent containing these groups are described as examples. A divalent linking group represented by L preferably has the length of 1 to 6 atoms and more preferably has the length of 1 to 3 atoms, and furthermore, may have a substituent.

One more of the compounds preferably being used is a compound represented by formula (C8).

Formula (C8)

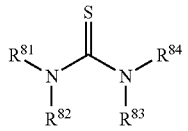

In formula (C8), $R^{81}$ to $R^{84}$ each independently represent one selected from a hydrogen atom and a substituent. As the substituents represented by $R^{81}$ to $R^{84}$, an alkyl group (including a cycloalkyl group), an alkenyl group (including a cycloalkenyl group), an alkynyl group, an aryl group, a heterocyclic group, an acyl group, an aryloxycarbonyl group, an alkoxycarbonyl group, a carbamoyl group, an imido group, and the like are described as examples.

Among the silver iodide complex-forming agents described above, the compounds represented by formulae (C3), (C4), (C5), (C6) and (C7) are preferable and, the compounds represented by formulae (C3) and (C5) are particularly preferable.

Preferable examples of silver iodide complex-forming agent are described below, however the present invention is not limited in these.

(1)

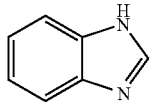

(2)

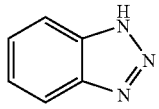

(3)

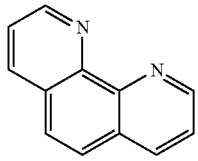

-continued (4)

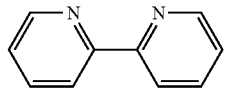

(5)

$C_5H_{11}SC_5H_{11}$ (6)

$C_4H_9SCH_2CH_2SC_4H_9$ (7)

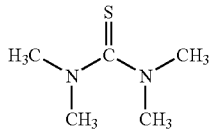

(8)

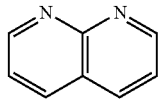

(9)

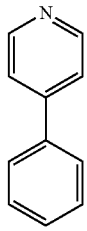

(10)

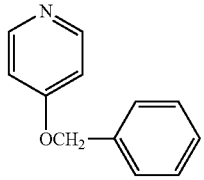

(11)

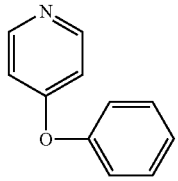

(12)

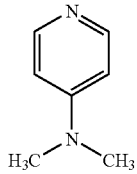

(13)

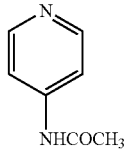

(14)

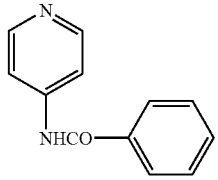

-continued
(15)
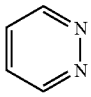
(16)
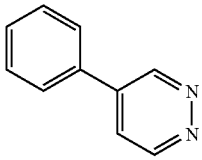
(17)
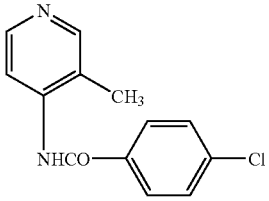
(18)
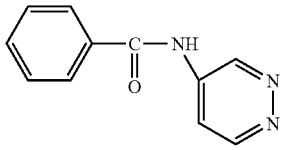
(19)
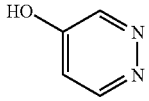
(20)
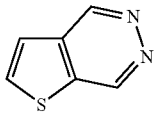
(21)
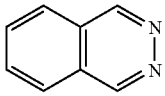
(22)
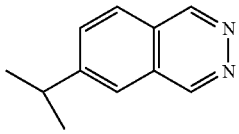
(23)
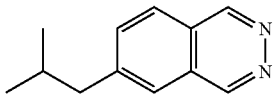
(24)
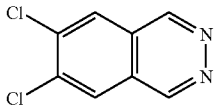
(25)
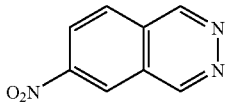
(26)
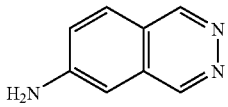
-continued
(27)
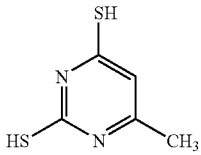
(28)
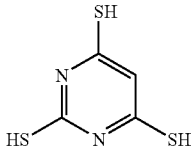
(29)
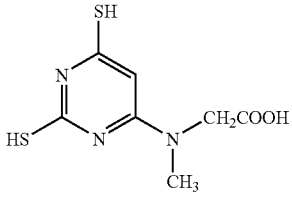
(30)
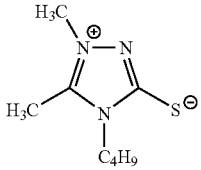
(31)
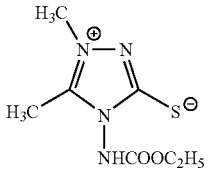
(32)
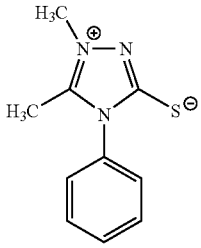
(33)
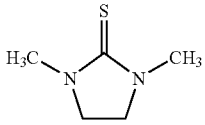
(34)
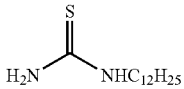
(35)
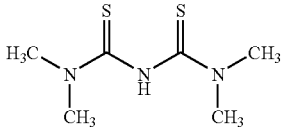
(36)
$HO(CH_2)_3S(CH_2)_2S(CH_2)_3OH$ -continued (37)

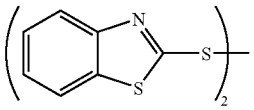

(38)

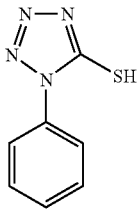

(39)

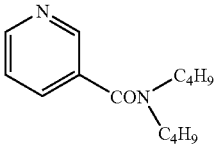

(40)

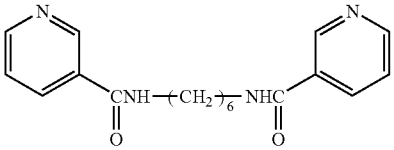

(41)

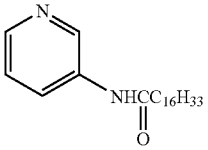

(42)

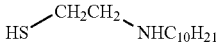

The silver iodide complex-forming agent according to the present invention can also be a compound common to a toner, in the case where the agent achieves the function of conventionally known toner. The silver iodide complex-forming agent according to the present invention can be used in combination with a toner. And, two or more kinds of the silver iodide complex-forming agents may be used in combination.

The silver iodide complex-forming agent according to the present invention preferably exists in a film under the state separated from a photosensitive silver halide, such as a solid state. It is also preferably added to the layer adjacent to the image forming layer. Concerning the silver iodide complex-forming agent according to the present invention, a melting point of the compound is preferably adjusted to a suitable range so that it can be dissolved when heated at thermal developing temperature.

In the present invention, an absorption intensity of ultra violet-visible light absorption spectrum of photosensitive silver halide after thermal development preferably becomes 80% or less as compared with before thermal development, more preferably 40% or less and, particularly preferably 10% or less.

The silver iodide complex-forming agent according to the invention may be incorporated into photothermographic material by being added into the coating solution, such as in the form of a solution, an emulsion dispersion, a solid fine particle dispersion, and the like.

As well known emulsion dispersing method, there can be mentioned a method comprising dissolving the silver iodide complex-forming agent in an oil such as dibutyl phthalate, tricresyl phosphate, glyceryl triacetate or diethyl phthalate or the like, and an auxiliary solvent such as ethyl acetate or cyclohexanone, followed by mechanically forming the emulsified dispersion.

As solid fine particle dispersing method, there can be mentioned a method comprising dispersing the powder of the silver iodide complex-forming agent in a proper medium such as water, by means of ball mill, colloid mill, vibrating ball mill, sand mill, jet mill, roller mill, or ultrasonics, thereby obtaining solid dispersion. In this case, there can also be used a protective colloid (such as polyvinyl alcohol), or a surfactant (for instance, an anionic surfactant such as sodium triisopropylnaphthalenesulfonate (a mixture of compounds having the isopropyl groups in different substitution sites)). In the mills enumerated above, generally used as the dispersion media are beads made of zirconia and the like, and Zr and the like eluting from the beads may be incorporated in the dispersion. Although depending on the dispersing conditions, the amount of Zr and the like generally incorporated in the dispersion is in the range of from 1 ppm to 1000 ppm. It is practically acceptable so long as Zr is incorporated in the photothermographic material in an amount of 0.5 mg or less per 1 g of silver.

Preferably, an antiseptic (for instance, sodium benzoisothiazolinone salt) is added in the water dispersion.

The silver iodide complex-forming agent according to the invention is preferably used in the form of a solid dispersion.

The silver iodide complex-forming agent according to the invention is preferably used in the range from 1 mol % to 5000 mol %, more preferably, from 10 mol % to 1000 mol % and, further preferably, from 50 mol % to 300 mol %, with respect to the photosensitive silver halide in each case.

(Phthalic Acid and Derivatives Thereof)

In the present invention, the photothermographic material preferably comprises the compound selected from phthalic acid and phthalic acid derivatives, together with the silver iodide complex forming agent. As phthalic acid and phthalic acid derivatives used in the present invention, the compound represented by the following formula (PH) is preferable.

Formula (PH)

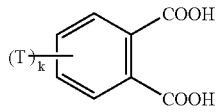

In the formula, T represents one selected from a halogen atom (fluorine, bromine and iodine atom), an alkyl group, an aryl group, an alkoxy group, and a nitro group. k represents an integral number of 0 to 4, and when k is 2 or more, plural k may be the same or different from each other. k preferably is 0 to 2, and more preferably, 0 or 1.

The compound represented by formula (PH) may be used just as an acid or may be used as suitable salt from the viewpoint of easy addition to a coating solution and from the viewpoint of pH adjustment. As a salt, an alkaline metal salt, an ammonium salt, an alkaline earth metals salt, an amine salt and the like can be used. An alkaline metal salt (Li, Na, K and the like) and an ammonium salt are preferred.

Phthalic acid and the derivatives thereof used in the present invention are described below, however the present invention is not limited in these compounds.

(1)

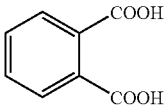

(2)

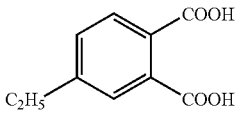

(3)

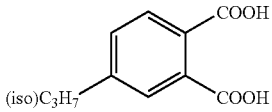

(4)

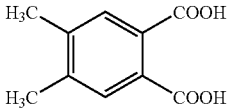

(5)

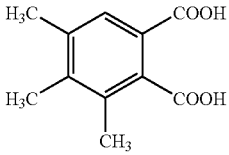

(6)

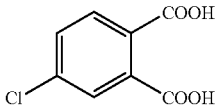

(7)

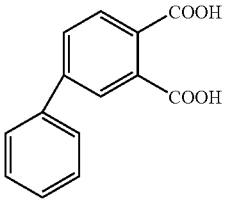

(8)

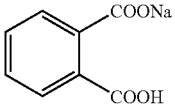

(9)

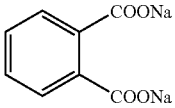

(10)

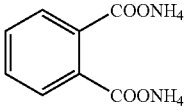

(11)

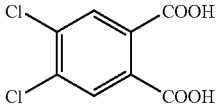

-continued (12)

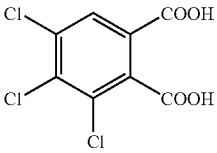

(13)

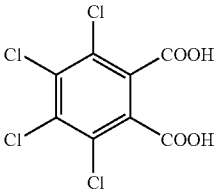

In the invention, the addition amount of phthalic acid and derivatives thereof is $1.0\times10^{-4}$ mol to 1 mol, preferably $1.0\times10^{-3}$ mol to 0.5 mol and, further preferably $2.0\times10^{-3}$ mol to 0.2 mol, per 1 mol of coated silver.

(Binder)

Any kind of polymer may be used as the binder for the image forming layer in the photothermographic material of the invention. Suitable as the binder are those that are transparent or translucent, and that are generally colorless, such as natural resin or polymer and their copolymers; synthetic resin or polymer and their copolymer; or media forming a film; for example, included are gelatin, rubber, poly(vinyl alcohol), hydroxyethyl cellulose, cellulose acetate, cellulose acetate butyrate, poly(vinyl pyrrolidone), casein, starch, poly(acrylic acid), poly(methylmethacrylic acid), poly (vinyl chloride), poly(methacrylic acid), styrene-maleic anhydride copolymers, styrene-acrylonitrile copolymers, styrene-butadiene copolymers, poly(vinyl acetal) (e.g., poly(vinyl formal) and poly(vinyl butyral)), polyester, polyurethane, phenoxy resin, poly(vinylidene chloride), polyepoxide, polycarbonate, poly(vinyl acetate), polyolefin, cellulose esters, and polyamide. A binder may be used with water, an organic solvent or emulsion to form a coating solution.

In the invention, the glass transition temperature (Tg) of the binder of the image forming layer is preferably in the range from 0° C. to 80° C., more preferably, from 10° C. to 70° C. and, further preferably, from 15° C. to 60° C.

In the specification, Tg is calculated according to the following equation.

$$1/Tg=\Sigma(Xi/Tgi)$$

Where, the polymer is obtained by copolymerization of n monomer compounds (from i=1 to i=n); Xi represents the mass fraction of the ith monomer ('Xi=1), and Tgi is the glass transition temperature (absolute temperature) of the homopolymer obtained with the ith monomer. The symbol Σ stands for the summation from i=1 to i=n.

Values for the glass transition temperature (Tgi) of the homopolymers derived from each of the monomers were obtained from J. Brandrup and E. H. Immergut, Polymer Handbook (3rd Edition) (Wiley-Interscience, 1989).

The polymer used for the binder may be of one kind or, may be two or more kinds of polymers, if necessary. And, the polymer having Tg of 20° C. or more and the polymer having Tg of less than 20° C. can be used in combination.

In the case where two or more kinds of polymers differing in Tg may be blended for use, it is preferred that the weight-average Tg is in the range mentioned above.

In the invention, it is preferred that a film is formed by first applying a coating solution containing 30% by weight or more of water in the solvent and by then drying.

In the case where the image forming layer is formed by first applying a coating solution containing 30% by weight or more of water in the solvent and by then drying, furthermore, in the case where the binder of the image forming layer is soluble or dispersible in an aqueous solvent (water solvent), and particularly in the case where a polymer latex having an equilibrium water content of 2% by weight or lower under 25° C. and 60% RH is used, the performance can be ameliorated. Most preferred embodiment is such prepared to yield an ion conductivity of 2.5 mS/cm or lower, and as such a preparing method, there can be mentioned a refining treatment using a separation function membrane after synthesizing the polymer.

The aqueous solvent in which the polymer is soluble or dispersible, as referred herein, signifies water or water containing mixed therein 70% by weight or less of a water-admixing organic solvent. As water-admixing organic solvents, there can be mentioned, for example, alcohols such as methyl alcohol, ethyl alcohol, propyl alcohol, and the like; cellosolves such as methyl cellosolve, ethyl cellosolve, butyl cellosolve, and the like; ethyl acetate, dimethylformamide, and the like.

The term aqueous solvent is also used in the case the polymer is not thermodynamically dissolved, but is present in a so-called dispersed state.

The term "equilibrium water content under 25° C. and 60% RH" as referred herein can be expressed as follows:

Equilibrium water content under 25° C. and 60%

$$RH=[(W1-W0)/W0]\times 100 \text{ (\% by weight)}$$

wherein, W1 is the weight of the polymer in moisture-controlled equilibrium under the atmosphere of 25° C. and 60% RH, and W0 is the absolutely dried weight at 25° C. of the polymer.

For the definition and the method of measurement for water content, reference can be made to Polymer Engineering Series 14, "Testing methods for polymeric materials" (The Society of Polymer Science, Japan, published by Chijin Shokan).

The equilibrium water content under 25° C. and 60% RH is preferably 2% by weight or lower, but is more preferably, 0.01% by weight to 1.5% by weight, and is most preferably, 0.02% by weight to 1% by weight.

The binders used in the invention are, particularly preferably, polymers capable of being dispersed in aqueous solvent. Examples of dispersed states may include a latex, in which water-insoluble fine particles of hydrophobic polymer are dispersed, or such in which polymer molecules are dispersed in molecular states or by forming micelles, and both are preferred. The mean particle size of the dispersed particles is in the range from 1 nm to 50,000 nm, and preferably from 5 nm to 1,000 nm. There is no particular limitation concerning particle size distribution of the dispersed particles, and may be widely distributed or may exhibit a monodisperse particle size distribution. From the viewpoint of controlling the physical properties of the coating solution, preferred mode of usage includes mixing two or more types of particles each having monodisperse particle distribution.

In the invention, preferred embodiment of the polymers capable of being dispersed in aqueous solvent includes hydrophobic polymers such as acrylic polymers, polyester, rubber (e.g., SBR resin), polyurethane, poly(vinyl chloride), poly(vinyl acetate), poly(vinylidene chloride), polyolefin, and the like. As the polymers above, usable are straight chain polymers, branched polymers, or crosslinked polymers; also usable are the so-called homopolymers in which one kind of monomer is polymerized, or copolymers in which two or more kinds of monomers are polymerized. In the case of a copolymer, it may be a random copolymer or a block copolymer. The molecular weight of these polymers is, in terms of number-average molecular weight, in the range from 5,000 to 1,000,000, preferably from 10,000 to 200,000. Those having too small molecular weight exhibit insufficient mechanical strength on forming the image forming layer, and those having too large molecular weight are also not preferred because the filming properties result poor.

<Specific Examples of Latex>

Specific examples of preferred polymer latexes are given below, which are expressed by the starting monomers with % by weight given in parenthesis. The molecular weight is given in number-average molecular weight. In the case polyfunctional monomer is used, the concept of molecular weight is not applicable because they build a crosslinked structure. Hence, they are denoted as "crosslinking", and the molecular weight is omitted. Tg represents glass transition temperature.

P-1; Latex of -MMA(70)-EA(27)-MAA(3)-(molecular weight 37000, Tg 61° C.)

P-2; Latex of -MMA(70)-2EHA(20)-St(5)-AA(5)-(molecular weight 40000, Tg 59° C.)

P-3; Latex of -St(50)-Bu(47)-MAA(3)-(crosslinking, Tg −17° C.)

P-4; Latex of -St(68)-Bu(29)-AA(3)-(crosslinking, Tg 17° C.)

P-5; Latex of -St(71)-Bu(26)-AA(3)-(crosslinking, Tg 24° C.)

P-6; Latex of -St(70)-Bu(27)-IA(3)-(crosslinking)

P-7; Latex of -St(75)-Bu(24)-AA(1)-(crosslinking, Tg 29° C.)

P-8; Latex of -St(60)-Bu(35)-DVB(3)-MAA(2)-(crosslinking)

P-9; Latex of -St(70)-Bu(25)-DVB(2)-AA(3)-(crosslinking)

P-10; Latex of -VC(50)-MMA(20)-EA(20)-AN(5)-AA(5)-(molecular weight 80000)

P-11; Latex of -VDC(85)-MMA(5)-EA(5)-MAA(5)-(molecular weight 67000)

P-12; Latex of -Et(90)-MAA(10)-(molecular weight 12000)

P-13; Latex of -St(70)-2EHA(27)-AA(3)-(molecular weight 130000, Tg 43° C.)

P-14; Latex of -MMA(63)-EA(35)-AA(2)-(molecular weight 33000, Tg 47° C.)

P-15; Latex of -St(70.5)-Bu(26.5)-AA(3)-(crosslinking, Tg 23° C.)

P-16; Latex of -St(69.5)-Bu(27.5)-AA(3)-(crosslinking, Tg 20.5° C.)

In the structures above, abbreviations represent monomers as follows. MMA: methyl metacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The polymer latexes above are commercially available, and polymers below are usable. As examples of acrylic polymers, there can be mentioned Cevian A-4635, 4718, and 4601 (all manufactured by Daicel Chemical Industries, Ltd.), Nipol Lx811, 814, 821, 820, and 857 (all manufactured by Nippon Zeon Co., Ltd.), and the like; as examples of polyester, there can be mentioned FINETEX ES650, 611, 675, and 850 (all manufactured by Dainippon Ink & Chemicals, Inc.), WD-size and WMS (all manufactured by Eastman Chemical Co.), and the like; as examples of polyurethane, there can be mentioned HYDRAN AP10, 20, 30, and 40 (all manufactured by Dainippon Ink & Chemicals, Inc.), and the like; as examples of rubber, there can be mentioned LACSTAR 7310K, 3307B, 4700H, and 7132C (all manufactured by Dainippon Ink & Chemicals, Inc.), Nipol Lx416, 410, 438C, and 2507 (all manufactured by Nippon Zeon Co., Ltd.), and the like; as examples of poly(vinyl chloride), there can be mentioned G351 and G576 (all manufactured by Nippon Zeon Co., Ltd.), and the like; as examples of poly(vinylidene chloride), there can be mentioned L502 and L513 (all manufactured by Asahi Chemical Industry Co., Ltd.), and the like; as examples of polyolefin, there can be mentioned Chemipearl S120 and SA100 (all manufactured by Mitsui Petrochemical Industries, Ltd.), and the like.

The polymer latex above may be used alone, or may be used by blending two or more kinds depending on needs.

<Preferable Latex>

Particularly preferable as the polymer latex for use in the invention is that of styrene-butadiene copolymer. The weight ratio of monomer unit for styrene to that of butadiene constituting the styrene-butadiene copolymer is preferably in the range from 40:60 to 95:5. Further, the monomer unit of styrene and that of butadiene preferably account for 60% by weight to 99% by weight with respect to the copolymer. Preferable range of molecular weight is similar to that described above.

As the latex of styrene-butadiene copolymer preferably used in the invention, there can be mentioned P-3 to P-8, and P-15, or commercially available LACSTAR-3307B, 7132C, Nipol Lx416, and the like.

In the image forming layer of the photothermographic material according to the invention, if necessary, there can be added hydrophilic polymers such as gelatin, polyvinyl alcohol, methyl cellulose, hydroxypropyl cellulose, carboxymethyl cellulose, and the like. The hydrophilic polymers above are added at an amount of 30% by weight or less, preferably 20% by weight or less, with respect to the total weight of the binder incorporated in the image forming layer.

According to the invention, the layer containing organic silver salt (the image forming layer) is preferably formed by using polymer latex for the binder. According to the amount of the binder for the image forming layer, the weight ratio for total binder to organic silver salt (total binder/organic silver salt) is preferably in the range of 1/10 to 10/1, more preferably 1/3 to 5/1, and further preferably 1/1 to 3/1.

The layer containing organic silver salt is, in general, a photosensitive layer (image forming layer) containing a photosensitive silver halide, i.e., the photosensitive silver salt; in such a case, the weight ratio for total binder to silver halide (total binder/silver halide) is in the range of from 400 to 5, more preferably, from 200 to 10.

The total amount of binder in the image forming layer of the invention is preferably in a range from 0.2 $g/m^2$ to 30 $g/m^2$, more preferably from 1 $g/m^2$ to 15 $g/m^2$, and further preferably from 2 $g/m^2$ to 10 $g/m^2$. As for the image forming layer of the invention, there may be added a crosslinking agent for crosslinking, a surfactant or the like to improve coating properties.

Preferable Solvent of Coating Solution

In the invention, a solvent of a coating solution for the image forming layer of the photothermographic material (wherein a solvent and water are collectively described as a solvent for simplicity) is preferably an aqueous solvent containing water at 30% by weight or more. Examples of solvents other than water may include any of water-miscible organic solvents such as methyl alcohol, ethyl alcohol, isopropyl alcohol, methyl cellosolve, ethyl cellosolve, dimethylformamide and ethyl acetate. The water content in a solvent is more preferably 50% by weight or more and still more preferably 70% by weight or more. Concrete examples of a preferable solvent composition, in addition to water=100, are compositions in which methyl alcohol is contained at ratios of water/methyl alcohol=90/10 and 70/30, in which dimethylformamide is further contained at a ratio of water/methyl alcohol/dimethylformamide=80/15/5, in which ethyl cellosolve is further contained at a ratio of water/methyl alcohol/ethyl cellosolve=85/10/5, and in which isopropyl alcohol is further contained at a ratio of water/methyl alcohol/isopropyl alcohol=85/10/5 (wherein the numerals presented above are values in % by weight).

(Antifoggant)

As an antifoggant, stabilizer and stabilizer precursor usable in the invention, there can be mentioned those disclosed as patents in paragraph number 0070 of JP-A No. 10-62899 and in line 57 of page 20 to line 7 of page 21 of EP-A No. 0803764A1, the compounds described in JP-A Nos. 9-281637 and 9-329864, in U.S. Pat. No. 6,083,681, and in EP-A No. 1048975. Furthermore, the antifoggant preferably used in the invention is an organic halogen compound, and those disclosed in paragraph Nos. 0111 to 0112 of JP-A No. 11-65021 can be enumerated as examples thereof. In particular, the organic halogen compound expressed by formula (P) in JP-A No. 2000-284399, the organic polyhalogen compound expressed by formula (II) in JP-A No. 10-339934, and organic polyhalogen compounds described in JP-A Nos. 2001-31644 and 2001-33911 are preferred.

1) Organic Polyhalogen Compound

The organic polyhalogen compound preferably used in the invention will be described in detail below. In the invention, as an antifoggant, the photothermographic material preferably contains the compound expressed by formula (H) below:

$$Q\text{—}(Y)n\text{-}C(Z_1)(Z_2)X \qquad \text{Formula (H)}$$

In formula (H), Q represents one selected from an alkyl group, an aryl group, and a heterocyclic group; Y represents a divalent linking group; n represents 0 or 1; $Z_1$ and $Z_2$ represent a halogen atom; and X represents one selected from a hydrogen atom and an electron-attracting group.

In formula (H), Q is preferably one of an aryl group and a heterocyclic group.

In formula (H), in the case where Q is a heterocyclic group, Q is preferably a nitrogen containing heterocyclic group having 1 or 2 nitrogen atoms and particularly preferably 2-pyridyl group or 2-quinolyl group.

In formula (H), in the case where Q is an aryl group, Q preferably is a phenyl group substituted by an electron-attracting group whose Hammett substituent constant σp yields a positive value. For the details of Hammett substituent constant, reference can be made to Journal of Medicinal Chemistry, vol. 16, No. 11 (1973), pp. 1207 to 1216, and the like. As such electron-attracting groups, examples include, halogen atoms (fluorine atom (σp value: 0.06), chlorine atom (σp value: 0.23), bromine atom (σp value: 0.23), iodine atom (σp value: 0.18)), trihalomethyl groups (tribromomethyl (σp value: 0.29), trichloromethyl (σp value: 0.33), trifluoromethyl (σp value: 0.54)), a cyano group (σp value: 0.66), a nitro group (σp value: 0.78), an aliphatic aryl or heterocyclic sulfonyl group (for example, methanesulfonyl (up value: 0.72)), an aliphatic aryl or heterocyclic acyl group (for example, acetyl (up value: 0.50) and benzoyl (σp value: 0.43)), an alkinyl (e.g., C≡CH (σp value: 0.23)), an aliphatic aryl or heterocyclic oxycarbonyl group (e.g., methoxycarbonyl (σp value: 0.45) and phenoxycarbonyl (σp value: 0.44)), a carbamoyl group (σp value: 0.36), sulfamoyl group (σp value: 0.57), sulfoxido group, heterocyclic group, and phosphoryl group. Preferred range of the σp value is from 0.2 to 2.0, and more preferably, from 0.4 to 1.0. Preferred as the electron-attracting groups are carbamoyl group, an alkoxycarbonyl group, an alkylsulfonyl group, and an alkylphosphoryl group, and particularly preferred among them is carbamoyl group.

X preferably is an electron-attracting group, more preferably, one selected from a halogen atom, an aliphatic aryl sulfonyl group, heterocyclic sulfonyl group, an aliphatic aryl acyl group, heterocyclic acyl group, an aliphatic aryl oxycarbonyl group, heterocyclic oxycarbonyl group, carbamoyl group, and sulfamoyl group; particularly preferred among them is a halogen atom. Among halogen atoms, preferred are chlorine atom, bromine atom, and iodine atom; more preferred are chlorine atom and bromine atom; and particularly preferred is bromine atom.

Y preferably represents one selected from —C(═O)—, —SO—, and —$SO_2$—; more preferably, one of —C(═O)— and —$SO_2$—; and particularly preferred is —$SO_2$ —. N represents 0 or 1, and preferred is 1.

Specific examples of the compounds expressed by formula (H) of the invention are shown below.

H-1

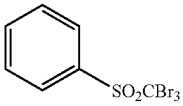

H-2

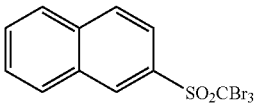

H-3

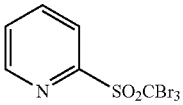

H-4

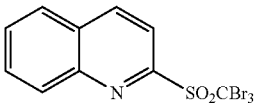

H-5

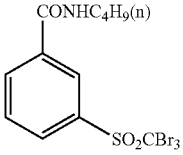

-continued

H-6

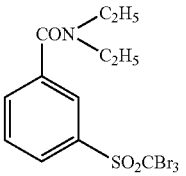

H-7

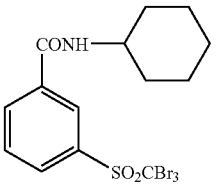

H-8

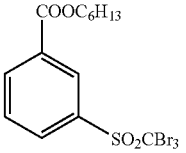

H-9

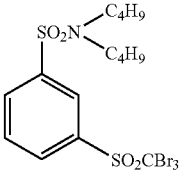

H-10

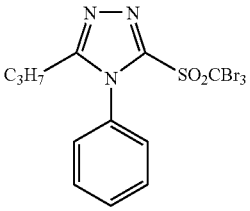

H-11

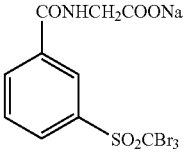

H-12

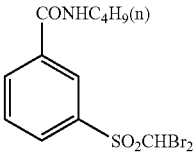

H-13

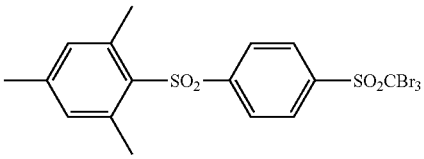

H-14

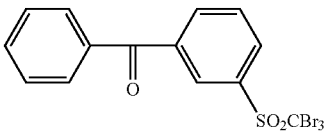

-continued

H-15

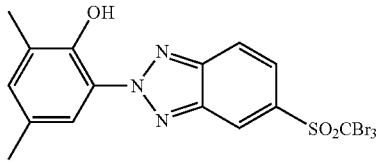

H-16

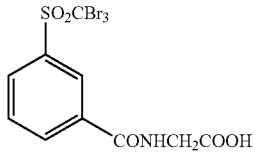

H-17

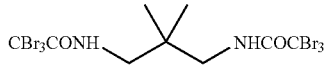

H-18

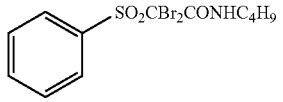

H-19

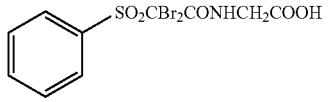

As preferred polyhalogen compounds of the invention other than those above, there can be mentioned compounds disclosed in JP-A Nos. 2001-31644, 2001-56526, and 2001-209145.

The compounds expressed by formula (H) of the invention are preferably used in an amount from $10^{-4}$ mol to 1 mol, more preferably, $10^{-3}$ mol to 0.5 mol, and further preferably, $1\times10^{-2}$ mol to 0.2 mol, per 1 mol of non-photosensitive silver salt incorporated in the image forming layer.

In the invention, usable methods for incorporating the compound expressed by formula (H) into the photosensitive material are those described above in the method for incorporating the reducing agent. Concerning the organic polyhalogen compound, it is preferred to be added in the form of a solid fine particle dispersion.

2) Other Antifoggants

As other antifoggants, there can be mentioned a mercury (II) salt described in paragraph number 0113 of JP-A No. 11-65021, benzoic acids described in paragraph number 0114 of the same literature, a salicylic acid derivative described in JP-A No. 2000-206642, a formaline scavenger compound expressed by formula (S) in JP-A No. 2000-221634, a triazine compound related to claim 9 of JP-A No. 11-352624, a compound expressed by formula (III), 4-hydroxy-6-methyl-1,3,3a,7-tetrazaindene and the like, as described in JP-A No. 6-11791.

The photothermographic material of the invention may further contain an azolium salt in order to prevent fogging. As azolium salts, there can be mentioned a compound expressed by formula (XI) as described in JP-A No. 59-193447, a compound described in JP-B No. 55-12581, and a compound expressed by formula (II) in JP-A No. 60-153039. The azolium salt may be added to any part of the photosensitive material, but as the addition layer, preferred is to select a layer on the side having thereon the image forming layer, and more preferred is to select the image forming layer. The azolium salt may be added at any time of the process of preparing the coating solution; in the case the azolium salt is added into the image forming layer, any time of the process may be selected, from the preparation of the organic silver salt to the preparation of the coating solution, but preferred is to add the salt after preparing the organic silver salt and just before the coating. As the method for adding the azolium salt, any method using a powder, a solution, a fine-particle dispersion, and the like, may be used. Furthermore, it may be added as a solution having mixed therein other additives such as sensitizing agents, reducing agents, tone adjusting agents, and the like. In the invention, the azolium salt may be added at any amount, but preferably, it is added in a range of from $1\times10^{-6}$ mol to 2 mol, and more preferably, from $1\times10^{-3}$ mol to 0.5 mol per 1 mol of silver.

(Other Additives)

1) Mercapto Compounds, Disulfides and Thiones

In the invention, mercapto compounds, disulfide compounds, and thione compounds may be added in order to control the development by suppressing or enhancing development, to improve spectral sensitizing efficiency, and to improve storage properties before and after development. Descriptions can be found in paragraph Nos. 0067 to 0069 of JP-A No. 10-62899, a compound expressed by formula (I) of JP-A No. 10-186572 and specific examples thereof shown in paragraph Nos. 0033 to 0052, in lines 36 to 56 in page 20 of EP-A No. 0803764A1, in JP-A No. 2001-100358 and the like. Among them, mercapto-substituted heterocyclic aromatic compounds are preferred.

2) Toner

In the photothermographic material of the present invention, the addition of a toner is preferred. The description of the toner can be found in JP-A No. 10-62899 (paragraph Nos. 0054 to 0055), EP-A No. 0803764A1 (page21, lines 23 to 48), JP-A Nos. 2000-356317 and the like. Preferred are phthalazinones (phthalazinone, phthalazinone derivatives and metal salts thereof, e.g., 4-(1-naphthyl)phthalazinone, 6-chlorophthalazinone, 5,7-dimethoxyphthalazinone and 2,3-dihydro-1,4-phthalazinedione); combinations of phthalazinones and phthalic acids (e.g., phthalic acid, 4-methylphthalic acid, 4-nitrophthalic acid, diammonium phthalate, sodium phthalate, potassium phthalate and tetrachlorophthalic anhydride); phthalazines (phthalazine, phthalazine derivatives and metal salts thereof, (e.g., 4-(1-naphthyl)phthalazine, 6-isopropylphthalazine, 6-ter-butylphthalazine, 6-chlorophthalazine, 5,7-dimethoxyphthalazine and 2,3-dihydrophthalazine); combinations of phthalazines and phthalic acids. Particularly preferred is a combination of phthalazines and phthalic acids. Among them, particularly preferable are the combination of 6-isopropylphthalazine and phthalic acid, and the combination of 6-isopropylphthalazine and 4-methylphthalic acid.

3) Plasticizer and Lubricant

Plasticizers and lubricants usable in the photothermographic material of the invention are described in paragraph No. 0117 of JP-A No. 11-65021. Lubricants are described in paragraph Nos. 0061 to 0064 of JP-A No. 11-84573.

4) Dyes and Pigments

From the viewpoint of improving color tone, preventing the generation of interference fringes and preventing irradiation on laser exposure, various kinds of dyes and pigments (for instance, C.I. Pigment Blue 60, C.I. Pigment Blue 64, and C.I. Pigment Blue 15:6) may be used in the image forming layer of the invention. Detailed description can be found in WO No. 98/36322, JP-A Nos. 10-268465 and 11-338098, and the like.

5) Nucleator

In the photothermographic material according to the invention, it is preferred to add a nucleator into the image forming layer. Details on the nucleators, method of their addition and addition amount can be found in paragraph No. 0118 of JP-A No. 11-65021, paragraph Nos. 0136 to 0193 of JP-A No. 11-223898, as compounds expressed by formulae (H), (1) to (3), (A), and (B) in JP-A No. 2000-284399; as a nucleation accelerator, description can be found in paragraph No. 0102 of JP-A No. 11-65021, and in paragraph Nos. 0194 to 0195 of JP-A No. 11-223898.

In the case of using formic acid or formates as a strong fogging agent, it is preferably incorporated into the side having thereon the image forming layer containing photosensitive silver halide, at an amount of 5 mmol or less, preferably, 1 mmol or less per 1 mol of silver.

In the case of using a nucleator in the photothermographic material of the invention, it is preferred to use an acid resulting from hydration of diphosphorus pentaoxide, or a salt thereof in combination. Acids resulting from the hydration of diphosphorus pentaoxide or salts thereof include metaphosphoric acid (salt), pyrophosphoric acid (salt), orthophosphoric acid (salt), triphosphoric acid (salt), tetraphosphoric acid (salt), hexametaphosphoric acid (salt), and the like. Particularly preferred acids obtainable by the hydration of diphosphorus pentaoxide or salts thereof include orthophosphoric acid (salt) and hexametaphosphoric acid (salt). Specifically mentioned as the salts are sodium orthophosphate, sodium dihydrogen orthophosphate, sodium hexametaphosphate, ammonium hexametaphosphate, and the like.

The amount of usage of the acid obtained by hydration of diphoshorus pentaoxide or the salt thereof (i.e., the coating amount per 1 $m^2$ of the photothermographic material) may be set as desired depending on sensitivity and fogging, but preferred is an amount from 0.1 $mg/m^2$ to 500 $mg/m^2$, and more preferably, from 0.5 $mg/m^2$ to 100 $mg/m^2$.

(Preparation of Coating Solution and Coating)

The temperature for preparing the coating solution for the image forming layer of the invention is preferably from 30° C. to 65° C., more preferably, from 35° C. or more to less than 60° C., and further preferably, from 35° C. to 55° C. Furthermore, the temperature of the coating solution for the image forming layer immediately after adding the polymer latex is preferably maintained in the temperature range from 30° C. to 65° C.

2. Layer Constitution and Other Constituents

The photothermographic material of the present invention is a "double-sided type" having image forming layers on both sides of the support, and it is particularly preferable as an image recording material for X-ray photographing.

The photothermographic material of th present invention is preferably applied for an image forming method to record X-ray images using an X-ray intensifying screen.

For the image forming method, the photothermographic material as described below can be preferably employed: where the photothermographic material is exposed with a monochromatic light having the same wavelength as the main emission peak wavelength of the X-ray intensifying screen and having a half band width of 15±5 nm, and after a thermal developing process, an exposure value required for a density of fog+0.5 for an image obtained by removing the image forming layer that is disposed on the opposite side of an exposure face is preferably 0.005 lux·sec to 0.07 lux·sec.

The image forming method using the photothermographic materials described above comprises the steps of:

(a) providing an assembly for forming an image by placing the photothermographic material between a pair of the X-ray intensifying screens, (b) putting an analyte between the assembly and the X-ray source, (c) applying an X-ray having an energy level of 25 kVp to 125 kVp to the analyte, (d) taking the photothermographic material out of the assembly, and (e) heating the thus taken out photothermographic material in the temperature range of 90° C. to 180° C.

The photothermographic material used for the assembly in the present invention is subjected to X-ray exposure through a step wedge tablet and thermal development. On the photographic characteristic curve having an optical density (D) and an exposure amount (log E) along the rectangular coordinates having the equal axis-of-coordinate unit, it is preferred to adjust so that the thermal developed image may have the photographic characteristic curve where the average gamma (γ) made at the points of a density of fog+0.1 and a density of fog+0.5 is from 0.5 to 0.9, and the average gamma (γ) made at the points of a density of fog+1.2 and a density of fog+1.6 is from 3.2 to 4.0. For the X-ray radiography employed in the practice of the present invention, the use of photothermographic material having the aforesaid photographic characteristic curve would give the X-ray images with excellent photographic properties that exhibit an extended bottom portion and high gamma value at middle density area. According to this photographic property, the photographic properties mentioned has the advantage of that the depiction in low density part on the mediastinal region and the heart shadow region having little X-ray transmittance becomes excellent, and that the density becomes pleasing to the eye, and that the contrast in the images on the lung field region having much X-ray transmittance becomes excellent.

The photothermographic material having the preferred photographic characteristic curve mentioned above can be easily prepared, for example, by the method where each of the image forming layer of both sides may be constituted of two or more image forming layers containing silver halide and having a sensitivity different from each other. Especially, the aforesaid image forming layer preferably comprises an emulsion of high sensitivity for the upper layer and an emulsion with photographic properties of low sensitivity and high contrast for the lower layer. In the case of preparing the image forming layer comprising two layers, the sensitivity difference between the silver halide emulsion in each layer is preferably from 1.5 times to 20 times, and more preferably from 2 times to 15 times. The ratio of the amount of emulsion used for forming each layer may depend on the sensitivity difference between emulsions used and the covering power. Generally, as the sensitivity difference is large, the ratio of the using amount of high sensitivity emulsion is reduced. For example, if the sensitivity difference is two times, and the covering power is equal, the ratio of the amount of high sensitivity emulsion to low sensitivity emulsion would be preferably adjusted to be in the range from 1:20 to 1:50 based on silver amount.

Concerning the method for emulsion sensitization, various additives, constituting materials and the like, there is no limitation, and for example, the various techniques described in JP-A Nos. 2-103037 and 2-115837 can be used.

As the techniques for crossover cut (in the case of double-sided coated photosensitive material) and anti-halation (in the case of single-sided coated photosensitive material), dyes or combined use of dye and mordant described in JP-A. No. 2-68539, (from page 13, left lower column, line 1 to page 14, left lower column, line 9) can be employed.

(X-ray Intensifying Screen)

Next the fluorescent intensifying screen (radiographic intensifying screen) employed in the practice of the present invention is explained below. The radiographic intensifying screen essentially comprises a support and a fluorescent substance layer coated on one side of the support as the fundamental structure. The fluorescent substance layer is a layer where the fluorescent substance is dispersed in binders. On the surface of a fluorescent substance layer opposite to the support side (the surface of the side that does not face on the support), a transparent protective layer is generally disposed to protect the fluorescent substance layer from chemical degradation and physical shock.

Preferred fluorescent substances of the present invention are described below.

Tungstate fluorescent substances ($CaWO_4$, $MgWO_4$, $CaWO_4$:Pb and the like), terbium activated rare earth sulfoxide fluorescent substances [$Y_2O_2S$:Tb, $Gd_2O_2S$:Tb, $La_2O_2S$:Tb, $(Y,Gd)_2O_2S$:Tb, $(Y,Gd)O_2S$:Tb, Tm and the like], terbium activated rare earth phosphate fluorescent substances ($YPO_4$:Tb, $GdPO_4$:Tb, $LaPO_4$:Tb and the like), terbium activated rare earth oxyhalogen fluorescent substances (LaOBr:Tb, LaOBr:Tb, Tm, LaOCl:Tb, LaOCl:Tb, Tm, LaOBr:Tb, GdOBr:Tb, GdOCl:Tb and the like), thulium activated rare earth oxyhalogen fluorescent substances (LaOBr:Tm, LaOCl:Tm and the like), barium sulfate fluorescent substances [$BaSO_4$:Pb, $BaSO_4$:$Eu^2$, $(Ba,Sr)SO_4$:$Eu^{2+}$ and the like], divalent europium activated alkali earth metal phosphate fluorescent substances [$(Ba_2PO_4)_2$:$Eu^{2+}$, $(Ba_2PO_4)_2$:$Eu^{2+}$, and the like], divalent europium activated alkali earth metal fluorinated halogenide fluorescent substances [BaFCl:$Eu^{2+}$, BaFBr:$Eu^{2+}$, BaFCl:$Eu^{2+}$, Tb, BaFBr:$Eu^{2+}$, Tb, $BaF_2$.BaCl.KCl:$Eu^{2+}$, $(Ba,Mg)F_2$.BaCl.KCl:$Eu^{2+}$, and the like], iodide fluorescent substances (CsI:Na, CsI:Tl, NaI, KI:Tl and the like), sulfide fluorescent substances [ZnS:Ag(Zn,Cd)S:Ag, (Zn,Cd)S:Cu, (Zn,Cd)S:Cu, Al and the like], hafnium phosphate fluorescent substances ($HfP_2O_7$:Cu and the like), $YTaO_4$ and a substance in which various activator is added as an emission center to $YTaO_4$. However, the fluorescent substance used in the present invention is not particularly limited to these specific examples, so long as to emit light in visible or near ultraviolet region by exposure to a radioactive ray.

In the fluorescent intensifying screen used in the present invention, the fluorescent substances are preferably packed in the grain size graded structure. Especially, fluorescent substance particles having a large particle size is preferably coated at the side of the surface protective layer and fluorescent substance particles having a small particle size is preferably coated at the side of the support. Hereto, the small particle size of fluorescent substance is preferably in the range from 0.5 μm to 2.0 μm and the large size is preferably in the range from 10 μm to 30 μm.

(Combined Use with Ultraviolet Fluorescent Intensifying Screen)

As for the image forming method using a photothermographic material according to the present invention, it is preferred that the method comprising forming an image in combination with a fluorescent substance having a main emission peak at 400 nm or lower. And more preferably, the image forming method is performed in combination with a fluorescent substance having a main emission peak at 380 nm or lower. Either single-sided coated photosensitive material or double-sided coated photosensitive material can be applied for the assembly. As the screen having a main emission peak at 400 nm or lower, the screens described in JP-A No. 6-11804 and WO No. 93/01521 and the like are used, but the present invention is not limited to these. As the techniques of crossover cut (for double-sided coated photosensitive material) and anti-halation (for single-sided coated photosensitive material) of ultraviolet radiation, the technique described in JP-A No. 8-76307 can be applied. As ultraviolet radiation absorbing dyes, the dye described in JP-A No. 2001-144030 is particularly preferred.

2-1. Non-photosensitive Layer

The photothermographic material according to the invention may have a non-photosensitive layer in addition to the image forming layer. The non-photosensitive layers can be classified depending on the layer arrangement into (a) a surface protective layer provided on the image forming layer (on the side farther from the support), (b) an intermediate layer provided among plural image forming layers or between the image forming layer and the protective layer, (c) an undercoat layer provided between the image forming layer and the support, and (d) a back layer which is provided to the side opposite to the image forming layer.

Furthermore, a layer that functions as an optical filter may be provided as (a) or (b) above. An antihalation layer may be provided as (c) or (d) to the photosensitive material. In the case of disposing an antistatic layer, it is preferred to introduce an antistatic agent in (c), (d), or outermost layers on both sides.

The constitutions and preferable components of these layers will be explained in detail below.

Further, the image forming layer may carry thereon an intermediate layer, and a surface protective layer. The material may carry a back layer, a back protective layer and the like on the opposite surface of the image forming layer toward the support.

(Antistatic Layer)

In this invention, it is preferred that an antistatic layer is disposed on at least one surface of a support, and it is more preferred that antistatic layers are disposed on both surfaces of a support. The aforementioned antistatic layer is preferably arranged between the aforementioned image forming layer and the aforementioned support, or the antistatic layer is arranged as an outermost layer on a surface opposite to the above-mentioned image forming layer toward the aforementioned support.

1) Metal Oxide

An embodiment of the antistatic layer in this invention is a conductive layer, in which metal oxides are dispersed into a binder. It is preferred that an edge electric resistance under the environment of 25° C. and 10% RH is preferably $10^{11}$ Ω or less.

Examples of a conductive metal oxide used in the conductive layer of the invention can include a crystalline metal oxide selected from a group comprising ZnO, $TiO_2$, $SnO_2$, $Al_2O_3$, $In_2O_3$, $SiO_2$, MgO, BaO and $MoO_3$, and particles of complex oxides thereof (fiber-like, needle-like, spherical, board-like, or amorphous). Metal oxides or particles of complex oxides thereof are described in JP-A Nos. 56-143430 and 60-258541. The preparing methods of these conductive metal oxide particles include, firstly, preparing metal oxides by calcination and then performing a heat treatment in the presence of heteroatom in order to increase conductivity, secondary, coexisting a heteroatom atom during the preparation of metal oxide particles by calcination, and thirdly, introducing an oxygen deficiency by reducing the oxygen concentration during calcination, and the like. As the heteroatoms, Al and In can be described for ZnO, Nb and Ta can be described for $TiO_2$, and Sb, Nb, P, B, In, V, and halogen can be described for $SiO_2$. The addition amount is preferably in the range from 0.01 mol % to 30 mol %, and particularly preferably from 0.1 mol % to 10 mol %. In addition, a silicone compound may be added to improve fine particle-dispersibility and transparency.

As described in JP-B No. 59-6235, conductive materials, which are made by adhering the abovementioned metal oxides to other crystalline metal oxide particles or a fiber-like material (for example, a titanium oxide), may be used. Conductive metal oxides used in the invention vary in shape, size, and volume electrical resistivity according to the species. In order to decrease the coating amount, most preferable shape is fiber-like having a high aspect ratio, and needle-like, amorphous and spherical follow. It is preferred that the volume electrical resistivity is low as possible, and the volume electrical resistivity is preferably $10^7$ Ω·cm or less, more preferably $10^5$ Ω·cm or less, and further preferably $10^2$ Ω·cm or less. A metal oxide which contains $SnO_2$ as a main component and antimony oxide in an amount of about 5% to 20%, a metal oxide which contains additionally other component (for example, silicone oxide, boron, phosphorous, or the like), ZnO, $TiO_2$, and $In_2O_3$ (all of them are amorphous) can reduce the coating amount per unit area the most considering also the shape and volume electrical resistivity, and they can be preferably used in the invention. Among them, particularly preferable are the metal oxide which contains $SnO_2$ as a main component and antimony oxide in an amount of about 5% by weight to 20% by weight, and a metal oxide which contains additionally other component (for example, silicone oxide, boron, phosphorous, and the like).

When the conductive materials used in the invention are amorphous or spherical, primary particle size is preferably 0.0001 μm to 1 μm, and when the size is 0.001 μm to 0.5 μm, it provides better stability after dispersion and it is more preferable. In order to improve permeability of light, the use of conductive particles having a size of 0.001 μm to 0.3 μm is preferable to form a transparent photosensitive material. These particles are normally secondary aggregates of several primary particles in a dispersion solution and in a coated film. The average particle size is preferably 0.005 μm to 0.5 μm, however, from viewpoint of reducing the coating amount per unit area, 0.005 μm to 0.3 μm is preferable, more preferable is 0.01 μm to 0.2 μm, and particular preferable is 0.01 μm to 0.18 μm.

The coating amount of the conductive metal oxide in the invention is not particularly limited. However, the smaller the coating amount is more preferable from the viewpoint of inhibiting coloring the photosensitize materials of the invention. Excessive reduction of the coating amount, however, will reduce antistaticity. Therefore, coating amount per unit area may be 1 mg/m$^2$ to 800 mg/m$^2$, and is preferably 2 mg/m$^2$ to 400 mg/m$^2$, more preferably 5 mg/m$^2$ to 250 mg/m$^2$, and particularly preferably 10 mg/m$^2$ to 150 mg/m$^2$. When a conductive metal oxide is fiber-like or needle-like, larger aspect ratio (length ratio of major axe to minor axe) can reduce more coating amount per unit area. Fiber-like or needle-like conductive metal oxides used preferably in the invention has preferably 20 μm or less in length and 1 μm or less in diameter, more preferably 10 μm or less in length and 0.3 μm or less in diameter, and particularly preferably 10 μm or less in length and 0.1 μm or less in diameter. The aspect ratio is 5 or more, preferably 10 or more, and more preferably 20 or more. The coating amount per unit area may be 0.1 mg/m$^2$ to 500 mg/m$^2$, and is preferably 0.5 mg/m$^2$ to 300 mg/m$^2$, more preferably 0.5 mg/m$^2$ to 150 mg/m$^2$, and particularly preferably 1 mg/m$^2$ to 200 mg/m$^2$.

The conductive metal oxides may be coated by mixing of two or more kinds thereof. Particularly, combination of an amorphous or spherical with fiber-like or needle-like is expected to enhance depression of coloring for photothermographic materials. For example, a mixture of mixing $V_2O_3$ to a metal oxide, which contains $SnO_2$ as a main component and antimony oxide in an amount of about 5% by weight to 20% by weight, at a weight ratio of 1/50, increases the effect of depressing coloring photothermographic materials. In the invention, conductive metal oxides may be coated without a binder from a coating solution, however, taking account of adhesion with a polymer on a conductive layer, and peeling of metal oxides during production processes, conductive metal oxides are preferably coated with a binder. As a binder, all kind of polymers having a film forming property can be used. For examples, water-soluble binder, such as a gelatin, a dextran, a polyacrylamide, starch, and a polyvinyalkohol, may used. And, a synthetic polymer binder, such as a polymethacrylester, a polyvinylacetate, a polyurethane, a polychlorovinyl, a polycholorovinylidene, a styrene/butane copolymer, a polystyrene, a polyester, a polyethylene, a polyethyleneoxide, a polypropyrene, a polycarbonatepolyvinylbutylal may be used with organic solvents or these polymer binder may be used as a water dispersion. In this case, when conductive metal oxides are amorphous or spherical, a weight ratio of conductive metal oxide/binder is 99/1 to 10/90. Smaller weight ratio of a conductive metal oxides/binder, and high antistaticity give better results. In order to achieve small weight ratio of a conductive metal oxides/binder and high antistaticity, it is preferably designed to make phase separation by mixing two or more kinds of binders, or to adhere metal oxides each other with small quantity in a conductive layer by adding an additive such as a flocculant for metal oxides. A weight ratio of conductive metal oxide/binder is preferably 95/5 to 30/70, more preferably 90/10 to 50/50, and particularly preferably 85/15 to 60/40. And, when a conductive metal oxide is fiber-like and needle-like, the weight ratio is 80/20 to 0.1/99.9, preferably 70/30 to 1/90, more preferably 50/50 to 1/90, and particularly preferably 30/70 to 1/90.

In this description, the edge electrical resistance means a terminal electric resistance (O) of the photosensitive material. The edge electrical resistance is measured by the following methods. That is, cut the photosensitive material in a size of 1.5 cm×5 cm, immerse both side of the long ends in electric conductive paste "DOTITE" (Fujikura Kasei Co.) about 1 mm for 5 seconds, and then dry for 1 hour, and attach electrodes (diagonically). Thus prepared sample is set under 25° C. and 10% RH for two hours, and the resistance between electrodes is measured. Thus obtained resistance is multiplied with the length (5) wherein coated with DOTITE, divided by distance (1.5) between DOTITEs. The result is the edge electrical resistance. The electrical resistance (the edge electrical resistance) of the photothermographic material including conductive layers which contain conductive metal oxides of the invention is preferably low as possible, and is $10^{11}$Ω or less at 25° C. and 10% RH, preferably $10^{10}$Ω or less, and more preferably $10^9$Ω or less. When the electrical resistance is $10^{11}$Ω or less at 25° C. and 10% RH, troubles caused by light-sensitizing the image forming layer by discharge of a cumulated static charge before thermal development of photothermographic materials, which will cause spots and string pattern after development, or troubles of dusts invited by a cumulated static charge, may be avoided. In addition, transportation problems of photothermographic materials caused by static can be avoided.

2) Conductive Polymer

As a water-soluble conductive polymer according to the invention, polymers containg at least one conductive group selected from a sulfonic acid group, a sufonylester group, a quarterly ammonium salt, a tertialy ammonium salt, a carboxyl acid, and a polyethyleneoxide group. Among these groups, a sulfonic acid group, a sufonylester group and a quaternary ammonium salt are preferable. Conductive groups require 5% by weight or more conductive group per 1 mol of polymer.

Specific examples of the water-soluble conductive polymer are described below, however, the present invention is not limited thereto.

P-1

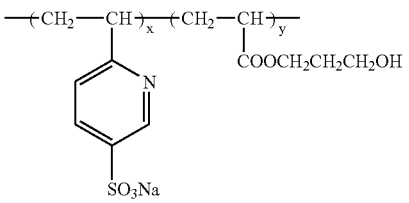

x:y = 70:30

$\bar{M}w \approx 20{,}000$

P-2

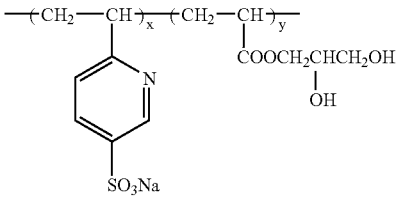

x:y = 70:30

$\bar{M}w \approx 700{,}000$

P-3

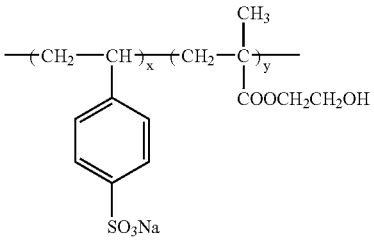

x:y = 70:30

$\bar{M}w \approx 10{,}000$

P-4

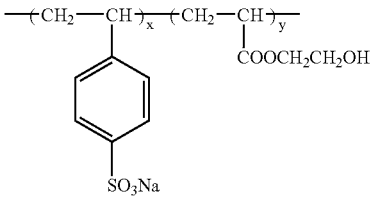

x:y = 70:30

$\bar{M}w \approx 5{,}000$

-continued

P-5

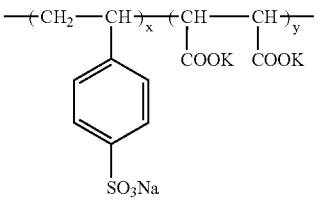

x:y = 70:30

$\bar{M}w \approx 6{,}000$

P-6

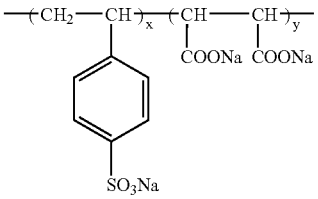

x:y = 650:35

$\bar{M}w \approx 120{,}000$

P-7

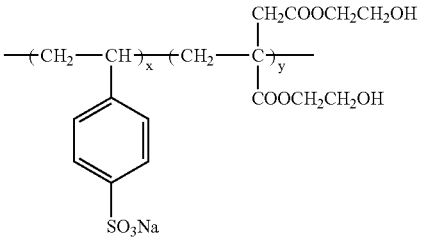

x:y = 98:2

$\bar{M}w \approx 200{,}000$

P-8

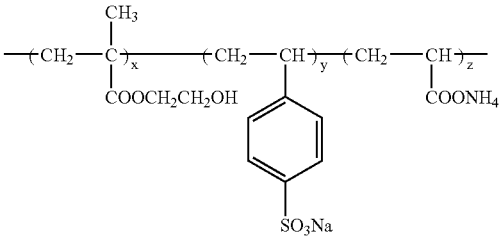

x:y = 40:30:1

$\bar{M}w \approx 750{,}000$

P-9

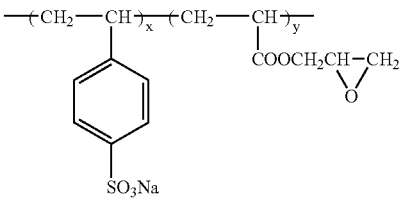

x:y = 70:30

$\bar{M}w \approx 20{,}000$

-continued
P-10
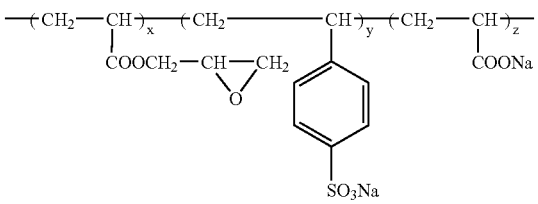
x:y:z = 85:13:2
$\bar{M}w \approx 800,000$
P-11
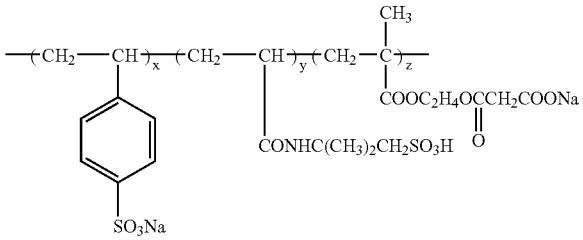
x:y:z = 85:13:2
$\bar{M}w \approx 900,000$
P-12
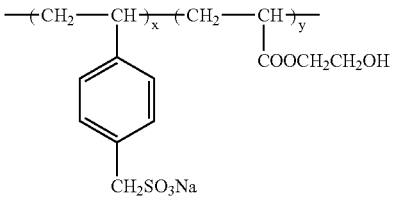
x:y = 80:20
$\bar{M}w \approx 1,000,000$
P-13
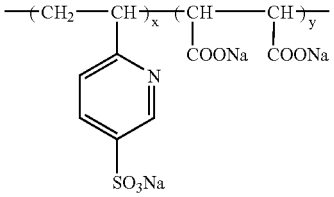
x:y = 80:20
$\bar{M}w \approx 10,000$
P-14
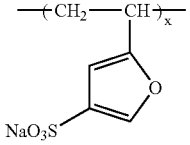
$\bar{M}w \approx 200,000$
P-15
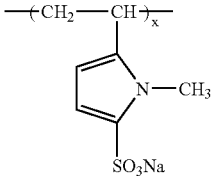
$\bar{M}w \approx 200,000$
-continued
P-16
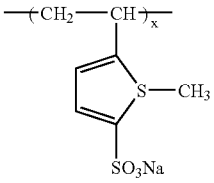
$\bar{M}w \approx 150,000$
P-17
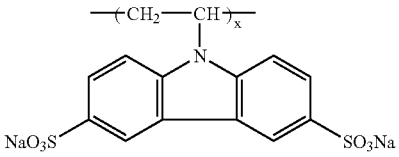
$\bar{M}w \approx 300,000$
P-18
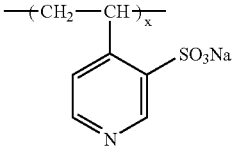
$\bar{M}w \approx 280,000$
P-19
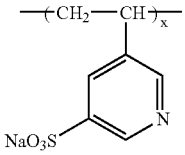
$\bar{M}w \approx 450,000$
P-20
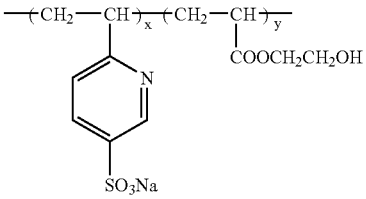
x:y = 60:40
$\bar{M}w \approx 800,000$
P-21
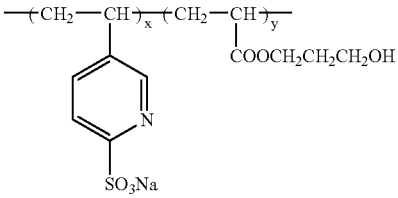
x:y = 70:30
$\bar{M}w \approx 650,000$
P-22
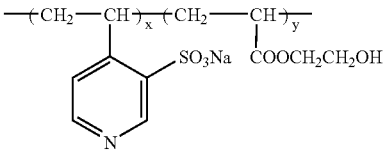
x:y = 80:20
$\bar{M}w \approx 500,000$ -continued
P-23
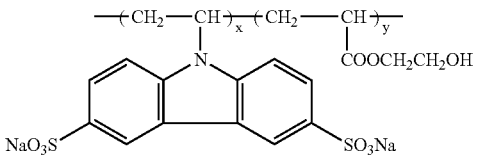
x:y = 75:25
$\bar{M}w \approx 400,000$
P-24
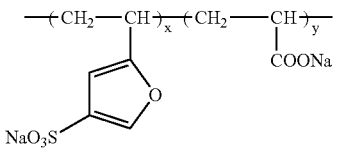
x:y = 80:20
$\bar{M}w \approx 600,000$
P-25
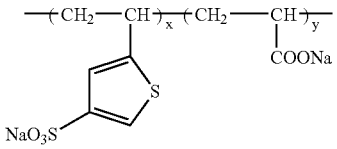
x:y = 90:10
$\bar{M}w \approx 400,000$
P-26
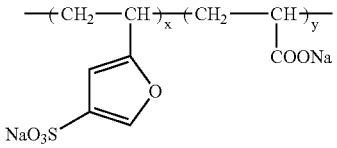
x:y = 55:45
$\bar{M}w \approx 320,000$
P-27
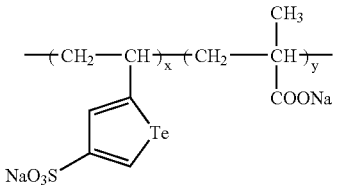
x:y = 90:10
$\bar{M}w \approx 600,000$
P-28
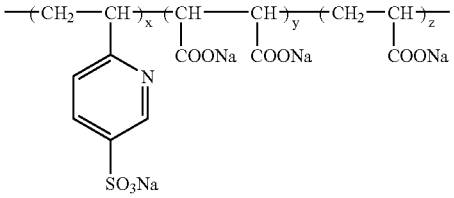
x:y:z = 80:10:10
$\bar{M}w \approx 800,000$
-continued
P-29
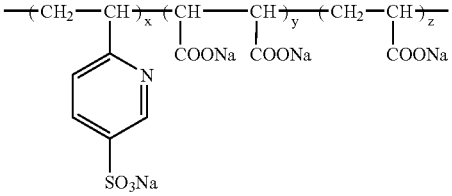
x:y:z = 70:30
$\bar{M}w \approx 10,000$
P-30
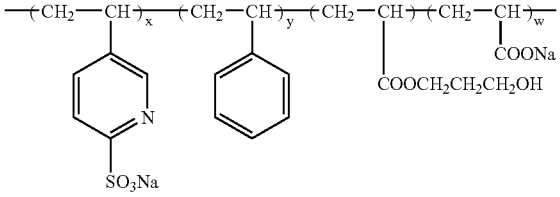
x:y:z:w = 60:30:8:2
$\bar{M}w \approx 800,000$
P-31
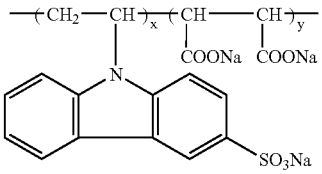
x:y = 60:40
$\bar{M}w \approx 30,000$
P-32
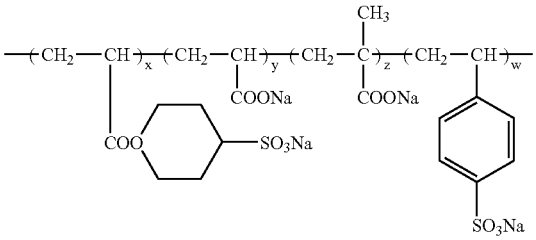
x:y:z:w = 40:30:20:10
$\bar{M}w \approx 500,000$
P-33
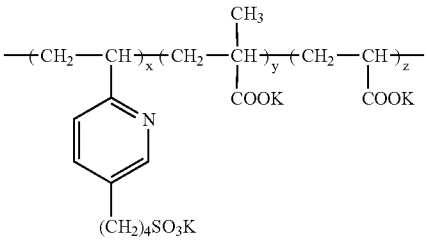
x:y:z = 60:30:10
$\bar{M}w \approx 300,000$ -continued

P-34

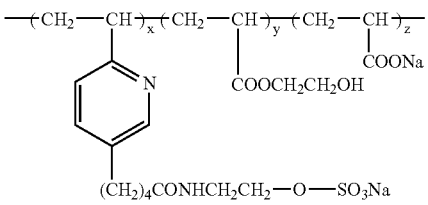

x:y:z = 40:30:30

$\bar{M}w \approx 500{,}000$

P-35

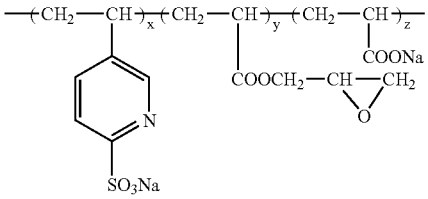

x:y:z = 55:35:10

$\bar{M}w \approx 300{,}000$

P-36

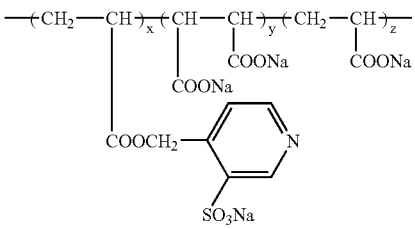

x:y:z = 50:30:20

$\bar{M}w \approx 600{,}000$

P-37

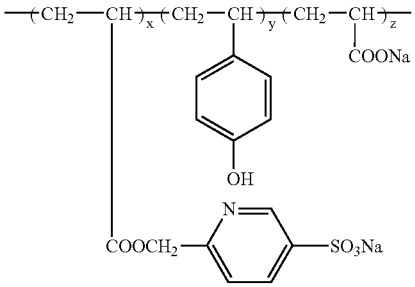

x:y:z = 60:30:10

$\bar{M}w \approx 600{,}000$

In the abovementioned P-1 to P-37, e, y and z represent a molar % of a monomer unit, and MW represents average molecular weight (in the present description, the average molecular weight means weight average molecular weight).

In the invention, the amount of conductive polymer included in the antistatic layer and in the conductive layer of the photothermographic material is preferably 0.001 g to 10 g per 1 $m^2$ on the basis of solid content, and particularly preferably 0.05 g to 5 g on the basis of solid content.

When conductive polymers are applied to a back layer, a backing protective layer or a image forming layer, the addition amount is preferably 0.01 g to 10 g on the basis of solid content.

Next, hydrophobic polymer particles according to the invention are described in detail below. Hydrophobic polymer particles included in a water-soluble conductive polymer layer are practically insoluble in water and contained as latex-like. These hydrophobic polymers are obtained through polymerization of freely assorted monomers from styrene, styrene derivatives, an alkyl methacrylate, olefine derivatives, halogenoethylene derivatives, acrylamodo derivatives, methacrylamide derivatives, vinyl ester derivatives, acrylonitrile, and the like. Particularly, styrene derivatives, where an alkyl methacrylate or alkylmethacrylate is contained at least 30% is preferable, and particularly preferably 50% or more.

In order to convert a hydrophobic polymer to latex-like, there are two methods, namely, emulsion polymerization and evaporation of solvent after solubilization of solid polymer in a low boiling solvent. From the viewpoints of fine particle size and uniformity, emulsion polymerization is preferable.

Surfactant used for the emulsion polymerization is preferably anionic or non-ionic. The amount of the surfactant used is preferably 10% by weight or less with respect to the monomer. Excess amount of surfactant makes conductive layer turbid. As for hydrophobic polymer, the molecular weight of 3000 or more is enough, and hardly influence on transparency.

Examples of hydrophobic polymer of the invention are described below.

L-1

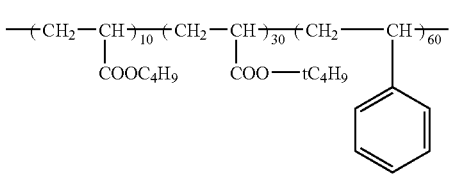

$\bar{M}w = 100{,}000$

L-2

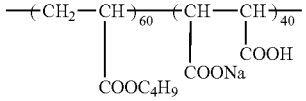

$\bar{M}w = 200{,}000$

L-3

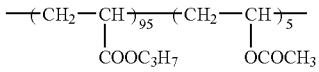

$\bar{M}w = 300{,}000$

L-4

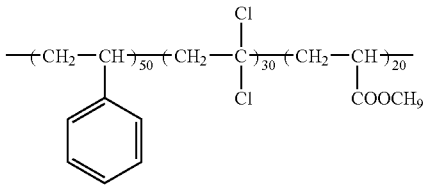

$\bar{M}w = 200{,}000$

L-5

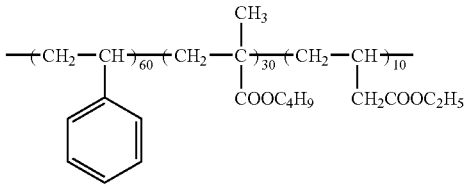

$\bar{M}w = 300{,}000$

-continued

L-6

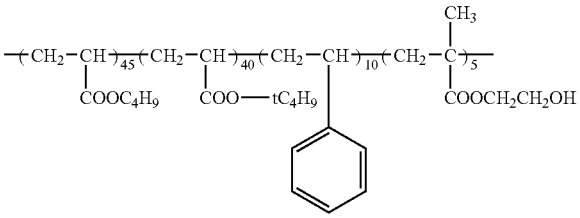

$\bar{M}w = 500,000$

L-7

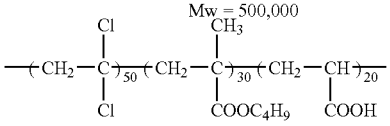

$\bar{M}w = 200,000$

L-8

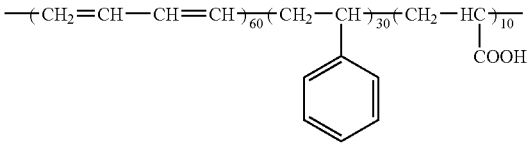

$\bar{M}w = 600,000$

L-9

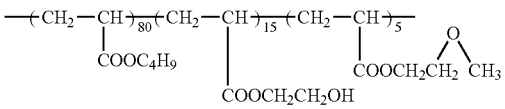

$\bar{M}w = 150,000$

The addition amount of hydrophobic polymer is 5% by weight to 60% by weight, and preferably 10% by weight to 40% by weight with respect to the water-soluble conductive polymer.

Next, hardners used in the invention are described below.

In the invention, various hardners as described below can be used.

A block isocyanate type, a multifunction aziridine type, an α-cyanoacrylate type, an epoxy type, and preferably, bifunctional ethylenoxide type containing triphenyl phosphine and an N-methylol type which is hardened by irradiation of an electron beam or an X-ray, a metal complex containg zinc and zirconium, a silane coupling agent, and an active carboxy type.

These hardners are explained below.

There is no limitation in block isocyanate hardners of the invention as far as the block isocyanate hardner releases isocyanate by heating, however the following compounds are preferably described as specific examples.

1-1

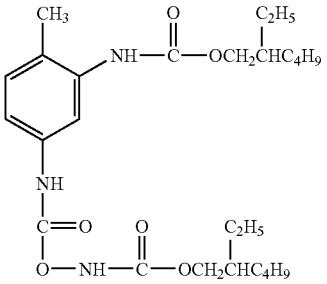

-continued 1-2

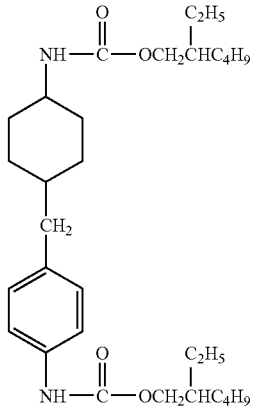

1-3

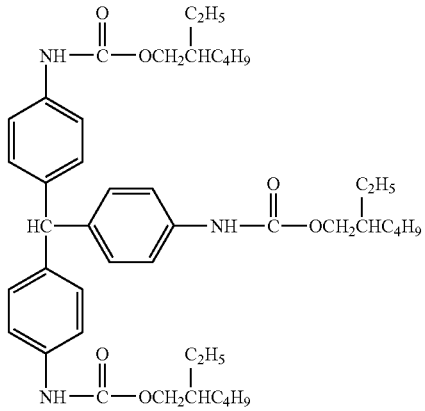

1-4

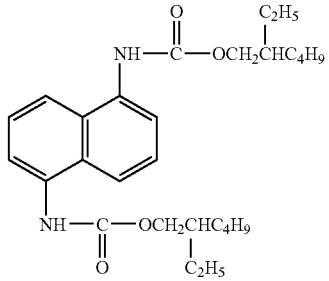

1-5

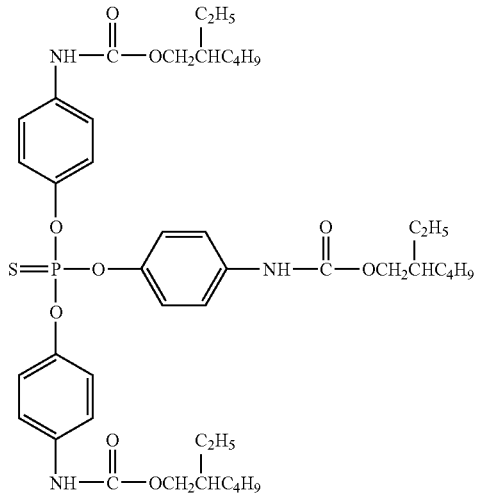

-continued 1-6

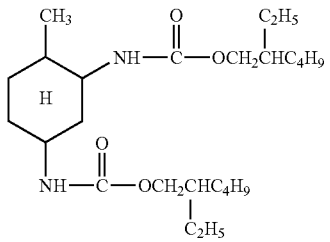

1-7

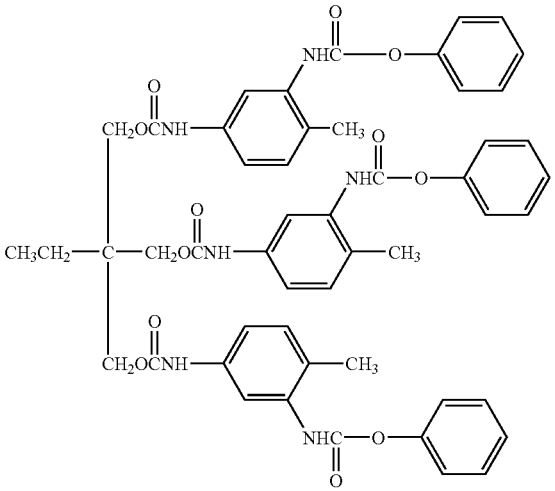

1-8

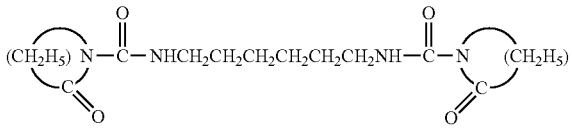

The above-mentioned compounds may be added as a solution of water or organic solvent such as alcohol, acetone or the like, or as a dispersion which is dispersed using surfactant such as a salt of dodecylbenzenesulfonic acid or nonylphenoxyalkyleneoxide. Preferable addition amount is 1 mg/m$^2$ to 1000 mg/m$^2$.

Multifunctional aziridine hardners used in the invention are represented by the following formula.

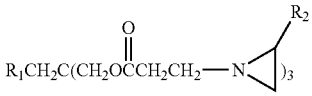

$R_1$ represents one selected from a hydrogen atom, an alkyl group having 20 or less carbon atoms, an aryl group having 20 or less carbon atoms, a hydroxyl group and a halogen atom. $R_2$ represents one selected from a hydrogen atom and an alkyl group having 10 or less carbon atoms.

Followings are preferably used, but the invention is not limited in these.

2-1

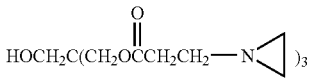

2-2

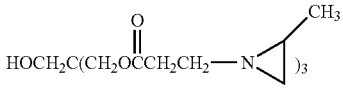

2-3

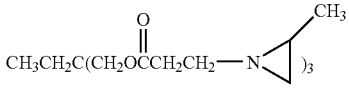

2-4

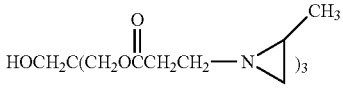

2-5

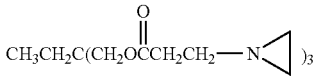

2-6

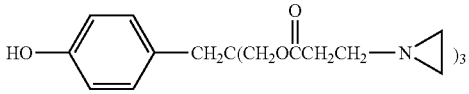

2-7

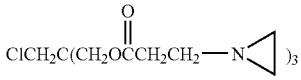

α-cyanoacrylate compounds used in the invention are represented by the following formula.

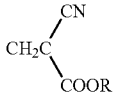

(In the formula, R represents a substituted or unsubstituted alkyl group having 1 to 12 carbon atoms.)

Examples are shown below, however the invention is not limited in these.

3-1

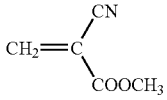

3-2

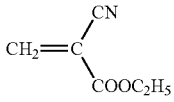

3-3

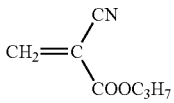

3-4

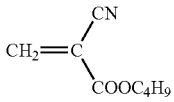

-continued
3-5
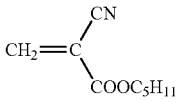
3-6
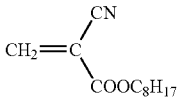
3-7
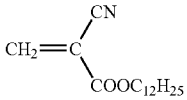
-continued
3-8
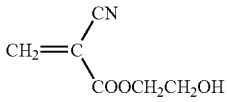
3-9
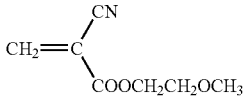
3-10
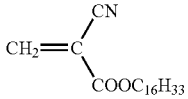
Hardner containing an epoxy group which is used in the invention is not limited, but the compounds shown below are preferably used as specific examples.
4-1
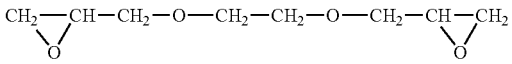
4-2
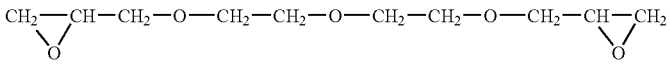
4-3
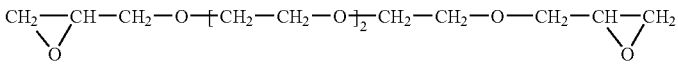
4-4
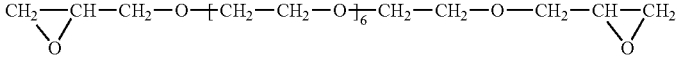
4-5
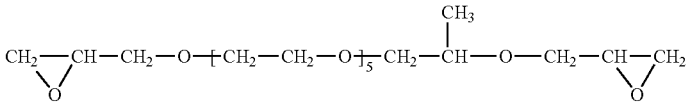
4-6
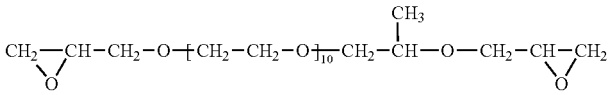
4-7
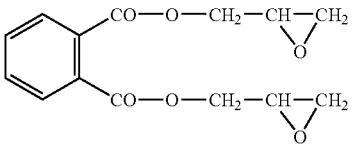
4-8
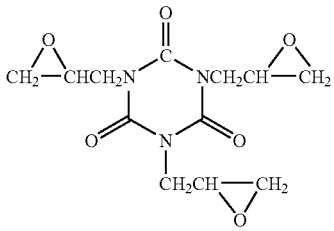
4-9
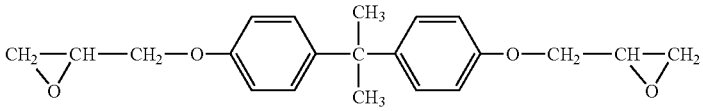

-continued
4-10
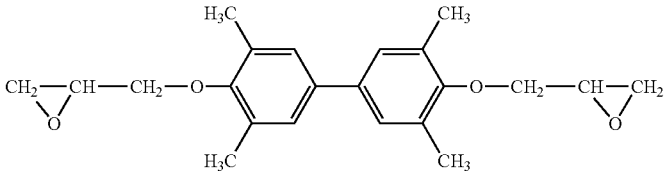
4-11
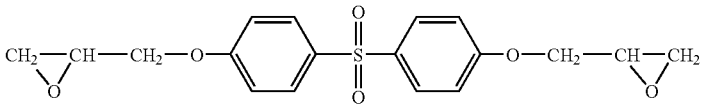
4-12
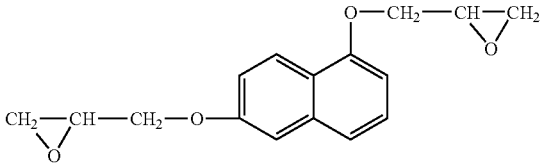
4-13
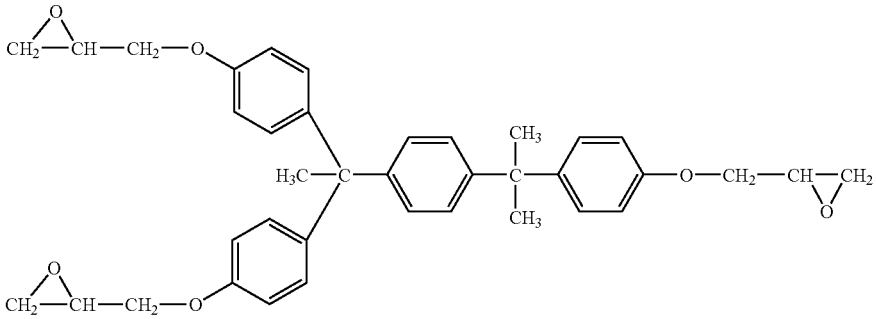
4-14
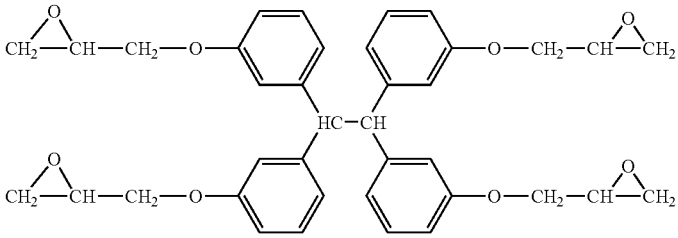
4-15
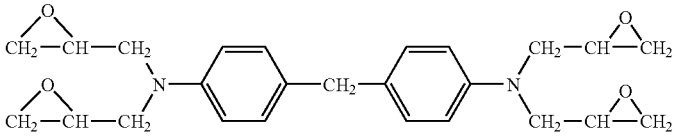
4-16
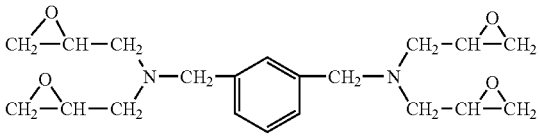
4-17
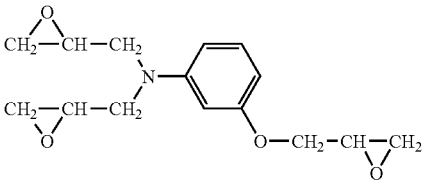
4-18
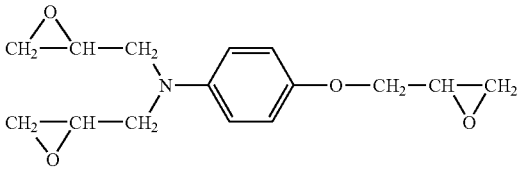

Most of the above-mentioned compounds are commercially available. The above-mentioned compounds may be added as a solution of water or an organic solvent such as alcohol, acetone or the like, or as dispersion which is dispersed using a surfactant such as a salt of dodecylbenzenesulfonic acid or nonylphenoxyalkyleneoxide. Preferable addition amount is 1 mg/m$^2$ to 1000 mg/m$^2$.

The combined use of above-mentioned crosslinking agents and triphenylphosphines represented by the following formula may further enhance the efficiency.

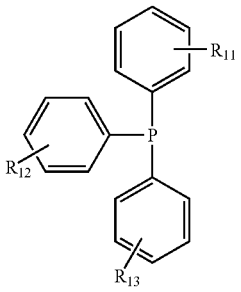

(In the formula, $R_{11}$ to $R_{13}$ each independently represent one selected from a substituted or unsubstituted alkyl group, a hydrogen atom, a halogen atom, a nitro group, a cyano group, a hydroxyl group, and an alkoxy group).

Triphenylphosphines are not limited, however, compounds presented below are preferably used.

4a-1

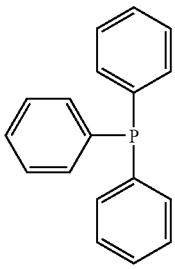

4a-2

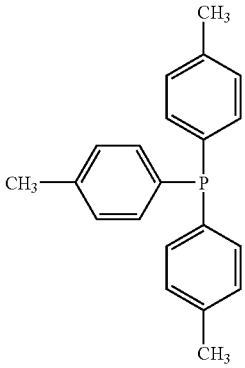

-continued 4a-3

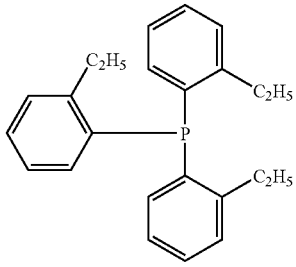

4a-4

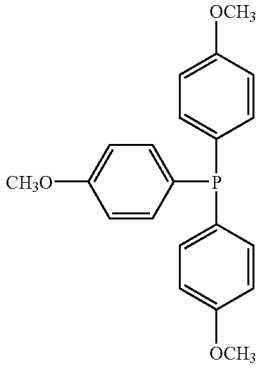

4a-5

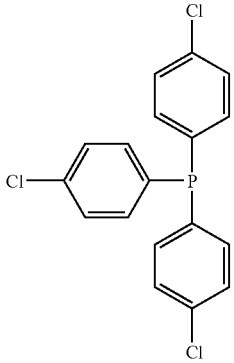

Bifunctional ethyleneoxide compounds used in the invention are represented by the formula below.

$$CH_2{=}CH{-}L{-}CH{=}CH_2$$

(In the formula, L represents a substituted or unsubstituted alkyleneoxide chain group.)

Specific examples are described below, however, the invention is not limited thereto.

5-1

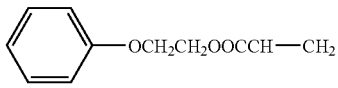

5-2

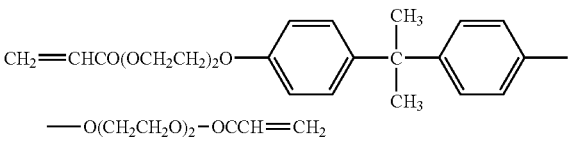

5-3

$$CH_2{=}CHCO(OCH_2CH_2)_4OOCCH{=}CH_2$$

-continued 5-4 $CH_2{=}CHCO(OCH_2CH_2)_9OOCCH{=}CH_2$ 5-5 $CH_3CH_2C{-}(CH_2OOCCH{=}CH_2)_3$ 5-6 $CH_3CH_2C{-}CH_2OCH_2CH_2OOCCH{=}CH_2)_3$ 5-7 $CH_2{=}C(CH_3)CO(OCH_2CH_2)_{23}OOC(CH_3){=}CH_2$ 5-8 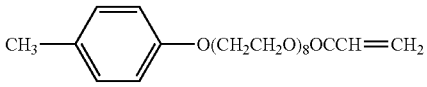

5-9 $CH_2{=}CHCOO(CH_2CH_2O)_3(CH_2CH(CH_3)O)_2{-}{-}(CH_2CH_2O)_4OCCH{=}CH_2$ 5-10 $CH_3CH_2{-}(CH_2OOCC(CH_3){=}CH_2)_3$

Conventionally, crosslinking to harden a bifunctional ethylene oxide compound has been carried out by a heating method, however, this reaction is slow and insufficient. This invention characterizes to use an electron beam or an X-ray irradiation for hardening.

Intensities of electron beam and X-ray required for hardening are described below.

Intensity of electron beam: $10^{-2}$ KW/m$^2$ to $10^6$ KW/m$^2$ (particularly preferably, 50 KW/m$^2$.)

Intensity of X-ray: $10^{-2}$ KW/m$^2$ to $10^6$ KW/m$^2$ (particularly preferably, 300 KW/m$^2$.)

Next, specific examples of N-methylole compounds used in the invention are shown below, however, the invention is not limited thereto.

6-1 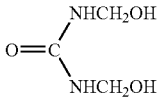

6-2 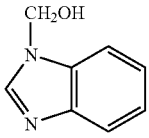

6-3 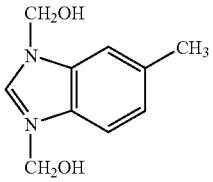

6-4 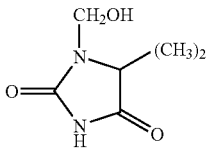

-continued 6-5 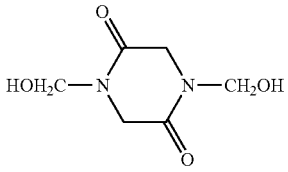

Specific examples of metal complex containg zinc or ziruconium metal which is used in the invention are presented below, however, the invention is not limited thereto.

7-1 $Zn(NH_3)_4(CH_3COO)_2$ 7-2 $Zn(NH_3)_4CO_3$ 7-3 $(NH_4)_3ZnOH(CO_3)_3$

The addition amount of the above-mentioned metal complex is preferably $10^{-3}$ mol to $10^3$ mol per 1 mol of the conductive polymer.

Conventionally, organic crosslinking agents have been mainly used, however, the use of metal oxides of this invention provides a sufficient crosslinking.

In the present invention, silane coupling agents shown below can be used also as a hardener.

8-1 $H_2NCH_2CH_2NHCH_2CH_2CH_2Si(OCH_3)_2$ 8-2 $CH_2{-}CH{-}CH_2OCH_2CH_2CH_2Si(OCH_3)_3$ (epoxide)

8-3 $CH_2{=}CH{-}Si(OCH_3)_3$

In the invention, an active carboxyl group type hardner is also used. Examples include a carbodiimido type presented below.

9-1 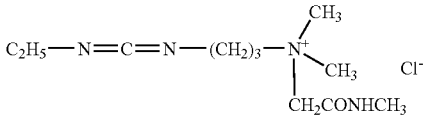

9-2 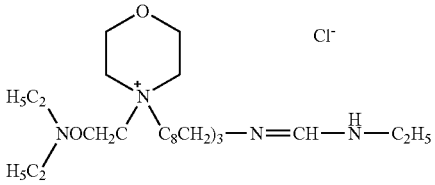

Among the above-mentioned hardeners, a multifunctional aziridine type or an epoxy type is preferably used in the present invention.

In the invention, an organic conductive polymer in a conductive layer is a compound in which a sulfonic acid group or a salt thereof links, directly or through divalent linking group, to an aromatic ring or a heterocycle. The molecular weight of the compound is in a range from 100 to 10,000,000, and particularly preferably 10,000 to 500,000. These polymers can be easily synthesized through polymerization of monomers which are commercially available or obtained through known methods.

Conductivity of the conductive polymers of the invention has a characteristic that resistivity of a surface, which is obtained by coating the conductive polymer singly on a polyethylene terephthalate film by 2 g/m$^2$ or more, is $10^{10}$ Ω·cm or less (23° C. and 20% RH).

3) Surfactant

As a surfactant, an anionic surfactant, a cationic surfactant, a nonionic surfactant, and a betaine surfactant are preferable. Anionic surfactants used preferably in the invention are represented by the following formulae (I) to (VI).

Formula (I)

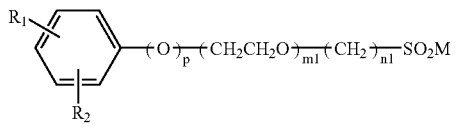

(In the formula, $R_1$ and $R_2$ each independently represent an alkyl group having 1 to 18 carbon atoms, and M represents one of a hydrogen atom and a cation. $m_1$ represent an integer of 0 to 50, and $n_1$ represents an integer of 0 to 4. p represents 0 or 1.)

Formula (II)

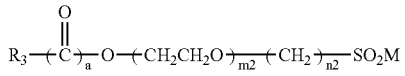

(In the formula, $R_3$ represents one of an alkyl group having 6 to 20 carbon atoms and an alkenyl group having 6 to 20 carbon atoms, and M represents on selected from a hydrogen atom and a cation. $m_2$ represent an integer of 0 to 50, and $n_2$ represents an integer of 0 to 4. a represents 0 or 1.)

Formula (III)

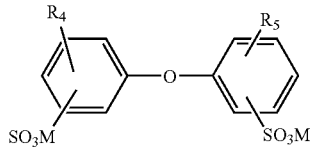

(In the formula, $R_4$ and $R_5$ each independently represent an alkyl group having 6 to 18 carbon atoms, and M represents one selected from a hydrogen atom and a cation.)

Formula (IV)

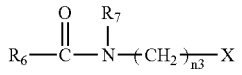

(In the formula, $R_6$ represents an alkyl group having 6 to 20 carbon atoms, $R_7$ represents an alkyl group having 1 to 4 carbon atoms. X represents one selected from —COOM and —$SO_3$M. M represents one selected from a hydrogen atom and a cation. $n_3$ represents an integer of 1 to 4.)

Formula (V)

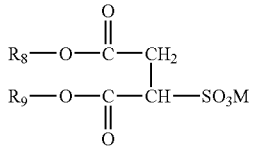

(In the formula, $R_8$ and $R_9$ each independently represent an alkyl group having 6 to 20 carbon atoms, and M represents one selected from a hydrogen atom and a cation.)

Formula (VI)

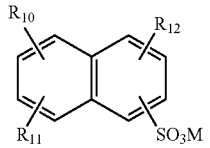

(In the formula, $R_{10}$, $R_{11}$, and $R_{12}$ each independently represent an alkyl group having 1 to 16 carbon atoms, and M represents one selected from a hydrogen atom and a cation.).

As an alkyl group having 1 to 18 carbon atoms represented by $R_1$ and $R_2$, for example, a methyl group, an ethyl group, a butyl group, an octyl group, a decyl group, a dodecyl group, an octadecyl group and the like can be described.

As an alkyl group having 6 to 20 carbon atoms represented by $R_3$, $R_6$, and $R_8$, for example, a hexyl group, a heptyl group, an octyl group, a dodecyl group, an octadecyl group, an eycocyl group, and the like can be described.

As an alkyl group having 6 to 18 carbon atoms represented by $R_4$, $R_5$, and $R_8$, for example, a hexyl group, a heptyl group, a dodecyl group, a pentadecyl group, an octadecyl group, and the like can be described.

As an alkyl group having 1 to 4 carbon atoms represented by $R_4$, for example, a methyl group, an ethyl group, a butyl group, and the like can be described.

As an alkyl group having 1 to 16 carbon atoms represented by $R_{10}$, $R_{11}$, and $R_{12}$, for example, a methyl group, an ethyl group, a butyl group, a decyl group, a dodecyl group, a hexadecyl group, and the like can be described.

The alkyl groups represented by $R_1$ to $R_{12}$ include the alkyl group having a substituent. In this case, the subsutituents are not included in the number of carbon atoms.

Specific examples are described below, however, the invention is not limited thereto.

a-1

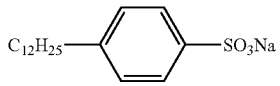

a-2

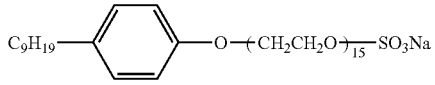

-continued a-3

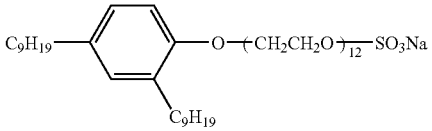

a-4

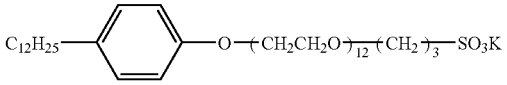

a-5

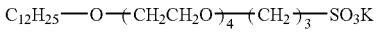

a-6

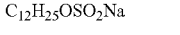

a-7

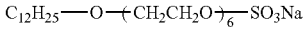

a-8

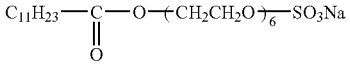

a-9

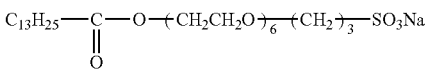

a-10

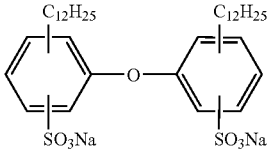

a-11

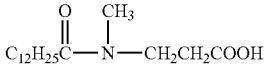

a-12

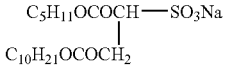

a-13

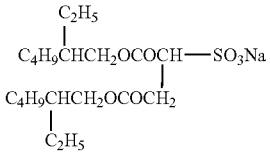

As nonionic surfactants preferably used in the invention, compounds represent by the following formulae (N-I), (N-II), and (N-III) can be described.

Formula (N-I)

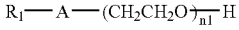

Formula (N-II)

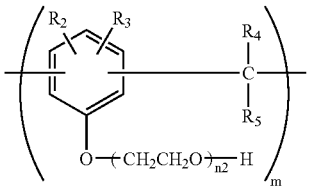

-continued

Formula (N-III)

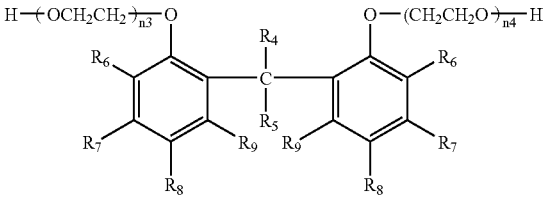

In the formulae, $R_1$ represents a hydrogen atom, or one of the following groups having 1 to 30 carbon atoms, namely, that is an alkyl group, an alkenyl group, and an aryl group, each of which may have a substituent. $R_1$ is preferably one of the following groups having 4 to 24 carbon atoms, namely, those are an alkyl group, an alkenyl group or an aryl group, and particularly preferably one of a hexyl group, a dodecyl group, an isostearyl group, an oleoyl group, a t-butylphenyl group, a 2,4-di-t-butylphenyl group, a 2,4-di-t-pentylphenyl group, a p-dodecylphenylgroup, a m-pentadecaphenyl group, a t-octylphenyl group, a 2,4-di-nonylphenyl group, an octylnaphtyl group, and the like.

A represents one selected from —O—, —S—, —COO—, —CO—, >N—$R_{10}$, —CO— ($R_{10}$)N—, and —$SO_2$— ($R_{10}$)N— (wherein $R_{10}$ is one of a hydrogen atom, or a substituted or unsubstituted alkyl group.). $R_2$, $R_3$, $R_7$, and $R_9$ each independently represent one selected from a hydrogen atom, an alkyl group, an aryl group, an alkoxy group, an aryloxy group, a halogen atom, an acyl group, an amide group, a sulfonamide group, a carbamoyl group, and a sulfamoyl group, each of which may have a substituent. $R_6$ and $R_8$ each independently represent one selected from an alkyl group, an aryl group, an alkoxy group, an aryloxy group, a halogen atom, an acyl group, an amide group, a sulfonamide group, a carbamoyl group, and a sulfamoyl group, each of which may have a substituent.

$R_6$ and $R_8$ are preferably the following groups having 1 to 20 carbon atoms, namely, those are an alkyl group, an aryl group such as a phenyl group, a p-chlorophenyl group or the like, an alkoxy group represented by —$OR_{15}$ (wherein $R_{15}$ represents one of an an alkyl group having 1 to 20 carbon atoms and an aryl group having 1 to 20 carbon atoms, each of which may have a substituent), an aryloxy group, a halogen atom such as a chlorine atom, a bromine atom and the like, an acyl group represented by —$COR_{15}$, an amide group represented by —$NR_{16}COR_{15}$ (wherein $R_{16}$ represents a hydrogen atom or an alkyl group having 1 to 20 carbon atoms), a sulfonamide represented by —$NR_{16}SO_2R_{15}$, a carbamoyl group represented by —$CONR_{16}R_{16}$, or a sulfamoyl group represented by —$SO_2NR_{16}R_{16}$. Among these, $R_6$ and $R_8$ are more preferably an alkyl group or a halogen atom, and most preferably a tertiary alkyl group such as a t-butyl group, a t-amyl group or a t-octyl group.

$R_2$, $R_3$, $R_7$, and $R_9$ are preferably a hydrogen atom or the groups mentioned in $R_6$ and $R_8$ as a preferable group. Among these, $R_7$ and $R_9$ are particularly preferably a hydrogen atom.

$R_4$ and $R_5$ each independently represent one selected from a hydrogen atom, an alkyl group, and an aryl group, each of which may have a substituent. $R_4$ and $R_5$ are particularly preferably a hydrogen atom, an alkyl group having 1 to 8 carbon atoms, a phenyl group, a furyl group, or the like.

$R_4$ and $R_5$, $R_6$ and $R_7$, and $R_8$ and $R_9$ may link each other to form a ring, for example, a cyclohexyl ring. Further, in formula (N-I), substituents at left and right sides on the phenyl ring may be unsymmetrical.

$n_1$, $n_2$, $n_3$, and $n_4$ are the number of average ethylenoxide addition mole, which are preferably 2 to 50, and more preferably 5 to 30. $n_3$ and $n_4$ may be the same or different. m is an integer of 2 to 50.

These compounds are described, for example, in U.S. Pat. Nos. 2,982,651, 3,428,456, 3,457,076, 3,454,625, 3,552,972, and 3,655,387, JP-B No. 51-9610, JP-A Nos. 53-29715, 54-89626, 57-85764, 57-90909, and "SHIN KAIMEN KASSEIZAI (The New Surfactant)" by Hiroshi Horiguchi, Sankyo Shuppan (1955).

Specific examples of nonionic surfactant preferably used in the present invention are shown below.

N-1

$HO-(CH_2CH_2O)_{10}-H$

N-2

$C_{17}H_{33}COO-(CH_2CH_2O)_{15}-H$

N-3

$C_{12}H_{25}O-(CH_2CH_2O)_{10}-H$

N-4

$C_{18}H_{35}O-(CH_2CH_2O)_{16}-H$

N-5

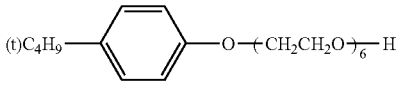

N-6

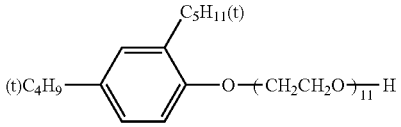

N-7

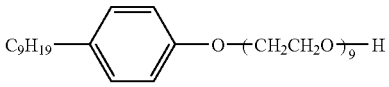

N-8

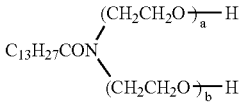

a + b = 15

N-9

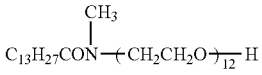

N-10

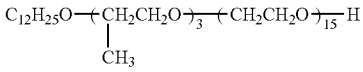

N-11

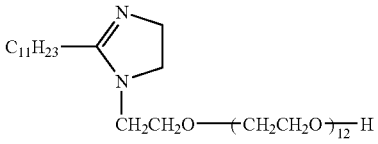

N-12

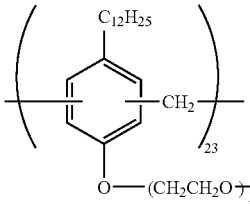

-continued

N-13

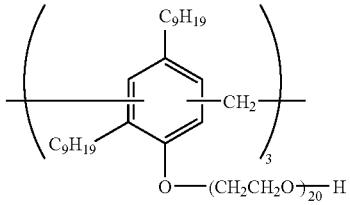

N-14

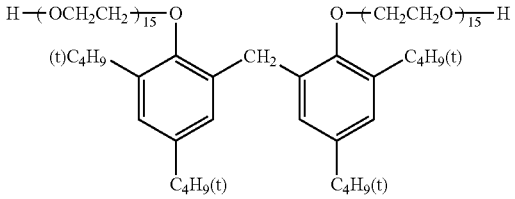

N-15

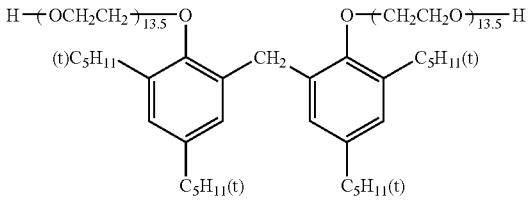

Cationic surfactants preferably used in the invention are the compounds represented by formula (C-I) or (C-II).

Formula (C-I)

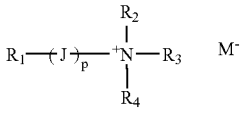

Formula (C-II)

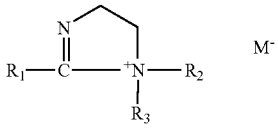

In the formula, $R_1$, $R_2$, $R_3$, and $R_4$ each independently represent one selected from an alkyl group, an alkenyl group, an alkylaryl group, and an arylalkyl group, those having 1 to 22 carbon atoms. $M^-$ represents an anion. The group represented by $R_1$ to $R_4$ may be substituted by a hydroxy group. J represents $—C(=O)—NH—(CH_2)_m—$, wherein m represents an integer of 1 to 5, and p represents an integer of 0 or 1.

Specific examples of cationic surfactant preferably used in the present invention are shown below.

C-1

$C_8H_{17}N^+(CH_3)_3$ $Cl^-$

C-2

$C_{12}H_{25}N^+(CH_3)_3$ $Cl^-$

C-3

$C_{18}H_{37}N^+(CH_3)_3$ $Cl^-$

-continued

C-4

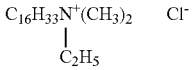

C-5

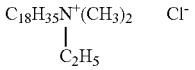

C-6

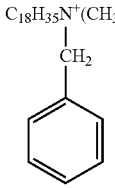

C-7

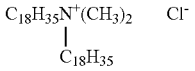

C-8

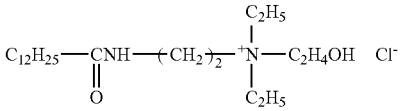

C-9

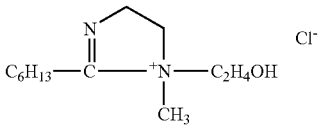

As betaine surfactants preferably used in the invention, compounds represented by formula (B-I) or (B-II) can be described.

Formula (B-I)

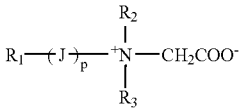

Formula (B-II)

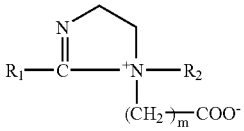

In the formula, $R_1$ to $R_3$ each independently represent one selected from an alkyl group, an alkenyl group, and an alkylaryl group, those having 1 to 22 carbon atoms. The group represented by $R_1$ to $R_3$ may be substituted by a hydroxy group. J represents —C(═O)—NH—$(CH_2)_n$—, wherein n represents an integer of 0 to 5, p represents an integer of 0 or 1, and m represents an integer of 1 to 5.

Specific examples of betaine surfactant preferably used in the present invention are shown below.

B-1

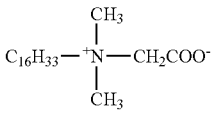

-continued

B-2

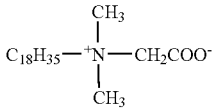

B-3

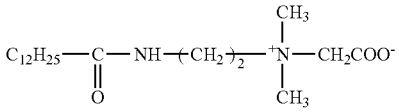

B-4

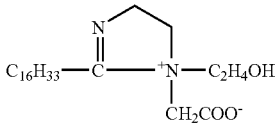

(Fluorocarbon Compound)

It is preferred that the photothermographic material of the present invention contains a fluorocarbon compound having a fluoroalkyl group which has 2 or more carbon atoms and 12 or less fluorine atoms. The fluorocarbon compound in the present invention can be used as a surfactant.

The fluorocarbon compound used in the present invention can have any structure, as far as it has a fluoroalkyl group described above (after now, fluorine substituted alkyl group is called as "Rf"). And the fluorocarbon compound may have at least one or more Rf, and can have two or more Rfs. The fluorocarbon having two or more Rfs is preferred.

As specific examples of Rf, the following compounds can be described, but Rf is not limited thereto.

—$C_2F_5$ group, —$C_3F_7$ group, —$C_4F_9$ group, —$C_5F_{11}$ group, —$CH_2$—$C_4F_9$ group, —$C_4F_8$—H group, —$C_2H_4$—$C_4F_9$ group, $C_4H_8$—$C_4F_9$ group, —$C_6H_{12}$—$C_4F_9$ group, —$C_8H_{16}$—$C_4F_9$ group, —$C_4H_8$—$C_2F_5$ group, —$C_4H_8$—$C_3F_7$ group, —$C_4H_8$—$C_5F_{11}$ group, —$C_8H_{16}$—$C_2F_5$ group, —$C_2H_4$—$C_4F_8$—H group, —$C_4H_8$—$C_4F_8$—H group, $C_6H_{12}$—$C_4F_8$—H group, —$C_6H_{12}$—$C_2F_4$—H group, —$C_8H_{16}$—$C_2F_4$—H group, —$C_2H_4$—$C_4F_8$—H group, —$C_4H_8$—$C_4F_8$—H group, —$C_6H_{12}$——$C_4F_8$—H group, —$C_6H_{12}$—$C_2F_4$—H group, —$C_8H_{16}$—$C_2F_4$—H group, —$C_6H_{12}$—$C_4F_8$—$CH_3$ group, —$C_2H_4$—$C_3F_7$ group, —$C_2H_4$—$C_5F_{11}$ group, —$C_4H_8$—CF $(CF_3)_2$ group, —$CH_2CF_3$ group, —$C_4H_8$—$CH(C_2F_5)$ group, —$C_4H_8$—$CH(CF_3)_2$ group, —$C_4H_8$—$C(CF_3)_3$ group, —$CH_2$—$C_4F_8$—H group, —$CH_2$—$C_6F_{12}$—H group Rf has 12 or less fluorine atoms, preferably 3 to 11 fluorine atoms, and more preferably 5 to 9 fluorine atoms. And Rf has 2 or more carbon atoms, preferably 4 to 16 carbon atoms, and more preferably 5 to 12 carbon atoms.

The structure of Rf is not particularly limited as far as Rf has 2 or more carbon atoms and 12 or less fluorine atoms, however, the group represented by the following formula (A) is preferred.

$-L^{03}-L^{04}-W$ Formula (A)

In formula (A), $L^{03}$ represents an alkylene group having 1 to 4 carbon atoms, preferably 1 to 3 carbon atoms, and more preferably 1 to 2 carbon atoms. An alkylene group represented by $L^{03}$ may be a linear or a branched chain.

$L^{04}$ represents a perfluoroalkylene group having 2 to 6 carbon atoms, and preferably 2 to 4 carbon atoms. Herein, the perfluoroalkylene group means an alkylene group where all hydrogen atoms of an alkylene group are replaced by fluorine atoms. The perfluoroalkylene group described above may be a linear or a branched chain, or a cyclic structure.

W represents one selected from a hydrogen atom, a fluorine atom and an alkyl group, preferably one of a hydrogen atom and a fluorine atom, and most preferably a fluorine atom.

The fluorocarbon compound in the present invention can have a cationic hydrophilic group. The cationic hydrophilic group means the group which becomes an anion when it is dissolved in water. As specific examples, tertiary ammonium, alkyl pyridium, alkyl imidazolium, primary to thirdly aliphatic amines and the like are described.

As a cation, an organic cationic substituent is preferably and an organic cationic group containing a nitrogen atom or a phosphorous atom is more preferred. And a pyridinium cation or an ammonium cation is further preferred.

A salt forming anion may be any of an inorganic anion or an organic anion. As an inorganic anion, iodide ion, bromide ion, chloride ion and the like are described. As an organic anion, p-toluenesulfonic acid ion, p-toluenesulfonate ion, benzenesulfonate ion, methanesulfonate ion, trifluoromethanesulfoate ion and the like are described.

In the present invention, the preferred cationic fluorocarbon compound is represented by the following formula (1).

Formula (1)

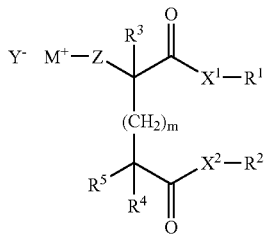

In formula (1), $R^1$ and $R^2$ each represent a substituted or unsubstituted alkyl group, however, at least one of $R^1$ and $R^2$ is a fluoroalkyl group (Rf) described above. It is preferred that both of $R^1$ and $R^2$ are Rf. $R^3$, $R^4$ and $R^5$ each independently represent one selected from a hydrogen atom and a substituent. $X^1$, $X^2$ and Z each independently represent one selected from a divalent linking group and a single bond. $M^-$ represents a cationic substituent. $Y^-$ represents a counter anion, however, when the charge results in 0 in a molecule, $Y^-$ is not necessary. m represents 0 or 1.

In formula (1) described above, when $R^1$ and $R^2$ each represents a substituted or unsubstituted alkyl group except Rf, above alkyl group has one or more carbon atoms and may be any of a linear, a branched chain or a cyclic structure. Above substituent can include, a halogen atom except fluorine, an alkenyl group, an aryl group, an alkoxyl group, a carboxylate group, a carbonamide group, a carbamoyl group, an oxycarbonyl group, a phosphate group and the like.

In the case where $R^1$ and $R^2$ each represents an alkyl group except Rf, namely an alkyl group not substituted by fluorine atom, the alkyl group is a substituted or unsubstituted alkyl group having 1 to 24 carbon atoms, more preferably a substituted or unsubstituted alkyl group having 6 to 24 carbon atoms. As preferable examples of the unsubstituted alkyl group having 6 to 24 carbon atoms, a n-hexyl group, a n-heptyl group, a n-octyl group, a tert-octyl group, a 2-ethylhexyl group, a n-nonyl group, a 1,1,3-trimethylhexyl group, a n-decyl group, a n-dodecyl group, a cetyl group, a hexadecyl group, a 2-hexyldecyl group, a octadecyl group, a eicosyl group, a 2-octyldodecyl group, a docosyl group, a tetracosyl group, a 2-decyltetradecyl group, a tricosyl group, a cyclohexyl group, a cycloheptyl group and the like are described. And as preferable examples of substituted alkyl group having 6 to 24 carbon atoms in total, a 2-hexenyl group, a oleyl group, a linoleyl group, a linolenyl group, a benzyl group, a β-phenethyl group, a 2-methoxyethyl group, a 4-phenylbutyl group, a 4-acetoxyethyl group, a 6-phenoxyhexyl group, a 12-phenyldodecyl group, a 18-phenyloctadecyl group, a 12-(p-chlorophenyl)dodecyl group, a 2-(diphenyl phosphate)ethyl group and the like are described.

As the alkyl group, except Rf, represented by $R^1$ and $R^2$, a substituted or unsubstituted alkyl group having 6 to 18 carbon atoms is more preferred. As preferable examples of the unsubstituted alkyl group having 6 to 18 carbon atoms, a n-hexyl group, cyclohexyl group, a n-heptyl group, a n-octyl group, a 2-ethylhexyl group, a n-nonyl group, a 1,1,3-trimethylhexyl group, a n-decyl group, a n-dodecyl group, a cetyl group, hexadecyl group, a 2-hexyldecyl group, an octadecyl group, a 4-tert-butylcyclohexyl group and the like are described. And as preferable examples of substituted alkyl group having 6 to 18 carbon atoms in total, a phenethyl group, a 6-phenoxyhexyl group, a 12-phenyldodecyl group, an oleyl group, a linoleyl group, a linolenyl group and the like are described.

As the alkyl group, except Rf, represented by $R^1$ and $R^2$, a n-hexyl group, a cyclohexyl group, a n-heptyl group, a n-octyl group, a 2-ethylhexyl group, a n-nonyl group, a 1,1,3-trimethylhexyl group, a n-decyl group, a n-dodecyl group, a cetyl group, a hexadecyl group, a 2-hexyldecyl group, an octadecyl group, an oleyl group, a linoleyl group and a linolenyl group is especially preferred. The unsubstituted linear, cyclic or branched alkyl group having 8 to 16 carbon atoms is most preferred.

In formula (1) described above, $R^3$, $R^4$ and $R^5$ each independently represents one selected from a hydrogen atom and a substituent. As the examples of the said substituent, an alkyl group (preferably an alkyl group having 1 to 20 carbon atoms, more preferably an alkyl group having 1 to 12 carbon atoms, especially preferably an alkyl group having 1 to 8 carbon atoms, e.g., a methyl group, an ethyl group, an isopropyl group, a tert-butyl group, a n-octyl group, a n-decyl group, a n-hexadecyl group, a cyclopropyl group, a cyclopentyl group, a cyclohexyl group and the like are described.), an alkenyl group (preferably an alkenyl group having 2 to 20 carbon atoms, more preferably an alkenyl group having 2 to 12 carbon atoms, especially preferably an alkenyl group having 2 to 8 carbon atoms, e.g., a vinyl group, an allyl group, a 2-butenyl group, a 3-pentenyl group and the like are described.), an alkyl group (preferably an alkyl group having 2 to 20 carbon atoms, more preferably an alkyl group having 2 to 12 carbon atoms, especially preferably an alkyl group having 2 to 8 carbon atoms, e.g., an propagyl group, 3-pentynyl group and the like are described.), an aryl group (preferably an aryl group having 6 to 30 carbon atoms, more preferably an aryl group having 6 to 20 carbon atoms, especially preferably an aryl group having 6 to 12 carbon atoms, e.g., a phenyl group, a p-methylphenyl group, a naphthyl group and the like are described.), a substituted or unsubstituted amino group (preferably an amino group having 0 to 20 carbon atoms, more preferably an amino group having 0 to 10 carbon atoms, especially preferably an amino group having 0 to 6 carbon atoms, e.g., an unsubstituted amino group, a methyl amino group, a dimethylamino group, a diethylamino group, a dibenzylamino group and the like are described.), an alkoxy group (preferably an alkoxy group having 1 to 20 carbon atoms, more preferably an alkoxy group having 1 to 12 carbon atoms, especially preferably an alkoxy group having 1 to 8 carbon atoms, e.g., a methoxy group, an ethoxy group, a butoxy group and the like are described.), an aryloxy group (preferably an aryloxy group having 6 to 20 carbon atoms, more preferably an aryloxy group having 6 to 16 carbon atoms, especially preferably an aryloxy group having 6 to 12 carbon atoms, e.g., a phenoxy group, a 2-naphthyloxy group and the like are described.), an acyl group (preferably an acyl group having 1 to 20 carbon atoms, more preferably an acyl group having 1 to 16 carbon atoms, especially preferably an acyl group having 1 to 12 carbon atoms, e.g., an acetyl group, a benzoyl group, a formyl group, a pivaloyl group and the like are described.), an alkoxycarbonyl group (preferably an alkoxycarbonyl group having 2 to 20 carbon atoms, more preferably an alkoxycarbonyl group having 2 to 16 carbon atoms, especially preferably an alkoxycarbonyl group having 2 to 12 carbon atoms, e.g., a methoxycarbonyl group, an ethoxycarbonyl group and the like are described.), an aryloxycarbonyl group (preferably an aryloxycarbonyl group having 7 to 20 carbon atoms, more preferably an aryloxycarbonyl group having 7 to 16 carbon atoms, especially preferably an aryloxycarbonyl group having 7 to 10 carbon atoms, e.g., a phenyloxycarbonyl group and the like are described.), an acyloxy group (preferably an acyloxy group having 2 to 20 carbon atoms, more preferably an acyloxy group having 2 to 16 carbon atoms, especially preferably an acyloxy group having 2 to 10 carbon atoms, e.g., an acetoxy group, a benzoyloxy group and the like are described.), an acylamino group (preferably an acylamino group having 2 to 20 carbon atoms, more preferably an acylamino group having 2 to 16 carbon atoms, especially preferably an acylamino group having 2 to 10 carbon atoms, e.g., an acetylamino group, a benzoylamino group and the like are described.), an alkoxycarbonylamino group (preferably an alkoxycarbonylamino group having 2 to 20 carbon atoms, more preferably an alkoxycarbonylamino group having 2 to 16 carbon atoms, especially preferably an alkoxycarbonylamino group having 2 to 12 carbon atoms, e.g., a methoxycarbonylamino group and the like are described.), an aryloxycarbonylamino group (preferably an aryloxycarbonylamino group having 7 to 20 carbon atoms, more preferably an aryloxycarbonylamino group having 7 to 16 carbon atoms, especially preferably an aryloxycarbonylamino group having 7 to 12 carbon atoms, e.g., a phenyloxycarbonylamino group and the like are described.), a sulfonylamino group (preferably a sulfonylamino group having 1 to 20 carbon atoms, more preferably a sulfonylamino group having 1 to 16 carbon atoms, especially preferably a sulfonylamino group having 1 to 12 carbon atoms, e.g., a metanesulfonylamino group, a benzenesulfonylamino group, and the like are described.), a sulfamoyl group (preferably a sulfamoyl group having 0 to 20 carbon atoms, more preferably a sulfamoyl group having 0 to 16 carbon atoms, especially preferably a sulfamoyl group having 0 to 12 carbon atoms, e.g., a sulfamoyl group, a methylsulfamoyl group, a dimethylsulfamoyl group, a phenylsulfamoyl group and the like are described.), a carbamoyl group (preferably a carbamoyl group having 1 to 20 carbon atoms, more preferably a carbamoyl group having 1 to 16 carbon atoms, especially preferably a carbamoyl group having 1 to 12 carbon atoms, e.g., an unsubstituted carbamoyl group, a methylcarbamoyl group, a diethylcarbamoyl group, a phenylcarbamoyl group and the like are described.), an alkylthio group (preferably an alkylthio group having 1 to 20 carbon atoms, more preferably an alkylthio group having 1 to 16 carbon atoms, especially preferably an alkylthio group having 1 to 12 carbon atoms, e.g., a methylthio group, an ethylthio group and the like are described.), an arylthio group (preferably an arylthio group having 6 to 20 carbon atoms, more preferably an arylthio group having 6 to 16 carbon atoms, especially preferably an arylthio group having 6 to 12 carbon atoms, e.g., a phenylthio group and the like are described.), a sulfonyl group (preferably a sulfonyl group having 1 to 20 carbon atoms, more preferably a sulfonyl group having 1 to 16 carbon atoms, especially preferably a sulfonyl group having 1 to 12 carbon atoms, e.g., a mesyl group, a tosyl group and the like are described.), a sulfinyl group (preferably a sulfinyl group having 1 to 20 carbon atoms, more preferably a sulfinyl group having 1 to 16 carbon atoms, especially preferably a sulfinyl group having 1 to 12 carbon atoms, e.g., a methanesulfinyl group, a benzenesulfinyl group and the like are described.), an ureido group (preferably an ureido group having 1 to 20 carbon atoms, more preferably an ureido group having 1 to 16 carbon atoms, especially preferably an ureido group having 1 to 12 carbon atoms, e.g., an unsubstituted ureido group, a methylureido group, a phenylureido group and the like are described.), a phosphonamide group (preferably a phosphonamide group having 1 to 20 carbon atoms, more preferably a phosphonamide group having 1 to 16 carbon atoms, especially preferably a phosphonamide group having 1 to 12 carbon atoms, e.g., a diethylphosphonamide group, a phenylphosphonamide and the like are described.), a hydroxy group, a mercapto group, a halogen atom (e.g., fluorine atom, chlorine atom, bromine atom and iodine atom), a cyano group, a sulfo group, a carboxyl group, a nitro group, a hydroxamic acid group, a sulfino group, a hydrazino group, an imino group, a heterocyclic group (preferably a heterocyclic group having 1 to 30 carbon atoms, more preferably a heterocyclic group having 1 to 12 carbon atoms, e.g., a heterocyclic group having a hetero atom such as nitrogen atom, oxygen atom, sulfur atom and the like, e.g., an imidazolyl group, a pyridyl group, a quinolyl group, a furyl group, a piperidyl group, a morpholino group, a benzoxazolyl group, a benzimidazolyl group, a benzthiazolyl group and the like are described.), a silyl group (preferably a silyl group having 3 to 40 carbon atoms, more preferably a silyl group having 3 to 30 carbon atoms, especially preferably a silyl group having 3 to 24 carbon atoms, e.g., a trimethlysilyl group, a triphenylsilyl group and the like are described.) and the like are described. These substituents may be further substituted. And in the case that two or more subsutituents are there, each may be the same or different. And if possible, these may combine each other to form a ring.

As $R^3$, $R^4$ and $R^5$, an alkyl group and a hydrogen atom are preferred and a hydrogen atom is more preferred.

In formula (1) described above, $X^1$ and $X^2$ each represents one selected from a divalent linking group and a single bond. There is no limitation regarding the divalent linking group described above, but an allylene group, —O—, —S— or —$NR^{31}$— ($R^{31}$ represents a hydrogen atom or a substituent and this substituent is the same as the examples which $R^3$, $R^4$ and $R^5$ each represents, and as $R^{31}$, an alkyl group, Rf described above or a hydrogen atom is preferred and a hydrogen atom is more preferred) or the group obtained by those combinations is preferred and —O—, —S—, or —$NR^{31}$— is more preferred. As $X^1$ and $X^2$, —O— or —$NR^{31}$— is more preferred, and —O— is especially preferred.

In formula (1) described above, Z represents one of a divalent linking group and a single bond. There is no limitation regarding the divalent linking group described above, but an alkylene, an allylene group, —C(=O)—, —O—, —S—, —S(=O)—, —S(=O)$_2$—, or —NR$^{32}$— (R$^{32}$ represents a hydrogen atom or a substituent and this substituent is the same as the examples which R$^3$, R$^4$ and R$^5$ each represents, and as R$^{32}$, an alkyl group, or a hydrogen atom is preferred and a hydrogen atom is more preferred) or the group obtained by the combination thereof is preferred. As Z, an alkylene group having 1 to 8 carbon atoms, —C(=O)—, —O—, —S—, —S(=O)—, —S(=O)$_2$— or —NR$^{32}$—, or the group obtained by the combination thereof is more preferred. Following examples are described.

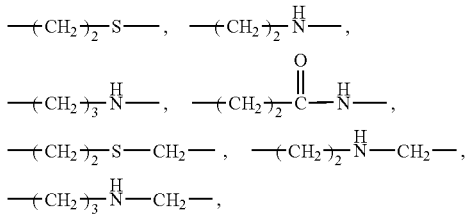

In formula (1) described above, M$^+$ represents a cationic subsutituent. As M$^+$, an organic cationic substituent is preferred and an organic cationic substituent having a nitrogen atom or a phosphor atom is more preferred. Further more, a pyridinium cation or an ammonium cation is preferred and a trialkyl ammonium cation represented by the following formula (2) is more preferred.

Formula (2)

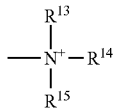

In formula (2), R$^{13}$, R$^{14}$ and R$^{15}$ each independently represent a substituted or unsubstituted alkyl group. As the said substituent, the subsutituents as a substituent of R$^4$ and R$^5$ described above can be applied. And when it is possible, R$^{13}$, R$^{14}$ and R$^1$, can form a ring by binding each other. As R$^{13}$ R$^{14}$ and R$^{15}$ an alkyl group having 1 to 12 carbon atoms is preferred and an alkyl group having 1 to 6 carbon atoms is more preferred and methyl group, ethyl group and methylcarboxyl group are still more preferred and methyl group is especially preferred.

In formula (1), Y$^-$ represents a counter anion and may be an inorganic anion or an organic anion. And when the charge results in 0 in a molecule, Y$^-$ is not necessary. As preferable inorganic anion, iodine ion, bromine ion, chloride ion and the like are described and as preferable organic anion, p-toluenesulfonate ion, benzenesulfonate ion, methanesulfonate ion, trifluoromethanesulfoate ion and the like are described. As Y$^-$, iodine ion, p-toluenesulfonate ion and benzenesulfonate ion are preferred and p-toluenesulfonic acid is more preferred.

In formula (1) described above, m represents 0 or 1 and 0 is preferred.

Among the compounds represented by formula (1), the compound represented by formula (1-a) is preferred.

Formula (1-a)

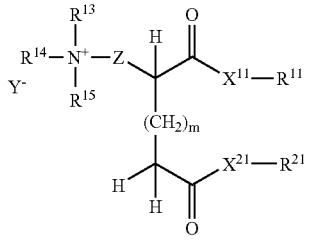

In the formula, R$^{11}$ and R$^{21}$ each independently represent a substituted or unsubstituted alkyl group, but at least one of R$^1$ and R$^2$ represents Rf described above, and R$^{11}$ and R$^{21}$ have 19 or less carbon atoms in total. R$^{13}$, R$^{14}$ and R$^{15}$ each independently represent a substituted or unsubstituted alkyl group and can form a ring by binding each other. X$^{11}$ and X$^{21}$ each independently represent one selected from —O—, —S—, and —NR$^{31}$—. R$^{31}$ represents one selected from a hydrogen atom and a substituent, and Z represents one selected from a divalent linking group and a single bond. Y$^-$ represents a counter anion, however, when the charge results in 0 in a molecule, Y$^-$ is not necessary.

m represents 0 or 1. In the formula, Z and Y$^-$ are the same as those in formula (1) and the preferred range is also similar. R$^{13}$ R$^{14}$, R$^{15}$ and m are the same as those in formula (1) and the preferred range is also similar.

In the formula, X$^{11}$ and X$^{12}$ each independently represent one selected from —O—, —S—, and —NR$^{31}$— (R$^{31}$ represents one of a hydrogen atom and a substituent, and as the said substituent, the substituent described as that of R$^3$, R$^4$ and R$^5$ can be applied and as R$^{31}$, an alkyl group, Rf described above or a hydrogen atom is preferred and a hydrogen atom is more preferred). As X$^{11}$ and X$^{21}$, —O— or —NH— is more preferable, and —O— is still more preferred.

In the formula described above, R$^{11}$ and R$^{21}$ are the same as R$^1$ and R$^2$ in formula (1) and the preferred range is also similar. However, R$^{11}$ and R$^{21}$ have 19 or less carbon atoms in total, and m is 0 or 1.

Specific example of the compound represented by the above formula (1) can be described, but the present invention is not limited by following specific examples. In the following structure donations of compounds, unless otherwise indicated, an alkyl group and a perfluoroalkyl group mean a linear structure. Also, in the structure donations, 2EH means 2-ethylhexyl.

FS-1

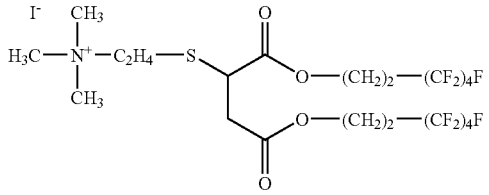

-continued
FS-2
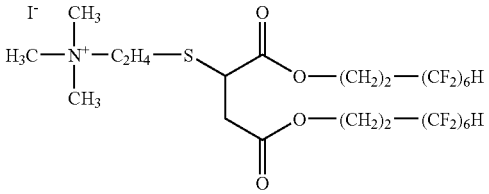
FS-3
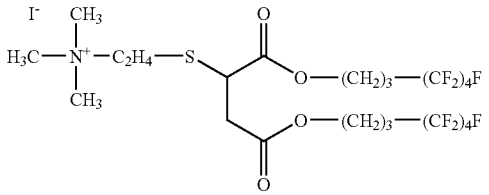
FS-4
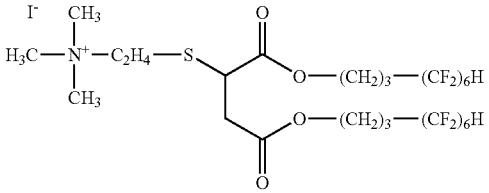
FS-5
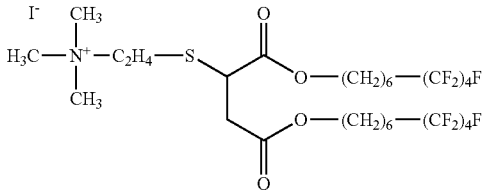
FS-6
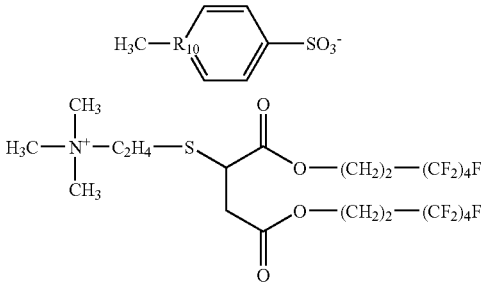
FS-7
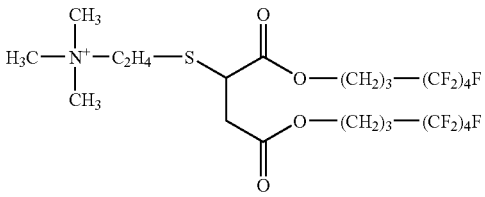
FS-8
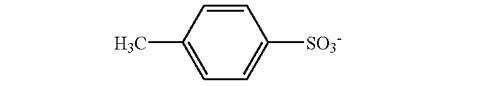
-continued
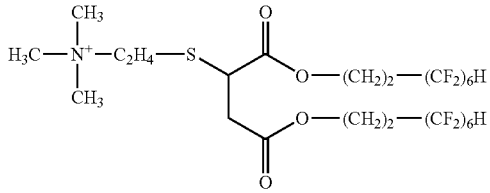
FS-9
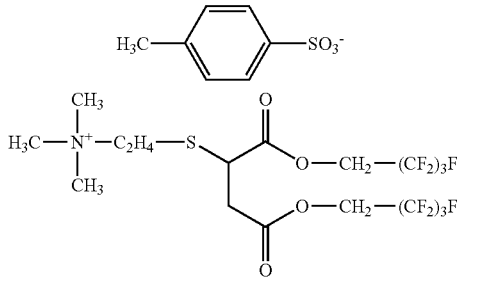
FS-10
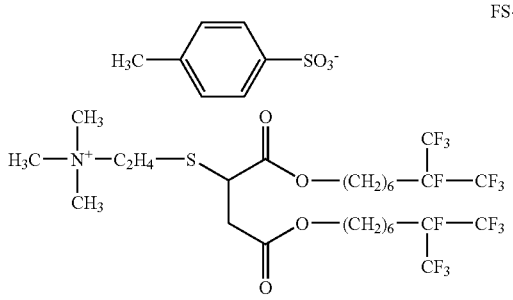
FS-11
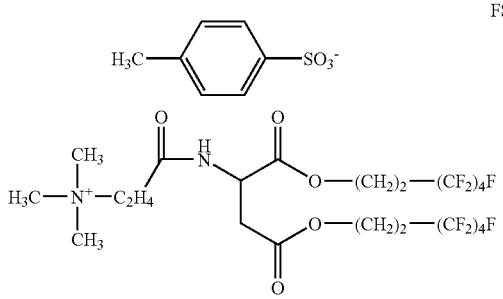
FS-12
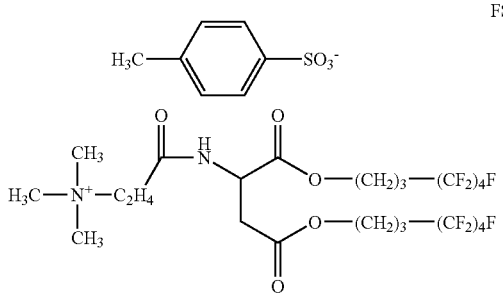
FS-13
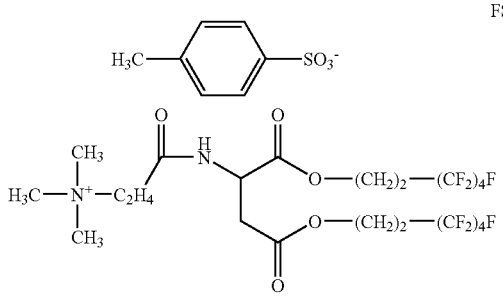

-continued
FS-14
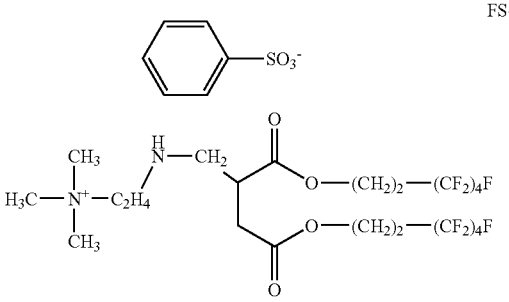
FS-15
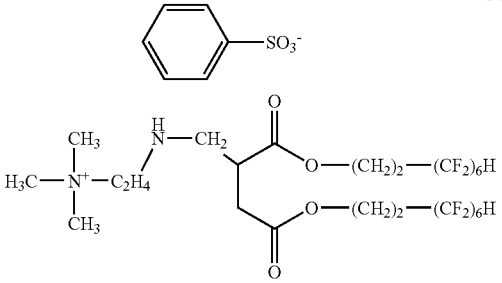
FS-16
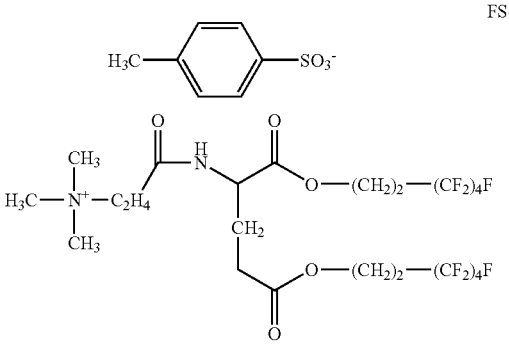
FS-17
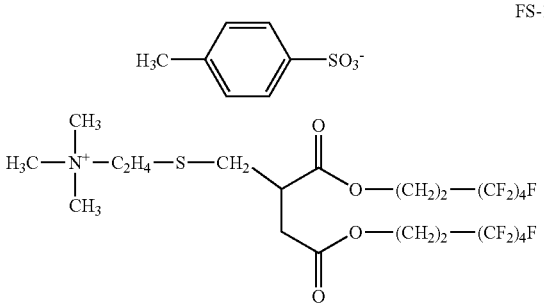
FS-18
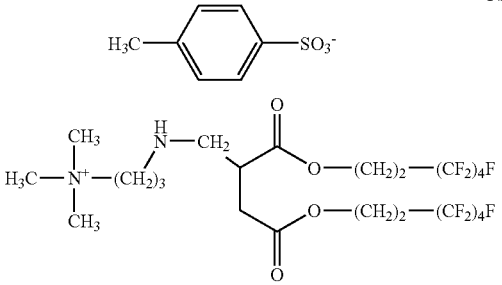
FS-19
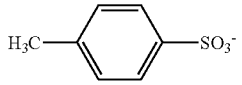
-continued
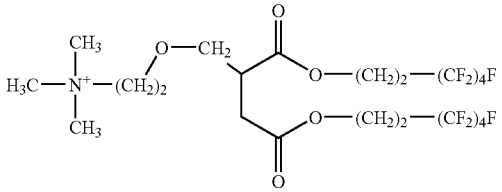
FS-20
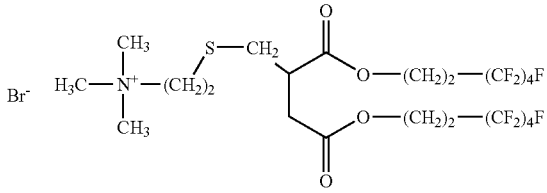
FS-21
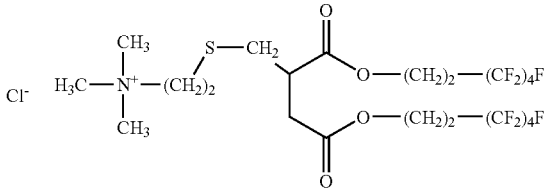
FS-22
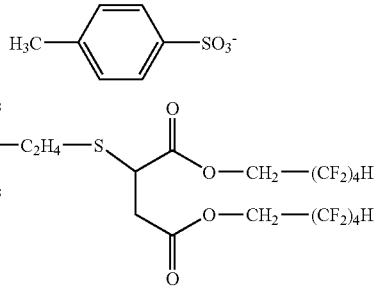
FS-23
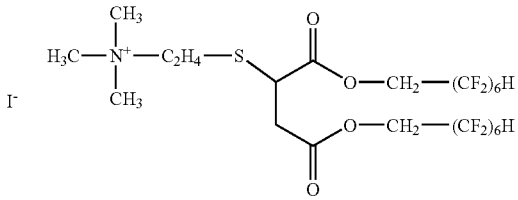
FS-24
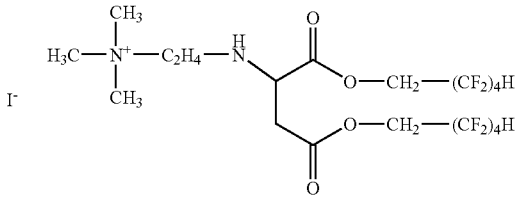
FS-25
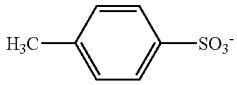

-continued
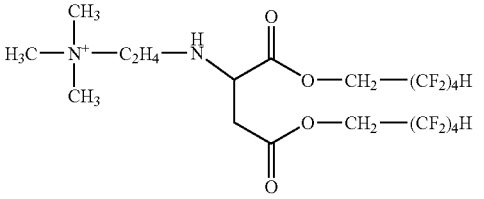
FS-26
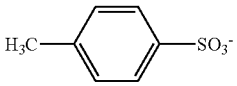
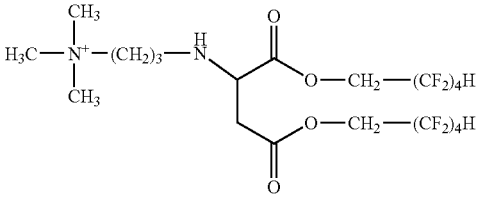
FS-27
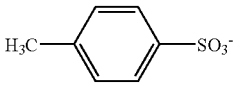
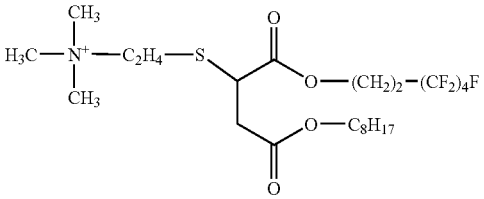
FS-28
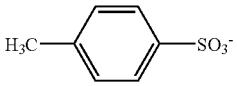
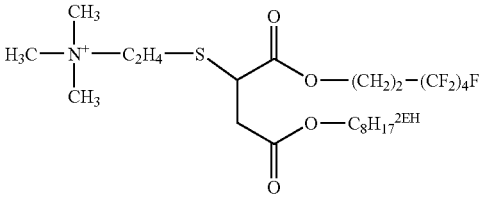
FS-29
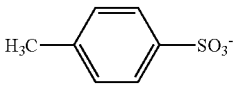
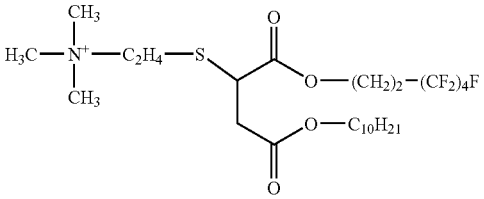
FS-30
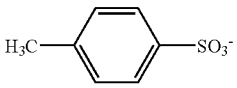
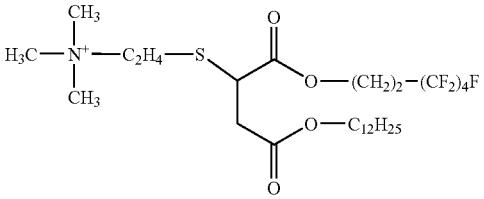
-continued
FS-31
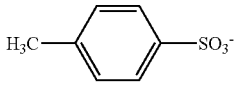
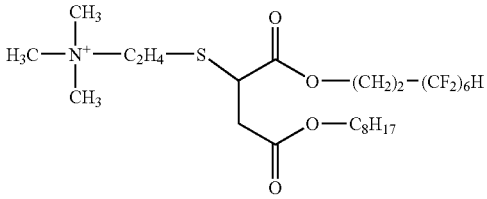
FS-32
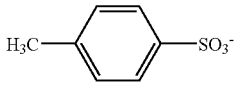
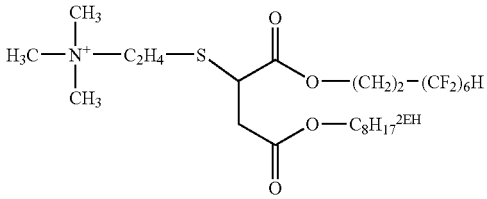
FS-33
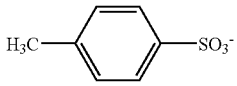
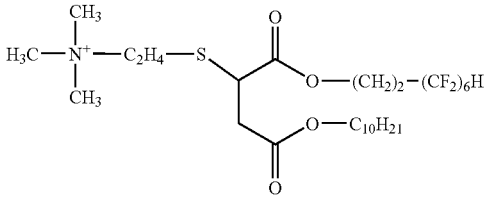
FS-34
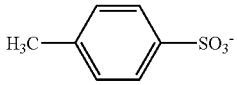
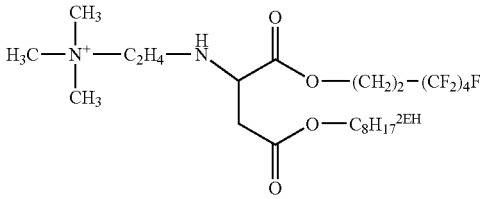
FS-35
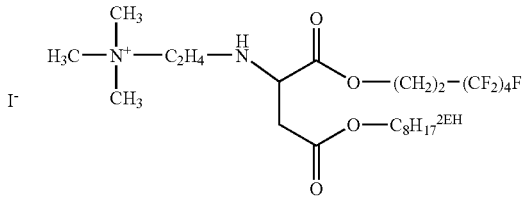
FS-36
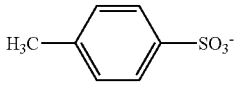

-continued
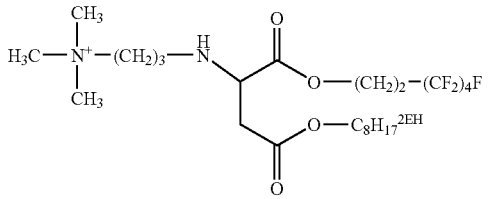
FS-37
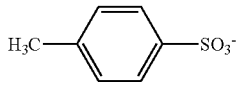
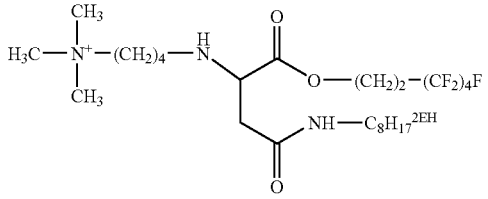
FS-38
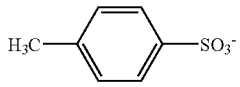
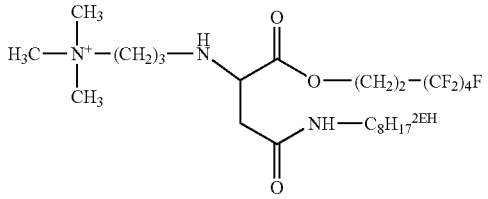
FS-39
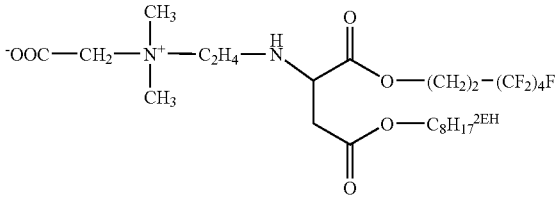
FS-40
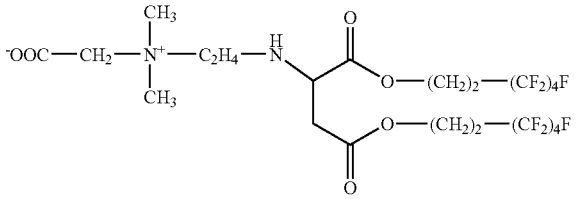
FS-41
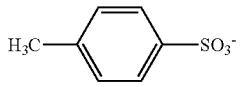
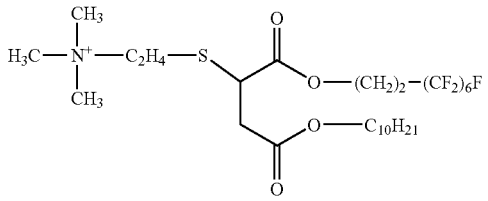
FS-42
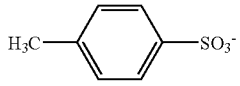
-continued
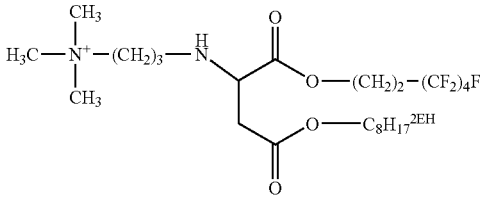
FS-43
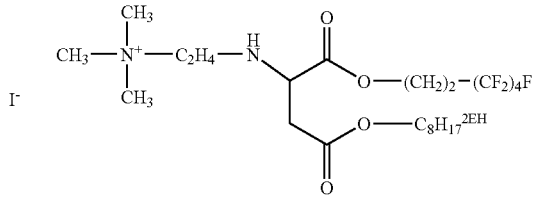
FS-44
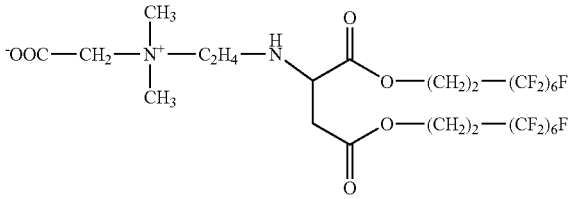
FS-45
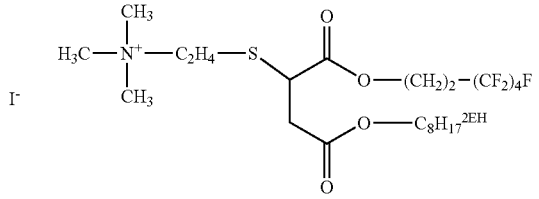
FS-46
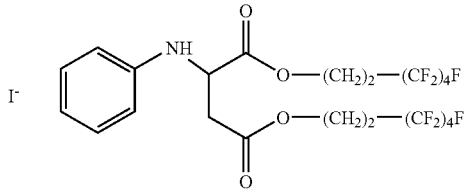
FS-47
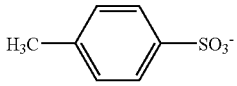
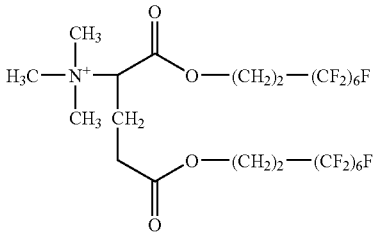
FS-48
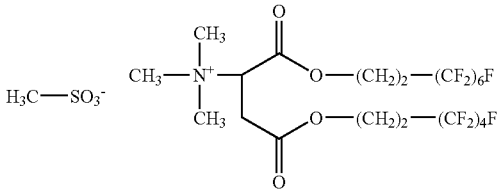

-continued
FS-49
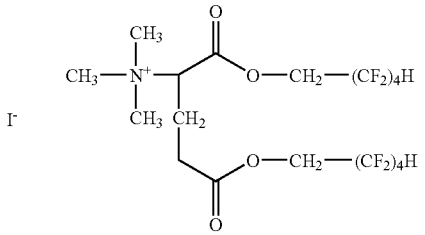
FS-50
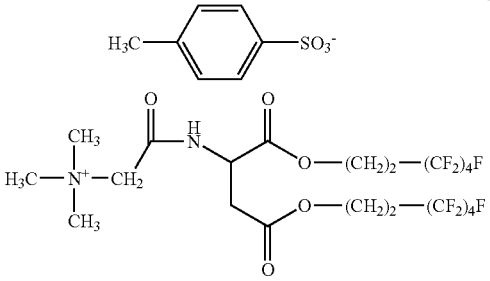
FS-51
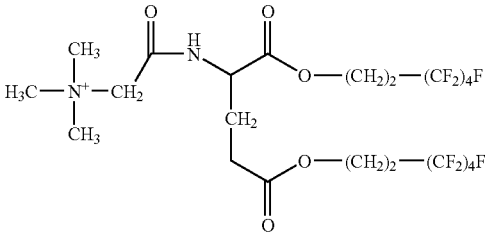
FS-52
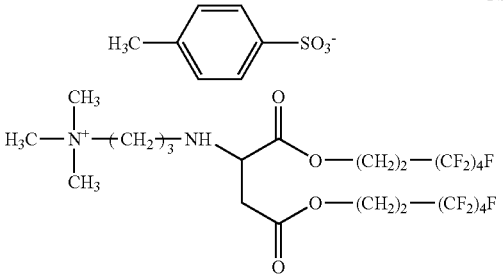
FS-53
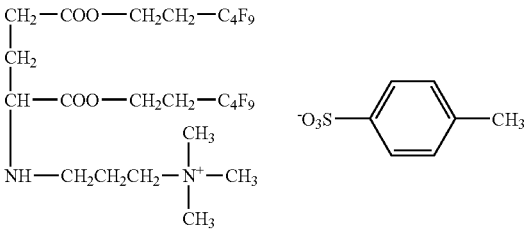
FS-54
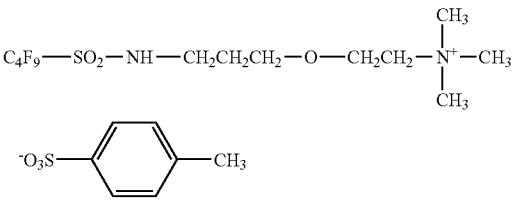
-continued
FS-55
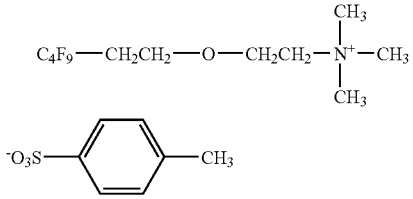
FS-56
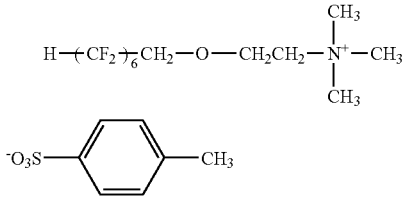
FS-57
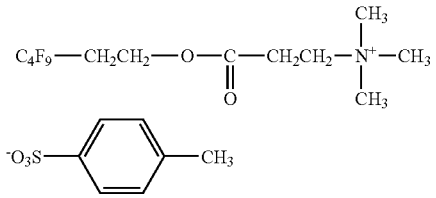
FS-58
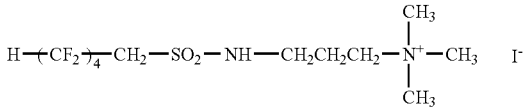
FS-59
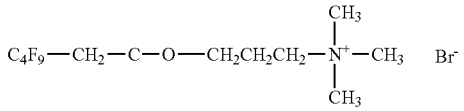
FS-60
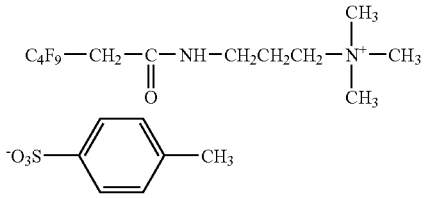
FS-61
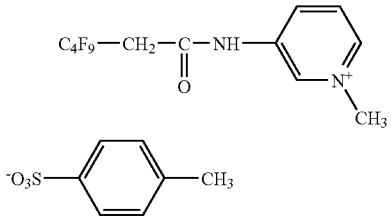
FS-62
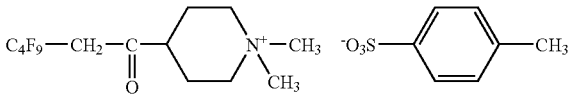
FS-63
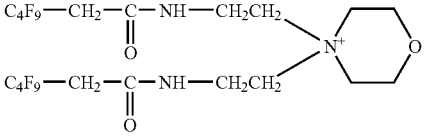

-continued

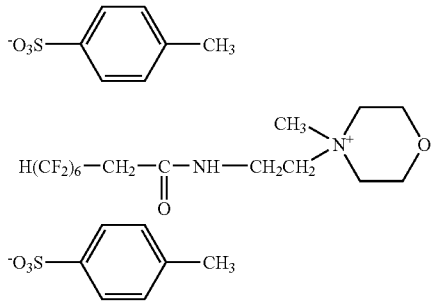

FS-64

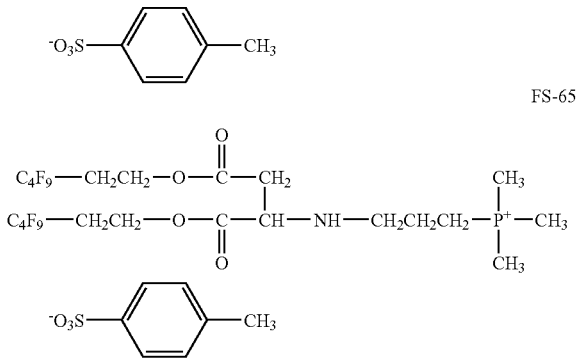

FS-65

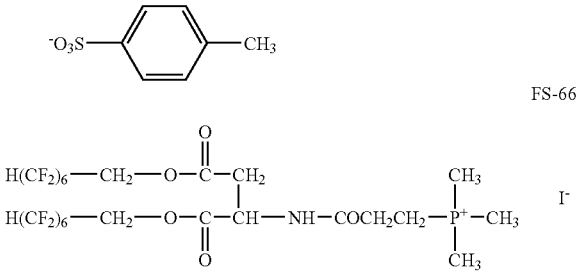

FS-66

Next, an example of general synthesis of compounds represented by the above formulae (1) and (1-a) in the present invention is shown, but the present invention is not limited in these.

The compounds of the present invention can be synthesized by using fumaric acid derivatives, maleic acid derivatives, itaconic acid derivatives, glutamic acid derivatives, aspartic acid derivatives and the like as the starting materials. For example, in the case where fumaric acid derivatives, maleic acid derivatives and itaconic acid derivatives are used as the starting material, the compounds in the present invention can be synthesized by the cationization with an alkylating agent after the Michael addition reaction to these double bonds with the nucleophilic agents.

The fluorocarbon compound in the present invention can have an anionic hydrophilic group.

The anionic hydrophilic group means an acidic group having pKa of 7 or less and an alkali metal salt or an ammonium salt thereof. Specifically, a sulfo group, a carboxyl group, phosphonic acid group, carbamoylsulfamoyl group, sulfamoylsulfamoyl group, acylsulfamoyl group or these salts can be described. Among these, a sulfo group, a carboxyl group, phosphonic acid group and these salts are preferred, and a sulfo group or a salt thereof is more preferred. As the cations to form a salt, lithium, sodium, potassium, cesium, ammonium, tetramethylammonium, tetrabutylammonium, methylpyridinium and the like can be described. Lithium, sodium, potassium and ammonium are preferred.

The preferred fluorocarbon compound having an anionic hydrophilic group in the present invention can be represented by the following formula (3).

Formula (3)

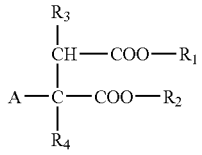

In the formula, $R^1$ and $R^2$ each independently represent an alkyl group, but at least one of them represents Rf. In the case where $R^1$ and $R^2$ represent an alkyl group except a fluoroalkyl group, an alkyl group having 2 to 18 carbon atoms is preferred and an alkyl group having 4 to 12 carbon atoms is more preferred. $R^3$ and $R^4$ each independently represent one of a hydrogen atom and a substituted or unsubstituted alkyl group.

Specific examples of a fluoroalkyl group represented by $R^1$ and $R^2$ are the groups described above and the preferred structure is also that represented by formula (1) described above. And preferred structures among them are also similar to the description of fluoroalkyl group described above. Each alkyl group represented by $R^1$ and $R^2$ is preferably a fluoroalkyl group described above.

A substituted or unsubstituted alkyl group represented by $R^3$ and $R^4$ may be a linear, a branched or a heterocyclic structure. The substituent described above may be any substituent, but is preferably an alkenyl group, an aryl group, an alkoxy group, a halogen atom (preferably chlorine), a carboxylate group, a carbonamide group, a carbamoyl group, an oxycarbonyl group, a phosphate group, or the like.

A represents $—L_b—SO_3M$, and M represents a cation. Herein, as preferred examples of the cation represented by M, an alkali metal ion (lithium ion, sodium ion, potassium ion and the like), an alkali earth metal ion (barium ion, calcium ion and the like), an ammonium ion and the like are described. Among these, lithium ion, sodium ion, potassium ion and ammonium ion are preferred and lithium ion, sodium ion and potassium ion are more preferred, and these can be suitably selected in terms of the total number of carbon atoms of the compound in formula (3), the branch degree of alkyl group or a substituent, and the like. In the case where the total number of carbon atoms in $R^1$, $R^2$, $R^3$, and $R^4$ is 16 or more, lithium ion for M is excellent in terms of being consistent with solubility (particularly in water) and antistatic activity or a coating uniformity.

$L_b$ represents one of a single bond and a substituted or unsubstituted alkylene group, and the subsutituent is preferably the one described in the case of $R^3$. In the case where $L_b$ is an alkylene group, $L_b$ has preferably 2 or less carbon atoms. Lb is preferably a single bond or a $—CH_2—$ group, and most preferably a $—CH_2—$ group.

The compound described by the above formula (3) is more preferably combined with the above preferable embodiment each other.

Specific examples of the fluorocarbon compound for use in the present invention are set forth below, but the present invention is not limited by the following specific examples.

Unless otherwise indicated, an alkyl group and a perfluoroalkyl group in the structure donation of following examples mean a linear structure.

F-1
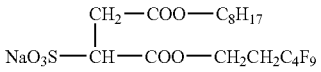
F-2
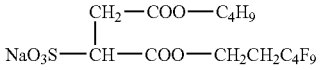
F-3
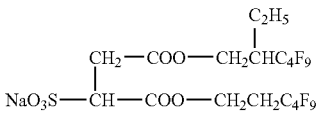
F-4
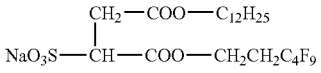
F-5
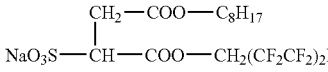
F-6
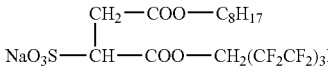
F-7
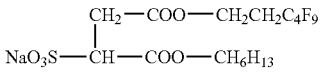
F-8
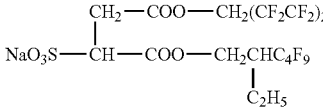
F-9
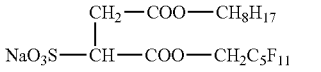
F-10
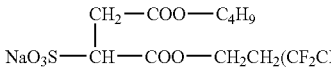
F-11
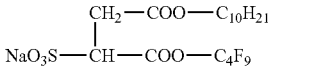
F-12
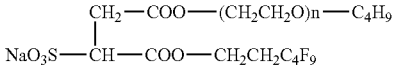
n = 5 ~ 15
F-13
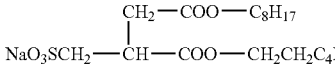
F-14
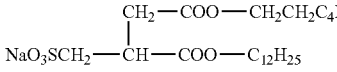
F-15
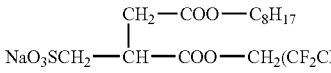
F-16
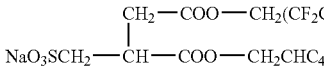
F-17
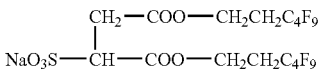
F-18
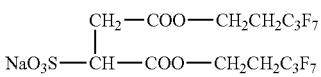
-continued
F-19
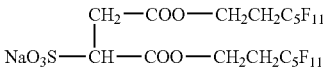
F-20
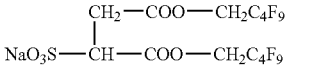
F-21
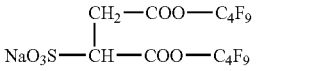
F-22
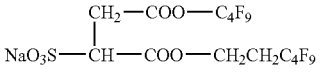
F-23
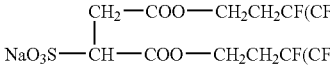
F-24
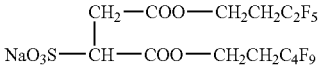
F-25
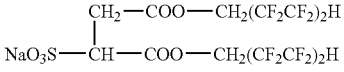
F-26
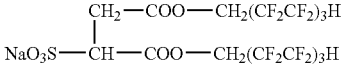
F-27
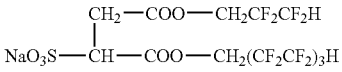
F-28
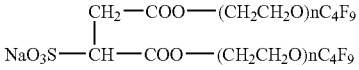
n = 5 ~ 15
F-29
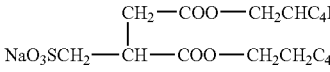
F-30
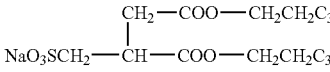
F-31
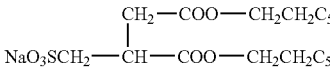
F-32
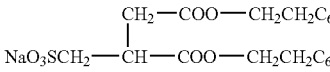
F-33
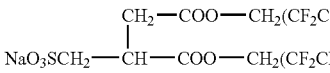
F-34
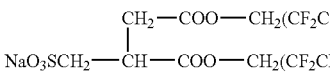
F-35
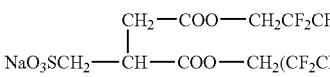
F-36
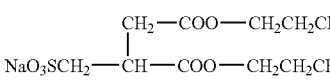
F-37
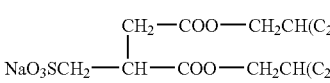

-continued

F-38

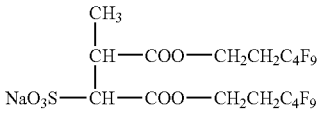

F-39

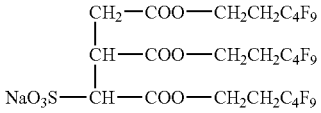

F-40

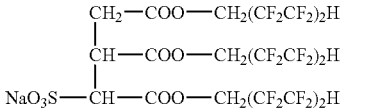

F-41

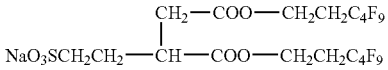

F-42

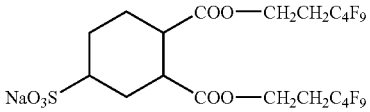

F-43

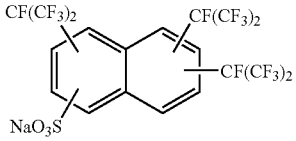

F-44

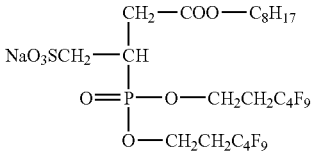

F-45

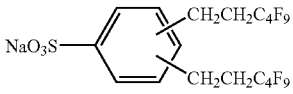

F-46

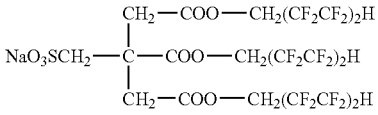

F-47

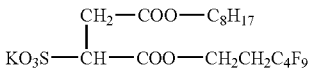

F-48

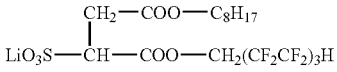

F-49

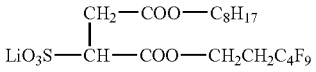

F-50

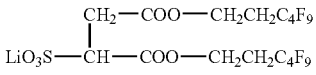

F-51

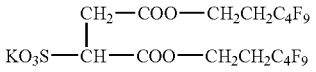

-continued

F-52

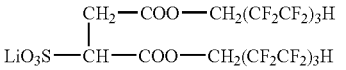

F-53

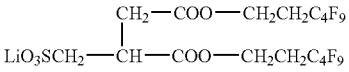

F-54

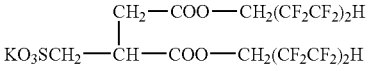

F-55

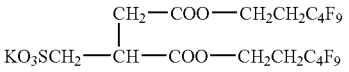

F-56

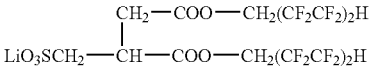

The fluorocarbon compound in the present invention can have a nonionic hydrophilic group. The nonionic hydrophilic group means the water-soluble group without dissociation as ion. Specific examples include poly(oxyethylene) alkylether, multivalent alcohol and the like, but the invention is not limited in these.

The preferred nonionic fluorocarbon compound in the present invention can be represented by the following formula (4).

$$\text{Rf-X}-((\text{CH}_2)_n-\text{O})_m\text{R} \qquad \text{Formula (4)}$$

In formula (4), Rf is a fluoroalkyl group described above and as specific examples, the substituents described above can be described and as the preferred structure, the above structure described in formula (F1) can be also be described. And the preferred structure in it is also similar to the description of Rf described above.

X in formula (4) represents a divalent linking group and is not especially limited. For examples,

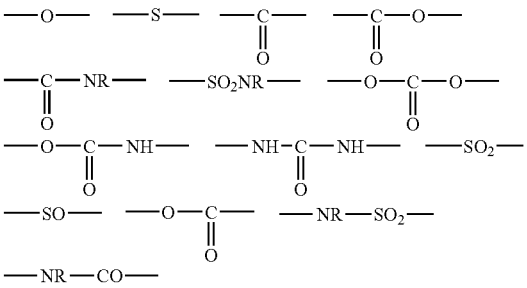

the like are described.

In formula (4), n represents an integer of 2 or 3, and m represents an integer of 1 to 30. R represents one selected from a hydrogen atom, an alkyl group, an aryl group, a heterocyclic group, Rf, and the group having one or more Rf as a substituent.

Specific examples of the nonionic fluorocarbon compound for use in the present invention are described below, but the present invention is not limited by following specific examples.

FN-1

$C_4F_9CH_2CH_2O—(CH_2CH_2)_n—H$ n = 5 ~ 15

FN-2

$H(CF_2)_6CH_2O—(CH_2CH_2O)_n—H$ n = 5 ~ 15

FN-3

$C_4F_9CH_2COO—(CH_2CH_2O)_n—H$ n = 5 ~ 15

FN-4

$C_4F_9CH_2CONH—(CH_2CH_2O)_n—H$ n = 5 ~ 15

FN-5

$C_4F_9CH_2SO_2NH—(CH_2CH_2O)_n—H$ n = 5 ~ 15

FN-6

$C_4F_9CH_2CH_2NHCOO—(CH_2CH_2O)_n—H$ n = 5 ~ 15

FN-7

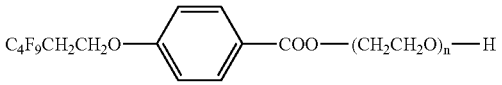

n = 5 ~ 15

FN-8

$H(CF_4)_4CH_2O—(CH_2CH_2CH_2O)_n—H$ n = 5 ~ 15

FN-9

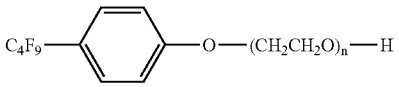

n = 5 ~ 15

FN-10

$C_4F_9CH_2CH_2O—(CH_2CH_2O)_{n1}—(CH_2CH_2CH_2O)_{n2}—(CH_2CH_2O)_{n3}—H$ n1 = 5 ~ 10
n2 = 5 ~ 10
n3 = 5 ~ 10

FN-11

$C_4F_9CH_2CH_2O—(CH_2CH_2O)_n—CH_3$ n = 10 ~ 20

FN-12

$C_4F_9CH_2CH_2O—(CH_2CH_2O)_n—C_4H_9$ n = 10 ~ 20

FN-13

$C_4F_9CH_2CH_2O—(CH_2CH_2O)_n—CH_2CH_2C_4H_9$ n = 10 ~ 20

FN-14

$$\begin{array}{l} CH_2COO—(CH_2CH_2O)_n—CH_2CH_2C_4F_9 \\ | \\ CH_2COO—(CH_2CH_2O)_n—CH_2CH_2C_4F_9 \end{array}$$

n = 5 ~ 10

FN-15

$$\begin{array}{l} CH_2COO—(CH_2CH_2O)_n—CH_2CH_2C_4F_9 \\ | \\ CHCOO—(CH_2CH_2O)_n—CH_2CH_2C_4F_9 \\ | \\ CH_2COO—(CH_2CH_2O)_n—CH_2CH_2C_4F_9 \end{array}$$

n = 5 ~ 10

FN-16

$$\begin{array}{l} CH_2O—(CH_2CH_2O)_n—CH_2CH_2C_4F_9 \\ | \\ CHO—(CH_2CH_2O)_n—CH_2CH_2C_4F_9 \\ | \\ CH_2O—(CH_2CH_2O)_n—CH_2CH_2C_4F_9 \end{array}$$

n = 5 ~ 10

-continued

FN-17

$H—C_6F_{12}CH_2O—(CH_2CH_2O)_n—CH_2C_6F_{12}—H$ n = 5 ~ 10

FN-18

$$\begin{array}{l} \quad\;\; CH_2O—(CH_2CH_2O)_n—CH_2(CF_2)_4H \\ \quad\;\; | \\ C_2H_5—O—CH_2O—(CH_2CH_2O)_n—CH_2(CF_2)_4H \\ \quad\;\; | \\ \quad\;\; CH_2O—(CH_2CH_2O)_n—CH_2(CF_2)_4H \end{array}$$

n = 5 ~ 10

The fluorocarbon compound is preferably used, in the present invention, in a coating component to form either layer of the surface side having the image forming layer. Among them, it is useful that the fluorocarbon compound is used for forming the outermost layer of photothermographic material, because of showing effective antistatic activity and coating uniformity and also useful for stock stability and improving the dependency on the using environment.

The addition amount of the fluorocarbon compound in the present invention is not especially limited and is arbitrarily determined corresponding to the structure and the using place of the fluorocarbon compound and the series and an amount of other additive contained in a component. For example, in the case where the fluorocarbon compound is used in the coating solution for the outermost layer of a photothermographic material, the coating amount of the fluorocarbon compound in a coating solution is preferably 0.1 mg/m$^2$ to 100 mg/m$^2$, and more preferably 0.5 mg/m$^2$ to 20 mg/m$^2$.

In the present invention, the fluorocarbon compound may be used alone or by mixing two or more kinds. In the case where two or more kinds are used by mixing, a fluorocarbon compound other than the fluorocarbon compound of the present invention can be used by mixing. Additionally, a surfactant other than a fluorocarbon compound can be used with the fluorocarbon compound in the present invention.

(Surface Protective Layer)

The photothermographic material of the invention may comprise a surface protective layer with an object to prevent adhesion of the image forming layer. The surface protective layer may be a single layer, or composed of a plurality of layers. Description on the surface protective layer may be found in paragraph Nos. 0119 to 0120 of JP-A No. 11-65021 and in JP-A No. 2001-348546.

Especially, the outermost surface layer is a very significant layer which determines the surface physical properties of the photothermographic materials and has an influence on the slippage, the adhesion, the anti-scratch, the electrically charge, the dust adhesion and the like. Therefore, a selection of the binder for the outermost surface layer is very important. In a case, crosslinking the binder, selection of a surfactant for the binder, an optimization of the matt degree, and the like are also important. The detail will be explained hereinafter.

1) Hydrophilic Binder

The hydrophilic binder is preferably used for the binder for the surface protective layer of the present invention. The kind of the hydrophilic binder for the surface protective layer is not particularly limited. For example, gelatin is preferred, but polyvinyl alcohol (PVA) is also preferably used alone or in combination. Examples of the gelatin include an inert gelatin (e.g., Nitta Gelatin 750) and a phthalated gelatin (e.g., Nitta Gelatin 801). Examples of PVA include those described in JP-A No. 2000-171936

(paragraph No. 0009 to 0020), and preferred examples thereof include completely saponified PVA-105, partially saponified product PVA-205 and PVA-335, and modified polyvinyl alcohol MP-203 (each trade name, produced by Kuraray Co., Ltd.). The coating amount (per 1 $m^2$ of the support) of polyvinyl alcohol for the protective layer (per one layer) is preferably from 0.3 $g/m^2$ to 4.0 $g/m^2$, and more preferably from 0.3 $g/m^2$ to 2.0 $g/m^2$. When two or more kinds of hydrophilic binders are used in combination, the total coating amounts of the binders preferably fall in the above range.

For the photothermographic material of the present invention, a swelling rate of side having the image forming layer is preferably in the range from 1% to 400%, more preferably from 1% to 300%, still more preferably from 1% to 200%, and particularly preferably from 1% to 150%. The swelling rate is expressed as the ratio between the thickness change after soaking the surface of the side having the image forming layer in water for 3 minutes at 25° C. and the thickness of the cross section of the photothermographic material observed by a scanning microscope.

2) Polymer Latex

The polymer latex used for the outermost surface layer of the present invention indicates a dispersed state where fine particles of a water-insoluble hydrophobic polymer are dispersed in water.

The mean particle size of the dispersed particles is in the range from 1 nm to 50,000 nm, preferably from 5 nm to 1,000 nm, more preferably 10 nm to 500 nm, and still more preferably 50 nm to 200 nm. There is no particular limitation concerning particle size distribution of the dispersed particles, and may be widely distributed or may exhibit a monodisperse particle size distribution. A method of using a mixture of two or more dispersed particles having a monodisperse particle size distribution is also preferred in controlling the physical properties of the coating solution.

The polymer latex used for the present invention preferably may include the hydrophobic polymer such as acrylic polymers, polyester, rubber (e.g., SBR resin), polyurethane, poly(vinyl chloride), poly(vinyl acetate), poly(vinylidene chloride), polyolefin, and the like. As the polymers above, usable are straight chain polymers, branched polymers, or crosslinked polymers; also usable are the so-called homopolymers in which one kind of monomer is polymerized, or copolymers in which two or more kinds of monomers are polymerized. In the case of a copolymer, it may be a random copolymer or a block copolymer (for example, urethane-vinyl copolymers containing an acidic group, or the like described in U.S. Pat. No. 6,077,648). The molecular weight of these polymers is, in terms of number-average molecular weight, in the range from 5,000 to 1,000,000, and preferably from 10,000 to 200,000. Those having too small molecular weight exhibit insufficient mechanical strength on forming the image forming layer, and those having too large molecular weight are also not preferred because the filming properties result poor. A polymer latex capable of crosslinking is particularly preferred.

The glass transition temperature (Tg) of the polymer latex used for the present invention is preferably in the range from −20° C. to 70° C., more preferably from −10° C. to 60° C., and most preferably from 0° C. to 50° C. The preparation of polymer latex by the combination of two or more polymers may be available in order to attain the above glass transition temperature. Namely even if the polymer have the glass transition temperature out of the above range, the resultant weight-average glass transition temperature may be preferably fallen in the above range.

<Specific Examples of Polymer Latex>

Specific examples of preferred polymer latexes are given below, which are expressed by the starting monomers with % by weight given in parenthesis. The molecular weight is given in number-average molecular weight. In the case polyfunctional monomer is used, the concept of molecular weight is not applicable because they build a crosslinked structure. Hence, they are denoted as "crosslinking", and the molecular weight is omitted. Tg represents glass transition temperature.

P-1; Latex of -MMA(70)-EA(27)-MAA(3)-(molecular weight 37000, Tg 61° C.)

P-2; Latex of -MMA(70)-2EHA(20)-St(5)-AA(5)-(molecular weight 40000, Tg 59° C.)

P-3; Latex of -St(50)-Bu(47)-MAA(3)-(crosslinking, Tg −17° C.)

P-4; Latex of -St(68)-Bu(29)-AA(3)-(crosslinking, Tg 17° C.)

P-5; Latex of -St(71)-Bu(26)-AA(3)-(crosslinking, Tg 24° C.)

P-6; Latex of -St(70)-Bu(27)-IA(3)-(crosslinking)

P-7; Latex of -St(75)-Bu(24)-AA(1)-(crosslinking, Tg 29° C.)

P-8; Latex of -St(60)-Bu(35)-DVB(3)-MAA(2)-(crosslinking)

P-9; Latex of -St(70)-Bu(25)-DVB(2)-AA(3)-(crosslinking)

P-10; Latex of -VC(50)-MMA(20)-EA(20)-AN(5)-AA(5)-(molecular weight 80000)

P-11; Latex of -VDC(85)-MMA(5)-EA(5)-MAA(5)-(molecular weight 67000)

P-12; Latex of -Et(90)-MAA(10)-(molecular weight 12000)

P-13; Latex of -St(70)-2EHA(27)-AA(3)-(molecular weight 130000, Tg 43° C.)

P-14; Latex of -MMA(63)-EA(35)-AA(2)-(molecular weight 33000, Tg 47° C.)

P-15; Latex of -St(70.5)-Bu(26.5)-AA(3)-(crosslinking, Tg 23° C.)

P-16; Latex of -St(69.5)-Bu(27.5)-AA(3)-(crosslinking, Tg 20.5° C.)

In the structures above, abbreviations represent monomers as follows. MMA: methyl metacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The polymer latexes above are commercially available and polymers below are usable. Examples of acrylic polymer include Cevian A-4635, 4718 and 4601 (trade mark, all manufactured by Daicel Chemical Industries, Ltd.), Nipol Lx 811, 814, 821, 820, 855 (P-17: Tg: 36° C.) and 857×2 (P-18: Tg: 43° C.) (trade mark, all manufactured by Nippon Zeon Co., Ltd.), Voncoat R3370 (P-19: Tg: 25° C.) and 4280 (P-20: Tg: 15° C.) (trade mark, all manufactured by Dainippon Ink & Chemicals, Inc.), Jurymer ET-410 (P-21: Tg: 44° C.) (trade mark, manufactured by Nihon Junyaku Co., Ltd.), AE-116 (P-22: Tg: 50° C.), AE-119 (P-23: Tg: 55° C.), AE-121 (P-24: Tg: 58° C.), AE-125 (P-25: Tg: 60° C.), AE-134 (P-26: Tg: 48° C.), AE-137 (P-27: Tg: 48° C.), AE-140 (P-28: Tg: 53° C.) and AE-173 (P-29: Tg: 60° C.) (trade mark, all manufactured by JSR Corp.), ARON A-104 (P-30: Tg: 45° C.) (trade mark, all manufactured by Toagosei Co., Ltd.), and the like; examples of the polyester include FINETEX ES650, 611, 675 and 850 (trade mark, all manufactured by Dainippon Ink & Chemicals, Inc.), WD-size, and WMS (trade mark, all manufactured by Eastman Chemical Co., Ltd.) and the like; examples of the polyurethane include HYDRAN AP-10 (P-31: Tg: 37° C.), 20, 30, 40 (P-32: Tg: 55° C.), 101H, Vondic 1320NS, and 1610NS (trade mark, all manufactured Dainippon Ink & Chemicals, Inc.) and the like; examples of the rubber include LACSTAR 7310K, 3307B (P-33: Tg: 13° C.), 4700H and 7132C(P-34: Tg: 70° C.) (trade mark, all manufactured by Dainippon Ink & Chemicals, Inc.), Nipol Lx416 (P-35: Tg: 50° C.), 410, 430, 435, 110, 415A (P-36: Tg: 27° C.), 438C, 2507H(P-37: Tg: 58° C.) and 303A (P-38: Tg: 100° C.) (trade mark, all manufactured by Nippon Zeon Co., Ltd.) and the like; examples of the poly(vinyl chloride) include G351 and G576 (trade mark, all manufactured by Nippon Zeon Co., Ltd.) and the like; examples of the poly(vinylidene chloride) include L502 and L513 (trade mark, all manufactured by Asahi Chemical Industry Co., Ltd.), D-5071 (P-39: Tg: 36° C.) (trade mark, manufactured by Dainippon Ink & Chemicals, Inc.) and the like; and examples of the polyolefin include Chemipearl S120, SA100 and V300 (P-40: Tg: 80° C.) (trade mark, all manufactured by Mitsui Petrochemical Industries, Ltd.), Voncoat 2830 (P-41: Tg: 38° C.), 2210 and 2960 (trade mark, all manufactured by Dainippon Ink & Chemicals, Inc.) and the like.

The polymer latex above may be used alone, or may be used by blending two or more kinds depending on needs.

<Preferred Polymer Latex>

Particularly preferable as the polymer latex for use in the invention is that of styrene-butadiene copolymer. The weight ratio of monomer unit for styrene to that of butadiene constituting the styrene-butadiene copolymer is preferably in the range from 40:60 to 95:5.

Furthermore, in the copolymer polymerized with two or more monomers, the sum total of the styrene monomer unit and the butadiene monomer unit preferably account for the ratio from 60% by weight to 99% by weight, based on the total copolymer. The copolymer for use in the present invention is preferably polymerized containing acrylic acid or methacrylic acid in an amount of 1% by weight to 6% by weight, based on the sum of styrene and butadiene, and more preferably acrylic acid or methacrylic acid in an amount of 2% by weight to 5% by weight. Especially, the copolymer polymerized in presence of acrylic acid is preferred. The preferred range of the molecular weight is similar to that described above.

As the latex of styrene-butadiene copolymer preferably used in the invention, there can be mentioned P-3 to P-8, P-14 and P-15, or commercially available LACSTAR-3307B, 7132C, Nipol Lx416, and the like.

<Layer in Which Polymer Latex can be Added>

In the photothermographic material of the present invention, the polymer latex may be used for the binder of the outermost surface layer. Because the polymer latex has no setting properties, a gelling agent is preferably added to the outermost layer or the layer adjacent to the outermost layer.

In the present invention, the polymer latex is preferably included 50% by weight or more, based on the total binder in the outermost layer, and more preferably from 70% by weight to 100% by weight.

As for the binder for the outermost layer, any water-soluble polymer can be used in combination (for example, including gelatin as a water-soluble polymer which is derived from animal protein and PVA as a water-soluble polymer which is not derived from animal protein).

3) Fluorine Atom-containing Copolymer

According to the present invention, the outermost layer preferably includes at least a copolymer polymerized from the following monomers (M1) and (M2) as starting materials:

(M1): a monomer having a group capable of forming a salt or a poly(alkylene oxide) group, and an unsaturated bond capable of radical polymerization, and (M2): a monomer having at least one fluorine atom and an unsaturated bond capable of radical polymerization.

Preferably, the above-described copolymer contains the above (M2) monomer in the range from 5% by weight to 99.5% by weight, and more preferably from 20% by weight to 80% by weight.

Additionally as the starting material, a monomer (M3) having unsaturated bond capable of radical polymerization, which is different from (M1) and (M2) monomer, is preferably added. In this case, (M1):(M2):(M3)=0.5% by weight to 60% by weight:5% by weight to 99.5% by weight:0% by weight to 94.5% by weight is preferable, and more preferable is (M1):(M2):(M3)=0.5% by weight to 15% by weight:5% by weight to 80% by weight:5% by weight to 80% by weight.

As for the monomer having group capable of forming a salt in (M1), anionic monomer, cationic monomer and amphoteric monomer can be described, and as for the monomer having a polyalkylene oxide group in (M1), non-ionic monomer can be described. In more detail, examples of the anionic monomers include unsaturated carboxylic acid monomer, unsaturated sulfonic acid monomer, unsaturated phosphoric acid monomer and the like; examples of the cationic monomers include unsaturated tert-amine-containing monomer, unsaturated ammonium salt-containing monomer and the like; examples of the amphoteric monomers include N-(3-sulfopropyl)-N-methacryloyl oxyethyl-N,N-dimethylammonium betaine, N-(3-sulfopropyl)-N-metahcrylolyl amidopropyl-N,N-dimethyl ammonium betaine, 1-(3-sulfopropyl)-2-vinyl pyridinium betaine and the like; examples of the non-ionic monomers include unsaturated polyoxyethylene oxide monomer, unsaturated polyoxypropylene oxide monomer and the like.

Specifically, for the anionic monomer, examples of the unsaturated carboxylic acid monomers include acrylic acid, methacrylic acid, crotonic acid, itaconic acid, maleic acid, fumaric acid, their anhydrides and their monoalkyl ester, and examples of the vinyl ethers include carboxyethyl vinylether, carboxypropyl vinylether and the like.

Examples of the unsaturated sulfonic acid monomers include styrene sulfonic acid, 2-acrylicamide-2-methylpropane sulfonic acid, 3-sulfopropyl methacrylic acid ester, bis-(3-sulfopropyl)-itaconic acid ester and salts thereof, and also sulfuric acid monoester of 2-hydroxyethyl methacrylic acid and a salt thereof.

Examples of the unsaturated phosphoric acid monomers include vinyl phosphonic acid, vinyl phosphate, acid phosphoxyethyl methacrylate, acid phosphoxypropyl methacrylate, bis (methacryloxy ethyl) phosphate, diphenyl-2-methacryloyloxy ethyl phosphate, diphenyl-2-methacrylolyoxy ethyl phosphate, dibutyl-2-methacryloyloxy ethyl phosphate, dibutyl-2-acryloyloxy ethyl phosphate, dioctyl-2-methacrylolyoxy ethyl phosphate and the like.

Examples of the cationic monomer include unsaturated tert-amine-containing monomer and unsaturated ammonium salt-containing monomer. Specifically, examples include mono-vinyl pyridines such as vinyl pyridine, 2-methyl-5-vinyl pyridine, 2-ethyl-5-vinyl pyridine and the like; styrenes having dialkyl amino group such as N,N-dimethylamino styrene and N,N-dimethylamino methyl styrene; esters having dialkylamino group of acrylic acid or methacrylic acid such as N,N-dimethylamino ethyl methacrylate, N,N-dimethylamino ethyl acrylate, N,N-diethylamino ethyl methacrylate, N,N-diethylamino ethyl acrylate, N,N-dimethylamino propyl methacrylate, N,N-dimethylamino propyl acrylate, N,N-diethylamino propyl methacrylate, N,N-diethylamino propyl acrylate; vinyl ethers having dialkylamino group such as 2-dimethylamino ethyl vinyl ether; acrylamides or methacrylamides having dialkylamino group such as N-(N',N'-dimethylamino ethyl) methacrylamide, N-(N',N'-dimethylamino ethyl) acrylamide, N-(N',N'-diethylamino ethyl) methacrylamide, N-(N',N'-diethylamino ethyl) acrylamide, N-(N',N'-dimethylamino propyl) methacrylamide, N-(N',N'-dimethylamino propyl) acrylamide, N-(N',N'-diethylamino propyl) methacrylamide, N-(N',N'-diethylamino propyl) acrylamide, and the quaternized compounds by well-known quaternizing agent such as a halogenated alkyl compound (alkyl group having 1 to 18 carbon atoms, as halogen, chloride, bromide and iodide), halogenated benzyl compounds such as, for example, benzyl chloride, or benzyl bromide, alkyl esters (alkyl group having 1 to 18 carbon atoms) of alkyl or arylsulfonic acid such as methane sulfonic acid, benzenesulfonic acid or toluenesulfonic acid, and dialkylsulfate (alkyl group having 1 to 4 carbon atoms).

Examples of the nonionic monomers include esters of unsaturated carboxylic acid monomer and polyalkylene oxide addition product with polyoxyalkylene glycol or lower alcohols, and the reaction products of allylglycidyl ether or glycidyl ether of unsaturated carboxylic acid monomer with polyoxyalkyene oxide addition product with polyoxyalkylene glycol or lower alcohols. For example, the compounds represented by the following formulae can be used.

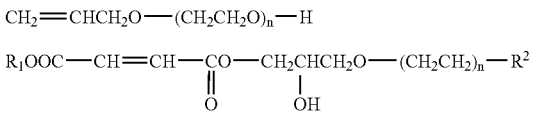

(in the formula $R^1$ is H, $CH_3$ or $-CH_2CHCH_2O-(CH_2CH_2O)_n-R^2$, and $R^2$ is H or $CH_3$)

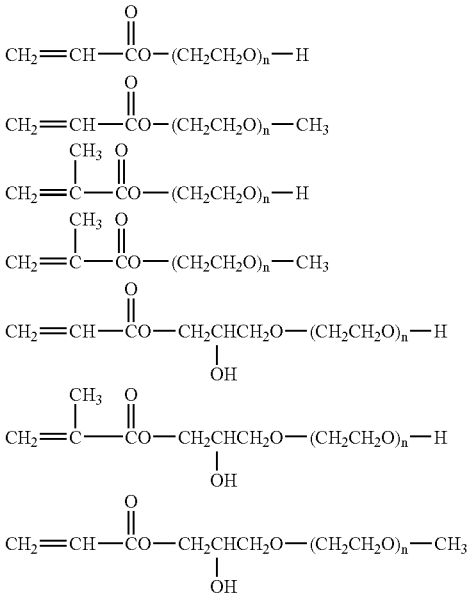

-continued

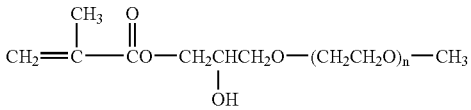

(In the above formulae, n is an integer of 2 to 100)

In the present invention, as for the (M2) monomer, well-known compounds having polyfluoroalkyl group or perfluoroalkyl group, such as methacrylate, vinyl ester, vinyl ether, maleate, fumaleate, α-olefin, can be described. More preferably, examples of the fluorine-containing monomers include the monomer having polyfluoroalkyl group or perfluoroalkyl group with 4 or more carbon atoms.

The exemplary compounds are as follows.

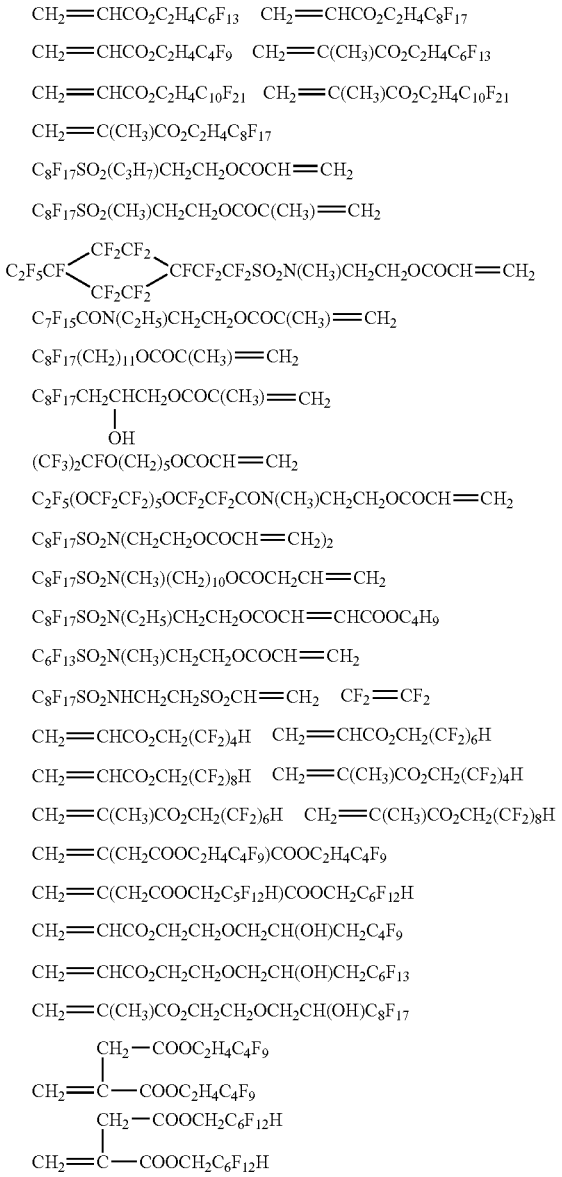

Moreover, a macro monomer of the monomer described above is included. The preparation of the macro monomer can be easily performed by well-known recipes in the art.

For example, the above monomer is subjected to the radical polymerization with thioglycolic acid and 2-mercapto ethanol in the presence of an initiator, and then the radical polymerizable unsaturated bond is introduced into the one terminal end by reacting the resultant reaction products with glycidyl methacrylate and isocyanato ethyl methacrylate and the like to form the above macro monomer.

The number-average molecular weight of the macro monomer is preferably 10,000 or less, and more preferably 5,000 or less.

Examples of the monomer (M3) having radical polymerizable unsaturated bonds besides (M1) and (M2) include well-known compounds such as (metha)acrylate, vinyl ester, vinyl ether maleate, fumaleate, α-olefin, and the like.

The specific examples of these compounds include vinyl esters such as vinyl acetate, vinyl propionate, vinyl butyrate, vinyl pivalate, vinyl capronate, vinyl laurate, vinyl versate, vinyl cyclohexene carboxylate and the like; vinyl ethers such as methyl vinyl ether, ethyl vinyl ether, n-propyl vinyl ether, isopropyl vinyl ether, n-butyl vinyl ether, isobutyl vinyl ether, t-butyl vinyl ether, n-pentyl vinyl ether, n-hexyl vinyl ether, n-octyl vinyl ether, 2-ethylhexyl vinyl ether, cyclohexyl vinyl ether, lauryl vinyl ether and the like; mono-olefins such as ethylene, propyrene and the like; maleates such as dimethyl maleate, diethyl maleate, dioctyl maleate and the like; di-olefins such as butadiene, isoprene and the like; allyl compounds such as allyl acetate and the like; methacrylic esters such as methyl methacrylate, ethyl methacrylate, n-butyl methacrylate, isobutyl methacrylate, 2-ethylhexyl methacrylate, n-octyl methacrylate, decyl methacrylate, dodecyl methacrylate and the like; styrene monomers such as styrene, vinyl toluene and the like; monomers such as acrylonitrile and the like. And in addition to the above, the macro monomer of the monomer described above is included.

The preparation of the macro monomer can be easily performed according to the well-known recipes in the art.

For example, the monomer described above is subjected to the radical polymerization with thioglycol acid and 2-mercapto ethanol in the presence of an initiator, and then the radical polymerizable unsaturated bond is introduced into the one terminal end by reacting the resultant reaction products with glycidyl methacrylate and isocyanato ethyl methacrylate and the like to form the above macro monomer.

The monomer used can be selected from one or more kinds of the monomers mentioned above.

The monomer (M2) preferably contains a repeating unit A derived from monomers of fluorine atom-containing acrylate or methacrylate.

Specifically, the repeating unit A can be derived from the mixture of fluoro methacrylate and fluoro acrylate represented by the following formula (P).

$$(Rf)pLOCOCR{=}CH_2 \qquad \text{Formula (P)}$$

wherein, the substituent Rf represents a monovalent aliphatic organic group having 1 to 20 carbon atoms, more preferably 2 to 10 carbon atoms, and at least one fluorine atom. The backbone chain of Rf may be either a straight chain, a branched chain or a ring chain, and may contain an quaternary divalent oxygen atom or a trivalent nitrogen atom bonded only to the carbon atom directly. Rf is preferably completely fluorinated, but the substituent of the backbone chain of Rf may include a hydrogen atom or a chlorine atom bonded to the carbon atom. Rf preferably contains at least one perfluoromethyl terminal group. p is preferably 1 or 2.

The bonding group L represents one of a bond having 1 to 12 carbon atoms and a hydrocarbyl group bonding group, and also a group substituted and/or interrupted arbitrary by another atoms such as O, P, S, and N, or an unsubstituted group. R represents one selected from a hydrogen atom and a methyl group. The mentioned fluoro methacrylate monomer preferably contains 30% by weight or more of fluorine atoms.

One example of the fluoro methacrylate preferred for the present invention includes the compound set forth below;

$$CF_3(CF_2)x(CH_2)yOCOCR{=}CH_2$$

wherein, x represents an integer of 0 to 20, more preferably an integer of 2 to 10, y represents an integer of 1 to 10, and R represents one selected from a hydrogen atom and a methyl group.

$$HCF_2(CF_2)xCH_2)yOCOCR{=}CH_2$$

wherein, x represents an integer of 0 to 20, preferably an integer of 2 to 10, y represents an integer of 1 to 10, and R represents one selected from a hydrogen atom and a methyl group.

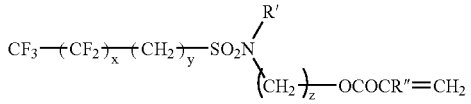

wherein, x represents an integer of 0 to 20, preferably an integer of 2 to 10, y represents an integer of 1 to 10, z represents an integer of 1 to 4, R' represents one selected from an alkyl group and an aryl alkyl group, and R' represents one selected from a hydrogen atom and a methyl group.

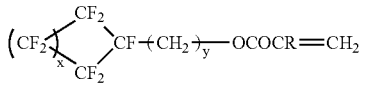

wherein, x represents an integer of 1 to 7, y represents an integer of 1 to 10, and R represents one selected from a hydrogen atom and a methyl group.

$$CF_3(CF_2CF_2O)x(CF_2O)y(CH_2)zOCOCR{=}CH_2$$

wherein, x+y represents an integer of 1 to 20, z represents an integer of 1 to 10, and R represents one selected from a hydrogen atom and a methyl group.

The copolymer according to the present invention may be either a random copolymer, a graft copolymer or a block copolymer. The molecular weight of the copolymer is preferably, in terms of weight-average molecular weight, in the range from about 5,000 to about 10,000,000, and more preferably from 5,000 to about 1,000,000.

As for the composition of the fluorine atom-containing copolymer used for the present invention, preferred specified examples are shown below. However, the scope of the present invention is not limited to these examples.

TABLE 1

| | FL-1 | FL-2 | FL-3 | FL-4 | FL-5 |
|---|---|---|---|---|---|
| MMA | 50.8 | 49.8 | 0 | 0 | 50.8 |
| LaMA | 0 | 0 | 0 | 22 | 0 |
| EtMA | 0 | 0 | 85 | 0 | 0 |
| Fluorine-containing monomer-1 | 41.2 | 48.2 | 7 | 70 | 36.2 |

TABLE 1-continued

| | FL-1 | FL-2 | FL-3 | FL-4 | FL-5 |
|---|---|---|---|---|---|
| 2-Acrylamido-2-methylpropanesulfonc acid | 8 | 0 | 0 | 0 | 0 |
| Acrylic acid | 0 | 2 | 8 | 0 | 8 |
| (Dimethylamino)ethyl methacrylate | 0 | 0 | 0 | 8 | 0 |
| Glycidyl methacrylate | 0 | 0 | 0 | 0 | 5 |

MMA: Methyl methacrylate

EtMA: Ethyl methacrylate

LaMA: Lauryl methacrylate

Fluorine atom-containing monomer-1: 1H,1H,2H,2H-Heptadecafluorodecyl methacrylate

TABLE 2

| | FL-6 | FL-7 | FL-8 |
|---|---|---|---|
| $CF_3(CF_2)7CH_2CH_2O—CH=CH_2$ | 72 | 0 | 0 |
| $CH_3(CH_2)_3—O—CH=CH_2$ | 14 | 0 | 0 |
| Thtrafluoroethylene | 0 | 25 | 0 |
| Propylene | 0 | 25 | 0 |
| Fluorine atom-containing monomer-2 | 0 | 0 | 50 |
| Fluorine atom-containing monomer-3 | 0 | 0 | 40 |
| Acrylic acid | 0 | 50 | 0 |
| Maleic anhydride | 14 | 0 | 0 |
| Methacrylic acid | 0 | 0 | 10 |

Fluorine Atom-containing Monomer-2

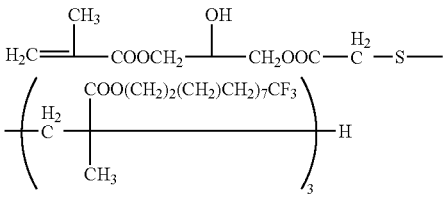

Fluorine Atom-containing Monomer-3

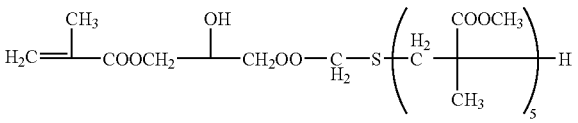

TABLE 3

| | FL-9 | FL-10 | FL-11 | FL-12 |
|---|---|---|---|---|
| MMA | 46.0 | 42.2 | 35.5 | 19.4 |
| BuA | 46.0 | 44.8 | 41.5 | 0 |
| Fluorine-containing monomer-4 | 5.0 | 10.0 | 20.0 | 40.0 |
| N-Methylolacrylamide | 1.0 | 1.0 | 1.0 | 1.0 |
| 2-Ethylhexyl acrylate | 0 | 0 | 0 | 37.6 |
| Acrylic acid | 2.0 | 2.0 | 2.0 | 2.0 |

BuA: Butyl acrylate

Fluorine-containing monomer-4: 2,2,2-Trifluoroethyl methacrylate

TABLE 4

| | FL-13 | FL-14 | FL-15 | FL-16 | FL-17 | FL-18 |
|---|---|---|---|---|---|---|
| Fluorine atom-containing monomer-5 | 5 | 15 | 25 | 20 | 5 | 10 |
| n-Butyl methacrylate | 90 | 60 | 65 | 70 | 83 | 78 |
| t-Butyl methacrylate | 0 | 20 | 0 | 0 | 0 | 0 |
| 2-Hydroxyethyl methacrylate | 0 | 0 | 5 | 5 | 10 | 10 |
| Acrylic acid | 5 | 5 | 5 | 5 | 2 | 2 |

Fluorine atom-containing monomer-5: β-(Perfluorooctyl)ethyl acrylate

The synthesis examples of the above specific examples will be described.

<Synthesis of FL-1>

Into the reaction vessel with a stirrer, a reflux condenser, a dropping funnel, a thermometer and a nitrogen gas inlet tube were added 64 parts of isopropyl alcohol, 4 parts of ion-exchanged water, 14.8 parts of methyl methacrylate, 41.2 parts of 1H, 1H, 2H, 2H-heptadecafluorodecyl methacrylate, and 8 parts of 2-acrylamide-2-methylpropane sulfonic acid, while the dissolved oxygen was removed by bubbling of nitrogen gas.

On the other hand, 36 parts of oxygen-free isopropyl alcohol, 36 parts of methyl methacrylate and 0.07 parts of azobis-isobutyronitrile were added into the dropping funnel.

After the temperature of the vessel was heated to 83±3° C., 2 parts of methyl ethyl ketone containing 0.13 parts of azobis-isobutyronitrile was added to the mixture, and the monomer was dropped from the dropping funnel in accordance with the consumption speed of the methyl methacrylate.

After the finish of dropping the monomer, 3 parts of methyl ethyl ketone prepared by dissolving 0.2 parts of azobis-isobutyronitrile was added thereto and the reaction was continued over a period of 2 hours. Thereafter, 2 parts of methyl ethyl ketone prepared by dissolving 0.1 part of azobis-isobutyronitrile was added and the reaction was continued over a period of 6 hours to give a homogeneous copolymer.

Thereafter, 15.5 parts of a 10% by weight aqueous sodium hydroxide solution was added to the resultant copolymer to neutralize, and then 300 parts of ion-exchange water was added. The remaining methyl ethyl ketone was removed under the reduced pressure to form an aqueous dispersion of polymer FL-1 of the present invention.

<Synthesis of FL-7>

Into 1 liter stainless steel-made autoclave with stirrer were added 450 parts of oxygen-free methyl ethyl ketone and 5 parts of acrylic acid, and an inner gas was replaced by a nitrogen gas.

After the inner gas was replaced by tetrafluoroethylene, the mixed monomer of propylene/tetrafluoroethylene=60 mol %/40 mol % was poured in the mixture and the inner pressure was set to 4.9 MPa.

The temperature was elevated after the start of the stirring, and when the inner temperature reached to 70° C., 10 parts of methyl ethyl ketone prepared by dissolving 0.9 parts of benzoyl peroxide was poured and the mixed monomer having the same composition as the above was added while keeping the inner pressure at 13.7 MPa. Thereafter 145 parts of acrylic acid was added over a period of 8 hours. While keeping the inner temperature at 75° C., each monomer was added in accordance with the consumption speed of propylene and tetrafluoroethylene, during the process the inner pressure was kept in the range of 12.7 Mpa to 13.7 MPa. Thereafter, at 3 hours later and at 6 hours later, 10 parts of methyl ethyl ketone prepared by dissolving 0.9 parts of benzoyl peroxide was added respectively and then after the reaction was continued over a period of 12 hours, the autoclave was cooled down and the volatile substances were evaporated. Where the consumption amount of the mixed monomer reached to approximately 150 parts.

The composition of the thus-prepared copolymer was measured by NMR method and the measurement resulted in the composition such as tetrafluoroethylene/propyrene/acrylic acid=25% by weight/25% by weight/50% by weight.

Thereafter, to the 100 parts of the copolymer (solid content: 38.5 parts), 27 parts of triethylamine and 160 parts of ion-exchange water were added and then the remaining methyl ethyl ketone was removed under the reduced pressure to form an aqueous dispersion of polymer FL-7 of the present invention.

The synthesizing method of the polymer used for the present invention is not restricted to the above procedures, but any well-known method can be applied. The details can be referred to the literature described in JP-A Nos. 2-147601, 5-17538, 8-208936, and 11-288061.

The solvent of the coating solution for the outermost layer may be either an organic solvent or an aqueous solvent, but an aqueous solvent is preferred. In the case of the aqueous solvent, the copolymer used in the present invention is preferably a hydrophobic polymer and preferably used as in the form of polymer latex in the coating solution. Herein the polymer latex means a dispersed state where fine particles of a water-insoluble hydrophobic polymer are dispersed in water.

The average particle size and the particle size distribution of the dispersed particles are the same values described in <Explanation of Polymer Latex> described above.

The term "an aqueous solvent" means a solvent consisted of water or a mixture of water and 70% by weight or less of a water-miscible organic solvent. Examples of the water-miscible organic solvents include alcohols such as methyl alcohol, ethyl alcohol, and propyl alcohol, cellosolves such as methyl cellosolve, ethyl cellosolve and butyl cellosolve, ethyl acetate and dimethyl formamide, and the like.

The copolymer according to the present invention can be used for the binder of the outermost layer. Depending on needs, the binder of the outermost layer may contain the hydrophilic polymers such as gelatin, polyvinyl alcohol, methyl cellulose, hydroxypropyl cellulose and carboxymethyl cellulose and/or the latex polymers described below in combination.

In addition, any layer besides the outermost layer may use the above copolymer as the binder thereof. If the polymer latex is used for the other layer besides the outermost layer, the above hydrophilic polymer and/or the latex polymer described below as used for the outermost layer also can be used in combination.

When the above-mentioned copolymer is used for the outermost layer, the content of the polymer is in the range from 50% by weight to 100% by weight, more preferably from 70% by weight to 100% by weight, based on the total binders.

The coating amount of the binder of the outermost layer is in the range from 0.3 $g/m^2$ to 4.0 $g/m^2$, and more preferably from 0.5 $g/m^2$ to 2.0 $g/m^2$.

4) Organic Crosslinking Agent

As the organic crosslinking agent for use in the present invention, it is enough that the organic crosslinking agent has two or more groups, which react with a carboxyl group, in a molecule, and the species of organic crosslinking agent are not particularly limited. The examples of organic crosslinking agent are described in T. H. James, "THE THEORY OF THE PHOTOGRAPHIC PROCESS, FOURTH EDITION" (Macmillan Publishing Co., Inc., pages 77 to 87, 1977).

As the preferable compound of organic crosslinking agent, carboxylic acid derivatives, carbamic acid derivatives, epoxy compounds, amine compounds, aziridine compounds, isocyanate compounds, carbodiimide compounds and oxazoline compounds can be described. Epoxy compounds, isocyanate compounds, carbodiimide compounds and oxazoline compounds are more preferred.

Specifically, following compounds can be described, however, the present invention is not limited in following examples.

(Carbodiimide)

Water-soluble or water-dispersible carbodiimide is preferred, and as examples, polycarbodiimide derived from isophorone diisocyanate described in JP-A Nos. 59-187029 and 5-27450, carbodiimide compounds derived from tetramethylxylylene diisocyanate described in JP-A No. 7-330849, multi-branched type carbodiimide described in JP-A No. 10-30024, and carbodiimide derived from dicyclohexyl methanediisocyanate described in JP-A No. 2000-7642 can be described.

(Oxazoline Compound)

Water-soluble or water-dispersible oxazoline compound is preferred, and as example, oxazoline compounds described in JP-A No. 2001-215653 can be described.

(Isocyanate Compound)

Since it is reactable compound with water, water-dispersible isocyanate is preferred from a viewpoint of the stability of its solution, and especially that having self-emulsification property is preferred. As examples, water-dispersible isocyanates described in JP-A Nos. 7-304841, 8-277315, 10-45866, 9-71720, 9-328654, 9-104814, 2000-194045, 2000-194237 and 2003-64149 can be described.

(Epoxy Compound)

Water-soluble or water-dispersible epoxy compound is preferred, and as examples, water-dispersible epoxy compounds described in JP-A Nos. 6-329877 and 7-309954 can be described.

More specific examples of crosslinking agent for use in the present invention are shown below, however the present invention is not limited in the following examples.

(Isocyanate Compound)

Trade Name:

Duranate WB40-100 (Asahi Chemical Industries Co., Ltd.)

Duranate WB40-80D (Asahi Chemical Industries Co., Ltd.)

Duranate WT20-100 (Asahi Chemical Industries Co., Ltd.))

Duranate WT30-100 (Asahi Chemical Industries Co., Ltd.)

CR-60N (Dainippon Ink & Chemicals, Inc.)

(Carbodiimide Compound)

Trade Name:

Carbodilite V-02 (Nisshinbo Industries, Inc.)

Carbodilite V-02-L2 (Nisshinbo Industries, Inc.)

Carbodilite V-04 (Nisshinbo Industries, Inc.)

Carbodilite V-06 (Nisshinbo Industries, Inc.)

Carbodilite V-02 (Nisshinbo Industries, Inc.)

Carbodilite E-01 (Nisshinbo Industries, Inc.)

Carbodilite E-02 (Nisshinbo Industries, Inc.) (Oxazoline compound)

Trade Name:

Epocros K-1010E (Nippon Shokubai Co., Ltd.)
Epocros K-1020E (Nippon Shokubai Co., Ltd.)
Epocros K-1030E (Nippon Shokubai Co., Ltd.)
Epocros K-2010E (Nippon Shokubai Co., Ltd.)
Epocros K-2020E (Nippon Shokubai Co., Ltd.)
Epocros K-2030E (Nippon Shokubai Co., Ltd.)
Epocros WS-500 (Nippon Shokubai Co., Ltd.)
Epocros WS-700 (Nippon Shokubai Co., Ltd.)

At the time when a coating solution is prepared, a crosslinking agent is preferably added as a solution. The solution of crosslinking agent is preferably added to the mixture for coating solution 180 minutes before coating to just before coating, preferably 60 minutes before to 10 seconds before coating. However, so long as the effect of crosslinking is sufficiently exhibited, there is no particular restriction concerning the mixing method and the conditions of mixing. As specific mixing methods, there can be mentioned a method of mixing in the tank, in which the average stay time calculated from the flow rate of addition and the feed rate to the coater is controlled to yield a desired time, or a method using static mixer as described in Chapter 8 of N. Harnby, M. F. Edwards, A. W. Nienow (translated by Koji Takahashi) "Liquid Mixing Technology" (Nikkan Kogyo Shinbunsha, 1989), and the like.

The coating solution for non-photosensitive protective layer is preferably prepared by addition of crosslinking agent to the composition of the other non-photosensitive protective layer with an in-line. The meaning of "addition with an in-line" means the adding method of mixing from another solution-preparing tank in the process to make the coating solution flow from the solution-preparing tank and coat. By an addition with in-line, the advantages, wherein the reaction efficiency of crosslinking agent becomes high, the membrane strength improves, a photographic property improves and the like, are obtained.

The addition amount of the organic crosslinking agent for use in the present invention preferably is from 0.5 part by weight to 200 part by weight with respect to 100 part by weight of binder in component layer including that organic crosslinking agent, more preferably from 2 part by weight to 100 part by weight, and further more preferably from 3 part by weight to 50 part by weight.

5) Matting Agent

In the present invention, a matting agent may be included in at least either the outermost layer or the layer adjacent to the outermost layer. The case, where a matting agent is included in the outermost layer, is preferred. The layer including a matting agent may be one layer or plural layers.

Particularly, the matting agent is preferably used as a particle dispersion, which is beforehand dispersed by water-soluble polymer not derived from animal protein. And the surfactant described below is more preferably added to a particle dispersion of the matting agent.

The matting agent in the present invention is generally water-insoluble organic or inorganic fine particle. The arbitrary matting agent can be used and for example, the organic matting agent described in U.S. Pat. Nos. 1,939,213, 2,701,245, 2,322,037, 3,262,782, 3,539,344, 3,767,448 and the like, the inorganic matting agent described in U.S. Pat. Nos. 1,260,772, 2,192,241, 3,257,206, 3,370,951, 3,523,022, 3,769,020 and the like, these well-known ones in the said industry, can be used.

As the organic compound used as a matting agent, aqueous dispersed vinyl polymers such as polymethyl acrylate, polymethyl methacrylate, polyacrylonitrile, acrylonitrile/α-methylstyrene copolymer, polystyrene, styrene/divinylbenzene copolymer, polyvinyl acetate, polyethylene carbonate, polytetrafluoroethylene and the like, cellulose derivatives such as methylcellulose, cellulose acetate, cellulose acetate propionate and the like, starch derivatives such as carboxy starch, carboxynitrophenyl starch, reactants of urea-formaldehyde-starch and the like, hardened gelatin by known hardener and the like, hardened gelatin as a fine hollow capsule particle by a coacervated hardening are preferably used.

As examples of inorganic compound, silicon dioxide, titanium dioxide, magnesium dioxide, aluminium oxide, barium sulfate, calcium carbonate, silver chloride and silver bromide desensitized by known method, glass, diatomaceous earth and the like are preferably used. Different kind of compound can be used by mixing with the above matting agent, depending on needs. As for a size of matting agent, an arbitrary particle size can be used without the limitation of particle size and form of matting agent. In this invention, the matting agent having a particle size of 0.1 μm to 30 μm is preferably used. The particle size is more preferably 0.3 μm to 20 μm, and still more preferably 0.5 μm to 10 μm. And the size distribution may be any of narrow and wide. The variation coefficient of a particle size distribution is preferably 50% or less, more preferably 40% or less, and still more preferably 30% or less. Herein, the variation coefficient means the value represented by (standard deviation of particle size)/(average value of particle size)×100. And the combined use of two kinds of matting agent, which has a low variation coefficient and the ratio of the average particle size is larger than 3, is preferable.

On the other hand, because a matting agent effects greatly to haze and surface gloss, it is preferred that the particle size, the shape and the size distribution are arranged in the suitable condition in proportion to the need at the making time of the matting agent or at the mixing time of plural matting agents.

Preferable examples of the matting agent used in the present invention are described below, however this invention is not limited in these.

M-1; polyethylene particle, specific gravity 0.90, (FLOW BEADS LE-1080 produced by Sumitomo Seika Co., Ltd.)

M-2; polyethylene particle, specific gravity 0.93, (FLOW BEADS EA-209 produced by Sumitomo Seika Co., Ltd.)

M-3; polyethylene particle, specific gravity 0.96, (FLOW BEADS HE-3040 produced by Sumitomo Seika Co., Ltd.)

M-4; silicon particle, specific gravity 0.97

M-5; silicon particle, specific gravity 1.00, (E-701 produced by Dow Corning Toray Silicone Co., Ltd.)

M-6; silicon particle, specific gravity 1.03

M-7; polystyrene particle, specific gravity 1.05, (SB-6 produced Sekisui Plastics Co., Ltd.)

M-8; poly(St/MAA=97/3) copolymer particle, specific gravity 1.05

M-9; poly(St/MAA=90/10) copolymer particle, specific gravity 1.06

M-10; poly(St/MMA/MAA=50/40/10) copolymer particle, specific gravity 1.09

M-11; crosslinking polyethylene particle, specific gravity 0.92

M-12; crosslinking polyethylene particle, specific gravity 0.95

M-13; crosslinking polyethylene particle, specific gravity 0.98

M-14; crosslinking silicon particle, specific gravity 0.99

M-15; crosslinking silicon particle, specific gravity 1.02

M-16; crosslinking silicon particle, specific gravity 1.04

M-17; poly(St/DVB=90/10) particle, specific gravity 1.06 (SX-713 produced by SOKENKAGAKU Co.)

M-18; poly(St/DVB=80/20) particle, specific gravity 1.06 (SX-713 produced by SOKENKAGAKU Co.)

M-19; poly(St/DVB=70/30) particle, specific gravity 1.07 (SX-713 produced by SOKENKAGAKU Co.)

M-20; copoly(St/MAA/DVB=87/3/10) particle, specific gravity 1.06, (SX-713 α produced by SOKENKAGAKU Co.)

M-21; copoly(St/MAA/DVB=80/10/10) particle, specific gravity 1.07, (SX-713 α produced by SOKENKAGAKU Co.)

M-22; copoly(St/MMA/MAA/DVB=40/40/10/10) particle, specific gravity 1.10

The content of a matting agent is set within a range in which the expected effect of the present invention can be exhibited and the original function of the layer containing a matting agent can not be prevented too much. The addition amount of the matting agent is preferably in the range from 1 mg/m$^2$ to 400 mg/m$^2$, more preferably from 5 mg/m$^2$ to 300 mg/m$^2$, with respect to the coating amount per 1 m$^2$ of the photosensitive material.

When the matting agent is contained in the image forming layer surface, it is generally that it is general that the amount of the matting agent is within the range not to occur star dust trouble and the matt degree of 500 seconds to 10,000 seconds is preferred, and more preferred, 500 seconds to 2,000 seconds as Beck's smoothness. When the matting agent is contained in a back layer, the matt degree of the back layer is preferably in a range of 2,000 seconds or less and 10 seconds or more, and more preferably 1,500 seconds or less and 50 seconds or more. Beck's smoothness can be calculated by seeing Japan Industrial Standared (JIS) P8119 and TAPPI standard method T479.

The matting agent contained in the outermost layer located on the side of image forming layer and the layer adjacent to the outermost layer is used as a dispersion of matting particles by pre-dispersion with water-soluble polymer not originated in animal protein. There are two dispersion methods.

(a) the preparing method of a matting agent dispersion to make a polymer droplet by emulsified dispersion in an aqueous medium of polymer solution prepared in advance (e.g., dissolved in an organic solvent having a low boiling point) as a matting agent and then to remove the organic solvent having a low boiling point from the emulsion (b) the method of arranging the dispersion of fine particle of polymer and the like prepared in advance as a matting agent in an aqueous medium not to get lumpy.

In the present invention, the method (b) that takes into consideration for environment not to exhaust a low boiling point solvent in air is preferably.

The dispersing method of the matting agent described above can comprised dispersing mechanically using the known high speed starring method (e.g., Disbar homogenizer, a homomixer, a turbine mixer, a homogenizer and the like) and an ultrasonic homogenizer in the beforehand presence of aqueous medium containing water-soluble polymer not derived from animal protein as a auxiliary dispersing agent in an aqueous solvent. At the dispersion, to prevent the occurrence of vesicular, the dispersing method which comprise dispersing the matting agent in the depressed condition less than atomospheric pressure can be used in combination. The auxiliary dispersing agent is generally dissolved in an aqueous solvent beforehand the addition of a matting agent, however can be added as an aqueous dispersion made by polymerized matting agent (without drying process). The auxiliary dispersing agent can be added in the dispersion solution during dispersion and can be added for the stabilization of physical property after dispersion. In each case, it is general that the solvent (e.g., water, alcohol and the like) is coexisted. At before and after the dispersion or during dispersion, pH may be controlled by a suitable pH controlling agent.

Besides the mechanical dispersing method, the stability of matting agent dispersion after dispersion may be increased by the pH control. And at dispersion, a very small quantity of organic solvent having a low boiling point can be used and in general, the organic solvent is removed after completion of the fine particlulating process.

The prepared dispersion can be stored with starring to prevent sedimentation of a matting agent at storage or can be stored in the highly viscosity condition using hydrophilic colloide (e.g., the case of jelly condition by using gelatin and the like). And to prevent the propagation of bacterium at the storage, the addition of antiseptics is preferred.

The water-soluble polymer not derived from animal protein is preferably added in an amount of 5% by weight to 300% by weight, and more preferably 10% by weight or to 200% by weight, with respect to the matting agent, and dispersed.

When the matting particle dispersion in the present invention contains a surfactant, the dispersion state becomes stable. Therefore, the addition of surfactant is preferable. The surfactant used herein is not especially limited, however, well-known compounds can be used. As an auxiliary dispersing agent disclosed conventionally, an anionic auxiliary dispersing agent such as alkylphenoxyethoxyethanesulfonate, polyoxyethylenealkyl phenyl ether sulfonate, alkylbenzenesulfonate, alkylnaphthalenesulfonate, alkylsulfonate, alkylsulfosuccinate, sodium oleilmethyltaurate, condensed polymer of formaldehyde and naphthalenesulfonic acid, polyacrylic acid, polymethacrylic acid, copolymer of maleic acid and acrylic acid, carboxymethyl cellulose, cellulose sulfate and the like, a nonionic auxiliary dispersing agent such as polyoxyethylene alkyl ether, sorbitane ester of aliphatic acid, polyoxyethylenesorbitane ester of aliphatic acid, blocked polymer of polyalkyleneoxide and the like, a cationic auxiliary dispersing agent and a betaine type auxiliary dispersing agent can be described. Particularly, an anionic surfactant such as sodium triisopropylnaphthalenesulfonate (a mixture of different substitution positions of three isopropyl groups) or the like is preferred.

As an antiseptic possible to add to the dispersion, for example, sodium salt of benzoisothiazolinone, p-hydroxybenzoic acid ester (methyl ester, butyl ester and the like) can be contained. Addition amount is preferably in a range from 0.005% to 0.1% with respect to the dispersion solution.

6) Fluorocarbon Surfactant

It is preferred that a photothermographic material of the present invention contains a fluorocarbon surfactant having a fluoroalkyl group which has at least 2 or more carbon atoms and 12 or less fluorine atoms, in at least one of the outermost layer and the layer adjacent to the outermost layer. The fluorocarbon surfactant according to the present invention may preferably be added to the matting agent dispersion described above.

The fluorocarbon surfactant for use in the present invention can have any structure, as far as it has a fluoroalkyl group described above (after now, fluorine atom-substituted alkyl group is called as [Rf]). And the fluorocarbon compound may have at least one or more Rf, and can have two or more Rfs. The fluorocarbon having two or more Rfs is preferred.

As specific examples of Rf, the following compounds can be described, but Rf is not limited thereto.

—$C_2F_5$ group, —$C_3F_7$ group, —$C_4F_9$ group, —$C_5F_{11}$ group, —$CH_2$—$C_4F_9$ group, —$C_4F_8$—H group, —$C_2H_4$—$C_4F_9$ group, $C_4H_8$—$C_4F_9$ group, —$C_6H_{12}$—$C_4F_9$ group, —$C_8H_{16}$—$C_4F_9$ group, $C_4H_8$—$C_2F_5$ group, —$C_4H_8$—$C_3F_7$ group, —$C_4H_8$—$C_5F_{11}$ group, —$C_8H_{16}$—$C_2F_5$ group, —$C_2H_4$—$C_4F_8$—H group, —$C_4H_8$—$C_4F_8$—H group, —$C_6H_{12}$—$C_4F_8$—H group, —$C_6H_{12}$—$C_2F_4$—H group, —$C_8H_{16}$—$C_2F_4$—H group, —$C_6H_{12}$—$C_4F_8$—$CH_3$ group, —$C_2H_4$—$C_3F_7$ group, —$C_2H_4$——$C_5F_{11}$ group, —$C_4H_8$—$CF(CF_3)_2$ group, —$CH_2CF_3$ group, —$C_4H_8$—$CH(C_2F_5)_2$ group, —$C_4H_8$—$CH(CF_3)_2$ group, —$C_4H_8$—$C(CF_3)_3$ group, —$CH_2$—$C_4F_8$—H group, —$CH_2$—$C_6F_{12}$—H group Rf has 12 or less fluorine atoms, preferably 3 to 11 fluorine atoms, and more preferably 5 to 9 fluorine atoms. And Rf has 2 or more carbon atoms, preferably 4 to 16 carbon atoms, and more preferably 5 to 12 carbon atoms.

The structure of Rf is not particularly limited as for as Rf has 2 or more carbon atoms and 12 or less fluorine atoms, however, the group represented by the following formula (A) is preferred.

-Rc-Re-W Formula (A)

In formula (A), Rc represents an alkylene group having 1 to 4 carbon atoms, however, preferably 1 to 3 carbon atoms, and more preferably 1 or 2 carbon atoms.

An alkylene group represented by Rc may be a linear or a branched chain.

Re represents a perfluoroalkylene group having 2 to 6 carbon atoms, and preferably 2 to 4 carbon atoms. Herein, the perfluoroalkylene group means an alkylene group where all hydrogen atoms of an alkylene group are replaced by fluorine atoms. The perfluoroalkylene group described above may be a linear chain, a branched chain or a cyclic structure.

W represents one selected from a hydrogen atom, a fluorine atom and an alkyl group, preferably one of a hydrogen atom and a fluorine atom, and most preferably a fluorine atom.

(Gelling Binder)

In the present invention, a binder gelled by decrease of temperature can be used in the layer adjacent to the outermost layer. The gelling binder means a water-soluble polymer derived from animal protein described below or a water-soluble polymer, in which a gelling agent is added, not derived from animal protein or a hydrophobic polymer. As the gelation loses the fludisity of the layer formed by coating, the surface of the image forming layer is hard to be effected by air for drying, so the photothermographic material with uniform coating surface can be obtained.

Herein, it is important that a coating solution does not been gelled at a coating step. It is convenient for operation that the coating solution has fluidity at the coating step and loses fluidity by gelation before the drying step and after coating step.

The viscosity of the said coating solution at coating step preferably is from 5 mPa·s to 200 mPa·s, and more preferably from 10 mPa·s to 100 mPa·s.

In the present invention, an aqueous solvent is used as the solvent for a coating solution. The aqueous solvent signifies water or the mixture of water and 70% by weight or less of water-miscible organic solvent. As water-miscible solvent, there can be mentioned, for example, alcohols such as methyl alcohol, ethyl alcohol, propyl alcohol and the like, cellosolves such as methyl cellosolve, ethyl cellosolve, butyl cellosolve and the like; ethyl acetate, dimethylformamide and the like.

Though it is difficult to measure the viscosity of formed layer at the time before the drying step and after coating step (at this point, the gelation occurs), it is guessed that the viscosity is almost 200 mPa·s to 5000 mPa·s, preferably 500 mPa·s to 5000 mPa·s.

The gelation temperature is not specifically limited, however to consider the easy work operation of coating, the gelation temperature is preferably nearly about a room temperature. Because at this temperature, it is easy to make the fluidity increase for easy coating of a coating solution and the fluidity can be maintained (that is namely the temperature level, in which the elevated temperature can be maintained easily) and this is the temperature that the cooling can be easily operated to make the fluidity of formed layer lose after coating. The typical gelation temperature is 0° C. to 40° C., and more preferably 0° C. to 35° C.

The temperature of coating solution at coating step is not specifically limited as far as the temperature is set higher than a gelation temperature and the cooling temperature at the point before drying step and after coating step is not specifically limited as far as the temperature is set lower than a gelation temperature. However, when the difference between the temperature of coating solution and a cooling temperature is small, the problem, that the gelation starts during coating and uniform coating can not be performed, occurs. On the other hand, when the temperature of the coating solution is set too high to make this temperature difference large, it causes the problem that the solvent of coating solution is evaporated and the viscosity is changed. Therefore, the said temperature difference is preferably set in a range from 5° C. to 50° C., and more preferably 10° C. to 40° C.

1) Water-soluble Polymer Derived from Animal Protein

In the present invention, the water-soluble polymer derived from animal protein means natural or chemically modified water-soluble polymer such as glue, casein, gelatin, egg white and the like.

It is preferably gelatin, in which are acid treated gelatin and alkali treated gelatin (lime extracted gelatin and the like) depending on a synthetic method and any of them can be preferably used. The molecular weight of gelatin used is preferably 10,000 to 1,000,000. Modified gelatin of an amino group or a carboxy group of gelatin (e.g., phthalated gelatin and the like) can be also used.

In an aqueous gelatin solution, solation occurs when a gelatin solution is heated to 30° C. or more, and a gelatin solution loses fluidity when it is cooled to 30° C. or less. As this sol-gel exchange occurs reversibly, an aqueous gelatin solution as coating solution has the set property. That means, a gelatin solution, which is a coating solution, loses fluidity when it is cooled to 30° C. or less.

The content of water-soluble polymer derived from animal protein is 1% by weight to 20% by weight with respect to the entire coating solution, and preferably 2% by weight to 12% by weight.

2) Gelling Agent

The gelling agent in the present invention is the compound, which occurs gelation of the solution by adding it to an aqueous solution of water-soluble polymer not derived from animal protein or an aqueous solution of hydrophobic polymer latex and by cooling, or the compound which gelates by combined use with a gelling accelerator. The fluidity falls remarkably by gelation.

The following water-soluble polysaccharides can be described as the specific examples of gelling agent. Namely, these are at least one kind selected from agar, κ-carrageenan, ι-carrageenan, alginic acid, alginate, agarose, furcellaran, jellan gum, glucono-δ-lactone, azotobacter vinelandii gum, xanthane gum, pectin, guar gum, locust been gum, tara gum, cassia gum (Oak gum) glucomannan, traganth gum, Karaya gum, pullulan, gum arabic, arabinogalactan, dextran, sodium carboxymethyl cellulose, methyl cellulose, cyalume seed gum, starch, chitin, chitosan and curdlan.

As the compound which can gelate by cooling after solved by heating, agar, carrageenan, jellan gum and the like can be described.

Among these gelling agents, κ-carrageenan (e.g., K-9F produced by DAITO Co.; K-15, 21, 22, 23, 24, and I-3, all produced by NITTA GELATIN Co.), ι-carrageenan and agar are more preferable, and κ-carrageenan is particularly preferable.

The gelling agent is preferably used in a range from 0.01% by weight to 10.0% by weight, preferably 0.02% by weight to 5.0% by weight, and more preferably 0.05% by weight to 2.0% by weight, with respect to the binder polymer.

The gelling agent is preferably used with a gelation accelerator. The gelation accelerator in the present invention is the compound which accelerates gelation by contact with a gelling agent, whereby the gelling function can be developed by specific combination with the gelling agent. In the present invention, the combination of the gelling agent and the gelation accelerator shown below can be used.

(1) A combination of an alkali metal ion such as potassium ion and the like and an alkali earth metal ion such as calcium ion, magnesium ion, and the like as the gelation accelerator, and carrageenan, alginate, azotobactor vinelanddi gum, pectin, sodium carboxymethyl cellulose, and the like as the gelling agent.

(2) A combination of boric acid and other boric acid compound as the gelation accelerator, and guar gum, locust been gum, tara gum, cassia gum, and the like as the gelling agent.

(3) A combination of acid or alkali compound as the gelation accelerator and alginate, glucomannan, pectin, chitin, chitosan, curdlan and the like as the gelling agent.

(4) A water-soluble polysaccharide which can form gel by reaction with the galling agent is used as the gelation accelerator. As typical examples, a combination of using xanthan gum as the gelling agent and cassia gum as the gelling accelerator, and a combination of carrageenan as the gelling agent and locust been gum as the gelation accelerator, and the like are illustrated.

As the typical example of the combination of these gelling agents and gelation accelerators, the following combinations a) to g) can be described.

a) combination of κ-darrageenan and potassium
b) combination of ι-carrageenan and calcium
c) combination of low methoxyl pectin and potassium
d) combination of sodium arginate and potassium
e) combination of locust been gum and xanthan gum
f) combination of jellan gum and acid
g) combination of locust been gum and xanthan gum These combinations can be used simultaneously as plural combinations.

Although these galation accelerators can be added to the same layer in which the gelling agent is added, they can be preferably added in the different layer as to react. It is more preferably to add these galation accelerators to the layer not directly adjacent to that layer to which the gelling agent is added. Namely, it is preferable to make a layer not containing any of the gelling agent and the galation accelerator and located between the layer containing the gelling agent and the layer containing the galation accelerator.

The galation accelerator is used in a range from 0.1% by weight to 200% by weight, and preferably 1.0% by weight to 100% by weight, with respect to the gelling agent.

(Antihalation Layer)

The photothermographic material of the present invention may comprise an antihalation layer provided to the side farther from the light source with respect to the image forming layer. Descriptions on the antihalation layer can be found in paragraph Nos. 0123 to 0124 of JP-A No. 11-65021, in JP-A Nos. 11-223898, 9-230531, 10-36695, 10-104779, 11-231457, 11-352625, 11-352626, and the like.

The antihalation layer contains an antihalation dye having its absorption at the wavelength of the exposure light. In the case the exposure wavelength is in the infrared region, an infrared-absorbing dye may be used, and in such a case, preferred are dyes having no absorption in visible region.

In the case of preventing halation from occurring by using a dye having absorption in visible region, it is preferred that the color of the dye would not substantially reside after image formation, and is preferred to employ a means for bleaching color by the heat of thermal development; in particular, it is preferred to add a thermal bleaching dye and a base precursor to the non-photosensitive layer to impart function as an antihalation layer. Those techniques are described in JP-A No. 11-231457 and the like.

The addition amount of the thermal bleaching dye is determined depending on the usage of the dye. In general, it is used at an amount as such that the optical density (absorbance) exceeds 0.1 when measured at the desired wavelength. The optical density is preferably in the range from 0.2 to 2. The addition amount of dyes to obtain optical density in the above range is generally from 0.001 $g/m^2$ to 1 $g/m^2$.

By decoloring the dye in such a manner, the optical density after thermal development can be lowered to 0.1 or lower. Two or more kinds of thermal bleaching dyes may be used in combination in a photothermographic material. Similarly, two or more kinds of base precursors may be used in combination.

In the case of thermal decolorization by the combined use of a decoloring dye and a base precursor, it is advantageous from the viewpoint of thermal decoloring efficiency to further use the substance capable of lowering the melting point by at least 3° C. when mixed with the base precursor (e.g., diphenylsulfone, 4-chlorophenyl(phenyl)sulfone) as disclosed in JP-A No. 11-352626.

(Matting Agent)

A matting agent may be preferably added to the surface protective layer in order to improve transportability. Description on the matting agent can be found in paragraphs Nos. 0126 to 0127 of JP-A No. 11-65021.

The addition amount of the matting agent is preferably in the range from 1 $mg/m^2$ to 400 $mg/m^2$, and more preferably, from 5 $mg/m^2$ to 300 $mg/m^2$, with respect to the coating amount per 1 $m^2$ of the photothermographic material.

The matt degree on the image forming layer surface is not restricted as far as star-dust trouble occurs, but the matt degree of 30 seconds to 2000 seconds is preferred, particularly preferred, 40 seconds to 1500 seconds as Beck's smoothness. Beck's smoothness can be calculated easily, by seeing Japan Industrial Standared (JIS) P8119 "The method of testing Beck's smoothness for papers and sheets using Beck's test apparatus", or TAPPI standard method T479.

In the present invention, a matting agent is preferably contained in an outermost layer, in a layer which can be function as an outermost layer, or in a layer nearer to outer surface, and also preferably is contained in a layer which can function as so-called protective layer.

(Antistatic Agent)

The photothermographic material of the invention may contain an electrically conductive layer including various kinds of metal oxides or electrically conductive polymers known to the public. The antistatic layer may serve as an undercoat layer described above, or a back surface protective layer, and the like, but can also be placed specially. As to the antistatic layer, technologies described in paragraph No. 0135 of JP-A No. 11-65021, JP-A Nos. 56-143430, 56-143431, 58-62646, and 56-120519, and in paragraph Nos. 0040 to 0051 of JP-A No. 11-84573, U.S. Pat. No. 5,575,957, and in paragraph Nos. 0078 to 0084 of JP-A No. 11-223898 can be applied.

(Support)

As the transparent support, favorably used is polyester, particularly, polyethylene terephthalate, which is subjected to heat treatment in the temperature range from 130° C. to 185° C. in order to relax the internal strain caused by biaxial stretching and remaining inside the film, and to remove strain ascribed to heat shrinkage generated during thermal development.

As the support of the photothermographic material used in combination with the ultraviolet radiation emission screen, PEN is preferably used, but the present invention is not limited thereto. As the PEN, polyethylene-2,6-naphthalate is preferred. The "polyethylene-2,6-naphthalate" herein means that the structure repeating units essentially may consist of ethylene-2,6-naphthalene dicarboxylate groups and also may include un-copolymerized polyethylene-2,6-naphthalene dicarboxylate, and the copolymer comprising 10% or less, and preferably 5% or less, of the structure repeating units denatured with the other components and mixtures or constituents of other polymer.

Polyethylene-2,6-naphthalate can be synthesized by reacting a naphthalene-2,6-dicarboxylic acid or functional derivatives thereof, and an ethylene glycol or functional derivatives thereof in the presence of a suitable catalyst at proper reaction condition. The polyethylene-2,6-naphthalate of the present invention may be copolymerized or blended polysters, where one or more kinds of suitable third component (denaturing agent) is added before the completion of polymerization of the polyethylene-2,6-aphthalate. As the suitable third component, compounds containing a divalent ester forming functional group, for example, dicarboxylic acids such as oxalic acid, adipic acid, phthalic acid, isophthalic acid, terephthalic acid, naphthalene-2,7-dicarboxylic acid, succinic acid, diphenylether dicarboxylic acid and the like, or lower alkylesters thereof, oxycarboxylic acids such as p-oxybenzoic acid, p-oxyethoxybenzoic acid, or lower alkylesters thereof, and divalent alcohols such as propylene glycol, trimethylene glycol and the like are described. Polyethylene-2,6-naphthalate and the denatured polymers thereof may include, for example, the polymer where the terminal hydroxy group and/or the carboxylic group is blocked by mono-functional compounds such as benzoic acid, benzoyl benzoic acid, benzyloxy benzoic acid, methoxy polyalkylene glycol and the like, or the polymer denatured with a very small amount of compounds having tri-functional or tetra-functional ester forming group such as glycerine and penta-erthritol in the extent to form linear chain copolymers substantially.

In the case of a photothermographic material for medical use, the transparent support may be colored with a blue dye (for instance, dye-1 described in Examples of JP-A No. 8-240877), or may be uncolored.

Exemplified embodiments of the support are described in paragraph No. 0134 of JP-A No. 11-65021.

As to the support, it is preferred to apply undercoating technology, such as water-soluble polyester described in JP-A No. 11-84574, a styrene-butadiene copolymer described in JP-A No. 10-186565, a vinylidene chloride copolymer described in JP-A No. 2000-39684.

(Other Additives)

Furthermore, antioxidant, stabilizing agent, plasticizer, UV absorbent, or a film forming promoting agent may be added to the photothermographic material. A solvent described in paragraph No. 0133 of JP-A No. 11-65021 may be added. Each of the additives is added to either of the image forming layer (photosensitive layer) or the non-photosensitive layer. Reference can be made to WO No. 98/36322, EP-A No. 803764A1, JP-A Nos. 10-186567 and 10-18568, and the like.

(Coating Method)

The photothermographic material of the invention may be coated by any method. More specifically, various types of coating operations inclusive of extrusion coating, slide coating, curtain coating, immersion coating, knife coating, flow coating, or an extrusion coating using the kind of hopper described in U.S. Pat. No. 2,681,294 are used. Preferably used is extrusion coating or slide coating described in pages 399 to 536 of Stephen F. Kistler and Petert M. Schweizer, "LIQUID FILM COATING" (Chapman & Hall, 1997), and particularly preferably used is slide coating.

Example of the shape of the slide coater for use in slide coating is shown in FIG. 11*b*.1, page 427, of the same literature. If desired, two or more layers can be coated simultaneously by the method described in pages 399 to 536 of the same literature, or by the method described in U.S. Pat. No. 2,761,791 and British Patent No. 837095.

The coating solution for the image forming layer according to the invention is preferably a so-called thixotropic fluid. For the details of this technology, reference can be made to JP-A No. 11-52509.

In the invention, viscosity of the coating solution for the image forming layer at a shear velocity of 0.1 $S^{-1}$ is preferably from 400 mPa·s to 100,000 mPa·s, and more preferably, from 500 mPa·s to 20,000 mPa·s.

At a shear velocity of 1000 $S^{-1}$, the viscosity is preferably from 1 mPa·s to 200 mPa·s, and more preferably, from 5 mPa·s to 80 mPa·s.

(Wrapping Material)

In order to suppress fluctuation from occurring on the photographic property during a preservation of the invention before thermal development, or in order to improve curling or winding tendencies when the photothermographic material is manufactured in a roll state, it is preferred that a wrapping material having low oxygen transmittance and/or vapor transmittance is used. Preferably, oxygen transmittance is 50 $mL \cdot atm^{-1}m^{-2}day^{-1}$ or lower at 25° C., more preferably, 10 $mL \cdot atm^{-1}m^{-2}day^{-1}$ or lower, and further preferably, 1.0 $mL \cdot atm^{-1}m^{-2}day^{-1}$ or lower. Preferably, vapor transmittance is 10 $g \cdot atm^{-1}m^{-2}day^{-1}$ or lower, more preferably, 5 $g \cdot atm^{-1}m^{-2}day^{-}$ or lower, and further preferably, 1 $g \cdot atm^{-1}m^{-2}day^{-1}$ or lower. As specific examples of a wrapping material having low oxygen transmittance and/or vapor transmittance, reference can be made to, for instance, the wrapping material described in JP-A Nos. 8-254793 and 2000-206653.

(Other Applicable Techniques)

Techniques which can be used for the photothermographic material of the invention also include those in EP-A No. 803764A1, EP-A No. 883022A1, WO No. 98/36322, JP-A Nos. 56-62648, 58-62644, JP-A Nos. 09-43766, 09-281637, 09-297367, 09-304869, 09-311405, 09-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, 2001-200414, 2001-234635, 2002-20699, 2001-275471, 2001-275461, 2000-313204, 2001-292844, 2000-324888, 2001-293864 and 2001-348546.

3. Image Forming Method

The image forming method of the present invention comprises recording X-ray images using an X-ray intensifying screen.

The image forming method comprises the steps of:

(a) providing an assembly for forming an image by placing the photothermographic material between a pair of the X-ray intensifying screens, (b) putting an analyte between the assembly and the X-ray source, (c) applying an X-ray having an energy level of 25 kVp to 125 kVp to the analyte, (d) taking the photothermographic material out of the assembly, and (e) heating the thus taken out photothermographic material in the temperature range of 90° C. to 180° C.

On the photographic characteristic curve of the photothermographic material for the assembly subjected to X-ray exposure through a step wedge tablet and thermal developed, it is preferred to adjust so that an average gamma (γ) made at the points of a density of fog+0.1 and a density of fog+0.5 is from 0.5 to 0.9, and an average gamma (γ) made at the points of a density of fog+1.2 and a density of fog+1.6 is from 3.2 to 4.0. For the X-ray radiography in the present invention, the photothermographic material having the aforesaid photographic characteristic curve would give the X-ray images with excellent photographic performances that exhibit an extended tone in bottom portion and high gamma value at middle density area. According to this photogaraphic performances, several advantages are obtained, such as that the depiction in low density part on the mediastinal region and the heart shadow region having little X-ray transmittance becomes excellent, and that the density becomes pleasing to the eye and the contrast becomes moderate in the images on the lung field region having much X-ray transmittance.

The photothermographic material having the preferred photographic characteristic curve mentioned above can be easily prepared, for example, by the method where each of the image forming layer on both sides may be constituted of two or more image forming layers containing silver halide having a different sensitivity each other. Especially, the aforesaid image forming layers preferably comprise an emulsion of higher sensitivity for the upper layer and an emulsion with photographic properties of lower sensitivity and high contrast for the lower layer. In the case of preparing the image forming layer comprising two layers, the sensitivity difference between the silver halide emulsion in each layer is preferably from 1.5 times to 20 times, and more preferably from 2 times to 15 times. The ratio of the amount of emulsion for forming each layer may depend on the sensitivity difference between emulsions and the covering power. Generally, as the sensitivity difference is larger, the ratio of the amount of higher sensitivity emulsion is more reduced. For example, if the sensitivity difference is two times, and the covering power is equal, the ratio of the amount of higher sensitivity emulsion to lower sensitivity emulsion would be preferably adjusted to be in the range from 1:20 to 1:50 based on silver amount.

As the techniques for crossover cut (in the case of double-side coated photosensitive material) and anti-halation (in the case of single-side coated photosensitive material), dyes or combined use of dye and mordant described in JP-A. No. 2-68539, (from page 13, left lower column, line 1 to page 14, left lower column, line 9) can be employed.

Next the fluorescent intensifying screen (radiographic intensifying screen) employed in the practice of the present invention is explained below. The radiographic intensifying screen essentially comprises a support and a fluorescent substance layer coated on one side of the support as the fundamental structure. The fluorescent substance layer is a layer where the fluorescent substance is dispersed in binders. On the surface of a fluorescent substance layer opposite to the support side (the surface of the side that does not face on the support), a transparent protective layer is generally disposed to protect the fluorescent substance layer from chemical degradation and physical shock.

Preferred fluorescent substances of the present invention are described below. Tungstate fluorescent substances ($CaWO_4$, $MgWO_4$, $CaWO_4$:Pb and the like), terbium activated rare earth sulfoxide fluorescent substances [$Y_2O_2S$:Tb, $Gd_2O_2S$:Tb, $La_2O_2S$:Tb, $(Y,Gd)_2O_2S$:Tb, $(Y,Gd)O_2S$:Tb, Tm and the like], terbium activated rare earth phosphate fluorescent substances ($YPO_4$:Tb, $GdPO_4$:Tb, $LaPO_4$:Tb and the like), terbium activated rare earth oxyhalogen fluorescent substances (LaOBr:Tb, LaOBr:Tb, Tm, LaOCl:Tb, LaOCl:Tb, Tm, LaOBr:Tb, GdOBr:Tb, GdOCl:Tb and the like), thulium activated rare earth oxyhalogen fluorescent substances (LaOBr:Tm, LaOCl:Tm and the like), barium sulfate fluorescent substances [$BaSO_4$:Pb, $BaSO_4$:$Eu^{2+}$, (Ba, Sr) $SO_4$: $Eu^{2+}$ and the like], divalent europium activated alkali earth metal phosphate fluorescent substances [$(Ba_2PO_4)_2$:$Eu^{2+}$, $(Ba_2PO_4)_2$:$Eu^{2+}$, and the like], divalent europium activated alkali earth metal fluorinated halogenide fluorescent substances [BaFCl:$Eu^{2+}$, BaFBr:$Eu^{2+}$, BaFCl:$Eu^{2+}$, Tb, BaFBr:$Eu^{2+}$, Tb, $BaF_2$ BaCl KCl:$Eu^{2+}$, (Ba,Mg)$F_2$.BaCl.KCl:$Eu^{2+}$, and the like], iodide fluorescent substances (CsI:Na, CsI:Tl, NaI, KI:Tl and the like), sulfide fluorescent substances [ZnS:Ag(Zn,Cd)S:Ag, (Zn,Cd)S:Cu, (Zn,Cd)S:Cu, Al and the like], hafnium phosphate fluorescent substances ($HfP_2O_7$:Cu and the like), $YTaO_4$ and a substance in which various activator is added as an emission center to $YTaO_4$. However, the fluorescent substance used in the present invention is not particularly limited to these specific examples, so long as to emit light in visible or near ultraviolet region by exposure to a radioactive ray.

The X-ray fluorescent intensifying screen preferably used in the present invention is a screen where 50% or more of the emission light have a wavelength region from 350 nm to 420 nm. Especially, as the fluorescent substance, divalent europium activated fluorescent substance is preferred, and more preferably divalent europium activated barium halogenide fluorescent substances. The emitted wavelength region is preferably from 360 nm to 420 nm, and more preferably from 370 nm to 420 nm. Moreover, the preferred fluorescent intensifying screen can emit 70% or more of the above region, and more preferably 85% or more thereof.

The ratio of the emission light can be calculated from the following method; the emitted spectrum is measured where an antilogarithm of the emitted wavelength is plotted on the abscissa axis at equal interval and a number of the emitted photon is plotted on the ordinate. The ratio of the emission light in the wavelength region from 350 nm to 420 nm is defined as a value dividing the area from 350 nm to 420 nm on the chart by the entire area of the emitted spectrum. The photothermographic materials of the present invention used in combination with the fluorescent substance emitting the above wavelength region can attain high sensitivity.

In order that most of the emission light of the fluorescent substance exist in the above wavelength region, the narrower half band width is preferred. It is preferred that the half band width is from 1 nm to 70 nm, more preferably from 5 nm to 50 nm, and still more preferably 10 nm to 40 nm.

The fluorescent substance used in the present invention is not particularly limited as far as the fluorescent substance has the above emission light is attained, but the europium activated fluorescent substance where the divalent europium is an emission center is preferred to attain high sensitivity as the purpose of the invention. The scope of the present invention is not limited to the following examples.

The examples of the fluorescent substance include BaFCl:Eu, BaFBr:Eu, BaFI:Eu, and the fluorescent substances where their halogen composition is changed; $BaSO_4$:Eu, SrFBr:Eu, SrFCl:Eu, SrFI:Eu, (Sr,Ba) $Al_2Si_2O_8$:Eu, $SrB_4O_7F$:Eu, $SrMgP_2O_7$:Eu, $Sr_3(PO_4)_2$:Eu, $Sr_2P_2O_7$:Eu and the like.

The preferred fluorescent substance used in the practice of the present invention is a divalent europium activated barium halogenide type fluorescent substance expressed by the following formula.

$$MX_1X_2:Eu$$

Wherein, M represents Ba as a main component, but a small quantity of Mg, Ca, Sr, or the other compounds may be included. $X_1$ and $X_2$ represent a halogen atom respectively, and can be selected from F, Cl, Br and I arbitrary. Herein, $X_1$ is more preferably a fluorine atom. $X_2$ can be selected from Cl, Br, and I, and the mixture with other halogen composition may be used. More preferably, $X_2$ is Br. Eu represents an europium atom. Eu as the emission center is preferably present at a ratio from $10^{-7}$ to 0.1, based on Ba, and more preferably from $10^{-4}$ to 0.05. Preferably the mixture with a small quantity of the other compounds can be included. The most preferred fluorescent substance include BaFCl:Eu, BaFBr:Eu and $BaFBr_{1-x}I_x$:Eu.

The fluorescent intensifying screen preferably consists of a support, an undercoated layer on the support, a fluorescent substance layer, and a surface protective layer.

The fluorescent substance layer is prepared as follows. A dispersion solution is prepared by dispersing the fluorescent substance particles described above in an organic solvent solution containing binder resins. The thus-prepared solution is coated directly on the support (or on the undercoated layer such as a light reflective layer beforehand provided on the support) and dried to form the fluorescent substance layer. Besides the above method, the fluorescent substance layer may be formed by the steps of coating the above dispersion solution on the temporary support, drying the coated dispersion to form a fluorescent substance sheet, peeling off the sheet from the temporary support, and fixing the sheet onto a permanent support by means of an adhesive agent.

The particle size of the fluorescent substance particles used in the present invention is not particularly restricted, but is usually in the range from about 1 μm to 15 μm, and preferably from about 2 μm to 10 μm. A higher volume filling factor of the fluorescent substance particles in the fluorescent substance layer is preferred, and the volume filling factor usually is in a range from 60% to 85%, more preferably from 65% to 80%, and particularly preferably from 68% to 75%. (The ratio of the fluorescent substance particles in the fluorescent substance layer is usually 80% by weight or more, more preferably 90% by weight or more, and particularly preferably 95% by weight or more). Many well-known publications and references describe the binder resins, organic solvents and the various additives used for forming the fluorescent substance layer. The thickness of the fluorescent substance layer may be set arbitrary according to the target sensitivity, but is preferably in the range from 70 μm to 150 μm for the front side screen, and in the range from 80 μm to 400 μm for the back side screen. The X-ray absorption efficiency of the fluorescent substance layer depends on the coating amount of the fluorescent substance particles in the fluorescent substance layer.

The fluorescent substance layer may be of one layer, or may consists of two or more layers, preferably consists of one to three layers, and more preferably one or two layers. For example, the layer may be prepared by coating a plurality of the layer comprising the fluorescent substance particles with different particle size having a comparatively narrow particle size distribution. In that case, the particle size of the fluorescent substance particles contained in each component layer may gradually decrease from the top component layer to the bottom layer provided next to the support. Especially the large size of fluorescent substance particles is preferably coated for the surface protective layer of the screen, and the small size of fluorescent substance particles is preferably coated for the layer near to the support. Wherein, the small particle size of fluorescent substance particles is preferably in the range from 0.5 μm to 2.0 μm, and the large grain size is preferably in the range from 10 μm to 30 μm. The fluorescent substance layer may be formed by mixing the fluorescent substance particles with different grain size, or the preferred is the fluorescent substance layer where the fluorescent substances may be preferably packed in the structure of particle size changing by gradation as described in JP-A No.55-33560 (page 3, line 3 on the left column to page 4, line 39 on the left column). Usually, a variation coefficient of a particle size distribution of the fluorescent substances is in the range from 30% to 50%, but the mono-disperse fluorescent substance particles with a variation coefficient of 30% or less can also be preferably used.

The attempts to attain a desired sharpness by dying the fluorescent substance layer over the emission light wavelength region are practiced. However, the layer with least dying is preferably required. The absorption length of the fluorescent substance layer is preferably 100 μm or more, and more preferably 1000 μm or more.

The scattering length of the fluorescent substance layer is preferably designed to be from 0.1 μm to 100 μm, and more preferably from 1 μm to 100 μm. The scattering length and the absorption length can be calculated from the equation based on the theory of Kubelka-Munk mentioned below.

As for the support, any support selected arbitrary from various kinds of the support used in the well-known radiographic intensifying screen may be preferably used depending on the purpose. For example, a polymer film containing white pigments such as titanium dioxide and the like, and a polymer film containing black pigments such as carbon black and the like may be preferably used. An undercoat layer comprising such as a light reflective layer containing a light reflective agent may be preferably coated on the surface of the support (the surface side where the fluorescent substance layer is disposed). The light reflective layer described in JP-A No. 2001-124898 may be preferably used. Especially, the light reflective layer containing yttrium oxide described in Example 1 of the above Patent or the light reflective layer described in the Example 4 of the same Patent is preferred. As for the preferred light reflective layer, the mentions described in JP-A No. 23001-124898 (paragraph 3, 15 line on the right side to paragraph 4, line 23 on the right side) can be referred.

The surface protective layer is preferably coated on the surface of the fluorescent substance layer. The light scattering length measured at the main emission wavelength of the fluorescent substance is preferably in the range from 5 μm to 80 μm, more preferably 10 μm to 70 μm, and particularly preferably 10 μm to 60 μm. Wherein, the light scattering length indicates a mean distance in which a light travels straight until it is scattered. Therefore a short scattering length means that the light scattering efficiency is high. On the other hand, the light absorption length which indicates a mean free distance until a light is absorbed is optional. From the viewpoint of the screen sensitivity, no absorption by the surface protective layer favors for preventing the desensitization. In order to compensate the scattering loss, a very slightly absorption may be allowable. Preferred absorption length is 800 μm or more, and more preferably 1200 μm or more. The light scattering length and the light absorption length can be calculated from the equation based on the theory of Kubelka-Munk using the measured data obtained by the following method.

Three or more sheets comprising the same component composition as the surface protective layer of the aimed sample but a different thickness each other are prepared, and then the thickness (μm) and the diffuse transmittance (%) of each samples are measured. The diffuse transmittance can be measured by means of a conventional spectrophotometer equipped with an integrating sphere. For the measurement of the present invention, an automatic recording spectrophotometer (type U-3210, manufactured by Hitachi Ltd.) equipped with an integrating sphere of 150 ϕ (150–0901) is used. The measuring wavelength must be accorded with the wavelength of the main emission peak of the fluorescent substance in the fluorescent substance layer having the surface protective layer. Thereafter, the film thickness (μm) and the diffuse transmittance (%) obtained in the above measurement is introduced to the following equation (A) derived from the theoretical equation of Kubelka-Munk. For example, the equation (A) can be derived easily, under the boundary condition of the diffuse transmittance (%), from the equations 5•1•12 to 5•1•15 on page 403 described in "Keikotai Hando Bukku" (the Handbook of Fluorescent Substance) (edited by Keikotai Gakkai, published by Ohmsha Ltd., 1987).

$$T/100=4\beta/[(1+\beta)^2\cdot\exp(\alpha d)-(1-\beta)^2\cdot\exp(-\alpha d)] \quad \text{Equation (A)}$$

Wherein, T represents a diffuse transmittance (%), d represents a film thickness (μm), and α and β are defined by the following equation respectively.

$$\alpha=[K\cdot(K+2S)]^{1/2}$$

$$\beta=[K/(K+2S)]^{1/2}$$

T (diffusion transmittance: %) and d (film thickness: μm) measured from three or more sheets of films are introduced respectively to the equation (A), and thereby the value of K and S are determined to satisfy the equation (A). The scattering length (μm) and the absorption length (μm) are defined by 1/S and 1/K respectively.

The surface protective layer may preferably comprise light scattering particles dispersed in a resin material. The light refractive index of the light scattering particles is usually 1.6 or more, and more preferably 1.9 or more. The particle size of the light scattering particles is in the range from 0.1 μm to 1.0 μm. Examples of the light scattering particles may include the fine particles of aluminum oxide, magnesium oxide, zinc oxide, zinc sulfide, titanium oxide, niobium oxide, barium sulfate, lead carbonate, silicon oxide, poly methyl methacrylate, styrene, and melamine.

The resin materials used for the formation of the surface protective layer is not particularly limited, but polyethylene terephthalate, polyethylene naphthalate, polyamide, aramid, fluorinated resin, polyesters and the like are preferably used. The surface protective layer can be formed by the step of dispersing the light scattering particles set forth above in an organic solvent solution containing the resin material (binder resin) to prepare a dispersion solution, coating the solution on the fluorescent substance layer directly (or via an optionally provided auxiliary layer), and then drying. By other way, the surface protective sheets prepared separately can be overlaid on the fluorescent substance layer by means of an adhesive agent. The thickness of the surface protective layer is usually in the range from 2 μm to 12 μm, and more preferably from 3.5 μm to 10 μm.

In addition, in respect of the preferred manufacturing methods and the materials used for the process of the radiographic intensifying screen, references are made to various publications, for example, JP-A No. 9-21899 (page 6, line 47 on left column to page 8, line 5 on left column), JP-A-No. 6-347598 (page 2, line 17 on right column to page 3, line 33 on left column) and (page 3, line 42 on left column to page 4, line 22 on left column).

In the fluorescent intensifying sheets used for the present invention, the fluorescent substance is preferably packed in the structure changing the particle size by gradation. Especially, the large particle size of fluorescent substance particles is preferably coated for the surface protective layer side and the small particle size of fluorescent substance particles is preferably coated for the layer side near to the support, where the small particle size is preferably in the range from 0.5 μm to 2.0 μm, and the large grain size is preferably in the range from 10 μm to 30 μm.

(Combined Use with Ultraviolet Fluorescent Intensifying Screen)

As for the image forming method using photothermographic material according to the present invention, it is preferred that the image forming method is performed in combination with a fluorescent substance having a main emission peak at 400 nm or lower. And more preferably, the image forming method is performed in combination with a fluorescent substance having a main emission peak at 380 nm or lower. Either single-sided coated photosensitive material or double-sided coated photosensitive material can be applied for the assembly. As the screen having a main emission peak at 400 nm or lower, the screens described in JP-A No. 6-11804 and WO No. 93/01521 and the like are used, but the present invention is not limited to these. As the techniques of crossover cut (for double-sided coated photosensitive material) and anti-halation (for single-sided coated photosensitive material) of ultraviolet radiation, the technique described in JP-A No. 8-76307 can be applied. As ultraviolet radiation absorbing dyes, the dye described in JP-A No. 2001-144030 is particularly preferred.

2) Dehydration Process

The hydration process used for the image forming method of the present invention is explained in detail hereinafter.

The image forming layer and the other various non-photosensitive layers of the photothermographic material have a different water content depending on the each layer composition of binders and additives thereof or the their storage environments. The inventors found that the maintenance of water content in the layer at a constant level is very important to attain a stable photographic performance. However, it is very difficult to keep the water content in the layer at a constant level, because the temperature and humidity of the storage conditions for the photothermographic material can not be fixed, and also the temperature and humidity in the processing environmental condition for an exposing step and a thermal developing step of the photothermographic material may be always changed.

As a result of our close investigation for a relation between the water content and the photographic properties, it is revealed that by decreasing the water content, the said dependence on the environmental temperature and humidity may remain in a smaller extent. Specifically, the task can be solved by the processing method where a dehydration process is intervened between after an exposure process and before a thermal developing process heated with a thermally developable temperature.

The dehydration process preferred for the present invention is a dehydration process where A/B×100 is 300% or less, wherein A represents the water content measured after processing of the photothermographic material which is subjected to the dehydration process at an environmental condition of 25° C. and 70% RH, and B represents the water content measured after processing of the material which is subjected to the dehydration process at a condition of 25° C. and 20% RH. More preferred is a dehydration process where A/B×100 is 275% or less, and most preferably 250% or less.

The above-mentioned water content according to the present invention can be calculated from the following procedure, namely, the material which is humid conditioned for over 24 hours at the target temperature and humidity is subjected to exposure in the above same condition and then conveyed to the dehydration process after the exposure. The mass "a" of the samples is measured immediately after the dehydration process, and then the mass "b" is measured again after the sample is dried in vacuum at 30° C. for 20 hours. The (a−b)/b is defined as the water content of the sample. In the present invention, according to the method described above, the water content is measured for both a sample which is humid conditioned for 24 hours at 25° C. and relative humidity of 70%, and a sample which is humid conditioned for 24 hours at 25° C. and relative humidity of 20%. Thereafter the ratio of the water content between high humidity condition and low humidity condition is determined from the above equation.

As for the dehydration means used herein, any known methods can be used, but specific examples of preferred method include:

a) preheating method wherein the photothermographic material can be heated in contact at a temperature lower than the thermally developable temperature, b) hot air-heating method, c) high frequency-heating method, and d) vacuum dehydration method.

Regarding the dehydration process applied for the present invention, in the case where the dehydration means is performed by means of heating, it is required that no thermal development is occurred by the heating. Therefore, the heating condition to cause thermal development is excluded for a dehydration means for the present invention. The heating condition for causing the development indicates the case where (Dmax−Dmin) of a sample heated in the said heating condition is 5% or more of (Dmax−Dmin) of a sample processed by the successive thermal development.

a) Preheating Method

The preheating method is a heating method wherein the photothermographic material can be heated in contact at a lower temperature than the thermally developable temperature. The exposed photothermographic material is preferably passed through the dehydration section at a fixed conveying speed before the material is conveyed at the same conveying speed to the heating means for thermal development. The temperature of the preheating section is adjusted so as to heat the photothermographic material at from 40° C. to 105° C., preferably from 60° C. to 100° C., and more preferably from 70° C. to 100° C. The temperature below 40° C. is not preferred because of the insufficient dehydration by the preheating section. The temperature over 105° C. is also not preferred because thermal development occurrs in the dehydration section.

The zone length of the preheating section is adjusted so that the residence time of the photothermographic material therein is in a period of from 0.1 seconds to 90 seconds, preferably from 0.1 seconds to 60 seconds, and more preferably 0.1 seconds to 30 seconds. The temperature is higher, the residence time may be shorter.

As for a heating means for the preheating section, the method known as the heating means used for thermal development can be selected, preferred is a drum heating method or a plate heater method.

b) Hot Air-heating Method

The hot air-heating method is a heating method wherein the photothermographic material can be heated at a lower temperature than the thermally developable temperature by a hot air. The exposed photothermographic material is preferably passed through the hot air-heating section at a fixed conveying speed before the material is conveyed at the same conveying speed to the heating means for thermal development. The temperature of the hot air-heating section is adjusted so as to heat the photothermographic material at from 40° C. to 105° C., preferably from 60° C. to 100° C., and more preferably from 70° C. to 100° C. The temperature below 40° C. is not preferred because of the insufficient dehydration by the preheating. The temperature over 10° C. is also not preferred because thermal development occurrs in the dehydration section. The zone length of the hot air-heating section is adjusted so that the residence time of the photothermographic material therein is in a period of from 0.1 seconds to 90 seconds, preferably from 0.1 seconds to 60 seconds, and more preferably 0.1 seconds to 30 seconds. The temperature is higher, the residence time may be shorter.

c) High Frequency-heating Method

The high frequency heating method is a heating method wherein the photothermographic material can be heated by exposure to an electromagnetic waves of high frequency. The exposed photothermographic material is preferably passed through the high frequency-heating section at a fixed conveying speed before the material is conveyed at the same conveying speed to the heating means for thermal development.

The temperature of the high frequency-heating section is adjusted by changing the output so as to heat the photothermographic material at from 40° C. to 105° C., preferably from 60° C. to 100° C., and more preferably from 70° C. to 100° C. The temperature below 40° C. is not preferred because of the insufficient dehydration by the preheating. The temperature over 105° C. is also not preferred because thermal development occurrs in the dehydration section. The zone length of the high frequency-heating section is adjusted so that the residence time of the photothermographic material therein is in a period of from 0.1 seconds to 90 seconds, preferably from 0.1 seconds to 60 seconds, and more preferably 0.1 seconds to 30 seconds. The higher the temperature is, the shorter may be the residence time.

d) Vacuum Dehydration Method

The vacuum dehydration method is a method where the photothermographic material is kept in a reduced pressure. Preferably the exposed photothermographic material is vacuumed just before development is performed. The atmosphere for the vacuum dehydration method is preferably vacuumed in a range from $10^{-3}$ Pa to $10^{4}$ Pa, more preferably from $10^{-3}$ Pa to $10^{3}$ Pa, and still more preferably from $10^{-3}$ Pa to $10^{2}$ Pa. The degas duration is preferably from 0.1 seconds to 300 seconds, and preferably from 1 second to 60 seconds.

As for the dehydration means used for the present invention, especially the preheating method described above is preferred.

3) Thermal Development

Although any method may be used for the development of the photothermographic material of the invention, the thermal development process is usually performed by elevating the temperature of the photothermographic material exposed imagewise. The temperature for the development is preferably in the range from 80° C. to 250° C., and more preferably, from 100° C. to 140° C. Time period for development is usually in the range from 1 second to 60 seconds, but for the image forming method of the present invention, a rapid development where time period for development is 15 seconds or less is preferable, and more preferable is from 7 seconds to 15 seconds.

In the process for thermal development, either drum type heater or plate type heater can be used, but plate type heater process is preferred. Preferable process for thermal development by a plate type heater may be a process described in JP-A NO. 11-133572, which discloses a thermal developing apparatus in which a visible image is obtained by bringing a photothermographic material with a formed latent image into contact with a heating means at a thermal developing section, wherein the heating means comprises a plate heater, and plurality of pressing rollers are oppositely provided along one surface of the plate heater, the thermal developing apparatus is characterized in that thermal development is performed by passing the photothermographic material between the pressing rollers and the plate heater. It is preferred that the plate heater is divided into 2 to 6 steps, with the leading end having the lower temperature by 1° C. to 10° C. Such a process is also described in JP-A NO. 54-30032, which allows for excluding moisture and organic solvents included in the photothermographic material out of the system, and also allows for suppressing the change of shapes of the support of the photothermographic material upon rapid heating of the photothermographic material.

It is preferable that the heater is more stably controlled, and top part of one sheet of the photothermographic material is exposed and thermal development of the exposed part is started before exposure of the end part of the sheet has completed, for downsizing the thermal developing apparatus and for shortening the time period for thermal development. Thermal development within 14 seconds is possible with this imager by using a three-steps of plate heaters controlled, for example, at 107° C., 121° C. and 121° C., respectively. And, output time of the first sheet is able to short about 60 sec. In a rapid development like this, there exists various problems as mentioned above, and it is particularly preferable to use in combination with the photothermographic material of the invention.

4) Thermal Developing Apparatus

Figure 2:
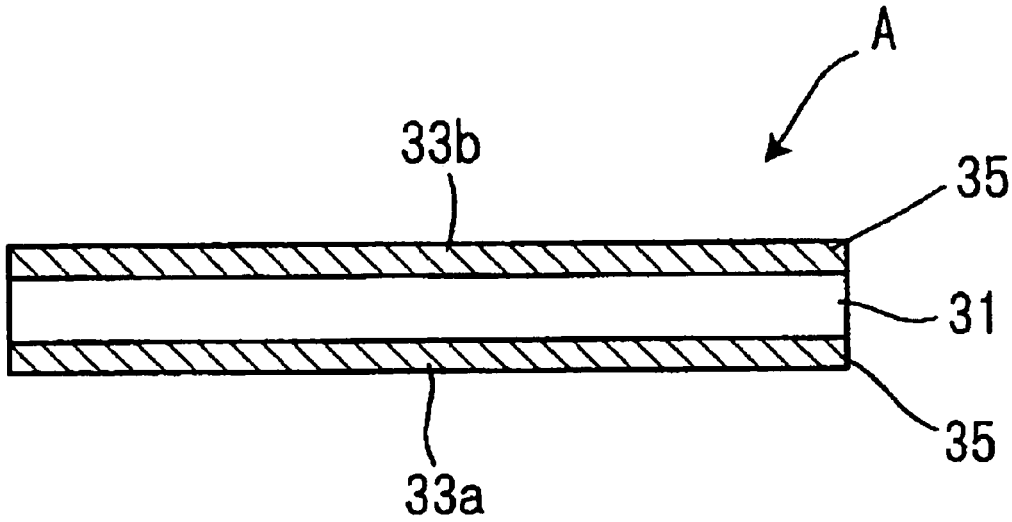
FIG. 2 is a sectional view showing a photosensitive thermal development recording material.
Figure 3:
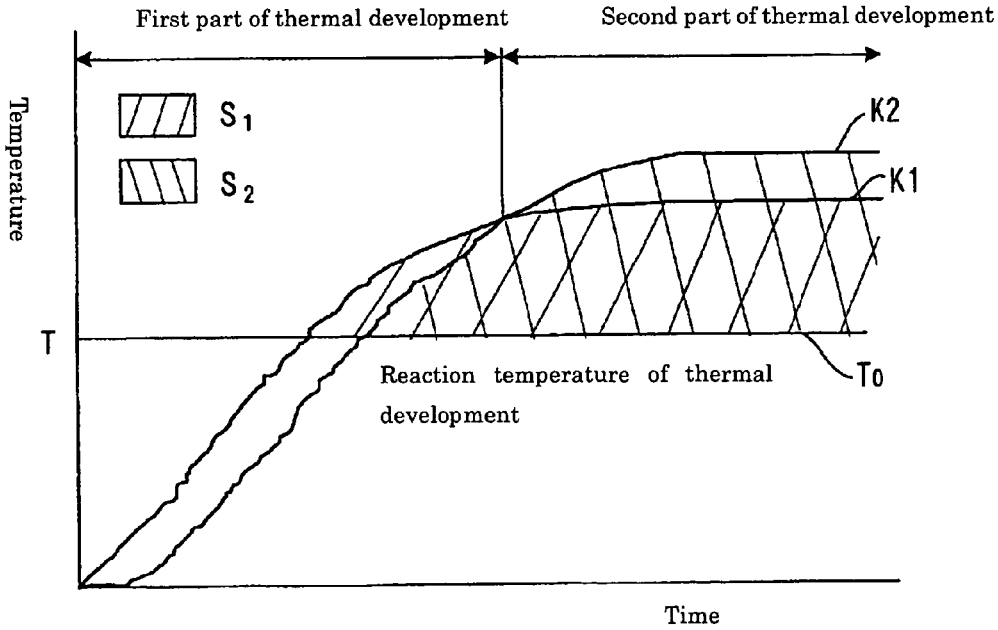
FIG. 3 is an explanatory diagram indicating a correlation between temperatures and time of the front and back surfaces of a recording material respectively heated by first and second heating means and time.
Figure 4:
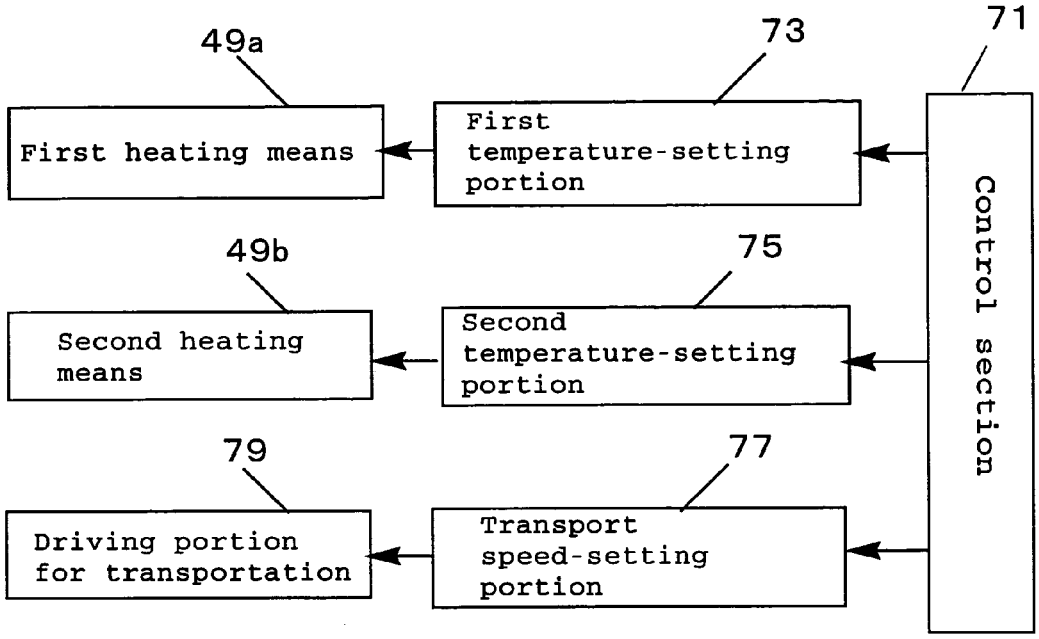
FIG. 4 is a block diagram showing a control means.

Preferred embodiments of a thermal developing method and a thermal developing apparatus used for the present invention are explained hereinafter in detail with reference to the attached drawings. FIG. 1 is a structural diagram illustrating a first embodiment of a thermal developing apparatus for practicing the present invention. FIG. 2 is a sectional view showing the photothermographic material of the present invention. FIG. 3 is an explanatory diagram indicating a correlation between temperatures and time of the front and back surfaces of a recording material respectively heated by first and second heating means and time. FIG. 4 is a block diagram showing a control means.

The thermal developing apparatus 100 according to the first embodiment of the present invention can heat the photothermographic material A to visualize the latent image recorded in the image forming layer. The photothermographic material A used for the thermal developing apparatus 100 comprises image forming layers 35, 35 coated both on a first surface 33*a* as one side of the support 31 and the other face, a second surface 33*b* as shown in FIG. 2.

Symbols used in FIG. 1 to FIG. 8 is explained below.

31: Support
33*a*: First surface
33*b*: Second surface
35: Image forming layer
49*a*, 81*a*, 91*a*, 101*a*: First heating means
49*b*, 81*b*, 91*b*, 101*b*: Second heating means
51: Plate
53: Pressing roller
83: Drum
85: Pressing drum
95: Endless belt
97: Pressing roller
100, 200, 300, 400: Thermal developing apparatuses
A: Recording material (photothermographic material)
C: Conveying route
H: Heater
T: Development reaction temperature
δ: Clearance In the thermal developing apparatus 100, for example, if a fluorescent intensifying screen (not shown) is placed on both sides of the first surface 33*a* and the second surface 33*b* of the photothermographic material A, the photothermographic material A will be used for the direct radiography. The fluorescent intensifying screen can emit a fluorescent light by exposure to X-ray beam. The image forming layers 35, 35 coated on the first surface 33*a* and the second surface 33*b* respectively have a sensitivity to the fluorescent light emitted by the fluorescent intensifying screen and then can be sensitized by a small amount of X-ray beam thereby. Further the photothermographic materials will be explained in detail hereinafter.

The photothermographic material having a latent image in the image forming layer 35 is usually stocked in a cassette 37 one by one, and the cassette 37 including the materials is loaded to the thermal developing apparatus 100. An opening and closing cover 39 of the cassette 37 loaded in the thermal developing apparatus 100 is opened and the photothermographic material A included is taken out from the cassette by means of a suction cup 41.

Further, the thermal developing apparatus 100 may have a structure installable of a magazine (not shown) where a plurality of the photothermographic material A are accommodated together. In this case, each of the photothermographic material A having a latent image is taken out from the cassette 37 in the darkroom and then stacked in the magazine. The photothermographic material A stacked and accommodated in the magazine is taken out one by one by means of the suction cup 41. In place of the suction cup 41, a pick-up roller can be applied.

The photothermographic material A taken out thereby is conveyed to a thermal developing section 47 located downstream to a traveling direction via a conveying roller pair 43 and a transporting guide 45. A width aligning portion which aligns the photothermographic material A taken out in the direction normal to that of the traveling direction and the position of the photothermographic material A in the thermal developing section 47 located downstream may be installed between the conveying roller pair 43 and the thermal developing section 47.

In the thermal developing section 47, a first heating means 49*a* for heating the first surface 33*a* of the photothermographic material A and a second heating means 49*b* for heating the second surface 33*b* of the photothermographic material A are equipped alternatively crossing the conveying route C of the photothermographic material A. According to the embodiment, the first heating means 49*a* and the second heating means 49*b* are composed of a plate 51 and a rotary pressing rollers 53 to push the photothermographic material A against the plate 51. Either the plate 51 or the pressing rollers 53 may include a heater as a heating source.

According to the first embodiment, the heater as a heating source is included in the plate 51. Therefore, in the first heating means 49*a*, the plate 51 is placed facing the first surface 33*a* of the photothermographic material A, and in the second heating means 49*b*, the plate 51 is placed facing the second surface 33*b* of the photothermographic material A. The first surface 33*a* and the second surface 33*b* may be heated alternatively thereby. The "heated alternatively" used herein means a heating method where the first surface 33*a* is heated at first and thereafter the second surface 33*b* is heated, and also include the case where the front and back surfaces or the material are heated in order one by one until the finish of heating.

The plate 51 has a circular-arc configuration and install a plurality of the pressing rollers 53 along the inner side. The photothermographic material A is inserted to the conveying route C formed in a clearance between the plate 51 and the pressing rollers 53, and conveyed tightly in contact with the plate 51 while pushing against the plate 51 by the pressing rollers 53. And then the material A is developed by the heat of the plate 51.

The heating source for the plate 51 is not particularly restricted, but a heat generating body such as a nichrome wire, a light source such as a halogen lamp, a hot wind heating or the other well-known method of heating means can be applied.

The pressing rollers 53 selected from a metal roller, a heat-resistant resin roller, a heat-resistant rubber roller and the like can be employed. Overall region in the plate 51 preferably install a plurality of the rollers.

According to the thermal developing section 47, in the first heating means 49*a*, wherein the second surface 33*b* of the photothermographic material A is pushed by the pressing rollers 53, the first surface 33*a* is pushed against the plate 51. Thereafter the photothermographic material A is conveyed to the second heating means 49*b*, wherein the first surface 33*a* is pushed by the pressing rollers 53, the second surface 33*b* is pushed against the plate 51. As the result, the first surface 33*a* and the second surface 33*b* of the photothermographic material A are heated alternatively. Thereby, the rapid temperature raise of the photothermographic material A can be avoided and also uniformly heating of both surfaces can be attained. In addition, the above-mentioned configuration has an advantage of decreasing the movable parts and miniaturizing the apparatus structure, because the pressing roller 53 rotates alone.

By the way, in the thermal developing section 47, with respect to the total heating amount which is more than the development reaction temperature for the image forming layer 35 heated by the first surface 33*a* and the second surface 33*b* of the photothermographic material A, if the total heating amount for the first surface 33*a* is taken as 100, the total heating amount for the second surface 33*b* is set to be in the range of 100±30.

The temperature of both the first heating means 49*a* and the second heating means 49*b* is set at more than the glass transition temperature of the photothermographic material A. The temperature of the heating means (the first heating means 49*a*) located upstream to the traveling direction of the photothermographic material A is set to at the lower temperature than that of the heating means (the second heating means 49*b*) located downstream to the traveling direction.

The above-mentioned total heating amount can be derived from the integral value by the temperature of more than the development reaction temperature and the time lapse since the temperature is reached to the development reaction temperature. Namely, in the graph shown in FIG. 3, the total heating amount of the first surface 33*a* can be obtained from the area S1 which is enclosed between the line segment To representing the development reaction temperature T and the curve K1 representing the temperature change of the first surface 33*a*. The total heating amount of the second surface 33*b* can be obtained from the area S2 which is enclosed between the line segment To representing the development reaction temperature T and the curve K2 representing the temperature change of the second surface 33*b*. Thereby, the total heating amount can be controlled by the specific parameters of the temperature and the time lapse for the first heating means 49*a* and the second heating means 49*b*, because the total heating amount (S1, S2) on the first surface 33*a* and the second surface 33*b* can be determined from the integral value of the temperature and the time lapse respectively. As the result, an uniformity of the total heating amount on both surfaces of the photothermographic material A can be easily attained.

Further, as for the total heating amount, if the heating temperature of the first heating means 49*a* and the second heating means 49*b* and a contact length L1, L2 of the photothermographic material A with the first heating means 49*a* and the second heating means 49*b* are used as the parameter, and more the total heating amount on the first surface 33*a* is taken as 100, then the total heating amount on the second surface 33*b* may be set to in the range of 100±30. Thereby, the total heating amount can be controlled by the specific parameter of the temperature and the contact length L1, L2, and then the uniformity of the total heating amount on both surfaces of the photothermographic material A can be easily attained.

According to the above configuration, the temperature of the photothermographic material A is higher than the glass transition temperature when the heating face is the first surface 33*a*, and also the temperature is higher than the glass transition temperature when the heating face is transferred from the first surface 33*a* to the second surface 33*b*. Therefore the photothermographic material A is maintained to be in a softening state during the heating process. Thereby, the generation of a wrinkle caused by pushing the photothermographic material A by the pressing rollers 53 can be prevented. Because the heating temperature of the first heating means 49*a* is set to be lower than the heating temperature of the second heating means 49*b*, the rapid temperature raise on the first surface 33*a* is avoided at the beginning stage of the heating. The generation of a wrinkle caused by a rapid thermal swelling of the photothermographic material A can be prevented thereby.

Furthermore, in the thermal developing section 47, the clearance δ between the first heating means 49*a* and the second heating means 49*b* is set to less than 100 mm. Therefore, when the photothermographic material A which first surface 33*a* is heated by the heating means 49*a* is conveyed to the second heating means 49*b* to heat the second surface 33*b*, the temperature drop of the photothermographic material A heated by the first heating means 49*a* is prevented at the utmost because of the narrow clearance such as less than 100 mm. Thereby, the photothermographic material A is kept at more than the predetermined temperature shown in FIG. 3, even if the heating face is changed from the front and back surfaces, and the development reaction can proceed successively without any delay.

And then the photothermographic material A developed in the thermal developing section 47 is conveyed to a gradually cooling section 61 located downstream to the traveling direction as shown in FIG. 1. The gradually cooling section 61 installs a plurality of cooled roller pairs 63 and can gradually cool the thermally developed photothermographic material A. The photothermographic material A cooled in the gradually cooling section 61 is then conveyed to the downstream direction by a discharging roller pairs 65, 67 and then discharged to a tray 69.

The thermal developing apparatus 100 also install a control section 71 which can control the first heating means 49*a*, the second heating means 49*b* and the transporting speed of the photothermographic material A. As shown in FIG. 4, the control section 71 can control the first heating means 49*a* via the first temperature-setting portion 73, the second heating means 49*b* via the second temperature-setting portion 75, and also control a driving portion for transportation 79 such as a driving motor via a transporting speed-setting portion 77. The control section 71 can control the total heating amount for heating the first surface 33*a* and the second surface 33*b* to be in the above described range using the temperature and the transporting speed as the parameter.

According to the thermal developing apparatus 100, the first surface 33*a* of the photothermographic material A may be heated first, and then the second surface 33*b* is heated. Therefore, the both surfaces of the photothermographic material A can be thermally developed, while depressing the rapid temperature raise. And also, because the total heating amount to the second surface 33*b* is set to be in the prescribed range to the total heating amount to the first surface 33*a*, the total heating amount to the both surfaces of the photothermographic material A result in approximately equal amount. Thereby, the photothermographic material A can be thermally developed evenly without any wrinkle generation, color tone difference and density fluctuation.

According to the thermal developing method using the thermal developing apparatus 100, the first surface 33*a* and the second surface 33*b* of the photothermographic material A are heated alternatively, and in respect to each of the total heating amount which is more than the development reaction temperature to the image forming layer 35 heated by the first surface 33*a* and the second surface 33*b*, if the total heating amount to the first surface 33*a* is taken as 100, the total heating amount to the second surface 33*b* is set to be in the range of 100±30. Thereby, both sides of the photothermographic material A are heated evenly and then can be thermally developed uniformly. In addition, even if the first surface 33*a* and the second surface 33*b* are heated alternatively, the both surfaces can be heated evenly while depressing the rapid temperature raise. Thereby, for the case of the photothermographic material A which has the image forming layer on the both sides, uniformly heat development of both surfaces can be attained without the generation of wrinkle, and also color tone difference and density fluctuation. The loading of the photothermographic material A to the thermal developing apparatus and the development thereof can be carried out without any consideration about the front and back surface sides.

The other embodiments of the thermal developing apparatus used for the present invention are explained hereinafter.

In the following embodiments, only the main portions of the thermal developing apparatus (thermal developing section) are shown. Every thermal developing section has a construction where the first surface 33*a* and the second surface 33*b* of the photothermographic material A are heated alternatively by the first heating means and the second heating means respectively, and the total heating amount to the second surface 33*b* is set to be in the range of 100±30 when the total heating amount to the first surface 33*a* is taken as 100.

Figure 5:
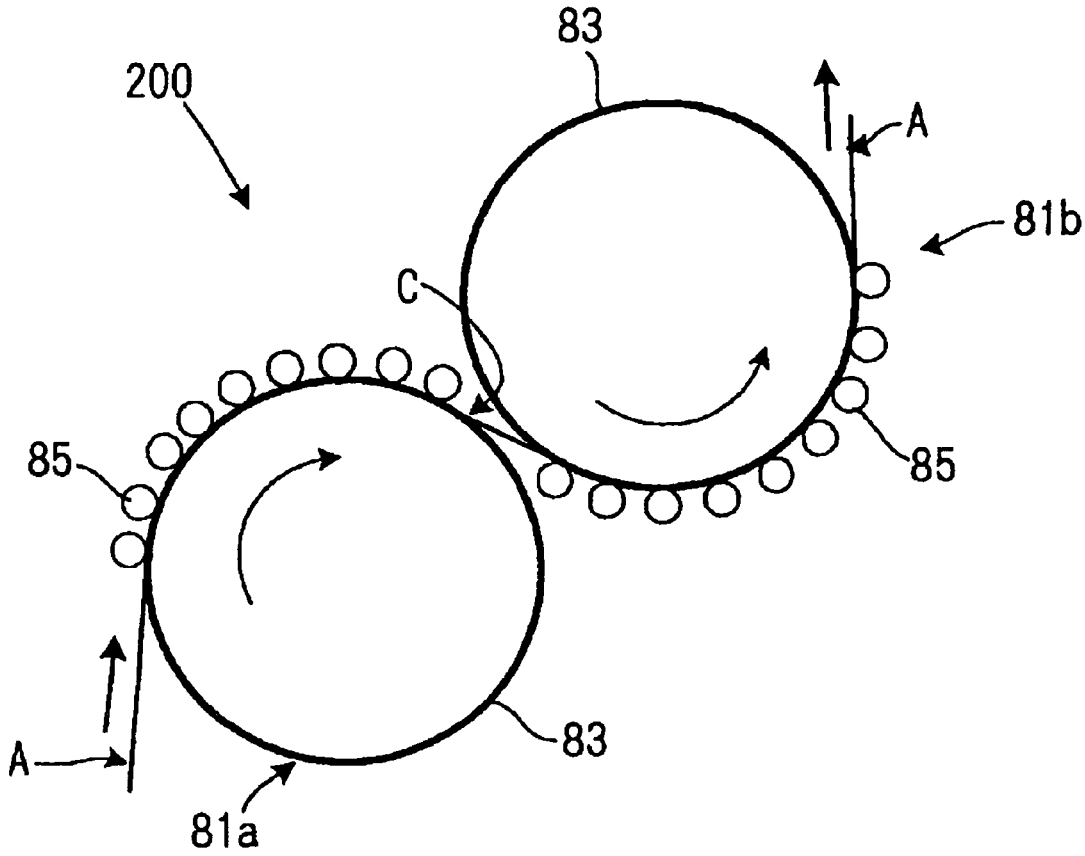
FIG. 5 is a structural view showing an essential part of a thermal developing apparatus having a drum and pressing rollers.

FIG. 5 show a schematic diagram of a main portion of a thermal developing apparatus installed with a drum and a plurality of pressing rollers according to the second embodiment.

The thermal developing apparatus 200 has a construction in which both of a first heating means 81*a* and a second heating means 81*b* install a rotary driven cylindrical drum 83 and a plurality of rotary pressing rollers 85 pushing the photothermographic material A against the circumference surface of the drum 83. A heater as a heating source may be equipped in either the drum 83 or the pressing rollers 85. In this embodiment, the drum 83 installs the heater as the heating source.

The first heating means 81*a* and the second heating means 81*b* are disposed closely, and the drum 83 of the first heating means 81*a* rotates reversely to the drum 83 of the second heating means 81*b*. Therefore, the first heating means 81*a* and the second heating means 81*b* form S-shaped conveying route. Even in the thermal developing apparatus 200 according to the embodiment, the first surface 33*a* of the photothermographic material A is heated by the first heating means 81*a* and then the second surface 33*b* is heated by the second heating means 81*b*.

The photothermographic material A transported by the first heating means 81*a* is conveyed with nipping by the drum 83 and the pressing rollers 85 while the first surface 33*a* is conveyed in close contact with the drum 83. As the result, the material is heated by the heat of the drum 83 to visualize the latent image formed by the exposure. Next to the above, the photothermographic material A in which the first surface 33*a* is heated is conveyed to the second heating means 81*b*, and then conveyed with nipping by the drum 83 and the pressing rollers 85 while the second surface 33*b* is conveyed in close contact with the drum 83 in a similar way as the above. Thereby the material is thermally developed by the heat of the drum 83.

According to the thermal developing apparatus 200, the first surface 33*a* of the photothermographic material A is pushed against the drum 83 in the heating means 81*a*, and then the second surface 33*b* is pushed against the drum 83 in the second heating means 81*b*. As the result, the first surface 33*a* and the second surface 33*b* of the photothermographic material A are heated alternatively. Therefore, the rapid temperature raise of the photothermographic material A can be avoided and then the uniformly heating of both faces is attained. And also, the configuration where the drum 83 and the pressing rollers 85 are rotated synchronized with the transporting speed of the photothermographic material A may result in no rubbing between the heating means and the photothermographic material A.

The thermal developing apparatus of the third embodiment of the present invention is explained hereinafter.

Figure 6:
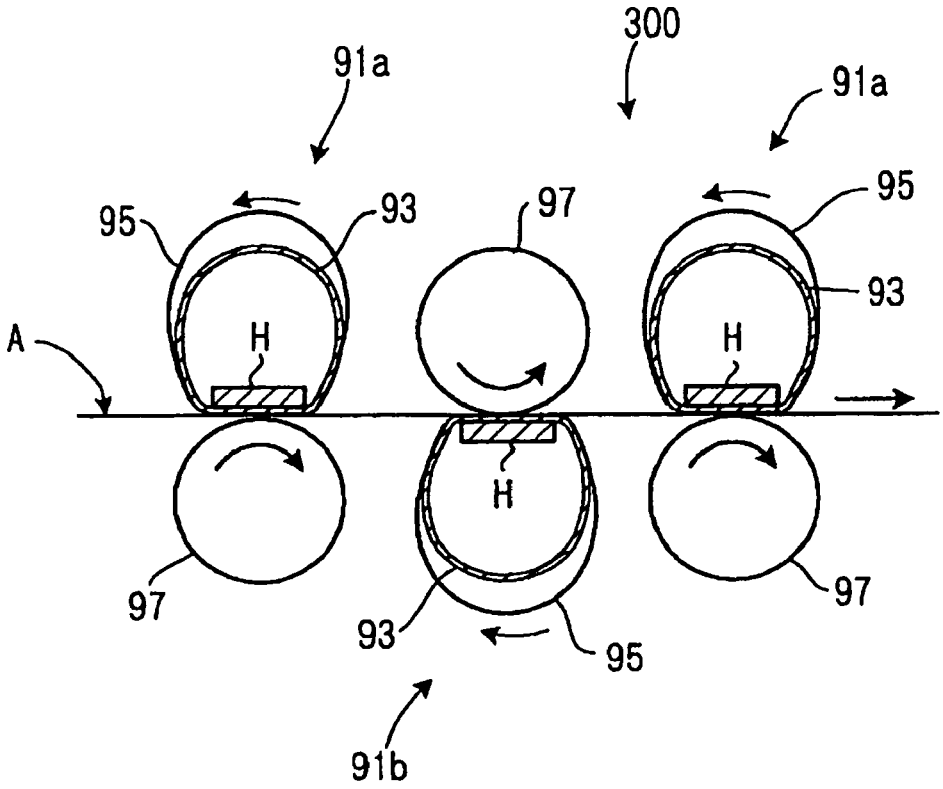
FIG. 6 is a structural view showing an essential part of a thermal developing apparatus having a support, an endless belt, and pressing rollers.

FIG. 6 shows a schematic diagram of the main portion of a thermal developing apparatus having a support, an endless belt and a pressing roller.

The thermal developing apparatus 300 has a construction in which each of the first heating means 91*a* and the second heating means 91*b* consist of the pipe type support 93 installed with a heater H as a heat source, the endless belt 95 surrounding the support 93, and the pressing roller 97 rotating the endless belt 95 at the same speed while pushing the endless belt 95 against the support 93. The endless belt 95 may be made of a material having enough heat conductance such as aluminum, resin and the like, or a rubber heater. With respect to the heating amount of the first heating means 91*a* and the second heating means 91*b*, if each heating means is adjusted to heat the front and back surfaces of the photothermographic material A evenly, the number of the first heating means 91*a* and the heating means 91*b* disposed is not necessary the same.

According to the thermal developing apparatus 300, for example, in the heating means 91*a* shown in the left side of FIG. 6, while pushing the second surface 33*b* of the photothermographic material A by the pressing roller 97, the first surface 33*a* is pushed against the support 93 by means of the endless belt 95, and then the photothermographic material A is conveyed to the second heating means 91*b*, in succession, while pushing the first surface 33*a* by the pressing roller 97, the second surface 33*b* is pushed against the support 93 by means of the endless belt 95. Thereby, the first surface 33*a* and the second surface 33*b* of the photothermographic material A are heated alternatively. Both surfaces of the photothermographic material A can be heated uniformly, and the gradually heating with the plural heating means may prevent the rapid temperature raise. And also, the configuration in which the endless belt 95 surrounding the support 93 is moved synchronized with the transporting speed of the photothermographic material A may result in no rubbing between the heating means and the photothermographic material A. Therefore no damage in the image forming layer is occurred.

The thermal developing apparatus of the fourth embodiment of the present invention will be explained in detail hereinafter.

Figure 7:
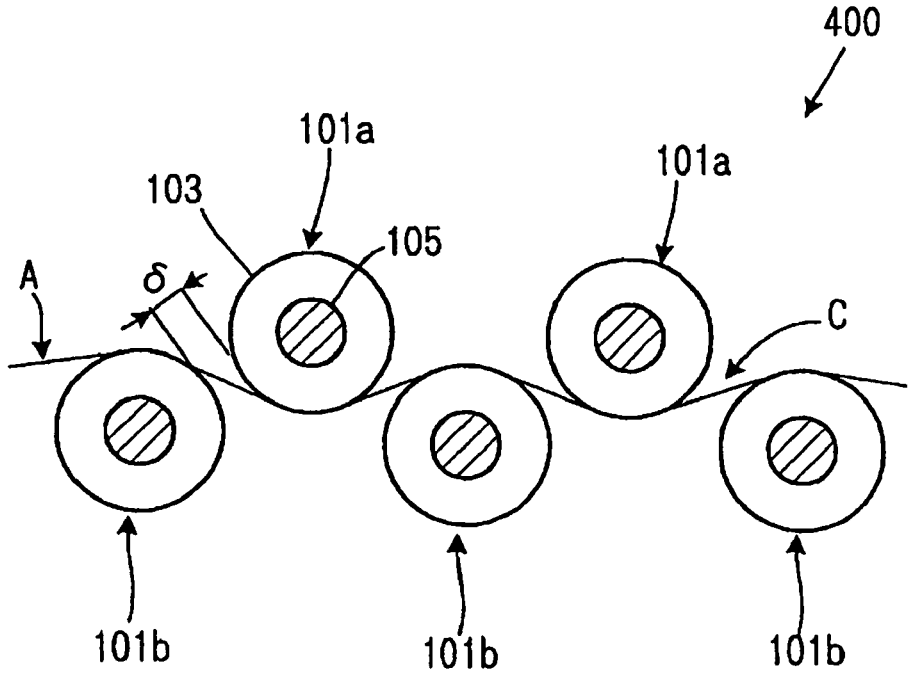
FIG. 7 is a structural view showing an essential part of a thermal developing apparatus having plural pairs of first and second heating means.

FIG. 7 shows a schematic diagram of a main portion of the thermal developing apparatus installed with plural sets of a first heating means and a second heating means.

The thermal developing apparatus 400 installs plural sets of a first heating means 101*a* composed of a heating roller 101 along the conveying route C of the photothermographic material A and a second heating means 101*b* composed of similar heating roller 101. The heating roller 101 consists of a cylindrical heating body 103 and a heating source 105 as a heating source such as a halogen heater and the like to heat the inner side of the heating body 103.

Especially, according to the embodiment, the first heating means 101*a* and the second heating means 101*b* are disposed in the staggered form along the conveying route C of the photothermographic material A.

Therefore, according to the thermal developing apparatus 400, after the first surface 33*a* and the second surface 33*b* of the photothermographic material A are heated alternatively by the first heating means 101*a* and the second heating means 101*b* of the first set respectively, the photothermographic material A is conveyed to the first heating means 101*a* and the second heating means 101*b* of the second set where the first surface 33*a* and the second surface 33*b* is again heated alternatively. This alternative heating is repeated in the plural sets of the heating means. Thereby, a rapid temperature raise in the photothermographic material A can be avoided and also both surfaces of the photothermographic material A can be heated uniformly with gradually heating.

The thermal developing apparatus 400 in which plural sets of the first heating means 101*a* and the heating means 101*b* are disposed in the staggered form along the conveying route C has the configuration where a plurality of the first heating means 101*a* disposed on the one side of the conveying route C and a plurality of the second heating means 101*b* disposed on the other side of the conveying route C are inserted alternatively in the gap between the neighboring heating means and disposed with some contact angle to each heating means. Therefore, the conveying route C is formed as a wavy shape. Thereby, the contact area between the photothermographic material A and the heating means is increased, the efficiency of the heat conductance to the photothermographic material A is enhanced.

(Application of the Invention)

The image forming method of the invention is preferably employed as image forming methods for photothermographic materials for use in medical imaging, through forming black and white images by silver imaging.

EXAMPLES

The present invention is specifically explained by way of Examples below, which should not be construed as limiting the invention thereto.

Example 1

(Preparation of PET Support)

1-1. Film Manufacturing

PET having IV (intrinsic viscosity) of 0.66 (measured in phenol/tetrachloroethane=6/4 (weight ratio) at 25° C.) was obtained according to a conventional manner using terephthalic acid and ethylene glycol. The product was pelletized, dried at 130° C. for 4 hours, melted at 300° C. Thereafter, the mixture was extruded from a T-die and rapidly cooled to form a non-tentered film.

The film was stretched along the longitudinal direction by 3.3 times using rollers of different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking part was slit off, and both edges of the film were knurled. Then the film was rolled up at the tension of 4 kg/cm$^2$ to obtain a roll having the thickness of 175 μm.

1-2. Surface Corona Discharge Treatment

Both surfaces of the support were treated at room temperature at 20 m/minute using Solid State Corona Discharge Treatment Machine Model 6KVA manufactured by Piller GmbH. It was proven that treatment of 0.375 kV·A·minute/m$^2$ was executed, judging from the readings of current and voltage on that occasion. The frequency upon this treatment was 9.6 kHz, and the gap clearance between the electrode and dielectric roll was 1.6 mm.

1-3. Undercoating

1) Preparations of Coating Solution for Undercoat Layer

| | |
|---|---|
| Pesresin A-520 manufactured by Takamatsu Oil & Fat Co., Ltd. (30% by weight solution) | 46.8 g |
| BAIRONAARU WD-1200 manufactured by Touyou Boseki Co., Ltd. | 10.4 g |
| Polyethylene glycol monononylphenylether (average ethylene oxide number = 8.5) (1% by weight solution) | 11.0 g |
| MP-1000 manufactured by Soken Chemical & Engineering Co., Ltd. (PMMA polymer fine particle, mean particle diameter of 0.4 μm) | 0.91 g |
| distilled water | 931 mL |

2) Undercoating

Both surfaces of the biaxially tentered polyethylene terephthalate support having the thickness of 175 μm were subjected to the corona discharge treatment as described above. Thereafter, the aforementioned formula of the coating solution for the undercoat was coated with a wire bar so that the amount of wet coating became 6.6 mL/m$^2$ (per one surface), and dried at 180° C. for 5 minutes. Thus, an undercoated support was produced.

2. Image Forming Layer, Intermediate Layer, and Surface Protective Layer 2-1. Preparations of Coating Material 1) Silver Halide Emulsion (Preparation of Silver Halide Emulsion A)

A solution was prepared by adding 4.3 mL of a 1% by weight potassium iodide solution, and then 3.5 mL of 0.5 mol/L sulfuric acid, 36.5 g of phthalated gelatin, and 160 mL of a 5% by weight methanol solution of 2,2'-(ethylene dithio)diethanol to 1421 mL of distilled water. The solution was kept at 75° C. while stirring in a stainless steel reaction vessel, and thereto were added total amount of: solution A prepared through diluting 22.22 g of silver nitrate by adding distilled water to give the volume of 218 mL; and solution B prepared through diluting 36.6 g of potassium iodide with distilled water to give the volume of 366 mL. A method of controlled double jet was executed through adding total amount of the solution A at a constant flow rate over 16 minutes, accompanied by adding the solution B while maintaining the pAg at 10.2. Thereafter, 10 mL of a 3.5% by weight aqueous solution of hydrogen peroxide was added thereto, and 10.8 mL of a 10% by weight aqueous solution of benzimidazole was further added. Moreover, a solution C prepared through diluting 51.86 g of silver nitrate by adding distilled water to give the volume of 508.2 mL and a solution D prepared through diluting 63.9 g of potassium iodide with distilled water to give the volume of 639 mL were added. A method of controlled double jet was executed through adding total amount of the solution C at a constant flow rate over 80 minutes, accompanied by adding the solution D while maintaining the pAg at 10.2. Potassium hexachloroiridate (III) was added in its entirety to give $1\times10^{-4}$ mol per 1 mol of silver, at 10 minutes post initiation of the addition of the solution C and the solution D. Moreover, at 5 seconds after completing the addition of the solution C, potassium hexacyanoferrate (II) in an aqueous solution was added in its entirety to give $3\times10^{-4}$ mol per 1 mol of silver. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 11.0.

The silver halide emulsion A was a pure silver iodide emulsion, and the obtained silver halide grains had a mean projected area equivalent diameter of 0.93 μm, a variation coefficient of a projected area equivalent diameter distribution of 17.7%, a mean thickness of 0.057 μm and a mean aspect ratio of 16.3. Tabular grains having an aspect ratio of 2 or more occupied 80% or more of the total projected area. The mean equivalent spherical diameter of the grains was 0.42 μm. 30% or more of the silver iodide existed in γ phase from the result of powder X-ray diffraction analysis.

(Preparation of Silver Halide Emulsion B)

1 mol of the silver iodide tabular grains prepared in the silver halide emulsion A was added to the reaction vessel. The pAg measured at 38° C. was 10.2. 0.5 mol/L potassium bromide solution and 0.5 mol/L silver nitrate solution were added at an addition speed of 10 mL/min over 10 minutes by the method of double jet addition to precipitate substantially a 5 mol % of silver bromide on the silver iodide host grains as epitaxial form while keeping the pAg at 10.2 during the operation.

Furthermore, the mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 11.0.

The above-mentioned silver halide dispersion was kept at 38° C. with stirring, and thereto was added 5 mL of a 0.34% by weight methanol solution of 1,2-benzoisothiazoline-3-one, and after 40 minutes the temperature was elevated to 60° C. At 20 minutes after elevating the temperature, sodium benzene thiosulfonate in a methanol solution was added at $7.6\times10^{-5}$ mol per 1 mol of silver. At additional 5 minutes later, tellurium sensitizer C in a methanol solution was added at $2.0\times10^{-5}$ mol per 1 mol of silver and subjected to ripening for 91 minutes. And then, 1.3 mL of a 0.8% by weight N,N'-dihydroxy-N",N"-diethylmelamine in methanol was added thereto, and at additional 4 minutes thereafter, 5-methyl-2-mercaptobenzimidazole in a methanol solution at $4.8\times10^{-3}$ mol per 1 mol of silver, 1-phenyl-2-heptyl-5-mercapto-1,3,4-triazole in a methanol solution at $5.4\times10^{-3}$ mol per 1 mol of silver, and 1-(3-methylureido phenyl)-5-mercaptotetrazole in an aqueous solution at $8.5\times10^{-3}$ mol per 1 mol of silver were added to produce silver halide emulsion B.

(Preparation of Silver Halide Emulsion C)

Preparation of silver halide emulsion C was conducted in a similar manner to the process in the preparation of the silver halide emulsion A except that adequately changing the addition amount of a 5% by weight methanol solution of 2,2'-(ethylene dithio)diethanol, the temperature at grain formation step, and the time for adding the solution A. The silver halide emulsion C was a pure silver iodide emulsion. The obtained silver halide grains had a mean projected area equivalent diameter of 1.369 μm, a variation coefficient of a projected area equivalent diameter distribution of 19.7%, a mean thickness of 0.130 μm and a mean aspect ratio of 11.1. Tabular grains having an aspect ratio of 2 or more occupied 80% or more of the total projected area. The mean equivalent spherical diameter of the grains was 0.71 μm. 30% or more of the silver iodide existed in γ phase from the result of powder X-ray diffraction analysis.

(Preparation of Silver Halide Emulsion D)

Preparation of silver halide emulsion D was conducted in a similar manner to the process in the preparation of silver halide emulsion B, except that using silver halide emulsion C instead of using silver halide emulsion A. Thereby, silver halide emulsion D containing 5 mol % of epitaxial silver bromide was prepared.

Preparation of Mixed Emulsion for Coating Solution

The silver halide emulsion B and the silver halide emulsion D at the rate of (silver halide emulsion B: silver halide emulsion D=) 3:2 by mol of silver were dissolved, and thereto was added benzothiazolium iodide at $7\times10^{-3}$ mol per 1 mol of silver with a 1% by weight aqueous solution. Further, as "a compound that can be one-electron-oxidized to provide a one-electron oxidation product, which releases one or more electrons", the compounds Nos. 1, 2, and 3 were added respectively in an amount of $2\times10^{-3}$ mol per 1 mol of silver in silver halide.

Thereafter, as "a compound having an adsorptive group and a reducible group", the compound Nos. 1 and 2 were added respectively in an amount of $8\times10^{-3}$ mol per 1 mol of silver halide.

Further, water was added thereto to give the content of silver halide of 15.6 g in terms of silver, per 1 liter of the mixed emulsion for a coating solution.

2) Preparation of Dispersion A of Silver Salt of Fatty Acid

<Preparation of Recrystallized Behenic Acid>

Behenic acid manufactured by Henkel Co. (trade name: Edenor C22-85R) in an amount of 100 kg was admixed with 1200 kg of isopropyl alcohol, and dissolved at 50° C. The mixture was filtrated through a 10 μm filter, and cooled to 30° C. to allow recrystallization. Cooling speed for the recrystallization was controlled to be 3° C./hour. The resulting crystal was subjected to centrifugal filtration, and washing was performed with 100 kg of isopropyl alcohol. Thereafter, the crystal was dried. The resulting crystal was esterified, and subjected to GC-FID analysis to give the results of the content of behenic acid being 96 mol %, lignoceric acid 2 mol %, and arachidic acid 2 mol %. In addition, erucic acid was included at 0.001 mol %.

<Preparation of Dispersion A of Silver Salt of Fatty Acid>

88 kg of the recrystallized behenic acid, 422 L of distilled water, 49.2 L of 5 mol/L sodium hydroxide aqueous solution, 120 L of t-butyl alcohol were admixed, and subjected to a reaction with stirring at 75° C. for one hour to give a solution of sodium behenate. Separately, 206.2 L of an aqueous solution of 40.4 kg of silver nitrate (pH 4.0) was provided, and kept at a temperature of 10° C. A reaction vessel charged with 635 L of distilled water and 30 L of t-butyl alcohol was kept at 30° C., and thereto were added the total amount of the solution of sodium behenate and the total amount of the aqueous silver nitrate solution with sufficient stirring at a constant flow rate over 93 minutes and 15 seconds, and 90 minutes, respectively. Upon this operation, during first 11 minutes following the initiation of adding the aqueous silver nitrate solution, the added material was restricted to the aqueous silver nitrate solution alone. The addition of the solution of sodium behenate was thereafter started, and during 14 minutes and 15 seconds following the completion of adding the aqueous silver nitrate solution, the added material was restricted to the solution of sodium behenate alone. The temperature inside of the reaction vessel was then set to be 30° C., and the temperature outside was controlled so that the liquid temperature could be kept constant. In addition, the temperature of a pipeline for the addition system of the solution of sodium behenate was kept constant by circulation of warm water outside of a double wall pipe, so that the temperature of the liquid at an outlet in the leading edge of the nozzle for addition was adjusted to be 75° C. Further, the temperature of a pipeline for the addition system of the aqueous silver nitrate solution was kept constant by circulation of cool water outside of a double wall pipe. Position at which the solution of sodium behenate was added and the position, at which the aqueous silver nitrate solution was added, was arranged symmetrically with a shaft for stirring located at a center. Moreover, both of the positions were adjusted to avoid contact with the reaction liquid.

After completing the addition of the solution of sodium behenate, the mixture was left to stand at the temperature as it was for 20 minutes. The temperature of the mixture was then elevated to 35° C. over 30 minutes followed by ripening for 210 minutes. Immediately after completing the ripening, solid matters were filtered out with centrifugal filtration. The solid matters were washed with water until the electric conductivity of the filtrated water became 30 μS/cm. A silver salt of fatty acid was thus obtained. The resulting solid matters were stored as a wet cake without drying.

When the shape of the resulting particles of the silver behenate was evaluated by an electron micrography, a crystal was revealed having a=0.21 μm, b=0.4 μm and c=0.4 μm on the average value, with a mean aspect ratio of 2.1, and a variation coefficient of an equivalent spherical diameter distribution of 11% (a, b and c are as defined aforementioned.).

To the wet cake corresponding to 260 kg of a dry solid matter content, were added 19.3 kg of polyvinyl alcohol (trade name: PVA-217) and water to give the total amount of 1000 kg. Then, a slurry was obtained from the mixture using a dissolver blade. Additionally, the slurry was subjected to preliminary dispersion with a pipeline mixer (manufactured by MIZUHO Industrial Co., Ltd.: PM-10 type).

Next, a stock liquid after the preliminary dispersion was treated three times using a dispersing machine (trade name: Microfluidizer M-610, manufactured by Microfluidex International Corporation, using Z type Interaction Chamber) with the pressure controlled to be 1150 kg/cm$^2$ to give a dispersion of the silver behenate. For the cooling manipulation, coiled heat exchangers were equipped in front of and behind the interaction chamber respectively, and accordingly, the temperature for the dispersion was set to be 18° C. by regulating the temperature of the cooling medium.

3) Preparations of Reducing Agent Dispersion

<Preparation of Reducing Agent-1 Dispersion>

To 10 kg of reducing agent-1 (2,2'-methylenebis-(4-ethyl-6-tert-butylphenol)) and 16 kg of a 10% by weight aqueous solution of modified polyvinyl alcohol (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by IMEX Co., Ltd.) packed with zirconia beads having a mean particle diameter of 0.5 mm for 3 hours. Thereafter, 0.2 g of a benzoisothiazolinone sodium salt and water were added thereto, thereby adjusting the concentration of the reducing agent to be 25% by weight. This dispersion was subjected to heat treatment at 60° C. for 5 hours to obtain reducing agent-1 dispersion. Particles of the reducing agent included in the resulting reducing agent dispersion had a median diameter of 0.40 μm, and a maximum particle diameter of 1.4 μm or less. The resultant reducing agent dispersion was subjected to filtration with a polypropylene filter having a pore size of 3.0 μm to remove foreign substances such as dust, and stored.

<Preparation of Reducing Agent-2 Dispersion>

To 10 kg of reducing agent-2 (6,6'-di-t-butyl-4,4'-dimethyl-2,2'-butylidenediphenol)) and 16 kg of a 10% by weight aqueous solution of modified polyvinyl alcohol (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by IMEX Co., Ltd.) packed with zirconia beads having a mean particle diameter of 0.5 mm for 3 hours and 30 minutes. Thereafter, 0.2 g of a benzoisothiazolinone sodium salt and water were added thereto, thereby adjusting the concentration of the reducing agent to be 25% by weight. This dispersion was warmed at 40° C. for one hour, followed by a subsequent heat treatment at 80° C. for one hour to obtain reducing agent-2 dispersion. Particles of the reducing agent included in the resulting reducing agent-2 dispersion had a median diameter of 0.50 μm, and a maximum particle diameter of 1.6 μm or less. The resultant reducing agent-2 dispersion was subjected to filtration with a polypropylene filter having a pore size of 3.0 μm to remove foreign substances such as dust, and stored.

4) Preparation of Hydrogen Bonding Compound Dispersion

To 10 kg of hydrogen bonding compound-1 (tri(4-t-butylphenyl)phosphineoxide) and 16 kg of a 10% by weight aqueous solution of modified polyvinyl alcohol (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by IMEX Co., Ltd.) packed with zirconia beads having a mean particle diameter of 0.5 mm for 4 hours. Thereafter, 0.2 g of a benzoisothiazolinone sodium salt and water were added thereto, thereby adjusting the concentration of the hydrogen bonding compound to be 25% by weight. This dispersion was warmed at 40° C. for one hour, followed by a subsequent heat treatment at 80° C. for one hour to obtain hydrogen bonding compound-1 dispersion. Particles of the hydrogen bonding compound included in the resulting hydrogen bonding compound dispersion had a median diameter of 0.45 μm, and a maximum particle diameter of 1.3 μm or less. The resultant hydrogen bonding compound dispersion was subjected to filtration with a polypropylene filter having a pore size of 3.0 μm to remove foreign substances such as dust, and stored.

5) Preparations of Dispersions of Development Accelerator and Color-tone-adjusting Agent <Preparation of Development Accelerator-1 Dispersion>

To 10 kg of development accelerator-1 and 20 kg of a 10% by weight aqueous solution of modified polyvinyl alcohol (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by IMEX Co., Ltd.) packed with zirconia beads having a mean particle diameter of 0.5 mm for 3 hours and 30 minuets. Thereafter, 0.2 g of a benzoisothiazolinone sodium salt and water were added thereto, thereby adjusting the concentration of the development accelerator to be 20% by weight. Accordingly, development accelerator-1 dispersion was obtained. Particles of the development accelerator included in the resulting development accelerator dispersion had a median diameter of 0.48 μm, and a maximum particle diameter of 1.4 μm or less. The resultant development accelerator dispersion was subjected to filtration with a polypropylene filter having a pore size of 3.0 μm to remove foreign substances such as dust, and stored.

Also concerning solid dispersions of development accelerator-2 and color-tone-adjusting agent-1, dispersion was executed in a similar manner to the development accelerator-1, and thus dispersions of 20% by weight and 15% by weight were respectively obtained.

6) Preparations of Organic Polyhalogen Compound Dispersion

<Preparation of Organic Polyhalogen Compound-1 Dispersion>

10 kg of organic polyhalogen compound-1 (tribromomethane sulfonylbenzene), 10 kg of a 20% by weight aqueous solution of modified polyvinyl alcohol (manufactured by Kuraray Co., Ltd., Poval MP203), 0.4 kg of a 20% by weight aqueous solution of sodium triisopropylnaphthalenesulfonate and 14 kg of water were thoroughly admixed to give a slurry. This slurry was fed with a diaphragm pump, and was subjected to dispersion with a horizontal sand mill (UVM-2: manufactured by IMEX Co., Ltd.) packed with zirconia beads having a mean particle diameter of 0.5 mm for 5 hours. Thereafter, 0.2 g of a benzoisothiazolinone sodium salt and water were added thereto, thereby adjusting the concentration of the organic polyhalogen compound to be 30% by weight. Accordingly, organic polyhalogen compound-1 dispersion was obtained. Particles of the organic polyhalogen compound included in the resulting organic polyhalogen compound dispersion had a median diameter of 0.41 μm, and a maximum particle diameter of 2.0 μm or less. The resultant organic polyhalogen compound dispersion was subjected to filtration with a polypropylene filter having a pore size of 10.0 μm to remove foreign substances such as dust, and stored.

<Preparation of Organic Polyhalogen Compound-2 Dispersion>

10 kg of organic polyhalogen compound-2 (N-butyl-3-tribromomethane sulfonylbenzoamide), 20 kg of a 10% by weight aqueous solution of modified polyvinyl alcohol (manufactured by Kuraray Co., Ltd., Poval MP203) and 0.4 kg of a 20% by weight aqueous solution of sodium triisopropylnaphthalenesulfonate were thoroughly admixed to give a slurry. This slurry was fed with a diaphragm pump, and was subjected to dispersion with a horizontal sand mill (UVM-2: manufactured by IMEX Co., Ltd.) packed with zirconia beads having a mean particle diameter of 0.5 mm for 5 hours. Thereafter, 0.2 g of a benzoisothiazolinone sodium salt and water were added thereto, thereby adjusting the concentration of the organic polyhalogen compound to be 30% by weight. This fluid dispersion was heated at 40° C. for 5 hours to obtain organic polyhalogen compound-2 dispersion. Particles of the organic polyhalogen compound included in the resulting organic polyhalogen compound dispersion had a median diameter of 0.40 μm, and a maximum particle diameter of 1.3 μm or less. The resultant organic polyhalogen compound dispersion was subjected to filtration with a polypropylene filter having a pore size of 3.0 μm to remove foreign substances such as dust, and stored.

7) Preparation of Silver Iodide Complex-forming Agent Solution 8 kg of modified polyvinyl alcohol MP203 was dissolved in 174.57 kg of water, and thereto were added 3.15 kg of a 20% by weight aqueous solution of sodium triisopropylnaphthalenesulfonate and 14.28 kg of a 70% by weight aqueous solution of 6-isopropylphthalazine. Accordingly, a 5% by weight solution of silver iodide complex-forming agent compound was prepared.

8) Preparations of Aqueous Solution of Mercapto Compound

<Preparation of Aqueous Solution of Mercapto Compound-1>

Mercapto compound-1 (1-(3-sulfophenyl)-5-mercaptotetrazole sodium salt) in an amount of 7 g was dissolved in 993 g of water to give a 0.7% by weight aqueous solution.

<Preparation of Aqueous Solution of Mercapto Compound-2>

Mercapto compound-2 (1-(3-methylureidophenyl)-5-mercaptotetrazole) in an amount of 20 g was dissolved in 980 g of water to give a 2.0% by weight aqueous solution.

9) Preparation of SBR Latex Solution

To a polymerization tank of a gas monomer reaction apparatus (manufactured by Taiatsu Techno Corporation, TAS-2J type), were charged 287 g of distilled water, 7.73 g of a surfactant (Pionin A-43-S (manufactured by TAKEMOTO OIL & FAT CO., LTD.): solid matter content of 48.5% by weight), 14.06 mL of 1 mol/L sodium hydroxide, 0.15 g of ethylenediamine tetraacetate tetrasodium salt, 255 g of styrene, 11.25 g of acrylic acid, and 3.0 g of tert-dodecyl mercaptan, followed by sealing of the reaction vessel and stirring at a stirring rate of 200 rpm. Degassing was conducted with a vacuum pump, followed by repeating nitrogen gas replacement several times. Thereto was injected 108.75 g of 1,3-butadiene, and the inner temperature is elevated to 60° C. Thereto was added a solution of 1.875 g of ammonium persulfate dissolved in 50 mL of water, and the mixture was stirred for 5 hours as it stands. The temperature was further elevated to 90° C., followed by stirring for 3 hours. After completing the reaction, the inner temperature was lowered to reach to the room temperature, and thereafter the mixture was treated by adding 1 mol/L sodium hydroxide and ammonium hydroxide to give the molar ratio of $Na^+$ion: $NH_4^+$ion=1:5.3, and thus, the pH of the mixture was adjusted to 8.4. Thereafter, filtration with a polypropylene filter having the pore size of 1.0 μm was conducted to remove foreign substances such as dust followed by storage. Accordingly, SBR latex was obtained in an amount of 774.7 g. Upon the measurement of halogen ion by ion chromatography, concentration of chloride ion was revealed to be 3 ppm. As a result of the measurement of the concentration of the chelating agent by high performance liquid chromatography, it was revealed to be 145 ppm.

The aforementioned latex had a mean particle diameter of 90 nm, Tg of 17° C., solid matter concentration of 44% by weight, the equilibrium moisture content at 25° C. and 60% RH of 0.6% by weight, ionic conductance of 4.80 mS/cm (measurement of the ionic conductance performed using a conductivity meter CM-30S manufactured by To a Electronics Ltd. for the latex stock solution (44% by weight) at 25° C.) and pH of 8.4.

3. Preparations of Coating Solution

1) Preparations of Coating Solution for Image Forming Layer

To the dispersion A of silver salt of fatty acid obtained as described above in an amount of 1000 g and 276 mL of water were serially added the organic polyhalogen compound-1 dispersion, the organic polyhalogen compound-2 dispersion, the silver iodide complex-forming agent solution, the SBR latex (Tg: 17° C.) solution, the reducing agent-1 dispersion, the reducing agent-2 dispersion, the humectant in a 20% by weight aqueous solution (the kind and the addition amount of the humectant are shown in Table 6 to Table 10), the hydrogen bonding compound-1 dispersion, the development accelerator-1 dispersion, the development accelerator-2 dispersion, the color-tone-adjusting agent-1 dispersion, the mercapto compound-1 aqueous solution, and the mercapto compound-2 aqueous solution. The coating solution for the image forming layer prepared by adding 118 g of the mixed emulsion for coating solution thereto followed by thorough mixing just prior to the coating was fed directly to a coating die.

2) Preparation of Coating Solution for Intermediate Layer

To 1000 g of polyvinyl alcohol PVA-205 (manufactured by Kuraray Co., Ltd.), and 4200 mL of a 19% by weight solution of methyl methacrylate/styrene/butyl acrylate/hydroxyethyl methacrylate/acrylic acid copolymer (weight ratio of the copolymerization of 64/9/20/5/2) latex, were added 27 mL of a 5% by weight aqueous solution of aerosol OT (manufactured by American Cyanamid Co.), 135 mL of a 20% by weight aqueous solution of ammonium secondary phthalate and water to give total amount of 10000 g. The mixture was adjusted with sodium hydroxide to give the pH of 7.5. Accordingly, the coating solution for the intermediate layer was prepared, and was fed to a coating die to provide 9.1 mL/$m^2$.

Viscosity of the coating solution was 58 [mPa·s] which was measured with a B type viscometer at 40° C. (No. 1 rotor, 60 rpm).

3) Preparation of Coating Solution-1 for First Layer of Surface Protective Layers In water was dissolved 64 g of inert gelatin, and thereto were added 80 g of a 27.5% by weight solution of methyl methacrylate/styrene/butyl acrylate/hydroxyethyl methacrylate/acrylic acid copolymer (weight ratio of the copolymerization of 64/9/20/5/2) latex, 23 mL of a 10% by weight methanol solution of phthalic acid, 23 mL of a 10% by weight aqueous solution of 4-metyl phthalic acid, 28 mL of 0.5 mol/L sulfuric acid, 5 mL of a 5% by weight aqueous solution of aerosol OT (manufactured by American Cyanamid Co.), 0.5 g of phenoxyethyl alcohol, and 0.1 g of benzoisothiazolinone. Water was added to give total amount of 750 g. Immediately before coating, 26 mL of a 4% by weight chrome alum which had been mixed with a static mixer was fed to a coating die so that the amount of the coating solution became 18.6 mL/$m^2$.

Viscosity of the coating solution was 20 [mPa·s] which was measured with a B type viscometer at 40° C. (No. 1 rotor, 60 rpm).

4) Preparation of Coating Solution-2 for First Layer of Surface Protective Layers Preparation of coating solution-2 for first layer of surface protective layers was conducted in a similar manner to the process in the preparation of the coating solution-1 for first layer of surface protective layers except that removing the chrome alum from the coating solution-1 for first layer of surface protective layers.

5) Preparation of Coating Solution-1 for Second Layer of Surface Protective Layers In water was dissolved 80 g of inert gelatin and thereto were added 102 g of a 27.5% by weight solution of methyl methacrylate/styrene/butyl acrylate/hydroxyethyl methacrylate/acrylic acid copolymer (weight ratio of the copolymerization of 64/9/20/5/2) latex, 3.2 mL of a 5% by weight solution of a fluorocarbon surfactant (F-1), 32 mL of a 2% by weight aqueous solution of another fluorocarbon surfactant (F-2), 23 mL of a 5% by weight aqueous solution of aerosol OT (manufactured by American Cyanamid Co.), 25 g of polymethyl methacrylate fine particles (mean particle diameter of 8.0 μm), 1.6 g of 4-methyl phthalic acid, 4.8 g of phthalic acid, 44 mL of 0.5 mol/L sulfuric acid, and 10 mg of benzoisothiazolinone. Water was added to give total amount of 650 g. Immediately before coating, 445 mL of 0.67% by weight phthalic acid was added and admixed with a static mixer to give a coating solution for the second layer of the surface protective layers-1, which was fed to a coating die so that 8.3 mL/m$^2$ could be provided.

Viscosity of the coating solution was 19 [mPa·s] which was measured with a B type viscometer at 40° C. (No. 1 rotor, 60 rpm).

6) Preparation of Coating Solution-2 to -10 for Second Layer of Surface Protective Layers Preparation of coating solution-2 to -10 for second layer of surface protective layers were conducted in a similar manner to the process in the preparation of coating solution-1 for second layer of surface protective layers except that in place of inert gelatin and methyl methacrylate/styrene/butyl acrylate/hydroxyethyl methacrylate/acrylic acid copolymer (weight ratio of the copolymerization of 64/9/20/5/2) latex, a water-soluble binder or a polymer latex (described in Table 6 to Table 10) of the present invention, and also a crosslinking agent (described in Table 6 to Table 10) of the present invention were added. Thereby, the coating solution-2 to -10 for second layer of surface protective layers was prepared. The water-soluble binder or the polymer latex of the present invention was used in the same weight as for the inert gelatin or methyl methacrylate/styrene/butyl acrylate/hydroxyethyl methacrylate/acrylic acid copolymer (weight ratio of the copolymerization of 64/9/20/5/2) latex. The crosslinking agent of the present invention was added in an amount of 15% by weight with respect to the water-soluble binder or the polymer latex used. The addition ratio of the solid content of the water-soluble binder or the polymer latex is expressed as X:Y (weight ratio: X+Y=100, described in Table 6 to Table 10).

The crosslinking agent (B) was used as an aqueous solution prepared by dissolving the chemical in water, and the crosslinking agent (C) was used as an aqueous dispersed solution supplied by the maker. The crosslinking agent (A) was used by emulsifying the chemical forehand using the known emulsion dispersing apparatus (MULTI-DISPER PB95, high speed mixing apparatus, rounded vane type, produced by SMT Co., Ltd.) by taking advantage of the self-emulsifying property in aqueous medium.

3. Coating

Simultaneous overlaying coating by a slide bead coating method was subjected, on both sides of the support, in order of the image forming layer, intermediate layer, first layer of the surface protective layers and second layer of the surface protective layers. The amount of coated silver in the image forming layer was 0.82 per one side, and 0.164 g/m$^2$ for total amount of both sides, with respect to the sum of the amounts of silver salt of fatty acid and silver halide.

The coating amount of each compound (g/m$^2$) for the image forming layer per one side is as follows.

| | |
|---|---|
| Silver salt of fatty acid | 2.80 |
| Organic polyhalogen compound-1 | 0.028 |
| Organic polyhalogen compound-2 | 0.094 |
| Silver iodide complex-forming agent | 0.46 |
| SBR latex | 5.45 |
| Reducing agent-1 | 0.33 |
| Reducing agent-2 | 0.13 |
| Hydrogen bonding compound-1 | 0.15 |
| Development accelerator-1 | 0.005 |
| Development accelerator-2 | 0.035 |
| Color-tone-adjusting agent-1 | 0.002 |
| Mercapto compound-1 | 0.001 |
| Mercapto compound-2 | 0.003 |
| Silver halide (on the basis of Ag content) | 0.146 |

Chemical structures of the compounds used in Examples of the invention are shown below.

Tellurium sensitizer C

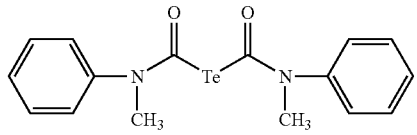

Compound 1 that can be One-electron-oxidized to Provide a One-electron Oxidation Product Which Releases One or More Electrons

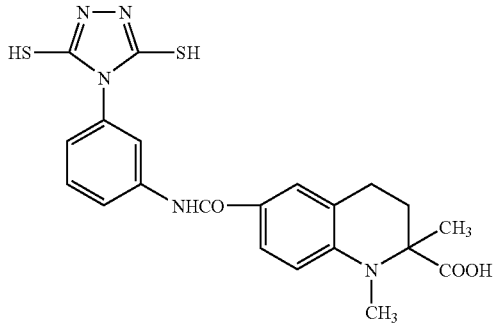

Compound 2 that can be One-electron-oxidized to Provide a One-electron Oxidation Product Which Releases One or More Electrons

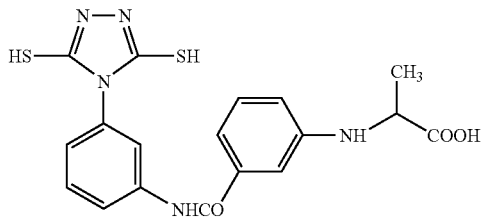

Compound 3 that can be One-electron-oxidized to Provide a One-electron Oxidation Product Which Releases One or More Electrons

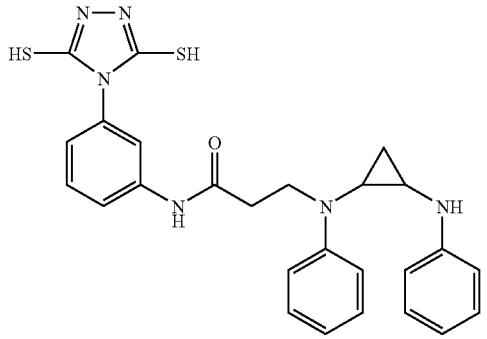

Compound 1 Having Adsorptive Group and Reducible Group

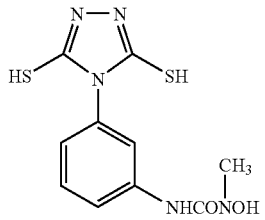

Compound 2 Having Adsorptive Group and Reducible Group

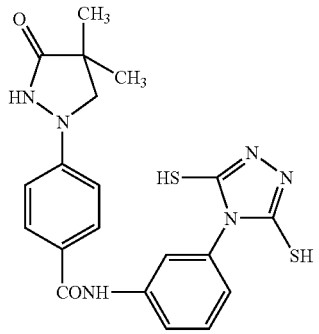

Reducing agent-1

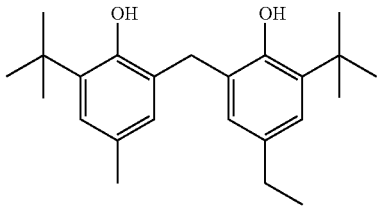

Reducing agent-2

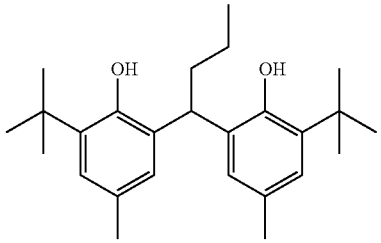

Hydrogen bonding compound-1

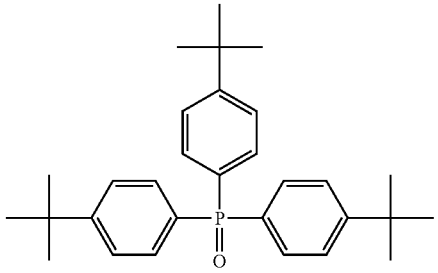

Organic polyhalogen compound-1

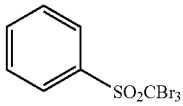

Organic polyhalogen compound-2

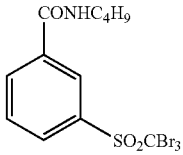

Mercapto compound-1

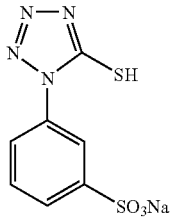

Mercapto compound-2

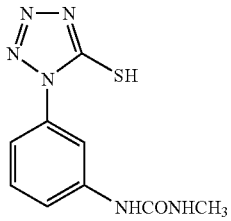

-continued

Silver iodide complex-forming agent

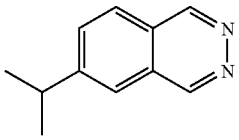

Development accelerator-1

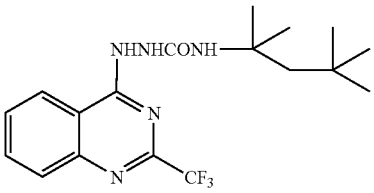

Development accelerator-2

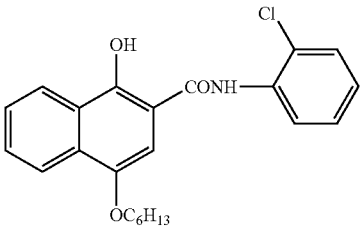

Color-tone-adjusting agent-1

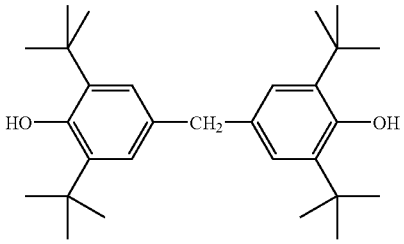

(F-1)

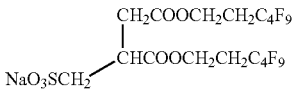

(F-2)

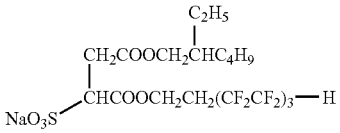

4. Evaluation of Photographic Properties 4-1. Preparation

The resulting sample was cut into a half-cut size, and was wrapped with the following packaging material under an environment of 25° C. and 50% RH, and stored for 2 weeks at an ambient temperature.

<Packaging Material>

A film laminated with PET 10 μm/PE 12 μm/aluminum foil 9 μm/Ny 15 μm/polyethylene 50 μm containing carbon at 3% by weight:

oxygen permeability at 25° C.: 0.02 $mL \cdot atm^{-1} m^{-2} day^{-1}$, vapor permeability at 25° C.: 0.10 $g \cdot atm^{-1} m^{-2} day^{-1}$.

4-2. Exposure and Thermal Development

Two sets of X-ray regular screen HI-SCREEN B3 ($CaWO_4$ was used as fluorescent substance, the emission peak wavelength of 425 nm) produced by Fuji Photo Film Co., Ltd. were used, and the assembly for image formation was provided by inserting the sample between them. This assembly was subjected to X-ray exposure for 0.05 seconds, and then X-ray sensitometry was performed. The X-ray apparatus used was DRX-3724HD (trade name) produced by Toshiba Corp., and a tungsten target tube was used. X-ray emitted by a pulse generator operated at three phase voltage of 80 kvp and penetrated through a filter comprising 7 cm thickness of water having the absorption ability almost the same as human body was used as the light source. By the method of distance, varying the exposure value of X-ray, the sample was subjected to exposure with a step wedge tablet having a width of 0.15 in terms of log E.

Figure 8:
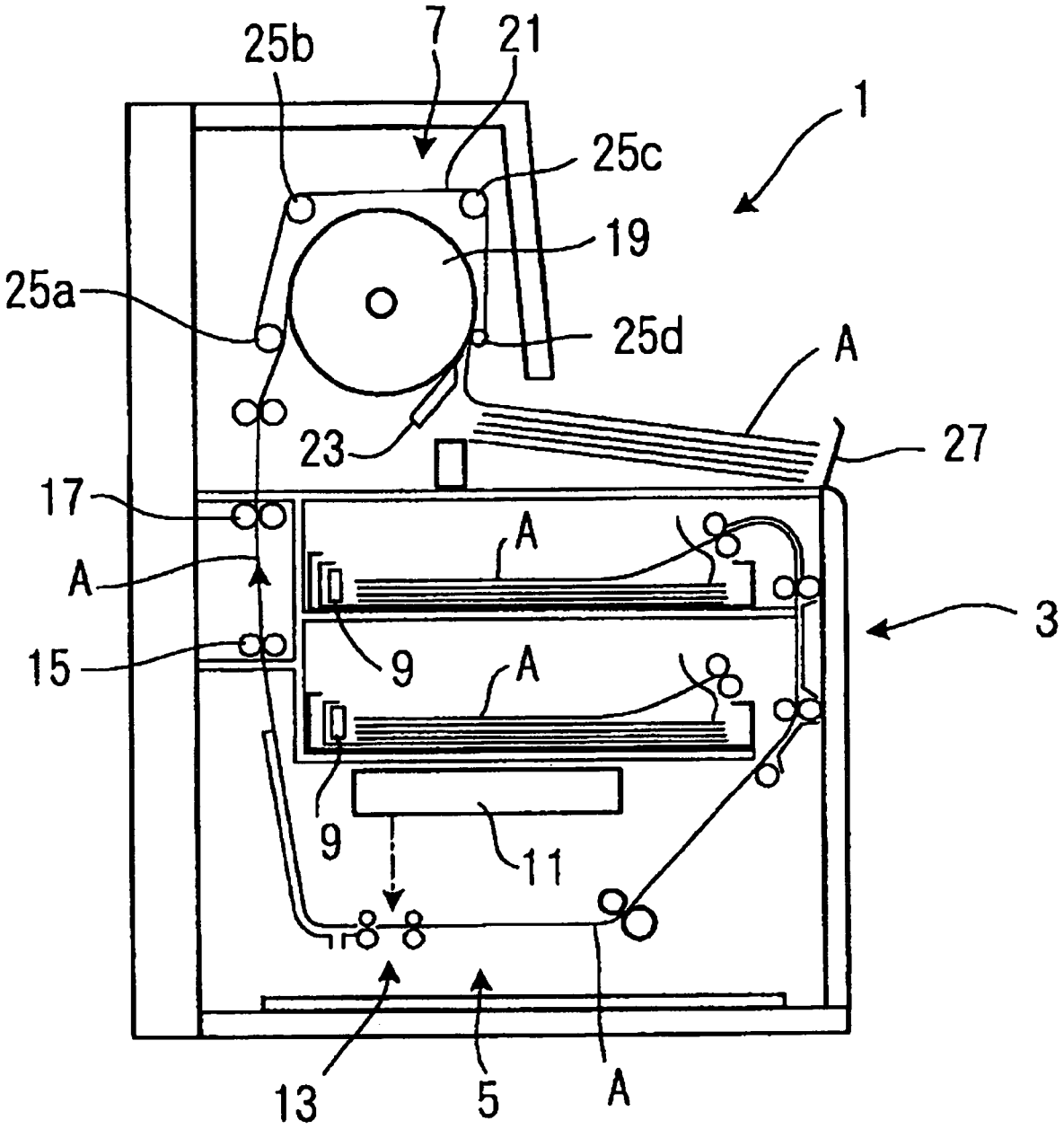
FIG. 8 is a structural view showing a conventional image forming apparatus provided with a thermal developing apparatus.
Figure 9:
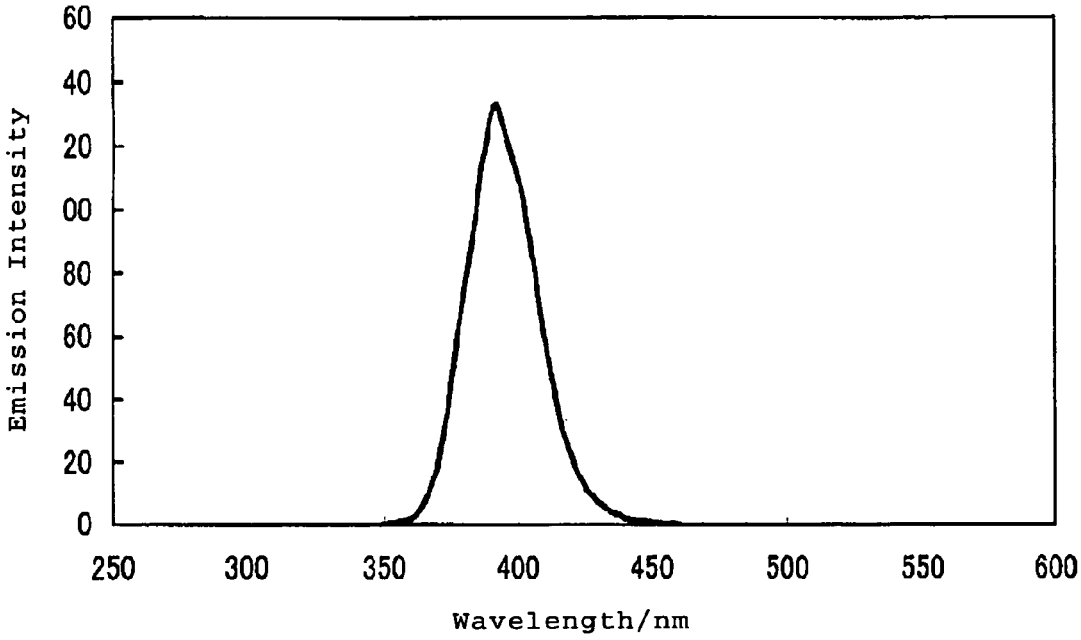
FIG. 9 shows an emission spectrum of a fluorescent intensifying screen A.

After exposure, the exposed sample was subjected to thermal development under the thermal developing condition using a thermal developing apparatus according to the invention. The temperature of the heating means of each thermal developing apparatus (see FIG. 1, FIG. 5, FIG. 6. FIG. 7, and FIG. 8) was set to 121° C., the sample was developed for t seconds. The time period for development t seconds was performed as shown in Table 5.

TABLE 5

| | FIG. 1 Thermal developing apparatus | FIG. 5 Thermal developing apparatus | FIG. 6 Thermal developing apparatus | FIG. 7 Thermal devel-oping apparatus | FIG. 8 Thermal devel-oping apparatus |
|---|---|---|---|---|---|
| t(sec) | 21 | 18 | 25 | 25 | 19 |

4-3. Method of Evaluation and Result

1) Sensitivity

Fog: an optical density (Dmin) of the unexposed part of the material.

Sensitivity: an inverse of the exposure value giving image density of fog+1.2.

Sensitivity Difference (ΔS): an absolute value of differences in sensitivity between a development at 25° C. and relative humidity of 70% and a development at 25° C. and relative humidity of 20%.

2) Density Change at Continuous Processing

The sample each was wrapped in a moisture proofed package in an environmental condition of 25° C. and 40% RH, and stored for 2 weeks. Thereafter, the sample was subjected to exposure and thermally developed.

50 sheets were successively processed from the beginning of the starting up of the thermal developing apparatus in the environmental condition described above.

The exposure condition was predetermined so as to give an image density of 1.2 for every sample one day before the evaluation. The change and unevenness in the image density of each processed sample were evaluated on the first sheet, second sheet, 5th sheet, and 10th sheet selected from 50 sheets processed successively, while placing the samples on a lighting table of 10,000 Lux.

The obtained results were sensory evaluated according to the following criteria.

◎: no density change and density unevenness are seen.

○: slightly density change and density unevenness are seen, but negligible level for diagnosis.

Δ: some density change and density unevenness are seen, and harmful level for diagnosis.

×: remarkable density change and density unevenness are seen, and apparently defective level for diagnosis.

3) Density Unevenness in Image Part

The 50th sheet of the above-processed sample selected from 50 sheets processed successively was observed on the density unevenness, while placing the samples on the lighting table of 10,000 Lux.

⊙: no density unevenness is perceived between the edge portion and the middle portion.

○: slightly density unevenness between the edge portion and the middle portion is perceived, but negligible level for diagnosis.

Δ: some density unevenness between the edge portion and the middle portion is perceived, harmful level for diagnosis.

×: remarkable density unevenness between the edge portion and the middle portion is perceived and apparently defective level for diagnosis.

The obtained results are shown in the following Table 6 to Table 10.

Crosslinking Agent (a) Duranate WB40-100 (Asahi Kasei Chemicals Corporation)

(b) Carbodilite V-06 (Nisshinbo Industries, Inc.)

(c) Epocros K-2020E (Nippon Shokubai Co., Ltd.)

TABLE 6

| Sample No. | First layer of surface protective layers | Second layer of surface protective layers: Binder(1) | Binder(2) | Ratio X:Y | Crosslinking agent | Humectant | Thermal developing apparatus | Photographic properties: $\Delta S_{1.0}$ | Density change at successive processing | Density unevenness in image part | Note |
|---|---|---|---|---|---|---|---|---|---|---|---|
| 1 | 1 | gelatin | MMA/St/Bu/HEMA/AA = 64/9/20/5/2 | 74:26 | — | — | 1 | 0.1 | ○ | ○ | Invention |
| 2 | 2 | gelatin | MMA/St/Bu/HEMA/AA = 64/9/20/5/2 | 74:26 | (a) | — | " | 0.06 | ○ | ○ | Invention |
| 3 | 2 | (A) | MMA/St/Bu/HEMA/AA = 64/9/20/5/2 | 15:85 | (b) | — | " | 0.03 | ⊙ | ⊙ | Invention |
| 4 | 2 | (B) | LP-13 | 15:85 | (b) | — | " | 0 | ⊙ | ⊙ | Invention |
| 5 | 2 | (B) | (C)P-3 | 15:85 | (b) | — | " | 0 | ⊙ | ⊙ | Invention |
| 6 | 2 | (B) | LP-13 | 15:85 | (a) | — | " | 0 | ⊙ | ⊙ | Invention |
| 7 | 2 | (B) | LP-13 | 15:85 | (c) | — | " | 0 | ⊙ | ⊙ | Invention |
| 8 | 2 | (B) | LP-4 | 15:85 | (b) | — | " | 0 | ⊙ | ⊙ | Invention |
| 9 | 2 | gelatin | LP-13 | 75:25 | (b) | glycerin (0.05 g/m$^2$) | " | 0.04 | ⊙ | ⊙ | Invention |
| 10 | 2 | gelatin | LP-13 | 75:25 | (b) | urea (0.5 g/m$^2$) | " | 0.01 | ⊙ | ⊙ | Invention |

(A): Modified polyvinyl alcohol-1 (trade name: KL-318, products from Kuraray Ltd.)

(B): Polyvinyl alcohol-2 (trade name: PVA-205, products from Kuraray Ltd.)

TABLE 7

| Sample No. | First layer of surface protective layers | Second layer of surface protective layers: Binder(1) | Binder(2) | Ratio X:Y | Crosslinking agent | Humectant | Thermal developing apparatus | Photographic properties: $\Delta S_{1.0}$ | Density change at successive processing | Density unevenness in image part | Note |
|---|---|---|---|---|---|---|---|---|---|---|---|
| 1 | 1 | gelatin | MMA/St/Bu/HEMA/AA = 64/9/20/5/2 | 74:26 | — | — | 5 | 0.14 | ○ | ○ | Invention |
| 2 | 2 | gelatin | MMA/St/Bu/HEMA/AA = 64/9/20/5/2 | 74:26 | (a) | — | " | 0.1 | ○ | ○ | Invention |
| 3 | 2 | (A) | MMA/St/Bu/HEMA/AA = 64/9/20/5/2 | 15:85 | (b) | — | " | 0.07 | ○ | ○ | Invention |
| 4 | 2 | (B) | LP-13 | 15:85 | (b) | — | " | 0.03 | ⊙ | ⊙ | Invention |
| 5 | 2 | (B) | (C)P-3 | 15:85 | (b) | — | " | 0.04 | ⊙ | ⊙ | Invention |
| 6 | 2 | (B) | LP-13 | 15:85 | (a) | — | " | 0.03 | ⊙ | ⊙ | Invention |
| 7 | 2 | (B) | LP-13 | 15:85 | (c) | — | " | 0.04 | ⊙ | ⊙ | Invention |
| 8 | 2 | (B) | LP-4 | 15:85 | (b) | — | " | 0.04 | ⊙ | ○ | Invention |
| 9 | 2 | gelatin | LP-13 | 75:25 | (b) | glycerin (0.05 g/m$^2$) | " | 0.09 | ○ | ○ | Invention |

TABLE 7-continued

| Sample No. | First layer of surface protective layers | Second layer of surface protective layers: Binder(1) | Binder(2) | Ratio X:Y | Crosslinking agent | Humectant | Thermal developing apparatus | Photographic properties: $\Delta S_{1.0}$ | Density change at successive processing | Density unevenness in image part | Note |
|---|---|---|---|---|---|---|---|---|---|---|---|
| 10 | 2 | gelatin | LP-13 | 75:25 | (b) | urea (0.5 g/m$^2$) | " | 0.05 | ◎ | ◎ | Invention |

(A): Modified polyvinyl alcohol-1 (trade name: KL-318, products from Kuraray Ltd.)
(B): Polyvinyl alcohol-2 (trade name: PVA-205, products from Kuraray Ltd.)

TABLE 8

| Sample No. | First layer of surface protective layers | Second layer of surface protective layers: Binder(1) | Binder(2) | Ratio X:Y | Crosslinking agent | Humectant | Thermal developing apparatus | Photographic properties: $\Delta S_{1.0}$ | Density change at successive processing | Density unevenness in image part | Note |
|---|---|---|---|---|---|---|---|---|---|---|---|
| 1 | 1 | gelatin | MMA/St/Bu/HEMA/AA = 64/9/20/5/2 | 74:26 | — | — | 6 | 0.13 | ○ | ○ | Invention |
| 2 | 2 | gelatin | MMA/St/Bu/HEMA/AA = 64/9/20/5/2 | 74:26 | (a) | — | " | 0.09 | ○ | ○ | Invention |
| 3 | 2 | (A) | MMA/St/Bu/HEMA/AA = 64/9/20/5/2 | 15:85 | (b) | — | " | 0.06 | ○ | ○ | Invention |
| 4 | 2 | (B) | LP-13 | 15:85 | (b) | — | " | 0.02 | ◎ | ◎ | Invention |
| 5 | 2 | (B) | (C)P-3 | 15:85 | (b) | — | " | 0.03 | ◎ | ◎ | Invention |
| 6 | 2 | (B) | LP-13 | 15:85 | (a) | — | " | 0.02 | ◎ | ◎ | Invention |
| 7 | 2 | (B) | LP-13 | 15:85 | (c) | — | " | 0.02 | ◎ | ◎ | Invention |
| 8 | 2 | (B) | LP-4 | 15:85 | (b) | — | " | 0.04 | ◎ | ○ | Invention |
| 9 | 2 | gelatin | LP-13 | 75:25 | (b) | glycerin (0.05 g/m$^2$) | " | 0.07 | ○ | ○ | Invention |
| 10 | 2 | gelatin | LP-13 | 75:25 | (b) | urea (0.5 g/m$^2$) | " | 0.04 | ◎ | ◎ | Invention |

(A): Modified polyvinyl alcohol-1 (trade name: KL-318, products from Kuraray Ltd.)
(B): Polyvinyl alcohol-2 (trade name: PVA-205, products from Kuraray Ltd.)

TABLE 9

| Sample No. | First layer of surface protective layers | Second layer of surface protective layers: Binder(1) | Binder(2) | Ratio X:Y | Crosslinking agent | Humectant | Thermal developing apparatus | Photographic properties: $\Delta S_{1.0}$ | Density change at successive processing | Density unevenness in image part | Note |
|---|---|---|---|---|---|---|---|---|---|---|---|
| 1 | 1 | gelatin | MMA/St/Bu/HEMA/AA = 64/9/20/5/2 | 74:26 | — | — | 7 | 0.11 | Δ | Δ | Invention |
| 2 | 2 | gelatin | MMA/St/Bu/HEMA/AA = 64/9/20/5/2 | 74:26 | (a) | — | " | 0.07 | ○ | ○ | Invention |
| 3 | 2 | (A) | MMA/St/Bu/HEMA/AA = 64/9/20/5/2 | 15:85 | (b) | — | " | 0.04 | ◎ | ◎ | Invention |
| 4 | 2 | (B) | LP-13 | 15:85 | (b) | — | " | 0 | ◎ | ◎ | Invention |
| 5 | 2 | (B) | (C)P-3 | 15:85 | (b) | — | " | 0.01 | ◎ | ◎ | Invention |
| 6 | 2 | (B) | LP-13 | 15:85 | (a) | — | " | 0 | ◎ | ◎ | Invention |
| 7 | 2 | (B) | LP-13 | 15:85 | (c) | — | " | 0.01 | ◎ | ◎ | Invention |
| 8 | 2 | (B) | LP-4 | 15:85 | (b) | — | " | 0.01 | ◎ | ◎ | Invention |
| 9 | 2 | gelatin | LP-13 | 75:25 | (b) | glycerin (0.05 g/m$^2$) | " | 0.05 | ◎ | ◎ | Invention |

TABLE 9-continued

| Sample No. | First layer of surface protective layers | Second layer of surface protective layers: Binder(1) | Binder(2) | Ratio X:Y | Crosslinking agent | Humectant | Thermal developing apparatus | $\Delta S_{1.0}$ | Photographic properties: Density change at successive processing | Density unevenness in image part | Note |
|---|---|---|---|---|---|---|---|---|---|---|---|
| 10 | 2 | gelatin | LP-13 | 75:25 | (b) | urea (0.5 g/m$^2$) | " | 0.02 | ⊙ | ⊙ | Invention |

(A): Modified polyvinyl alcohol-1 (trade name: KL-318, products from Kuraray Ltd.)
(B): Polyvinyl alcohol-2 (trade name: PVA-205, products from Kuraray Ltd.)

TABLE 10

| Sample No. | First layer of surface protective layers | Second layer of surface protective layers: Binder(1) | Binder(2) | Ratio X:Y | Crosslinking agent | Humectant | Thermal developing apparatus | $\Delta S_{1.0}$ | Photographic properties: Density change at successive processing | Density unevenness in image part | Note |
|---|---|---|---|---|---|---|---|---|---|---|---|
| 1 | 1 | gelatin | MMA/St/Bu/HEMA/AA = 64/9/20/5/2 | 74:26 | — | — | 8 | 0.32 | X | X | Comp. Ex. |
| 2 | 2 | gelatin | MMA/St/Bu/HEMA/AA = 64/9/20/5/2 | 74:26 | (a) | — | " | 0.28 | X | X | Comp. Ex. |
| 3 | 2 | (A) | MMA/St/Bu/HEMA/AA = 64/9/20/5/2 | 15:85 | (b) | — | " | 0.25 | Δ | X | Comp. Ex. |
| 4 | 2 | (B) | LP-13 | 15:85 | (b) | — | " | 0.21 | Δ | Δ | Comp. Ex. |
| 5 | 2 | (B) | (C)P-3 | 15:85 | (b) | — | " | 0.22 | Δ | Δ | Comp. Ex. |
| 6 | 2 | (B) | LP-13 | 15:85 | (a) | — | " | 0.21 | Δ | Δ | Comp. Ex. |
| 7 | 2 | (B) | LP-13 | 15:85 | (c) | — | " | 0.21 | Δ | Δ | Comp. Ex. |
| 8 | 2 | (B) | LP-4 | 15:85 | (b) | — | " | 0.22 | Δ | Δ | Comp. Ex. |
| 9 | 2 | gelatin | LP-13 | 75:25 | (b) | glycerin (0.05 g/m$^2$) | " | 0.26 | Δ | X | Comp. Ex. |
| 10 | 2 | gelatin | LP-13 | 75:25 | (b) | urea (0.5 g/m$^2$) | " | 0.23 | Δ | Δ | Comp. Ex. |

(A): Modified polyvinyl alcohol-1 (trade name: KL-318, products from Kuraray Ltd.)
(B): Polyvinyl alcohol-2 (trade name: PVA-205, products from Kuraray Ltd.)

Example 2

(Preparation of PET Support)

1-1. Film Manufacturing
It was done similar to Example 1.

1-2. Surface Corona Discharge Treatment
It was done similar to Example 1.

1-3. Undercoating
It was done similar to Example 1.

2. Antistatic Layer

1) Preparation of Processed Solution-I of Antistatic Agent 85 g of inert gelatin was dissolved in water, therein the amount described in Table 11 of Compound No. N-1 as an antistatic agent and 0.5 g of Proxel (trade name, manufactured by Avecia K.K.) were added. Water was added to make a total amount of 1,000 g and then stirred well. Thereby, the processed solution-1 of antistatic agent was prepared.

2) Preparations of Processed Solution-2 to −4 of Antistatic Agent

In a similar manner to the preparation of the processed solution-1 of antistatic agent, the processed solutions of the antistatic agent described below were prepared.

Processed solution-2 of antistatic agent: an antistatic agent compound No. C-1.

Processed solution-3 of antistatic agent: an antistatic agent compound No. P-6.

Processed solution-3 of antistatic agent: an antistatic agent compound shown below,

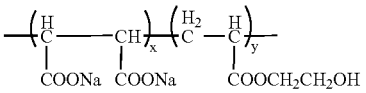

Average molecular weight: 45,000

3) Preparation of Processed Solution-5 of Antistatic Agent

| | |
|---|---|
| $SnO_2$/SbO (weight ratio 9/1, mean particle size 0.5 μm, 17% by weight dispersion) | 117 g |
| Gelatin | 85 g |
| Metolose TC-5 (trade mark, available from Shin-Etsu Chemical Co., Ltd.) (2% by weight aqueous solution) | 10 g |

-continued

| | |
|---|---|
| Sodium dodecylbenzene sulfonate (1% by weight aqueous solution) | 10 mL |
| Sodium hydroxide (1% by weight) | 7 g |
| Proxel (trade name, available from Avecia KK) | 0.5 g |
| Water to make | 1,000 g |

In the case where the processed solution-1 to −5 of antistatic agent were coated over the second layer of surface protective layers, the fluorocarbon surfactant F-1, and F-2 were added to the processed solution-1 to −5 of antistatic agent so that coating amounts of the surfactants therein were the same to the amounts in the second layer of surface protective layers, in place of the addition of the said surfactants for the second layer of surface protective layers.

4) Coating

Coating was performed as described in Table 11. The coating amount is adjusted so that the coating amount of gelatin became 0.5 g/m$^2$.

In the table, OC layer (over coated layer) means an outermost layer adjacent to the second layer of surface protective layers seen from the support, and UC layer (under coated layer) means a layer between the support and the image forming layer.

3. Image Forming Layer, Intermediate Layer, and Surface Protective Layer 3-1. Preparations of Coating Material They were done similar to Example 1.

3-2. Preparations of Coating Solution

1) Preparation of Coating Solution for Image Forming Layer

It was done similar to Example 1.

2) Preparation of Coating Solution for Intermediate Layer

It was done similar to Example 1.

3) Preparation of Coating Solution for First Layer of Surface Protective Layers

It was done in a similar manner to the process in the preparation of coating solution-1 for first layer of surface protective layers in Example 1.

4) Preparation of Coating Solution for Second Layer of Surface Protective Layers It was done in a similar manner to the process in the preparation of coating solution-1 for second layer of surface protective layers in Example 1.

TABLE 11

| | | Antistatic Layer | | | | | | | |
|---|---|---|---|---|---|---|---|---|---|
| | | | Coating | Photographic Properties | | | | Raw Stock | Image |
| Sample No. | Antistatic Agent Kind | Addition Layer | Amount (mg/m$^2$) | Fog | Sensitivity (S) | Gradation | Electrostatic Fault | Storability (ΔS) | Storability (ΔDmin) |
| 101 | — | — | — | 0.19 | 100 | 1.56 | X | 0.15 | 0.04 |
| 102 | Processed solution of antistatic agent-1 | OC | 4 | 0.19 | 100 | 1.56 | ○ | 0.16 | 0.06 |
| 103 | Processed solution of antistatic agent-1 | OC | 15 | 0.19 | 100 | 1.56 | ○ | 0.2 | 0.07 |
| 104 | Processed solution of antistatic agent-2 | OC | 4 | 0.19 | 100 | 1.56 | ○ | 0.16 | 0.06 |
| 105 | Processed solution of antistatic agent-2 | OC | 15 | 0.19 | 100 | 1.56 | ○ | 0.21 | 0.07 |
| 106 | Processed solution of antistatic agent-3 | OC | 100 | 0.19 | 100 | 1.56 | ○ | 0.15 | 0.04 |
| 107 | Processed solution of antistatic agent-4 | OC | 100 | 0.19 | 100 | 1.56 | ○ | 0.15 | 0.04 |
| 108 | Processed solution of antistatic agent-3 | UC | 450 | 0.19 | 100 | 1.62 | ○ | 0.15 | 0.04 |
| 109 | Processed solution of antistatic agent-4 | UC | 450 | 0.19 | 100 | 1.65 | ○ | 0.15 | 0.04 |
| 110 | Processed solution of antistatic agent-5 | UC | 100 | 0.21 | 100 | 1.56 | ○ | 0.18 | 0.06 |
| 111 | Processed solution of antistatic agent-1 | OC | 2 | 0.19 | 100 | 1.62 | ◎ | 0.15 | 0.05 |
| 112 | Processed solution of antistatic agent-1 | OC | 2 | 0.19 | 100 | 1.65 | ◎ | 0.15 | 0.05 |
| 113 | Processed solution of antistatic agent-1 | OC | 2 | 0.21 | 100 | 1.56 | ◎ | 0.15 | 0.06 |

3-3. Preparations of Photothermographic Material-101 to -113

Simultaneous overlaying coating by a slide bead coating method was subjected, on both sides of the support where the antistatic layer was coated as shown in Table 11, in order of the image forming layer, intermediate layer, first layer of the surface protective layers and second layer of the surface protective layers, and thus samples of the photothermographic material-101 to -113 were produced. In this method, the temperature of the coating solution was adjusted to 31° C. for the image forming layer and intermediate layer, to 36° C. for the first layer of the surface protective layers, and to 37° C. for the second layer of the surface protective layers. The amount of coated silver in the image forming layer was 0.821 g/m$^2$ per one side with respect to the sum of the amounts of silver salt of fatty acid and silver halide.

The coating amount of each compound (g/m$^2$) for the image forming layer per one side is as follows. Thickness of the image forming layer was 10 μm.

| | |
|---|---|
| Silver salt of fatty acid | 2.80 |
| Organic polyhalogen compound-1 | 0.028 |
| Organic polyhalogen compound-2 | 0.094 |
| Silver iodide complex-forming agent | 0.46 |
| SBR latex | 5.20 |
| Reducing agent-1 | 0.33 |
| Reducing agent-2 | 0.13 |
| Hydrogen bonding compound-1 | 0.15 |
| Development accelerator-1 | 0.005 |
| Development accelerator-2 | 0.035 |
| Color-tone-adjusting agent-1 | 0.002 |
| Mercapto compound-1 | 0.001 |
| Mercapto compound-2 | 0.003 |
| Silver halide (on the basis of Ag content) | 0.146 |

Conditions for coating and drying were as follows.

The support was decharged by ionic wind. Coating was performed at the speed of 160 m/min. Conditions for coating and drying were adjusted within the range described below, and conditions were set to obtain the most stable surface state.

The clearance between the leading end of the coating die and the support was 0.10 mm to 0.30 mm.

The pressure in the vacuum chamber was set to be lower than atmospheric pressure by 196 Pa to 882 Pa.

In the subsequent cooling zone, the coating solution was cooled by wind having the dry-bulb temperature of 10° C. to 20° C.

Transportation with no contact was carried out, and the coated support was dried with an air of the dry-bulb of 23° C. to 45° C. and the wet-bulb of 15° C. to 21° C. in a helical type contactless drying apparatus.

After drying, moisture conditioning was performed at 25° C. in the humidity of 40% RH to 60% RH.

Then, the film surface was heated to be 70° C. to 90° C., and after heating, the film surface was cooled to 25° C.

Thus prepared photothermographic material had a matt degree of 550 seconds as Beck's smoothness. In addition, measurement of the pH of the film surface gave the result of 6.0.

4. Evaluation of Photographic Properties

1) Preparation

It was done similar to Example 1.

2) Exposure and Development

<Exposure>

It was done similar to that in Example 1, using HI-SCREEN B3 ($CaWO_4$ is used as fluorescent substance, the emission peak wavelength of 425 nm) produced by Fuji Photo Film Co., Ltd.

<Thermal Development>

The thermal developing section of Fuji Medical Dry Laser Imager FM-DP L was modified so that it can heat from both sides, and by another modification the conveying rollers in the thermal developing section were changed to the heating drum so that the sheet of film could be conveyed. The temperatures of four panel heaters were set to 112° C.- 118° C.- 120° C.- 120° C., and the temperature of the heating drum was set to 120° C. By increasing the speed of transportation, the total time period for thermal development was set to be 14 seconds.

3) Method of Evaluation

<Photographic Property>

Fog: a minimum density of the thermally developed photothermographic material described above.

Sensitivity: expressed as a relative value when the sensitivity of Sample No.101 is taken as 100.

Gradation: expressed as an average gradient of a straight line connecting the points at densities of fog+0.03 and fog+0.08.

<Development Unevenness>

One hundred sheets of the photothermographic material were subjected to exposure in combination with a fluorescent intensifying screen in an environmental condition of 25° C. and 10% RH. Thereafter, the sheets were thermally developed by means of the thermal developing apparatus described above in the same environment condition. The obtained samples were evaluated as follows, ×: for a case where some development unevenness among them is perceived.

○: for a case where no development unevenness among them is perceived.

Furthermore, as a forced aging test, the material was subjected to exposure in an environmental condition of 25° C. and 10% RH in combination with a fluorescent intensifying screen. Thereafter, before separating the material from the screen, the material was treated by rubbing each other with the screen by go and back at amplitude of 5 cm, 60 times per 1 minute. Soon after the rubbing, the material was separated from the screen and then subjected to thermal development in the thermal developing apparatus described above at the same environmental condition. The obtained samples were evaluated as follows, ○: for a case where some development unevenness among them is perceived.

◎: for a case where no development unevenness among them is perceived.

<Evaluation of Raw Stock Storability>

As the form of packaged product, the photothermographic materials were stored at 30° C. for 60 days and at 5° C. for 60 days. Thereafter, the materials were thermally developed in the thermal developing apparatus. The raw stock storability of the photothermographic material is evaluated according to the sensitivity difference between them.

<Evaluation of Image Storability>

The thermally developed samples are irradiated to a light of 10,000 Lux for 10 minutes in an environmental condition of 25° C. and 50% RH, and then stored for 72 hours in the darkness at 60° C. The image storability of the photothermographic material is evaluated according to the change in Dmin during the above treatment.

4) Result of Evaluation

The results are shown in Table 11.

It is apparent from Table 11 that the photothermographic material of the present invention exhibits the excellent electrically charged properties. Especially, the raw stock storability and the image storability are preferably improved by means of the antistatic layer of the present invention.

Example 3

1. Preparation of PET Support and Undercoating

They were done similar to Example 1.

2. Image Forming Layer, Intermediate Layer, and Surface Protective Layer

1) Preparation of Coating Solution A for Image Forming Layer

It was done similar to the process in the preparation of coating solution for image forming layer in Example 1.

2) Preparation of Coating Solution B for Image Forming Layer

Preparation of coating solution B for image forming layer was conducted in a similar manner to the process in the preparation of coating solution for image forming layer in Example 1, except that using the following dispersion B of silver salt of fatty acid instead of using dispersion A of silver salt of fatty acid.

<Preparation of Dispersion B of Silver Salt of Fatty Acid>

Preparation of dispersion B of silver salt of fatty acid was conducted in a similar manner to the process in the preparation of dispersion A of silver salt of fatty acid, except that using the behenic acid manufactured by Henkel Co. (trade name: Edenor C22-85R) in an amount of 87.5 kg instead of using recrystallized behenic acid. The behenic acid manufactured by Henkel Co. is a mixture with the content of stearic acid being 1.9 mol %, arachidic acid 6 mol %, behenic acid 90 mol %, lignoceric acid 2 mol %, and erucic acid 0.1 mol %.

3) Preparation of Coating Solution for First Layer of Surface Protective Layers

It was done in a similar manner to the process in the preparation of coating solution-1 for first layer of surface protective layers in Example 1.

4) Preparation of Coating Solution for Second Layer of Surface Protective Layers It was done in a similar manner to the process in the preparation of coating solution-1 for second layer of surface protective layers in Example 1.

3. Preparations of Photothermographic Material-201 and -202

Simultaneous overlaying coating by a slide bead coating method was subjected, on both sides of the support, in order of the image forming layer, intermediate layer, first layer of the surface protective layers and second layer of the surface protective layers, and thus samples of the photothermographic material were produced, similar to Example 1. Sample No.201 was prepared by using the coating solution A for image forming layer, and Sample No. 202 was prepared by using the coating solution B for image forming layer.

Thickness of the image forming layer was 10 μm. The coating amount of silver salt of fatty acid was 0.0625 mol/m$^2$ per one side. The amount of coated silver in the image forming layer was 0.821 g/m$^2$ per one side with respect to the sum of the amounts of silver salt of fatty acid and silver halide.

4. Evaluation of Photographic Properties

1) Preparation

It was done similar to Example 1.

2) Exposure and Development

<Exposure>

It was done similar to Example 1.

<Thermal Development>

Thermal development was performed utilizing the thermal developing section of Fuji Medical Dry Laser Imager FM-DP L.

Condition 1: The temperature of first step of four panel heaters was set to 60° C. to make the first step being a preheating zone, and the temperatures of 3 steps thereafter were set to 119° C.- 121° C.- 121° C., to image these steps being thermal developing zone. By controlling the transporting linear speed, the time period for preheating was set to be 6 seconds and the time period for thermal development was set to be 18 seconds.

Condition 2 to Condition 7: The temperature and the transporting linear speed were changed and linear speed were changed and were set according to the conditions described in Table 12 and Table 13.

3) Method of Evaluation and Results

<Terms for Evaluation>

Fog: an optical density (Dmin) of the unexposed portion of the material.

Dmax: a maximum density saturated with increasing the exposure value.

Sensitivity: an inverse of the exposure value giving a image density of fog+1.2, and expressed as a relative value when the sensitivity of the material developed by Condition 1 is taken as 100.

Sensitivity Difference (ΔS): expressed as a logarithm value of the ratio of a sensitivity ($S_{75}$) developed at 25° C. and relative humidity of 75% to a sensitivity ($S_{20}$) developed at 25° C. and relative humidity of 20%.

$$\Delta S = \log S_{75}/S_{20}$$

Development Unevenness

Ten sheets (a size of 356 mm×432 mm) of each sample were subjected to exposure by an X-ray in the condition mentioned above to give an image density of 1.2. The obtained image is sensory evaluated by the visual observation. The sensory evaluation is shown according to the following rankings, ◎: no development unevenness in the image part is perceived.

○: slightly development unevenness in the image portion is perceived, but negligible level for inspecting the image.

Δ: some development unevenness in the image part is perceived, and impractical level for inspecting the image.

×: apparent development unevenness in the image part is perceived, and difficult level for the inspection.

Development Unevenness when Materials are Processed Continuously

While arranging the said first sheet, 5th sheet, and 10th sheet, the sensory evaluation on the samples was performed with visual observation. The sensory evaluation is shown according to the following rankings, ◎: no development unevenness and difference thereof among the three sheets are seen.

○: slightly development unevenness and difference thereof among the three sheets are seen, but negligible level for inspecting the image.

Δ: some development unevenness and difference thereof among the three sheets are seen, impractical level for inspecting the image.

×: apparent development unevenness and difference thereof among the three sheets are seen, difficult level for the inspection.

<Result of Evaluation>

The results of the evaluation are shown in the following Table 12 and Table 13.

TABLE 12

<Experiment using photothermographic material-201>

| Condition | Condition of Panel Heaters: First Step (Preheat) Temperature (° C.) | First Step (Preheat) Residence Time (second) | Second Step Temperature (° C.) | Second Step Residence Time (second) | Third Step Temperature (° C.) | Third Step Residence Time (second) | Fourth Step Temperature (° C.) | Fourth Step Residence Time (second) | Photographic Properties: Fog | Sensitivity | Dmax | Development Unevenness | Continuous Processing Unevenness |
|---|---|---|---|---|---|---|---|---|---|---|---|---|---|
| 1 | 105 | 6 | 119 | 6 | 121 | 6 | 121 | 6 | 0.18 | 100 | 3.2 | ◎ | ◎ |
| 2 | 80 | 6 | 119 | 6 | 121 | 6 | 121 | 6 | 0.18 | 100 | 3.2 | ◎ | ◎ |
| 3 | 60 | 6 | 119 | 6 | 121 | 6 | 121 | 6 | 0.18 | 100 | 3.2 | ○ | ◎ |
| 4 | 25 | 6 | 119 | 6 | 121 | 6 | 121 | 6 | 0.18 | 100 | 3.2 | Δ | Δ |
| 5 | 112 | 5 | 119 | 5 | 121 | 5 | 121 | 5 | 0.18 | 101 | 3.2 | Δ | Δ |
| 6 | 121 | 4 | 121 | 4 | 121 | 4 | 121 | 4 | 0.18 | 101 | 3.2 | X | Δ |
| 7 | 80 | 11 | 80 | 11 | 119 | 11 | 121 | 11 | 0.18 | 100 | 3.2 | ◎ | ◎ |

TABLE 13

<Experiment using photothermographic material-202>

| Condition | Condition of Panel Heaters: First Step (Preheat) Temperature (° C.) | First Step (Preheat) Residence Time (second) | Second Step Temperature (° C.) | Second Step Residence Time (second) | Third Step Temperature (° C.) | Third Step Residence Time (second) | Fourth Step Temperature (° C.) | Fourth Step Residence Time (second) | Photographic Properties: Fog | Sensitivity | Dmax | Development Unevenness | Continuous Processing Unevenness |
|---|---|---|---|---|---|---|---|---|---|---|---|---|---|
| 1 | 105 | 6 | 119 | 6 | 121 | 6 | 121 | 6 | 0.18 | 105 | 3.25 | ○ | ◎ |
| 2 | 80 | 6 | 119 | 6 | 121 | 6 | 121 | 6 | 0.18 | 105 | 3.25 | ○ | ◎ |
| 3 | 60 | 6 | 119 | 6 | 121 | 6 | 121 | 6 | 0.18 | 105 | 3.25 | ○ | ○ |
| 4 | 25 | 6 | 119 | 6 | 121 | 6 | 121 | 6 | 0.18 | 105 | 3.25 | Δ | Δ |
| 5 | 112 | 5 | 119 | 5 | 121 | 5 | 121 | 5 | 0.18 | 107 | 3.25 | Δ | Δ |
| 6 | 121 | 4 | 121 | 4 | 121 | 4 | 121 | 4 | 0.18 | 107 | 3.20 | X | Δ |
| 7 | 80 | 11 | 80 | 11 | 119 | 11 | 121 | 11 | 0.18 | 106 | 3.25 | ○ | ◎ |

From the results, it is apparent that that the preheating process of the present invention before thermal development can provide images with less development unevenness, and also the difference between a sensitivity when the sample is developed at high humid condition and a sensitivity when the sample is developed at low humid condition was depressed by passing through the preheating process.

Example 4

1. Preparations of Sample

1) Preparations of Photothermographic Material-203 to -206

Preparations of photothermographic material-203 to -206 were conducted in a similar manner to the process in the preparation of photothermographic material-202, except that changing the amount of coated silver to the amount shown in Table 14.

2) Preparations of Photothermographic Material-207 to -213

Preparations of photothermographic material-207 to -213 were conducted in a similar manner to the process in the preparation of photothermographic material-203, except that adding a nucleator to the image forming layer as shown in Table 14 and changing the amount of coated silver.

2. Evaluation of Property

1) Measurement of Moisture Content

The evaluation was performed according to Condition 2 of Example 3.

The photothermographic material was humid conditioned for 24 hours at 25° C. and 70% RH, and then subjected to exposure at the same environmental condition. Thereafter, the sample was taken out from the first heating plate immediately after passing through the first plate. The moisture content (A) of the photothermographic material taken out was measured according to the procedure described below. Concurrently, the material was humid conditioned for 24 hours at 25° C. and 20% RH, and then subjected to exposure at the same environmental condition. Thereafter, the sample was taken out from the first heating plate immediately after passing through the first plate. The moisture content (B) of the photothermographic material taken out was measured according to the procedure described below. The ratio A/B×100 is shown in Table 3.

The measurement of the moisture content is performed on the materials taken out from the preheating means soon after passing through the process. The mass measured soon after taking out is taken as "a", and the mass measured again after vacuum drying the same material for 20 hours at 30° C. is taken as "b". The moisture content of the material can be expressed by as (a−b)/b.

2) Property

The results evaluated in a similar manner to Example 3 are shown in Table 14. The thermal developing condition was the same condition as in Example 3.

The photothermographic material with less coated silver amount can attain an image having a high density by incorporating the nucleator of the present invention.

The incorporation of the nucleator or the infectious reducing agent described above can reduce the amount of coated silver of the material, but generally result in enhancing the development unevenness thereof. The treatment by passing the material through the dehydration process of the present invention can lower the ratio A/B and improve significantly the fluctuation in photographic property and the development unevenness.

-continued

| | |
|---|---|
| MP-1000 manufactured by Soken Chemical & Engineering Co., Ltd. (PMMA polymer fine particle, mean particle diameter of 0.4 μm) | 0.91 g |
| distilled water | 931 mL |
| Formula (2) (for first layer on the back surface) | |
| Styrene-butadiene copolymer latex (solid content of 40% by weight, styrene/butadiene weight ratio = 68/32) | 130.8 g |
| 2,4-Dichloro-6-hydroxy-S-triazine sodium salt (8% by weight aqueous solution) | 5.2 g |
| Sodium laurylbenzenesulfonate (1% by weight aqueous solution) | 10 mL |

TABLE 14

| Sample No. | A/B × 100 | Nucleator No. | Nucleator g/m² | Reducing Agent | Amount of Coated Silver* (g/m²) | Thermal Development Condition | Photographic Properties Fog | Sensitivity | Dmax | Difference in Sensitivity(ΔS) | Development Unevenness | Continuous Processing Unevenness |
|---|---|---|---|---|---|---|---|---|---|---|---|---|
| 202 | 340 | — | — | Reducing agent-1 | 0.146 | 4 | 0.15 | — | 0.53 | 0.35 | Δ | ○ |
| 203 | 385 | — | — | Reducing agent-1 | 1.02 | 4 | 0.22 | 102 | 2.87 | 0.36 | Δ | Δ |
| 204 | 235 | — | — | Reducing agent-1 | 1.02 | 2 | 0.22 | 102 | 2.92 | 0.17 | ○ | ○ |
| 205 | 342 | — | — | Reducing agent-2 | 0.146 | 4 | 0.18 | 105 | 3.25 | 0.41 | Δ | Δ |
| 206 | 225 | — | — | Reducing agent-2 | 0.146 | 2 | 0.18 | 105 | 3.25 | 0.12 | ○ | ⊙ |
| 207 | 347 | SH-1 | 0.036 | Reducing agent-1 | 0.146 | 4 | 0.18 | 105 | 3.25 | 0.43 | Δ | Δ |
| 208 | 280 | SH-1 | 0.036 | Reducing agent-1 | 0.146 | 3 | 0.18 | 105 | 3.25 | 0.18 | ○ | ○ |
| 209 | 220 | SH-1 | 0.036 | Reducing agent-1 | 0.146 | 2 | 0.18 | 105 | 3.25 | 0.09 | ○ | ⊙ |
| 210 | 227 | SH-4 | 0.036 | Reducing agent-1 | 0.146 | 2 | 0.18 | 106 | 3.22 | 0.11 | ○ | ⊙ |
| 211 | 230 | SH-7 | 0.036 | Reducing agent-1 | 0.146 | 2 | 0.18 | 107 | 3.20 | 0.10 | ○ | ⊙ |
| 212 | 228 | SH-8 | 0.036 | Reducing agent-1 | 0.146 | 2 | 0.18 | 105 | 3.24 | 0.11 | ○ | ⊙ |
| 213 | 226 | SH-11 | 0.036 | Reducing agent-1 | 0.146 | 2 | 0.18 | 107 | 3.14 | 0.09 | ○ | ⊙ |

*Amount of coated silver contained in silver halide per one side

Example 5

Back layers described below were coated on a support similar to that of Example 3, which was subjected to the surface corona discharge treatment similar to Example 3.

(Undercoating)

1)Preparations of Coating Solution for Undercoat Layer

| | |
|---|---|
| Formula (1) (for undercoat layer on the image forming layer side) | |
| Pesresin A-520 manufactured by Takamatsu Oil & Fat Co., Ltd. (30% by weight solution) | 46.8 g |
| BAIRONAARU MD-1200 manufactured by Touyou Bouseki Co., Ltd. | 10.4 g |
| Polyethylene glycol monononylphenylether (average ethylene oxide number = 8.5) (1% by weight solution) | 11.0 g |

-continued

| | |
|---|---|
| Polystyrene particle dispersion (mean particle diameter of 2 μm, 20% by weight) | 0.5 g |
| distilled water | 854 mL |
| Formula (3) (for second layer on the back surface) | |
| $SnO_2$/SbO (9/1 weight ratio, mean particle diameter of 0.5 μm, 17% by weight dispersion) | 84 g |
| Gelatin | 7.9 g |
| METOLOSE TC-5 manufactured by Shin-Etsu Chemical Co., Ltd. (2% by weight aqueous solution) | 10 g |
| Sodium dodecylbenzenesulfonate (1% by weight aqueous solution) | 10 mL |
| NaOH (1% by weight) | 7 g |
| Proxel (manufactured by Imperial Chemical Industries PLC) | 0.5 g |
| distilled water | 881 mL |

Both surfaces of the biaxially tentered polyethylene terephthalate support having the thickness of 175 μm were subjected to the corona discharge treatment as described above. Thereafter, the aforementioned formula (1) of the coating solution for the undercoat was coated on one surface (image forming layer surface) with a wire bar so that the amount of wet coating became 6.6 mL/m$^2$ (per one surface), and dried at 180° C. for minutes. Then, the aforementioned formula (2) of the coating solution for the undercoat was coated on the reverse face (back surface) with a wire bar so that the amount of wet coating became 5.7 mL/m$^2$, and dried at 180° C. for 5 minutes. Furthermore, the aforementioned formula (3) of the coating solution for the undercoat was coated on the reverse face (back surface) with a wire bar so that the amount of wet coating became 8.4 mL/m$^2$, and dried at 180° C. for 6 minutes. Thus, an undercoated support was produced.

(Back Layer)

1) Preparations of Coating Solution for Back Layer

<Preparation of Dispersion of Solid Fine Particles (a) of Base Precursor>

To base precursor-1 in an amount of 2.5 kg, and 300 g of a surfactant (trade name: DEMOL N, manufactured by Kao Corporation), 800 g of diphenyl sulfone and 1.0 g of benzoisothiazolinone sodium salt, was added distilled water to give the total amount of 8.0 kg and mixed. The mixed liquid was subjected to beads dispersion using a horizontal sand mill (UVM-2: manufactured by IMEX Co., Ltd.). Process for dispersion included feeding the mixed liquid to UVM-2 packed with zirconia beads having a mean particle diameter of 0.5 mm with a diaphragm pump, followed by the dispersion at the inner pressure of 50 hPa or higher until desired mean particle diameter could be achieved.

The dispersion was continued until the ratio of the optical density at 450 nm and the optical density at 650 nm for the spectral absorption of the dispersion ($D_{450}/D_{650}$) became 3.0 upon spectral absorption measurement. Thus resulting dispersion was diluted with distilled water so that the concentration of the base precursor became 25% by weight, and filtrated (with a polypropylene filter having a mean fine pore diameter of 31m) for eliminating dust to put into practical use.

<Preparation of Dispersion of Solid Fine Particle of Dye>

Cyanine dye-1 in an amount of 6.0 kg, and 3.0 kg of sodium p-dodecylbenzenesulfonate, 0.6 kg of DEMOL SNB (a surfactant manufactured by Kao Corporation), and 0.15 kg of a defoaming agent (trade name: SURFYNOL 104E, manufactured by Nissin Chemical Industry Co., Ltd.) were mixed with distilled water to give the total liquid amount of 60 kg. The mixed liquid was subjected to dispersion with 0.5 mm zirconia beads using a horizontal sand mill (UVM-2: manufactured by IMEX Co., Ltd.).

The dispersion was dispersed until the ratio of the optical density at 650 nm and the optical density at 750 nm for the spectral absorption of the dispersion ($D_{650}/D_{750}$) became 5.0 or more upon spectral absorption measurement. Thus resulting dispersion was diluted with distilled water so that the concentration of the cyanine dye became 6% by weight, and filtrated with a filter (mean fine pore diameter: 1 μm) for eliminating dust to put into practical use.

<Preparation of Coating Solution for Antihalation Layer>

A vessel was kept at 40° C., and thereto were added 37 g of gelatin having an isoelectric point of 6.6 (trade name: ABA GELATIN, manufactured by Nippi Co. Ltd.), 0.1 g of benzoisothiazolinone and water to allow gelatin to be dissolved. Additionally, 36 g of the aforementioned dispersion of the solid fine particle of the dye, 73 g of the aforementioned dispersion of the solid fine particles (a) of the base precursor, 43 mL of a 3% by weight aqueous solution of sodium polystyrenesulfonate, and 82 g of a 10% by weight solution of SBR latex (styrene/butadiene/acrylic acid copolymer: weight ratio of the copolymerization of 68.3/28.7/3.0) was admixed to give a coating solution for the antihalation layer. The total volume of the finished solution was 773 mL, and the pH of the finished solution was 6.3.

<Preparation of Coating Solution for Back Surface Protective Layer>

A vessel was kept at 40° C., and thereto were added 43 g of gelatin having an isoelectric point of 4.8 (trade name: PZ GELATIN, manufactured by Miyazaki Chemical Co. Ltd.), 0.21 g of benzoisothiazolinone and water to allow gelatin to be dissolved. Additionally, 8.1 mL of a 1 mol/L sodium acetate aqueous solution, 0.93 g of monodispersed poly (ethylene glycol dimethacrylate-co-methyl methacrylate) fine particles (mean particle diameter of 7.7 μm, standard deviation of particle size being 0.3), 5 g of a 10% by weight emulsion of liquid paraffin, 10 mL of a 5% by weight aqueous solution of di(2-ethylhexyl) sodium sulfosuccinate, 17 mL of a 3% by weight aqueous solution of sodium polystyrenesulfonate, 2.4 mL of a 2% by weight solution of a fluorocarbon surfactant (F-1), 2.4 mL of a 2% by weight solution of another fluorocarbon surfactant (F-2), and 30 mL of a 20% by weight solution of ethyl acrylate/acrylic acid copolymer (weight ratio of the copolymerization of 96.4/3.6) latex were admixed. Just prior to the coating, 50 mL of a 4% by weight aqueous solution of N,N-ethylenebis(vinylsulfone acetamide) was admixed to give a coating solution for the back surface protective layer. The total volume of the finished solution was 855 mL, and the pH of the finished solution was 6.2.

2) Coating of Back Layer

The back surface side of the undercoated support as described above was subjected to simultaneous double coating so that the coating solution for the antihalation layer gave the amount of coated gelatin of 0.5.4 g/m$^2$, and so that the coating solution for the back surface protective layer gave the amount of coated gelatin of 1.85 g/m$^2$, followed by drying to produce a back layer.

(Coating of Image Forming Layer)

The image forming layer, intermediate layer, and surface protective layers similar to those of Example 4 were coated. However, the flow rate of the coating solution for image forming layer was increased to twice so that the amount of coated silver of the sample became similar to Example 4.

(Evaluation of Property)

Evaluation was performed similar to Example 4. From the result, it was confirmed that in the case of single-sided coated photothermographic material, the image unevenness is small even when preheating is not performed, and that in case of double-sided coated photothermographic material, the effect of the invention is largely shown.

Example 6

(Preparation of Fluorescent Intensifying Screen A)

(1) Preparation of Undercoat Layer

In a similar manner to Example 4 in JP-A. No. 2001-124898, a light reflecting layer comprising alumina powder was coated on polyethylene terephthalate film (support) having a thickness of 250 μm. The light reflecting layer which had a film thickness of 50 μm after drying, was prepared.

(2) Preparation of Fluorescent Substance Sheet 250 g of BaFBr:Eu fluorescent substance (mean particle size of 3.5 μm), 8 g of polyurethane type binder resin (manufactured by Dai Nippon Ink & Chemicals, Inc., trade name: PANDEX T5265M), 2 g of epoxy type binder resin (manufactured by Yuka Shell Epoxy Co., Ltd., trade name: EPIKOTE 1001) and 0.5 g of isocyanate compounds (manufactured by Nippon Polyurethane Industry Co., Ltd., trade name: CORONATE HX) were added into methylethylketone, and the mixture was then dispersed by a propeller mixer to prepare the coating solution for the fluorescent substance layer having a viscosity of 25 PS (25° C.). This coating solution was coated on the surface of a temporary support (pretreated by coating a silicone agent on the surface of polyethylene terephthalate film), and dried to make the fluorescent substance layer. Thereafter, the fluorescent substance sheet was prepared by peeling the fluorescent substance layer from the temporary support.

(3) Overlaying the Fluorescent Substance Sheet on Light Reflective Layer.

The fluorescent substance sheet prepared above was overlaid on the surface of the light reflective layer of the support having a light reflective layer made in the above process (1), and then pressed by a calendar roller at the pressure of 400 kgw/cm$^2$ and the temperature of 80° C. to form the fluorescent substance layer on the light reflective layer. The thickness of the obtained fluorescent substance layer was 125 μm and the volume filling factor of fluorescent substance particles in the fluorescent substance layer was 68%.

(shown as 51 in FIG. 1) for thermal development was adjusted at 121° C. and the conveying speed was adjusted so that the time period for thermal development being 18 seconds. The temperature of preheating roller 44 was adjusted at 105° C., and the conveying speed was adjusted so that the time period for thermal development being 6 seconds. With regard to Conditions 5-2 to 5-7, the temperature and the transporting linear speed were changed and were set according to the conditions described in Table 15.

It is revealed from the above examples that the preheating process of the present invention before thermal development can provide the image formation with less development unevenness, and also the difference between a sensitivity in which the photothermographic material is developed at high humidity condition and a sensitivity in which the photothermographic material is developed at low humidity condition is depressed by passing through the preheating process. Furthermore, it is also apparent from the comparison with Example 4 that by the thermal development using the thermal developing apparatus described in Example 7, the development unevenness and the difference between a sensitivity when the photothermographic material is developed at high humidity condition and a sensitivity when the photothermographic material is developed at low humidity condition are further depressed.

TABLE 15

| | Condition of Preheat Rollers | | Condition of Panel Heaters | | | | Photographic Properties | | | | | |
|---|---|---|---|---|---|---|---|---|---|---|---|---|
| | | | First Step | | Second Step | | | | | | | |
| Condition | Temperature (° C.) | Residence Time (second) | Temperature (° C.) | Residence Time (second) | Temperature (° C.) | Residence Time (second) | Fog | Sersitivity | Dmax | Difference in Sensitivity ($\Delta S_{75} - S_{20}$) | Development Unevenness | Continuous Processing Unevenness |
| 5-1 | 105 | 6 | 119 | 9 | 121 | 9 | 0.17 | 110 | 3.27 | 0.13 | ○ | ◎ |
| 5-2 | 80 | 6 | 119 | 9 | 121 | 9 | 0.18 | 105 | 3.27 | 0.04 | ◎ | ◎ |
| 5-3 | 60 | 6 | 119 | 9 | 121 | 9 | 0.18 | 105 | 3.27 | 0.07 | ◎ | ○ |
| 5-4 | 25 | 6 | 119 | 9 | 121 | 9 | 0.18 | 105 | 3.25 | 0.37 | Δ | Δ |
| 5-5 | 112 | 5.3 | 119 | 8 | 121 | 8 | 0.19 | 110 | 3.25 | 0.25 | Δ | Δ |
| 5-6 | 121 | 4 | 121 | 6 | 121 | 6 | 0.21 | 107 | 3.17 | 0.28 | x | Δ |
| 5-7 | 80 | 11 | 80 | 17 | 119 | 17 | 0.18 | 106 | 3.28 | 0.03 | ◎ | ◎ |

(4) Preparation of Surface Protective Layer

Polyester type adhesive agents were coated on one side of polyethylene terephthalate film having a thickness of 6 μm, and thereafter the surface protective layer was formed on the fluorescent substance layer by a laminating method. As described above, the fluorescent intensifying screen A comprising a support, a light reflective layer, a fluorescent substance layer and a surface protective layer was prepared.

(5) Emission Characteristics

The emission spectrum of the intensifying screen A was measured by X-ray at 40 kvp and is shown in FIG. 1. The fluorescent intensifying screen A showed an emission having a peak at 390 nm and a narrow half band width.

Development was performed similar to Example 1 and Example 2, except that using the aforementioned screen, and the effect of the present invention similar to Example 1 and Example 2 was obtained.

Example 7

Thermal development was performed as in Example 3 except that the material of Example 3 was subjected to exposure similar to Example 3 and thermal development in the thermal developing apparatus shown in FIG. 1. With regard to Condition 5-1, the temperature of the heating plate

What is claimed is:

1. An image forming method comprising:

providing a photothermographic material having image forming layers containing at least a photosensitive silver halide, a non-photosensitive organic silver salt, a reducing agent, and a binder on both surfaces of a support, imagewise exposing the photothermographic material with a fluorescent intensifying screen, and thermally developing the photothermographic material in a thermal developing apparatus having a heating section, wherein:

the heating section has at least two heating means in which a first heating means for heating a first surface of the photothermographic material and a second heating means for heating a second surface of the photothermographic material are disposed separately in a back to back relation with each other along a conveying route of the photothermographic material, which is sandwiched by the first and second heating means, so that the first surface is heated first and thereafter the second surface is heated; and a difference between a sensitivity when the photothermographic material is developed at 25° C. and relative humidity of 75% and a sensitivity when the photothermographic material is developed at 25° C. and relative humidity of 20% is 0.20 or less.

2. The image forming method according to claim 1, wherein the difference between sensitivities is 0.05 or less.

3. The image forming method according to claim 1, wherein at least one of the heating means has a plate, and rollers which push the photothermographic material to the plate and rotate, and a heater serving as a heating source is built into at least one of the plate and the rollers.

4. The image forming method according to claim 3, wherein the plate and another plate are disposed separately in a back to back relation with each other along the conveying route of the photothermographic material, which is sandwiched by both of the plates.

5. The image forming method according to claim 1, wherein at least one of the heating means has a cylindrical drum, and pressing rollers which push the photothermographic material to a circumferential surface of the drum and rotate, and a heater serving as a heating source is built into at least one of the drum and the pressing rollers.

6. The image forming method according to claim 5, wherein the drum and another drum are disposed separately in a back to back relation with each other along the conveying route of the photothermographic material, which is sandwiched by both of the drums.

7. The image forming method according to claim 1, wherein at least one of the heating means is provided with a carrier into which a heater serving as a heating means is built, an endless belt situated so as to surround the carrier, and pressing rollers for driving the endless belt to rotate by rotating while pressing the endless belt to the carrier.

8. The image forming method according to claim 7, wherein the carrier into which a heater serving as a heating means is built and another carrier are disposed separately in a back to back relation with each other to along the conveying route of the photothermographic material, which is sandwiched by both of the carriers.

9. The image forming method according to claim 1, further comprising a dehydration step between the imagewise exposure step and the heating step for heating the photothermographic material at a thermal developing temperature, wherein:

a moisture content of the photothermographic material under an atmosphere at 25° C. and 70% RH after applying the dehydration step is represented by A, a moisture content of the photothermographic material under an atmosphere at 25° C. and 20% RH after applying the dehydration step is represented by B, and A is 300% or less with respect to B.

10. The image forming method according to claim 9, wherein A is 275% or less with respect to B.

11. The image forming method according to claim 9, wherein A is 250% or less with respect to B.

12. The image forming method according to claim 9, wherein the dehydration step is a preheating step for heating the photothermographic material at a temperature of from 40° C. to 105° C. for a time period of from 0.1 seconds to 90 seconds.

13. The image forming method according to claim 12, wherein a heating temperature in the preheating step is from 60° C. to 100° C.

14. The image forming method according to claim 1, wherein 50% or more of a total projected area of the grains of the photosensitive silver halide has an aspect ratio of 2 to 100.

15. The image forming method according to claim 14, wherein the photosensitive silver halide grains are tabular grains having a mean equivalent spherical diameter of from 0.3 μm to 5.0 μm.

16. The image forming method according to claim 1, wherein an average silver iodide content of the photosensitive silver halide is 40 mol % or higher.

17. The image forming method according to claim 16, wherein the average silver iodide content of the photosensitive silver halide is 90 mol % or higher.

18. The image forming method according to claim 16, wherein the photothermographic material contains a compound which substantially reduces visible light absorption by the photosensitive silver halide after thermal development.

19. The image forming method according to claim 18, wherein the compound which substantially reduces visible light absorption by the photosensitive silver halide after thermal development is a silver iodide complex-forming agent.

20. The image forming method according to claim 1, wherein the photothermographic material contains a humectant.

21. The image forming method according to claim 20, wherein the humectant is a compound represented by the following formula (1):

Formula (1)

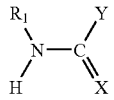

wherein in formula (1), $R_1$ represents one selected from a hydrogen atom, an alkyl group, an cycloalkyl group, an aryl group, and a heterocyclic group; X represents chalcogen atom; Y represents one selected from an amino group, an anilino group, a hydroxy group, an alkoxy group, an aryloxy group, an acylamino group, and a sulfonamide group.

22. The image forming method according to claim 1, wherein an outermost layer of at least one surface of the photothermographic material contains a hydrophilic binder and an organic crosslinking agent.

23. The image forming method according to claim 1, wherein 50% by weight or more of a binder contained in an outermost layer of at least one surface of the photothermographic material is a polymer latex.

24. The image forming method according to claim 1, wherein 50% by weight or more of a binder contained in an outermost layer of at least one surface of the photothermographic material is a copolymer prepared from raw materials including at least the following monomers (M1) and (M2):

(M1) a monomer having a group capable of forming a salt or a poly(alkylene oxide) group, and an unsaturated bond capable of radical polymerization; and (M2) a monomer having at least one fluorine atom and an unsaturated bond capable of radical polymerization.

25. The image forming method according to claim 1, wherein the photothermographic material contains at least one of a compound having an adsorptive group with respect to photosensitive silver halide grains and a reducible group or a precursor thereof.

26. The image forming method according to claim 1, wherein the photothermographic material contains a compound that can be one-electron-oxidized to provide a one-electron oxidation product, which releases one or more electrons.

27. The image forming method according to claim 1, wherein the photothermographic material contains a means for nucleation.

28. The image forming method according to claim 27, wherein the means for nucleation is at least one of a nucleator and an infectious developing reducing agent.

29. The image forming method according to claim 28, wherein the nucleator is a compound selected from the group consisting of a hydrazine derivative, a vinyl compound, a quaternary onium compound, and an olefin compound.

30. The image forming method according to claim 29, wherein the hydrazine derivative is a compound represented by the following formula (V):

Formula (V)

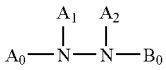

wherein in formula (V), $A_0$ represents one selected from an aliphatic group, an aromatic group, a heterocyclic group, and a $-G_0-D_0$ group, each of which may have a substituent; $B_0$ represents a blocking group; $A_1$ and $A_2$ both represent hydrogen atoms, or one of $A_1$ or $A_2$ represents a hydrogen atom and the other represents one selected from an acyl group, a sulfonyl group, and an oxalyl group; $G_0$ represents one selected from a —CO— group, a —COCO— group, a —CS— group, a —C(=$NG_1D_1$)— group, an —SO— group, an —$SO_2$— group, and a —P(O)($G_1D_1$) group; $G_1$ represents one selected from a mere bonding hand, an —O— group, an —S— group, and an —N($D_1$) group; $D_1$ represents one selected from an aliphatic group, an aromatic group, a heterocyclic group, and a hydrogen atom, and when a plurality of $D_1$ exists in one molecule, they may be the same as or different from each other; and $D_0$ represents one selected from a hydrogen atom, an aliphatic group, an aromatic group, a heterocyclic group, an amino group, an alkoxy group, an aryloxy group, an alkylthio group, and an arylthio group.

31. The image forming method according to claim 29, wherein the vinyl compound is a compound represented by the following formula (VI):

Formula (VI)

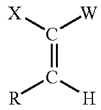

wherein in formula (VI), X represents an electron-attracting group, W represents one selected from a hydrogen atom or a group substitutable for a carbon atom, and R represents a group substitutable for a carbon atom.

32. The image forming method according to claim 28, wherein the infectious developing reducing agent is a compound represented by the following formula (R1):

Formula (VI)

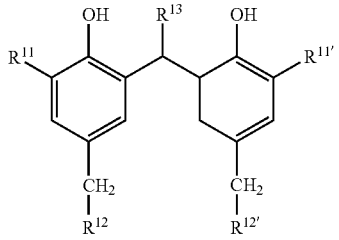

wherein in formula (R1), $R^{11}$ and $R^{11'}$ each independently represent a secondary or tertiary alkyl group having 3 to 20 carbon atoms; $R^{12}$ and $R_{12'}$ each independently represent one selected from a hydrogen atom, and a group being connected through a nitrogen, oxygen, phosphorous, or sulfur atom; and $R^{13}$ represents one selected from a hydrogen atom and an alkyl group having 1 to 20 carbon atoms.

33. The image forming method according to claim 32, wherein, in formula (R1), $R_{12}$ and $R^{12'}$ each independently represent one selected from a hydrogen atom, a hydroxy group, an alkoxy group, a carbonyloxy group, an aryloxy group, an acyloxy group, an alkylthio group, an arylthio group, an amino group, an anilino group, an acylamino group, an ureido group, an urethane group, a heterocyclic group, and a heterocyclothio group.

34. The image forming method according to claim 32, wherein, in formula (R1), $R^{12}$ and $R^{12'}$ each independently represent one selected from a hydrogen atom, a hydroxy group, an alkoxy group, an amino group, and an anilino group.

35. The image forming method according to claim 1, wherein the non-photosensitive organic silver salt includes from 80 mol % to 99 mol % of silver behenate.

* * * * *